US008599109B2

(12) United States Patent
Kimura

(10) Patent No.: US 8,599,109 B2
(45) Date of Patent: Dec. 3, 2013

(54) DISPLAY DEVICE AND DRIVING METHOD THEREOF

(75) Inventor: Hajime Kimura, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 259 days.

(21) Appl. No.: 12/977,940

(22) Filed: Dec. 23, 2010

(65) Prior Publication Data

US 2011/0134163 A1 Jun. 9, 2011

Related U.S. Application Data

(60) Continuation of application No. 11/595,989, filed on Nov. 13, 2006, now Pat. No. 7,859,520, and a division of application No. 10/245,711, filed on Sep. 18, 2002, now Pat. No. 7,138,967.

(30) Foreign Application Priority Data

Sep. 21, 2001 (JP) ..... 2001-289983

(51) Int. Cl.
*G09G 5/00* (2006.01)

(52) U.S. Cl.
USPC ..... 345/73; 345/76; 345/82; 345/92

(58) Field of Classification Search
USPC ..... 345/173, 76, 82, 92
See application file for complete search history.

(56) References Cited

U.S. PATENT DOCUMENTS 5,396,133 A 3/1995 Zhang
5,504,444 A 4/1996 Neugebauer (Continued)

FOREIGN PATENT DOCUMENTS

EP 1 049 360 11/2000
EP 1 061 497 12/2000

(Continued)

OTHER PUBLICATIONS

Inukai.K et al., "4.0-in. TFT-OLED Displays and a Novel Digital Driving Method,", SID Digest '00: SID International Symposium Digest of Technical Papers, 2000, vol. 31, pp. 924-927.

(Continued)

*Primary Examiner* — William Boddie
*Assistant Examiner* — Leonid Shapiro
(74) *Attorney, Agent, or Firm* — Eric J. Robinson; Robinson Intellectual Property Law Office, P.C.

(57) ABSTRACT

Each pixel of a display device has a current supply circuit, a switch portion, and a light emitting element. The light emitting element, the current supply circuit, and the switch portion are connected in series between a power supply reference line and a power supply line. The switch portion is switched between ON and OFF using a digital video signal. The amount of constant current flowing in the current supply circuit is determined by a control signal inputted from the outside of the pixel. When the switch portion is ON, a constant current determined by the current supply circuit flows in the light emitting element and light is emitted. As a result, a low-cost display device can be provided in which the light emitting element can emit light at a constant luminance even when the current characteristic is changed by degradation or the like, which is fast in writing signals in pixels, which can display in gray scales accurately, and which can be reduced in size with a low cost, as well as a driving method of the display device.

15 Claims, 79 Drawing Sheets

(56) References Cited

U.S. PATENT DOCUMENTS

| | | | |
|---|---|---|---|
| 5,526,058 | A | 6/1996 | Sano et al. |
| 5,548,238 | A | 8/1996 | Zhang et al. |
| 5,714,968 | A | 2/1998 | Ikeda |
| 5,940,053 | A | 8/1999 | Ikeda |
| 5,952,789 | A | 9/1999 | Stewart et al. |
| 6,011,529 | A | 1/2000 | Ikeda |
| 6,091,203 | A | 7/2000 | Kawashima et al. |
| 6,169,528 | B1 | 1/2001 | Oguchi et al. |
| 6,222,357 | B1 | 4/2001 | Sakuragi |
| 6,229,506 | B1 | 5/2001 | Dawson et al. |
| 6,266,000 | B1 | 7/2001 | Jusuf et al. |
| 6,339,414 | B1 | 1/2002 | Todokoro et al. |
| 6,341,275 | B1 | 1/2002 | Shi et al. |
| 6,373,454 | B1 | 4/2002 | Knapp et al. |
| 6,411,159 | B1 | 6/2002 | Callahan, Jr. |
| 6,445,367 | B1 | 9/2002 | Suzuki et al. |
| 6,466,189 | B1 | 10/2002 | Albu et al. |
| 6,498,596 | B1 | 12/2002 | Nakamura et al. |
| 6,501,466 | B1 | 12/2002 | Yamagishi et al. |
| 6,528,951 | B2 | 3/2003 | Yamazaki et al. |
| 6,580,408 | B1 | 6/2003 | Bae et al. |
| 6,583,775 | B1 | 6/2003 | Sekiya et al. |
| 6,670,773 | B2 | 12/2003 | Nakamura et al. |
| 6,715,728 | B2 | 4/2004 | Nielsen |
| 6,744,414 | B2 | 6/2004 | Lee et al. |
| 6,753,654 | B2 | 6/2004 | Koyama |
| 6,760,004 | B2 | 7/2004 | Koyama |
| 6,798,148 | B2 | 9/2004 | Inukai |
| 6,853,370 | B2 | 2/2005 | Numao |
| 6,859,193 | B1 | 2/2005 | Yumoto |
| 6,864,863 | B2 | 3/2005 | Kasai |
| 6,870,553 | B2 | 3/2005 | Kondo et al. |
| 6,914,390 | B2 | 7/2005 | Koyama |
| 6,919,868 | B2 | 7/2005 | Tam |
| 6,919,870 | B2 | 7/2005 | Fukuda |
| 6,943,759 | B2 | 9/2005 | Tam |
| 6,992,663 | B2 | 1/2006 | Nakamura et al. |
| 7,091,936 | B1 | 8/2006 | Yamada |
| 7,138,967 | B2 | 11/2006 | Kimura |
| 7,145,532 | B2 | 12/2006 | Kageyama et al. |
| 7,170,479 | B2 | 1/2007 | Kimura |
| 7,184,034 | B2 | 2/2007 | Kimura |
| 7,193,591 | B2 | 3/2007 | Yumoto |
| 7,336,035 | B2 | 2/2008 | Koyama |
| 7,365,713 | B2 | 4/2008 | Kimura |
| 7,379,039 | B2 | 5/2008 | Yumoto |
| 7,388,564 | B2 | 6/2008 | Yumoto |
| 7,474,285 | B2 | 1/2009 | Kimura |
| 7,511,687 | B2 | 3/2009 | Kimura |
| 7,532,209 | B2 | 5/2009 | Kimura |
| 2003/0016198 | A1 | 1/2003 | Nagai et al. |
| 2004/0183769 | A1 | 9/2004 | Schreyer et al. |
| 2005/0024298 | A1 | 2/2005 | Tam |

FOREIGN PATENT DOCUMENTS

| | | | |
|---|---|---|---|
| EP | 1 102 234 | | 5/2001 |
| EP | 1 130 565 | | 9/2001 |
| JP | 62-122488 | A | 8/1987 |
| JP | 62-122488 | U | 8/1987 |
| JP | 08-054835 | | 2/1996 |
| JP | 08-129359 | | 5/1996 |
| JP | 08-129359 | A | 5/1996 |
| JP | 10-319908 | A | 12/1998 |
| JP | 11-212493 | | 8/1999 |
| JP | 11-282419 | | 10/1999 |
| JP | 2000-081920 | A | 3/2000 |
| JP | 2000-284751 | | 10/2000 |
| JP | 2001-042822 | | 2/2001 |
| JP | 2001-042822 | A | 2/2001 |
| JP | 2001-060076 | | 3/2001 |
| JP | 2001-109399 | A | 4/2001 |
| JP | 2001-142427 | A | 5/2001 |
| JP | 2001-147659 | | 5/2001 |
| JP | 2002-514320 | | 5/2002 |
| JP | 2002-517806 | | 6/2002 |
| JP | 2002-278497 | | 9/2002 |
| JP | 2003-036054 | A | 2/2003 |
| JP | 03-066909 | | 3/2003 |
| JP | 2003-066909 | A | 3/2003 |
| JP | 2003-330416 | | 11/2003 |
| WO | WO 98/48403 | | 10/1998 |
| WO | WO 99/65011 | | 12/1999 |
| WO | WO 01/06484 | | 1/2001 |
| WO | WO 01/73741 | | 10/2001 |
| WO | WO-02/75713 | | 9/2002 |
| WO | WO-02/77958 | | 10/2002 |

OTHER PUBLICATIONS

Klemens Kohlgruber, et al., Co-Rotating Twin-Screw Extruders: Fundamentals, Technology, and Applications, Hanser Gardner Publications, Chapter 5.2, pp. 92-94 (2007).

Klemens Kohlgruber, et al., Co-Rotating Twin-Screw Extruders: Fundamentals, Technology, and Applications, Hanser Gardner Publications, Chapter 5.8, pp. 103-104 (2007).

Klemens Kohlgruber, et al., Co-Rotating Twin-Screw Extruders: Fundamentals, Technology, and Applications, Hanser Gardner Publications, Chapter 12, pp. 215-235 (2007).

Search Report dated Dec. 17, 2004 from the Singapore Patent Office for Application Serial No. 200302785-1.

M.T. Johnson et al., "Active Matrix PolyLED Displays," IDW '00, pp. 235-238, 2000.

International Preliminary Examination Report dated Jun. 17, 2004 for Application No. PCT/JP2002/009354 filed Sep. 12, 2002.

(TD1)

(TD2)

(a)

(b)

(a)

(b)

DISPLAY DEVICE AND DRIVING METHOD THEREOF

TECHNICAL FIELD

The present invention relates to a display device and a driving method thereof. Specifically, the invention relates to an active matrix display device in which a transistor is provided in each pixel to control light emission of the pixel, and to a method of driving the display device.

BACKGROUND ART

An active matrix display device has been proposed in which each pixel has a light emitting element and a transistor for controlling light emission of the light emitting element. A light emitting element refers to an element which has a first electrode and a second electrode and whose luminance is controlled by the amount of current flowing between the first electrode and the second electrode. Display devices using OLED (Organic Light Emitting Diode) elements as light emitting elements (hereinafter referred to as OLED display devices) are attracting attention. OLED display devices have advantages such as excellent responsiveness, low voltage operation, and wide viewing angle, thereby receiving attention as the next-generation flat panel displays.

In active matrix OLED display devices, luminance information is written in each pixel by a voltage signal or by a current signal. The former is called a voltage writing type and the latter is called a current writing type analog method. These driving methods will be described below using examples.

FIG. 30 shows a structural example of a pixel in a conventional voltage writing type OLED display device. In FIG. 30, each pixel has two TFTs (a first TFT and a second TFT), a capacitor element, and an OLED. The first TFT (hereinafter referred to as selecting TFT), which is denoted by 3001, has a gate electrode connected to a gate signal line 3002 and has a source terminal and a drain terminal one of which is connected to a source signal line 3003. The other of the source terminal and drain terminal of the selecting TFT 3001 is connected to a gate electrode of the second TFT (hereinafter referred to as driving TFT), which is denoted by 3004, and to one of electrodes of the capacitor element (hereinafter referred to as storage capacitor), which is denoted by 3007. The other electrode of the storage capacitor 3007 is connected to a power supply line 3005. The driving TFT 3004 has a source terminal and a drain terminal one of which is connected to the power supply line 3005 and the other of which is connected to a first electrode 3006*a* of the OLED, which is denoted by 3006. A second electrode 3006*b* of the OLED 3006 receives a constant electric potential. Here, the electrode of the OLED 3006 that is connected to the driving TFT 3004, namely, the first electrode 3006*a*, is called a pixel electrode whereas the second electrode 3006*b* is called an opposite electrode.

The description given below is about a driving method for when the selecting TFT 3001 in FIG. 30 is an n-channel TFT, the driving TFT 3004 is a p-channel TFT, the first electrode 3006*a* and second electrode 3006*b* of the OLED are an anode and a cathode, respectively, and the electric potential of the second electrode 3006*b* is set to 0 V.

A signal is inputted to the gate signal line 3002 to turn the selecting TFT 3001 conductive, and then a signal voltage is inputted to the selecting TFT 3001 from the source signal line 3003. Upon input of the signal voltage from the source signal line 3003, electric charges are accumulated in the storage capacitor 3007. In an amount according to the voltage held in the storage capacitor 3007, a current flows into the OLED 3006 through the source-drain of the driving TFT 3004 from the power supply line 3005 and the OLED 3006 emits light.

Voltage writing type display devices having pixels structured as shown in FIG. 30 can employ two types of driving methods, analog method and digital method. Hereinafter, the two are called as a voltage writing type analog method and a voltage writing type digital method.

In the voltage writing type analog driving method, the gate voltage (gate-source voltage) of the driving TFT 3004 in each pixel is changed to change the drain current of the driving TFT 3004. The method thus changes the amount of current flowing in the OLED 3006 to change the luminance. In order to obtain intermediate gray scale, the driving TFT 3004 operates in a range where a change in drain current is large to a change in gate voltage.

The voltage writing type analog method described above has a problem in that the current flowing in the OLED 3006 fluctuates greatly due to changes in drain current caused by fluctuation in current characteristic of the driving TFT 3004 when signals inputted to pixels from their respective source signal lines 3003 have the same electric potential. Fluctuation in current characteristic of the driving TFT 3004 is influenced by parameters such as threshold voltage and carrier mobility. As an example thereof, fluctuation in current characteristic due to fluctuation in threshold voltage of the driving TFT 3004 is described with reference to FIG. 31.

FIG. 31(A) is a diagram showing only the driving TFT 3004 and OLED 3006 of FIG. 30. The source terminal of the driving TFT 3004 is connected to the power supply line 3005. The gate voltage of the driving TFT 3004 is indicated by Vgs in the drawing. The drain current of the driving TFT 3004 is indicated by an arrow Id in the drawing. FIG. 31(B) shows the relation between the absolute value |Vgs| of the gate voltage of the driving TFT 3004 and its drain current Id (the current characteristic). Denoted by 3101*a* is a curve showing the relation between the gate voltage and the drain current when the absolute value of the threshold voltage of the driving TFT 3004 is Vth1. On the other hand, 3101*b* is a curve showing the relation between the gate voltage and the drain current when the absolute value of the threshold voltage of the driving TFT is Vth2. Here, Vth1 is larger than Vth2 (Vth1>Vth2). An operation range (1) shown in the drawing corresponds to the operation range of the driving TFT 3004 in the voltage writing type analog method. If the threshold of the driving TFT 3004 fluctuates in the operation range (1), the drain current of one is Id1 whereas the drain current of another is Id2 and the difference is large even though they have the same gate voltage Vgs1. Fluctuation in threshold voltage causes fluctuation in luminance of the OLED 3006 since the luminance of the OLED 3006 is in proportion to the amount of current flowing in the OLED 3006.

The voltage writing type digital driving method has been proposed in order to reduce the above-described influence of fluctuation in current characteristic of the driving TFT 3004. In the voltage writing type digital driving method, the OLED 3006 of each pixel is in a state chosen from light emission at a constant luminance and no-light emission. The driving TFT 3004 in FIG. 30 serves as a switch to select connection between the power supply line 3005 of each pixel and the pixel electrode 3006*a* of the OLED 3006. While the OLED 3006 is emitting light in the voltage writing type digital method, the driving TFT 3004 operates in a linear range that is an operation range where the absolute value of a source-drain voltage Vds is smaller than the absolute value of Vgs–

Vth obtained by subtracting the threshold Vth from the gate voltage Vgs, particularly, in a range where the absolute value of the gate voltage is large.

The operation range of the driving TFT 3004 in the voltage writing type digital method is an operation range (2) in FIG. 31(B). The operation range (2) is a linear range and, in the driving TFT 3004 operating in this range, fluctuation in drain current due to fluctuation in threshold voltage and the like is small and an almost constant current Id3 flows if the same gate voltage Vgs2 is applied. Therefore fluctuation in current flowing in the OLED 3006 is lowered and changes in light emission luminance are reduced.

The relation between the driving TFT 3004 operating in the linear range, the OLED 3006, and voltages applied to 3004 and 3006 is explained with reference to FIG. 32. FIG. 32(A) shows only the driving TFT 3004 and OLED 3006 of FIG. 30 for the explanation. Here, the source terminal of the driving TFT 3004 is connected to the power supply line 3005. The source-drain voltage of the driving TFT 3004 is indicated by Vds. The voltage between the cathode and anode of the OLED 3006 is indicated by $V_{OLED}$. The current flowing in the OLED 3006 is denoted by $I_{OLED}$. The current $I_{OLED}$ equals the drain current Id of the driving TFT 3004. The electric potential of the power supply line 3005 is indicated by Vdd. The electric potential of the opposite electrode of the OLED 3006 is set to 0 V In FIG. 32(B), 3202*a* is a curve showing the relation between $V_{OLED}$ and $I_{OLED}$ of the OLED 3006 (I-V characteristic). Denoted by 3201 is a curve showing the relation between the source-drain voltage Vds of the driving TFT 3004 and its drain current Id ($I_{OLED}$) when the gate voltage is Vgs2 in FIG. 31(B). The operation condition (operation point) of the driving TFT 3004 and OLED 3006 is determined by the intersection point of the two curves. The operation point is an intersection point 3203*a* of the curve 3201 and the curve 3202*a* in the linear range shown in the drawing since the driving TFT 3004 operates in the linear range. This means that the voltage between the anode and cathode of the OLED 3006 is $V_A$1 and the current thereof is $I_{OLED}$1.

On the other hand, in display devices having current writing type analog method pixels, a signal current is inputted to each pixel from a signal line (source signal line). Here, a signal current is current signals linearly corresponding to luminance information of video signals. The gate voltage of a TFT whose drain current is the inputted signal current is held in a capacitor portion. In this way, the OLED keeps receiving the current held by the capacitor portion after the source signal line stops inputting a signal current to the pixel. By changing a signal current inputted to a source signal line as this, the amount of current flowing in an OLED is changed to control the light emission luminance of the OLED and display in gray scales.

As an example of the current writing type analog method pixel, FIG. 33 shows a pixel structure disclosed in "IDW '00 p235: Active Matrix PolyLED Displays", and a driving method thereof will be described. In FIG. 33, a pixel is composed of an OLED 3306, a selecting TFT 3301, a driving TFT 3303, a capacitor element (storage capacitor) 3305, a holding TFT 3302, a light emission TFT 3304, a source signal line 3307, a first gate signal line 3308, a second gate signal line 3309, a third gate signal line 3310, and a power supply line 3311.

A gate electrode of the selecting TFT 3301 is connected to the first gate signal line 3308. The selecting TFT 3301 has a source terminal and a drain terminal one of which is connected to the source signal line 3307 and the other of which is connected to a source terminal or drain terminal of the driving TFT 3303, to a source terminal or drain terminal of the holding TFT 3302, and to a source terminal or drain terminal of the light emission TFT 3304. Of the source terminal and drain terminal of the holding TFT 3302, one that is not connected to the selecting TFT 3301 is connected to one of electrodes of the storage capacitor 3305 and to a gate electrode of the driving TFT 3303. The side of the storage capacitor 3005 that is not connected to the holding TFT 3002 is connected to the power supply line 3311. A gate electrode of the holding TFT 3302 is connected to the second gate signal line 3309. Of the source terminal and drain terminal of the driving TFT 3303, one that is not connected to the selecting TFT 3301 is connected to the power supply line 3311. Of the source terminal and drain terminal of the light emission TFT 3304, one that is not connected to the selecting TFT 3301 is connected to one electrode 3306*a* of the OLED 3306. A gate electrode of the light emission TFT 3304 is connected to the third gate signal line 3310. The other electrode 3306*b* of the OLED 3306 is kept at a constant electric potential. Of the two electrodes 3306*a* and 3306*b* of the OLED 3306, one that is connected to the light emission TFT 3304, i.e., the electrode 3306*a* is called a pixel electrode and the other electrode, i.e., the electrode 3306*b* is called an opposite electrode.

In the pixel structured as shown in FIG. 33, the current value of a signal current inputted to the source signal line is controlled by a video signal input current supply 3312. In practice, plural video signal input current supplies 3312 respectively associated with plural pixel columns correspond to a part of a source signal line driving circuit. In the example shown here, the pixel has n-channel TFTs for the selecting TFT 3301, the holding TFT 3302, and the light emission TFT 3304, and has a p-channel TFT for the driving TFT 3303, and the pixel electrode 3306*a* serves as an anode.

A driving method of the pixel having the structure of FIG. 33 is described with reference to FIGS. 34 and 35. In FIG. 34, the selecting TFT 3301, the holding TFT 3302, and the light emission TFT 3304 are shown as switches to make it easy to see whether they are in a conductive state or nonconductive state. Pixel states (A1) to (A4) correspond to states in periods TA1 to TA4 in a timing chart of FIG. 35, respectively.

In FIG. 35, G_1, G_2, and G_3 represent electric potentials of the first gate signal line 3308, second gate signal line 3309, and third gate signal line 3310, respectively. |Vgs| is the absolute value of the gate voltage (gate-source voltage) of the driving TFT 3303. $I_{OLED}$ is the current flowing in the OLED 3306. $I_{Video}$ is the current value determined by the video signal input current supply 3312.

In the period TA1, a signal inputted to the first gate signal line 3308 turns the selecting TFT 3301 conductive and a signal inputted to the second gate signal line 3309 turns the holding TFT 3302 conductive. Then the power supply line 3311 is connected to the source signal line 3307 through the driving TFT 3303 and the selecting TFT 3301. The current amount $I_{Video}$ determined by the video signal input current supply 3312 flows in the source signal line 3307 and, therefore, when enough time has elapsed to reach the steady state, the drain current of the driving TFT 3303 becomes $I_{Video}$ and a gate voltage according to the drain current $I_{Video}$ is held in the storage capacitor 3005. At this point, the light emission TFT 3304 is in a nonconductive state. After the voltage is held in the storage capacitor 3005 and the drain current of the driving TFT 3303 is fixed to $I_{Video}$, the signal of the second gate signal line 3309 is changed in the period TA2 to turn the holding TFT 3302 nonconductive.

Next, in the period TA3, the signal of the first gate signal line 3308 is changed to turn the selecting TFT 3301 nonconductive. In the period TA4, a signal inputted to the third gate signal line 3310 turns the light emission TFT 3304 conductive and then the signal current $I_{Video}$ is inputted to the OLED 3306 through the source-drain of the driving TFT 3303 from the power supply line 3311. In this way, the OLED 3306 emits light at a luminance according to the signal current $I_{Video}$.

A series of operations in the periods TA1 through TA4 is called a signal current $I_{Video}$ writing operation. In the operation, the signal current $I_{Video}$ is changed in an analog fashion to change the luminance of the OLED 3306 and display in gray scales.

In the timing chart of FIG. 35, the absolute value |Vgs| of the gate voltage of the driving TFT 3303 is increased with time in the period TA1 and an operation of holding a gate voltage according to the drain current $I_{Video}$ is shown. This corresponds to the case where electric charges are not held in the storage capacitor 3305 when the writing operation is started, or the case where the absolute value |Vgs| of the gate voltage of the driving TFT 3303 that is held in the preceding writing operation is smaller than the absolute value |Vgs| of the gate voltage of the driving TFT 3303 of when a given drain current that is determined by the video signal input current supply 3312 flows in the subsequent writing operation.

If the absolute value |Vgs| of the gate voltage of the driving TFT 3303 that is held in the preceding writing operation is larger than the absolute value |Vgs| of the gate voltage of the driving TFT 3303 of when a given drain current that is determined by the video signal input current supply 3312 flows in the subsequent writing operation, the absolute value |Vgs| of the gate voltage of the driving TFT 3303 is reduced with time in the period TA1 and an operation of holding a gate voltage according to the drain current $I_{Video}$ is observed.

In the current writing type analog method display device described above, the driving TFT 3303 operates in a saturation region. The drain current of the driving TFT 3303 is determined by a signal current inputted from the source signal line 3307. This means that the gate voltage of the driving TFT 3303 is automatically changed so that a constant drain current flows irrespective of fluctuation in threshold voltage, mobility, or the like.

A pixel structure disclosed in JP 2001-147659 A is shown in FIG. 29 as another example of the current writing type analog method pixel, and a driving method thereof will be described in detail. In FIG. 29, a pixel is composed of an OLED 2906, a selecting TFT 2901, a driving TFT 2903, a current TFT 2904, a capacitor element (storage capacitor) 2905, a holding TFT 2902, a source signal line 2907, a first gate signal line 2908, a second gate signal line 2909, and a power supply line 2911.

A gate electrode of the selecting TFT 2901 is connected to the first gate signal line 2908. The selecting TFT 2901 has a source terminal and a drain terminal one of which is connected to the source signal line 2907 and the other of which is connected to a source terminal or drain terminal of the current TFT 2904 and to a source terminal or drain terminal of the holding TFT 2902. Of the source terminal and drain terminal of the current TFT 2904, one that is not connected to the selecting TFT 2901 is connected to the power supply line 2911. Of the source terminal and drain terminal of the holding TFT 2902, one that is not connected to the selecting TFT 2901 is connected to one of electrodes of the storage capacitor 2905 and to a gate electrode of the driving TFT 2903. The other side of the storage capacitor 2905 is connected to the power supply line 2911. A gate electrode of the holding TFT 2902 is connected to the second gate signal line 2909. The driving TFT 2903 has a source terminal and a drain terminal one of which is connected to the power supply line 2911 and the other of which is connected to one electrode 2906*a* of the OLED 2906. The other electrode 2906*b* of the OLED 2906 is kept at a constant electric potential. The electrode 2906*a* of the OLED 2906 that is connected to the driving TFT 2903 is called a pixel electrode and the other electrode, 2906*b*, is called an opposite electrode.

In the pixel structured as shown in FIG. 29, the current value of a signal current inputted to the source signal line 2907 is controlled by a video signal input current supply 2912. In practice, plural video signal input current supplies 2912 respectively associated with plural pixel columns correspond to a part of a source signal line driving circuit.

In the example shown in FIG. 29, the pixel has n-channel TFTs for the selecting TFT 2901 and the holding TFT 2902 and p-channel TFTs for the driving TFT 2903 and the current TFT 2904, and the pixel electrode 2906*a* serves as an anode. Here, consider the current characteristic of the driving TFT 2903 as identical with the current characteristic of the current TFT 2904 for simplification. A driving method of the pixel having the structure of FIG. 29 is described with reference to FIGS. 28 and 27. In FIG. 28, the selecting TFT 2901 and the holding TFT 2902 are shown as switches to make it easy to see whether they are in a conductive state or nonconductive state. Pixel states (TA1) to (TA3) correspond to states in periods TA1 to TA3 in a timing chart of FIG. 27, respectively.

In FIG. 27, G_1 and G_2 represent electric potentials of the first gate signal line 2908 and second gate signal line 2909, respectively. |Vgs| is the absolute value of the gate voltage (gate-source voltage) of the driving TFT 2903. $I_{OLED}$ is the current flowing in the OLED 2906. $I_{Video}$ is the current value determined by the video signal input current supply 2912.

In the period TA1, a signal inputted to the first gate signal line 2908 turns the selecting TFT 2901 conductive and a signal inputted to the second gate signal line 2909 turns the holding TFT 2902 conductive. Then the power supply line 2911 is connected to the source signal line 2907 through the current TFT 2904, the holding TFT 2902, and the selecting TFT 2901. The current amount $I_{video}$ determined by the video signal input current supply 2912 flows in the source signal line 2907 and, therefore, when enough time has elapsed to reach the steady state, the drain current of the current TFT 2904 becomes $I_{Video}$ and a gate voltage corresponding to the drain current $I_{Video}$ is held in the storage capacitor 2905.

After the voltage is held in the storage capacitor 2905 and the drain current of the current TFT 2904 is fixed to $I_{Video}$, the signal of the second gate signal line 2909 is changed in the period TA2 to turn the holding TFT 2902 nonconductive. At this point, the drain current $I_{Video}$ flows in the driving TFT 2903. In this way, the signal current $I_{Video}$ is inputted to the OLED 2906 through the driving TFT 2903 from the power supply line 2911. The OLED 2906 emits light at a luminance according to the signal current $I_{Video}$.

Next, in the period TA3, the signal of the first gate signal line 2908 is changed to turn the selecting TFT 2901 nonconductive. The signal current $I_{Video}$ is kept supplied to the OLED 2906 through the driving TFT 2903 from the power supply line 2911 after the selecting TFT 2901 is made nonconductive and the OLED 2906 continues emitting light.

A series of operations in the periods TA1 through TA3 is called a signal current $I_{Video}$ writing operation. In the operation, the signal current $I_{Video}$ is changed in an analog fashion to change the luminance of the OLED 2906 and display in gray scales.

In the current writing type analog method display device described above, the driving TFT 2903 operates in a saturation region. The drain current of the driving TFT 2903 is determined by a signal current inputted from the source signal line 2907. This means that the gate voltage of the driving TFT 2903 is automatically changed so that a constant drain current flows irrespective of fluctuation in threshold voltage, mobility, or the like if the driving TFT 2903 and the current TFT 2904 in the same pixel have the same current characteristic.

The relation between the voltage applied to an OLED and the amount of current flowing therein (the I-V characteristic) is changed by environment temperature of the surroundings, degradation of the OLED, and the like. Therefore a problem of conventional display devices in which driving TFTs operate in a linear range, typically, voltage writing type digital method display devices, is that the amount of current actually flows is varied even when a constant voltage is applied between two electrodes of an OLED.

FIG. 36 show a change in operation point when the I-V characteristic of an OLED is changed by degradation or the like in a display device using a conventional voltage writing type digital driving method.

FIG. 36(A) is a diagram showing only the driving TFT 3004 and OLED 3006 of FIG. 30. Here, the source terminal of the driving TFT 3004 is connected to the power supply line 3005. The source-drain voltage of the driving TFT 3004 is indicated by Vds. The voltage between the cathode and anode of the OLED 3006 is indicated by $V_{OLED}$ and the current thereof is denoted by $I_{OLED}$. The current $I_{OLED}$ equals the drain current Id of the driving TFT 3004. The electric potential of the power supply line 3005 is indicated by Vdd. The electric potential of the opposite electrode of the OLED 3006 is set to 0 V.

In FIG. 36(B), a curve 3202*a* shows the I-V characteristic of the OLED 3006 before degradation and a curve 3202*b* shows its I-V characteristic after degradation. The operation condition of the driving TFT 3004 and OLED 3006 before degradation is determined by an intersection point 3203*a* between the curve 3202*a* and a curve 3201. The operation condition of the driving TFT 3004 and OLED 3006 after degradation is determined by an intersection point 3203*b* between the curve 3202*b* and the curve 3201.

In a pixel for which a light emission state is chosen, a gate electric potential that turns the driving TFT 3004 conductive is inputted to 3004. At this point, the voltage between the two electrodes of the OLED 3006 is $V_A$1. When the OLED 3006 is degraded to change its I-V characteristic, the operation point is changed even though the same gate voltage is inputted, and the current flowing therein is changed from $I_{OLED}$1 to $I_{OLED}$2 even though almost the same voltage $V_A$1 is applied between the two electrodes of the OLED 3006. The light emission luminance of the OLED 3006 is thus changed according to the degree of degradation of the OLED 3006 in each pixel.

On the other hand, in display devices which have the pixel structure shown n FIG. 33 or FIG. 29 and which use the conventional current writing type analog riving method, the luminance is expressed by a constant current flowing into an OLED. Degradation or the like causes a change in I-V characteristic of the OLED in this case and influence of the change is described with reference to FIG. 37. Components common to FIG. 37 and FIG. 33 are denoted by the same symbols and explanations thereof are omitted. In FIG. 33, the light emission TFT 3304 is simply deemed as a switch and the source-drain voltage thereof is ignored.

FIG. 37(A) shows only the driving TFT 3303 and OLED 3306 of FIG. 33. Here, the source terminal of the driving TFT 3303 is connected to the power supply line 3305. The source-drain voltage of the driving TFT 3303 is indicated by Vds. The voltage between the cathode and anode of the OLED 3306 is indicated by $V_{OLED}$. The current flowing in the OLED 3306 is denoted by $I_{OLED}$. The current $I_{OLED}$ equals the drain current Id of the driving TFT 3303. The electric potential of the power supply line 3305 is indicated by Vdd. The electric potential of the opposite electrode of the OLED 3306 is set to 0 V.

In FIG. 37(B), 3701 is a curve showing the relation between the source-drain voltage of the driving TFT 3303 and its drain current. Denoted by 3702*a* is a curve showing the I-V characteristic of the OLED 3306 before degradation and 3702*b* is a curve showing the I-V characteristic of the OLED 3306 after degradation. The operation condition of the driving TFT 3303 and OLED 3306 before degradation is determined by an intersection point 3203*a* between the curve 3702*a* and a curve 3701. The operation condition of the driving TFT 3303 and OLED 3306 after degradation is determined by an intersection point 3703*b* between the curve 3702*b* and the curve 3701.

In the current writing type analog method pixel, the driving TFT 3303 operates in a saturation region. Through degradation of the OLED 3306, the voltage between the two electrodes of the OLED 3306 changes from $V_B$1 to $V_B$2, but the current flowing in the OLED 3306 is kept almost constant at $I_{OLED}$1. This change in operation condition of the driving TFT and OLED due to a change in I-V characteristic of the OLED applies to the driving TFT 2903 and the OLED 2906 in the pixel structure shown in FIG. 29.

However, the current writing type analog driving method needs to hold electric charges according to a signal current anew in a capacitor portion (storage capacitor) of each pixel each time pixels are used for display. Holding a given level of electric charges in a storage capacitor, when signals are written in a pixel, takes longer as the signal current becomes smaller because of cross capacitance of wirings or the like. Therefore it is difficult to write a signal current quickly.

A small signal current also increases influence of noises such as leak current caused by plural pixels that are connected to the same source signal line other than the pixel in which a signal current is being written. Accordingly there is a strong possibility that the pixel cannot emit light at an accurate luminance.

In a pixel structure having a current mirror circuit, which is represented by a pixel as the one shown in FIG. 29, a pair of TFTs whose gate electrodes are connected have to have the same current characteristic in the current mirror circuit. However, in practice, matching the current characteristics of the TFTs that forms a pair exactly is difficult and it results in fluctuation.

Here, the driving TFT 2903 and current TFT 2904 of FIG. 29 are given a threshold Vtha and a threshold Vthb, respectively. Now let us examine displaying black when their threshold fluctuates and the absolute value |Vtha| of Vtha is smaller than the absolute value |Vthb| of Vthb. The drain current lowing in the current TFT 2903 corresponds to the current value $I_{Video}$ determined by the video signal input current supply 2912 and is zero. However, there is a possibility that a voltage slightly smaller than |Vthb| is held in the storage capacitor 2905 although no drain current flows in the current TFT 2903. Then the drain current of the driving TFT 2903 might not be zero since |Vthb|>|Vtha|. In this way, a drain current flows in the driving TFT 2903 to cause the OLED 2906 to emit light even though black display is intended. This brings a problem of reduction in contrast.

Furthermore, conventional current writing type analog method display devices have a video signal input current supply for inputting a signal current in each pixel for each column of pixels, and the devices have to make current characteristics of all the video signal input current supplies match and control the current value so as to change the current value accurately in an analog fashion. For that reason, it is difficult to manufacture video signal input current supplies having the same current characteristic in transistors that use a polycrystalline semiconductor thin film. The video signal input current supplies are therefore manufactured from an IC chip. On the other hand, pixels are generally formed on a glass or other insulating substrate (a substrate having an insulating surface) from cost and other reasons. Then the IC chip has to be bonded to the glass or other insulating substrate. Bonding the chip requires a large area, which is a problem because it makes reduction of the frame area in the periphery of the pixel region impossible.

The present invention is proposed in view of the above, and has an object of providing a low-cost display device with a reduced size in which a light emitting element can emit light at a constant luminance irrespective of a change in current characteristic due to degradation or the like, which is fast in writing signals in pixels, and which is capable of displaying in precise gray scales, as well as a method of driving the display device.

DISCLOSURE OF THE INVENTION

A display device according to the present invention is comprised of a pixel, means for converting a first current into a voltage, means for holding the converted voltage, means for converting the voltage held into a second current, and means for causing the second current to flow to the light emitting element using a digital video signal.

The means for converting the voltage held into a second current may be means for converting the voltage into a second current that has the same current value as the first current, or into a second current whose current value is in proportion to the first current.

A display device according to the present invention may have means for preventing the second current from flowing into the light emitting element using a signal different from the digital video signal.

The present invention is a display device which includes a pixel having a current supply circuit and a switch portion, the current supply circuit causing a constant current flow, the switch portion using a digital video signal to switch between ON and OFF, and which controls light emission of a light emitting element, and the switch portion, the current supply circuit, and the light emitting element may be connected in series.

A display device according to the present invention includes a pixel having a current supply circuit, a switch portion, a power supply line, and a power supply reference line, the current supply circuit having a first terminal and a second terminal and fixing a current flow between the first terminal and the second terminal constant, the switch portion having a third terminal and a fourth terminal and using a digital video signal to switch the path between the third terminal and the fourth terminal conductive or nonconductive, and the current supply circuit, the switch portion, and a light emitting element are connected between the power supply line and the power supply reference line such that a current flowing between the first terminal and the second terminal flows between an anode and cathode of the light emitting element when the path between the third terminal and the fourth terminal is made conductive.

A display device according to the present invention is comprised of a pixel, means for setting a first current as a drain current of a first transistor, means for holding a gate voltage of the first transistor, means for setting the gate voltage as a gate voltage of a second transistor that has the same polarity as the first transistor, and means for causing a drain current of the second transistor to flow into a light emitting element using a digital video signal.

In the display device, the ratio of the gate length to gate width of the first transistor may be different from the ratio of the gate length to gate width of the second transistor, and the device may have means for electrically connecting a gate electrode and drain terminal of the first transistor.

The display device may have means for preventing the drain current of the second transistor from flowing into the light emitting element using a signal different from the digital video signal.

A display device according to the present invention is comprised of a pixel, means for inputting a first current to a transistor to set it as a drain current of the transistor, means for holding a gate voltage of the transistor, and means for using a digital video signal to apply a voltage between source and drain terminals of the transistor and cause a drain current of the transistor which is determined by the gate voltage held to flow into a light emitting element.

The display device may further be comprised of means for electrically connecting a gate electrode and drain terminal of the transistor, and means for preventing the drain current of the transistor from flowing into the light emitting element using a signal different from the digital video signal.

In the display device, the first current may not be changed by the digital video signal.

In the display device, the pixel may have means for choosing input of the digital video signal to the pixel, and means for holding the digital video signal.

In the display device, the pixel may be more than one and at least some of the plural pixels may have the same current value for the first current.

The display device of the present invention may further be comprised of a driving circuit for inputting a constant current to the pixel.

A display device driving method according to the present invention is comprised of a first operation and a second operation, the first operation being conversion of a first current that is inputted to a pixel into a voltage to hold the converted voltage, the second operation being conversion of the voltage held into a second current to cause the second current to flow into a light emitting element using a digital video signal inputted.

In the driving method, the second operation may include an operation of choosing input of the digital video signal to the pixel and holding the digital video signal inputted, and the first operation and the second operation may be conducted independently.

In the driving method, the ratio of a period in which the second current flows into the light emitting element in one frame period may be changed to display in gray scales.

In the driving method, one frame period may be divided into plural sub-frame periods, the second operation may be conducted in each of the plural sub-frame periods to display in gray scales, a non-display period in which a signal different from the digital video signal is used to prevent the second current from flowing into the light emitting element may be provided in at least one of the plural sub-frame periods, and the first operation may be conducted in the non-display period.

The basic structure of the display device according to the present invention and a driving device thereof will be described with reference to FIG. 1.

FIG. 1 is a schematic diagram showing the structure of a pixel in a display device of the present invention. Each pixel of the display device of the present invention has a current supply circuit, a switch portion, and a light emitting element.

The light emitting element, the current supply circuit, and the switch portion are connected in series between a power supply reference line and a power supply line. The current supply circuit is a circuit for causing a fixed current flow. The light emitting element can be any element as long as its state is controlled by a current or a voltage. EL elements (ones using organic materials are particularly called OLEDs) and FE (Field Emission) elements are given as examples thereof. Other elements can also be employed in the present invention as long as their state is controlled by a current or a voltage.

An OLED is structured to have an anode, a cathode, and an organic compound layer sandwiched between them. The anode and the cathode correspond to a first electrode and a second electrode, respectively. A voltage is applied between the electrodes to cause the OLED to emit light. An organic compound layer usually has a laminate structure. A typical laminate structure consists of a hole transporting layer, a light emitting layer, and an electron transporting layer. Other than that, it may have a structure in which a hole injection layer, a hole transporting layer, a light emitting layer, and an electron transporting layer, or a hole injection layer, a hole transporting layer, a light emitting layer, an electron transporting layer, and an electron injection layer, are layered on an anode in the order stated. A light emitting layer may be doped with a fluorescent pigment or the like. All layers provided between a cathode and an anode are generically called an organic compound layer. Therefore, the hole injection layer, hole transporting layer, light emitting layer, electron transporting layer, electron injection layer mentioned above are all included in the organic compound layer. When a given voltage is applied to an organic compound layer structured as above from a pair of electrodes (an anode and a cathode), recombination of carriers takes place in its light emitting layer and light is emitted. The OLED may be one that utilizes light emission from a singlet exciton (fluorescence) or may be one that utilizes light emission from a triplet exciton (phosphorescence).

FIG. 1 shows as a representative a structure in which a light emitting element, a switch, and a current supply circuit are connected in series in this order between a power supply reference line and a power supply line. The present invention is not limited thereto and, for example, a structure in which a light emitting element, a current supply circuit, and a switch portion are connected in series in this order between a power supply reference line and a power supply line may by employed. There is no fixed order for connecting a light emitting element, a current supply circuit, and a switch portion in series between a power supply reference line and a power supply line. A plurality of switch portions may be provided. For instance, a light emitting element, a first switch portion, a second switch portion, and a current supply circuit may be connected in series between a power supply reference line and a power supply line. A switch portion may share some parts with a current supply circuit. In other words, some elements that constitute a current supply circuit may be used as a switch portion.

A digital video signal is used to switch between ON and OFF (conductive and nonconductive) of the switch portion. The amount of constant current flowing in the current supply circuit is determined by a control signal inputted from the outside of the pixel. When the switch portion is ON, a constant current determined by the current supply circuit flows in the light emitting element and light is emitted. When the switch portion is OFF, the light emitting element receives no current flow and does not emit light. ON and OFF of the switch portion is thus controlled by a video signal to display in gray scales.

If there are plural switch portions, signals for switching between ON and OFF of the respective plural switch portions may be video signals or other arbitrary signals, or video signals and other arbitrary signals both. However, at least one of the plural switch portions has to be switched between ON and OFF by a video signal. For example, in a structure where a light emitting element, a first switch portion, a second switch portion, and a current supply circuit are connected in series between a power supply reference line and a power supply line, the first switch portion is switched between ON and OFF by a video signal and a signal that is not a video signal is used to switch ON and OFF of the second switch portion. Alternatively, both the first switch portion and second switch portion may be switched between ON and OFF by video signals.

In a display device of the present invention, a control signal for determining a constant current that flows in the current supply circuit is inputted aside from a video signal for driving the switch portion. The control signal may be a voltage signal or a current signal. The control signal is inputted to the current supply circuit at a timing determined arbitrarily. Input of the control signal to the current supply circuit may be in sync with input of a video signal to the switch portion or may be not.

In a display device of the present invention, the current flowing in the light emitting element is kept constant when an image is displayed and therefore the light emitting element can emit light at a constant luminance irrespective of a change in current characteristic due to degradation or the like.

In a display device of the present invention, the amount of current flowing in the current supply circuit placed in each pixel is controlled by a signal that is not a video signal and is always kept constant. The display device is characterized in that a digital video signal is used to drive the switch portion to choose whether a constant current flows into the light emitting element or not and switch between a light emission state and a non-light emission state for display in gray scales by a digital method.

In the pixel structure of a display device of the present invention, the switch portion of a pixel for which a light emission state is not chosen by a video signal cuts a current flow to the light emitting element completely. Therefore, accurate gray scale display is obtained. This means that the slightest light emission can be avoided when black display is intended. Accordingly, lowering of contrast is prevented. Also, a video signal can be written in a pixel quicker since a light emission state or a non-light emission state is chosen for each pixel by using a digital video signal to choose ON or OFF of the switch portion.

In the conventional current writing type analog method pixel structure, a current inputted to a pixel has to be reduced in accordance with the luminance and it raises a problem of large influence of noises. On the other hand, the pixel structure of a display device of the present invention can reduce influence of noises by setting the constant current flowing in the current supply circuit to a rather large current value.

The current in a conventional current writing type analog method pixel is a video signal. Therefore, in order to rewrite video information, a current value suited to the luminance thereof has to be used to rewrite video information held in the pixel. Video information of all pixels have to be rewritten in 1/60 second for each frame since one frame period is 1/60 second. Therefore, once the specification (for example, the number of pixels) of the display device is decided, rewriting video information has to be completed within a fixed time allotted to each pixel. This means that rewriting video information accurately within a fixed time is difficult because of influence of wiring loads (such as cross capacitance and wiring resistance) particularly when the signal current value is small.

However, the present invention uses a control signal inputted aside from a video signal to determine the value of the current flowing in the current supply circuit of the pixel. The timing of inputting the control signal, the period during which the control signal is inputted, and the input cycle of the control signal are arbitrary. Therefore, the situation in prior art can be avoided.

Furthermore, conventional current writing type analog method display devices need a driving circuit for inputting an analog signal current according to a video signal to the current supply circuit placed in each pixel. The driving circuit is required to output an analog signal current accurately to each pixel and therefore has to be manufactured from an IC chip. This causes problems such as high cost and difficulty in reducing size. A display device of the present invention, on the other hand, does not need a driving circuit for changing the value of the current flowing in the current supply circuit that is placed in each pixel in accordance with video signals. The structure that does not require an external driving circuit manufactured from an IC chip makes it possible to lower the cost and reduce the size.

It is thus possible to provide a low-cost display device with a reduced size in which a light emitting element can emit light at a constant luminance irrespective of a change in current characteristic due to degradation or the like, which is fast in writing signals in pixels, and which is capable of displaying in precise gray scales, as well as a method of driving the display device.

BEST MODE FOR CARRYING OUT THE INVENTION

Figure 1:
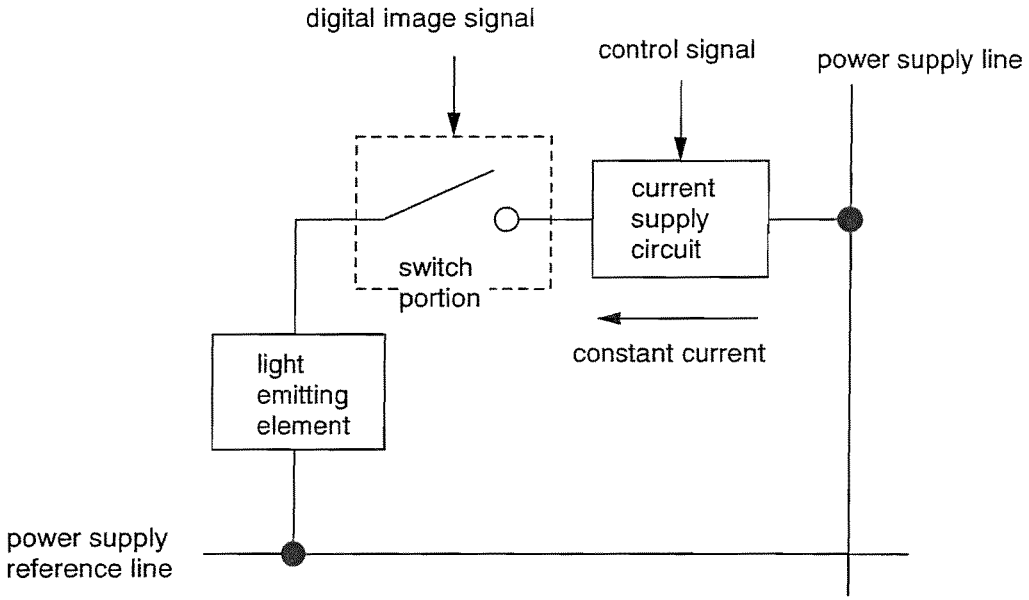
FIG. 1 is a schematic diagram showing a method of driving a pixel in a display device of the present invention.

FIG. 3A is a schematic diagram of the structure of a pixel in a display device of the present invention. In FIG. 3A, each pixel 100 is composed of a scanning line G, a video signal input line S, a power supply line W, a switch portion 101, a current supply circuit 102, and a light emitting element 106.

In each pixel 100, the switch portion 101 has a terminal C and a terminal D. A pixel electrode 106*a* of the light emitting element 106 is connected to the terminal D of the switch portion. The terminal C of the switch portion is connected to a terminal B of the current supply circuit 102. A terminal A of the current supply circuit 102 is connected to the power supply line W. The current supply circuit 102 is schematically shown by a symbol consisting of a circle and an arrow that is placed in the circle. The current supply circuit 102 is a circuit that causes a plus constant current flow in the direction indicated by the arrow of the symbol, namely, from the terminal A toward the terminal B. Of the terminals A and B, one is called an input terminal of the current supply circuit 102 and the other is called an output terminal of the current supply circuit 102.

If the pixel 100 receives a signal that chooses a light emission state from the video signal input line S, the path between the terminal C and terminal D of the switch portion 101 is made conductive. Thus, the pixel electrode 106*a* of the light emitting element 106 is connected with the power supply line W through the path between the terminal C and terminal D of the switch portion 101 and through the path between the terminal A and terminal B of the current supply circuit 102.

The switch portion 101 has a first switch and a second switch. The first switch switches input of a video signal on the video signal input line S to the pixel by a signal inputted from the scanning line G. The second switch is switched between ON and OFF by a video signal inputted to the pixel. By switching between ON and OFF of the second switch, the path between the terminal C and terminal D of the switch portion is made conductive or nonconductive. Of the terminals C and D, one is called an input terminal of the switch portion 101 and the other is called an output terminal of the switch portion 101.

The light emitting element 106 is an element whose luminance changes in accordance with a current flowing from the pixel electrode 106*a* to an opposite electrode 106*b*, or in the reverse direction.

In FIG. 3A, the terminal A of the current supply circuit 102 is connected to the power supply line W and the terminal B thereof is connected to the pixel electrode 106*a* of the light emitting element 106 through the path between the terminal C and terminal D of the switch portion 101. Therefore, the pixel electrode 106*a* of the light emitting element 106 serves as an anode and the opposite electrode 106*b* serves as a cathode. In this case, an electric potential $V_{com}$ given to the opposite electrode 106*b* of the light emitting element 106 is set lower than the electric potential of the power supply line W. The electric potential $V_{com}$ is given by a power supply reference line (not shown in the drawing).

Alternatively, the terminal A of the current supply circuit 102 may be connected to the terminal C of the switch portion 101 whereas the terminal B of 102 is connected to the power supply line W. In this case, the pixel electrode 106*a* of the light emitting element 106 serves as a cathode and the opposite electrode 106*b* serves as an anode. An electric potential $V_{com}$ given to the opposite electrode 106*b* of the light emitting element 106 is set higher than the electric potential of the power supply line W.

The current supply circuit 102, the switch portion 101, and the light emitting element 106 can be connected in an arbitrary order. For instance, the current supply circuit 102 may be placed between the switch portion 101 and the light emitting element 106. Then the terminal B of the current supply circuit 102 is connected to the pixel electrode 106*a* of the light emitting element 106, the terminal A of the current supply circuit 102 is connected to the terminal D of the switch portion 101, and the terminal C of the switch portion 101 is connected to the power supply line W. A structure in which the terminal A and terminal B of the current supply circuit 102 are inverted may be employed. Then, the terminal A of the current supply circuit 102 is connected to the pixel electrode 106*a* of the light emitting element 106, the terminal B of the current supply circuit 102 is connected to the terminal D of the switch portion 101, and the terminal C of the switch portion 101 is connected to the power supply line W. In this case, the pixel electrode 106*a* of the light emitting element 106 serves as a cathode and the opposite electrode 106*b* serves as an anode. The electric potential $V_{com}$ given to the opposite electrode 106*b* of the light emitting element 106 is set higher than the electric potential of the power supply line W.

When the path between the terminal C and terminal D of the switch portion 101 is made conductive in the pixel 100, a constant current determined by the current supply circuit 102 is inputted to the light emitting element 106 and light is emitted from the light emitting element 106.

Examples of the basic structure of the current supply circuit 102 are shown in FIG. 3(B) and FIG. 3(C). In the examples given, the constant current flowing in the current supply circuit of each pixel is determined by a current signal. A current supply circuit structured as this is called a current control type current supply circuit. The terminals A and B in FIG. 3(B) and FIG. 3(C) correspond to the terminals A and B of FIG. 3(A), respectively.

In FIG. 3(B) and FIG. 3(C), the current supply circuit 102 has a transistor (current supply transistor) 112 and a capacitor element (current supply capacitor) 111. The drain current of the current supply transistor 112 operating in a saturation region is a constant current (hereinafter referred to as pixel reference current) corresponding to a constant current (hereinafter referred to as reference current) that is inputted from the outside of the pixel. In short, a constant current (reference current) is inputted from the outside of the pixel. If a gate voltage Vgs (hereinafter referred to as pixel corresponding reference voltage) at this point is held by the current supply capacitor 111 and the current supply transistor 112 operates in a saturation region, a constant current (pixel reference current) corresponding to the reference current flows as the drain current in the current supply transistor 112 and the light emitting element 106. In this way, the current supply transistor 112 continues to cause a pixel reference current to flow in accordance with the pixel corresponding reference voltage held in the current supply capacitor 111 when a voltage is applied to its source-drain after the external current supply stops inputting the reference current. The current supply capacitor 111 may be omitted if a gate capacitance of other transistor or the like is utilized.

An operation of obtaining and holding a gate voltage necessary for the current supply transistor 112 to cause a pixel reference current flow in the current supply capacitor 111 provided in each pixel is called a pixel setting operation. Transistors in the present invention may be thin film transistors (TFTs) or single crystal transistors.

Transistors utilizing organic may also be employed. For example, transistors formed by using the SOI technique can be employed as single crystal transistors. Thin film transistors may be ones that use a polycrystalline semiconductor as their active layers, or may be ones that use an amorphous semiconductor as their active layers. TFTs using polysilicon, TFTs using amorphous silicon, and the like can be employed.

When the drain current flows in the current supply transistor 112 in the current supply circuit 102, one of electrodes of the current supply capacitor 111 is connected to a gate electrode of the current supply transistor 112 and the other (indicated by a terminal A' in the drawings) receives a constant electric potential. The electric potential of the gate electrode of the current supply transistor 112 (gate electric potential) is held by electric charges held in the current supply capacitor 111. The terminal A' and a source terminal of the current supply transistor 112 may have the same electric potential or different electric potentials. However, the difference in electric potential between the terminals has to be always the same when the pixel reference current flows in the current supply transistor. The gate voltage Vgs (pixel corresponding reference voltage) of when the pixel reference current flows in the current supply transistor 112 is held in this way. In the transistor operating in a saturation region, the drain current is also changed in accordance with the gate voltage Vgs. Therefore, the terminal A' is desirably connected to the source terminal to keep the gate voltage Vgs constant even when there is a change in electric potential of the source terminal. The current supply transistor 112 in FIG. 3(B) and the current supply transistor 112 in FIG. 3(C) have different polarities. The current supply transistor 112 has a p-channel polarity in FIG. 3(B) whereas it has an n-channel polarity in FIG. 3(C).

When the connection is as shown in FIG. 3(A) and the current supply transistor 112 is a p-channel transistor, a current flows from the source terminal to the drain terminal in the current supply transistor 112. If the current supply transistor 112 is an n-channel transistor, a current flows from the drain terminal to the source terminal in the current supply transistor 112. Accordingly, the source terminal of the current supply transistor 112 is connected to the terminal A and the drain terminal is connected to the terminal B when the current supply transistor 112 is a p-channel transistor. When the current supply transistor 112 is an n-channel transistor, on the other hand, the drain terminal of the current supply transistor 112 is connected to the terminal A and the source terminal is connected to the terminal B.

Roughly speaking, there are two methods to control the pixel reference current using a current signal (reference current) that is inputted from the outside of the pixel.

One method is named a current mirror method. A current mirror circuit has a pair of transistors whose gate electrodes are electrically connected to each other, and the gate electrode of one of the transistors is electrically connected to its drain terminal. In the current mirror method, of a pair of transistors that constitute a current mirror circuit, one transistor serves as the current supply transistor 112 and the other serves as a current transistor. A drain terminal of the current transistor is electrically connected to its gate electrode and a reference current is inputted to the source-drain thereof.

The other method is named as an identic-transistor method. In the identic-transistor method, a reference current is inputted directly to the source-drain of the current supply transistor 112 whose drain terminal and gate electrode are electrically connected. A modification of the identic-transistor method is called a multi-gate method.

A current supply circuit using the current mirror method is called a current mirror method current supply circuit. A current supply circuit using the identic-transistor method is called an identic-transistor method current supply circuit. A current supply circuit using the multi-gate method is called a multi-gate method current supply circuit. A reference current is inputted to the current supply circuit 102 once and a pixel corresponding reference voltage is held in the current supply capacitor 111. After the pixel setting operation is completed, an operation of inputting a reference current is not needed again unless electric charges held in the current supply capacitor 111 are discharged.

In practice, electric charges held in the current supply capacitor 111 are changed with time due to influence of leak current and various noises. It is therefore necessary to repeat the pixel setting operation periodically. However, once the pixel setting operation is completed, the periodical setting operation only needs to hold changed portions of electric charges anew that have been held in the current supply capacitor 111 and changed by leak current. Accordingly, compared to the initial pixel setting operation, the subsequent periodical pixel setting operation takes a shorter period of time.

Embodiment Mode 1

Figure 3:
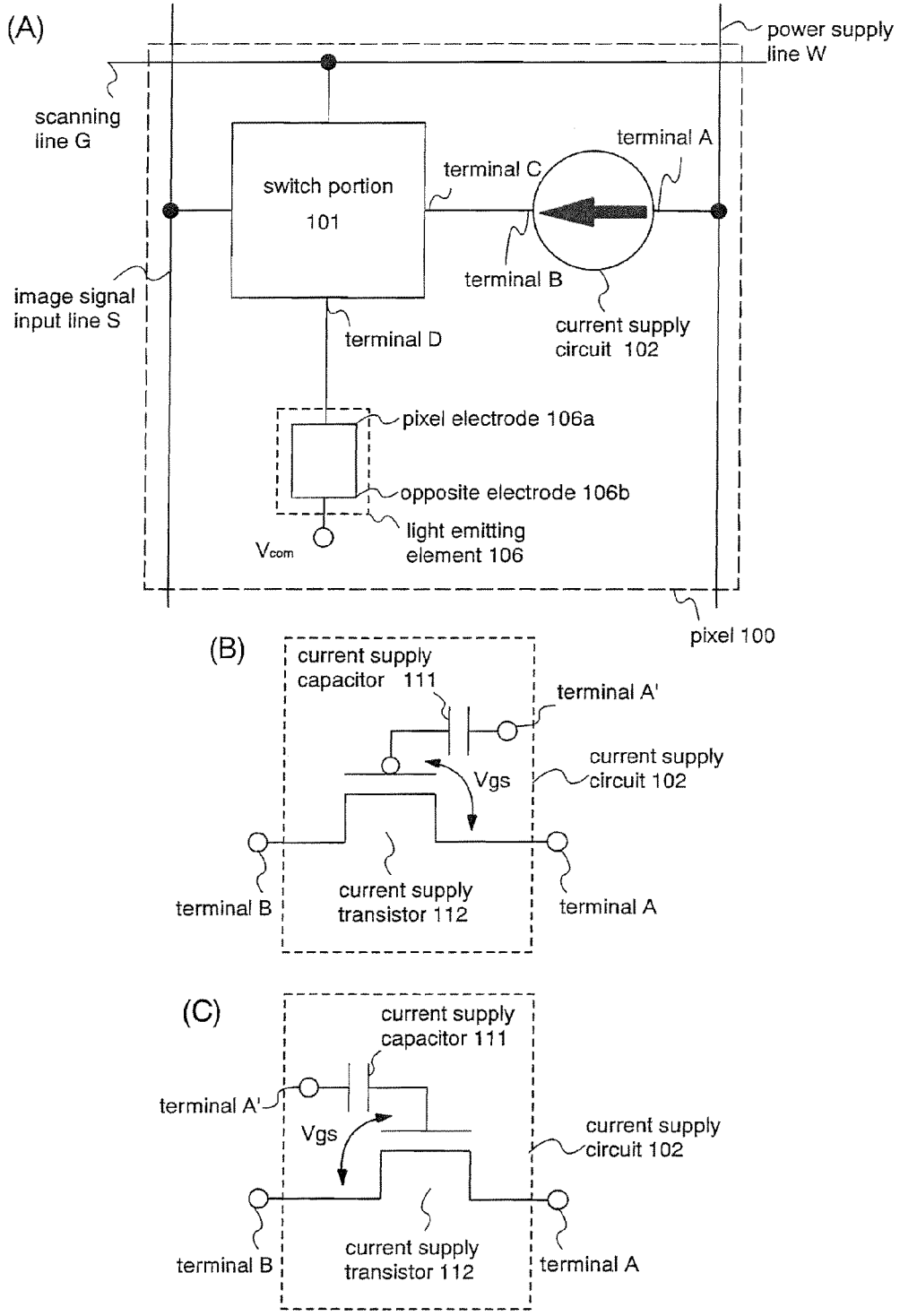
FIG. 3 are block diagrams showing the structure of a pixel in a display device of the present invention.
Figure 4:
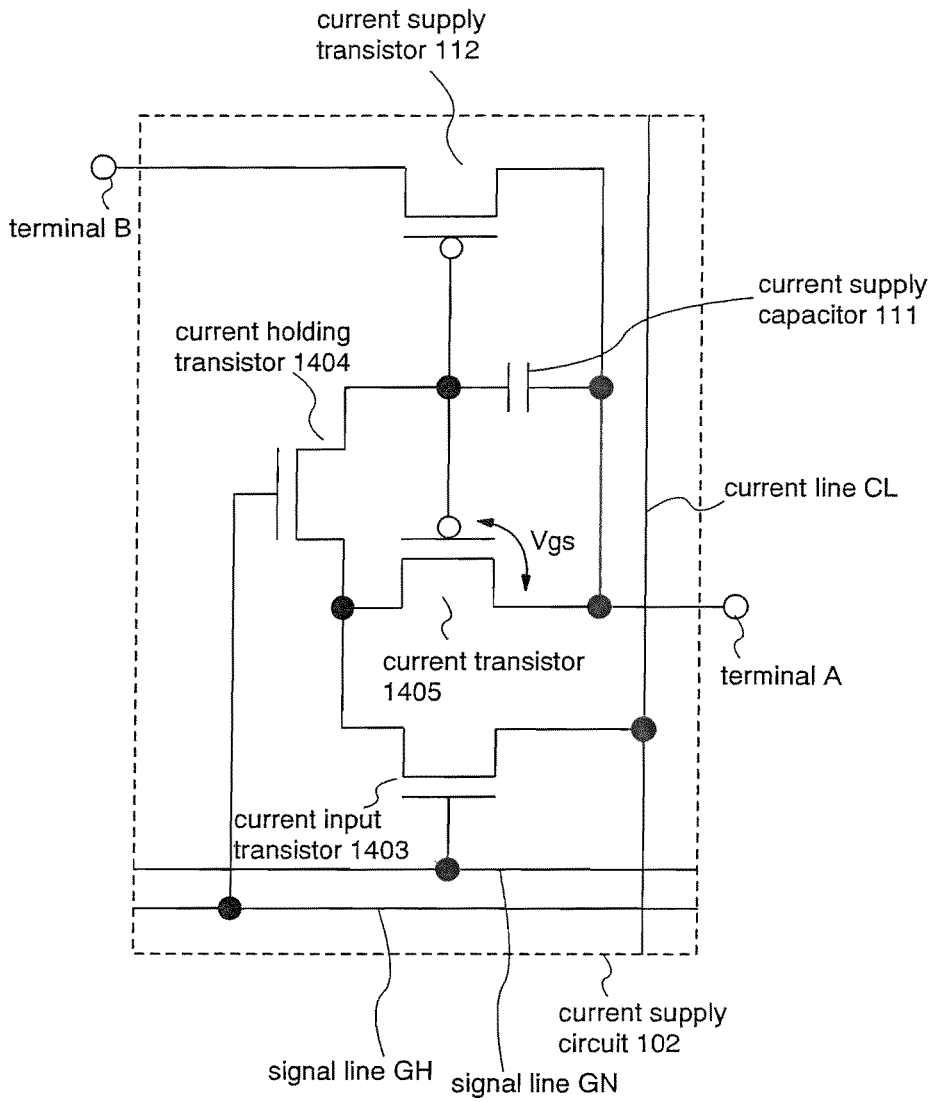
FIG. 4 is a circuit diagram showing a current supply circuit in a display device of the present invention.

An example of the pixel structure is shown for a display device of the present invention. FIG. 4 shows a structural example of a current supply circuit placed in each pixel. In FIG. 4, components identical with those in FIG. 3 are denoted by the same symbols. The example shown in FIG. 4 is of a current mirror method current supply circuit. A current supply circuit 102 is composed of a current supply capacitor 111, a current supply transistor 112, a current transistor 1405, a current input transistor 1403, a current holding transistor 1404, a current line CL, a signal line GN, and a signal line GH. The current supply transistor 112 and the current transistor 1405 form a pair to constitute a current mirror circuit, and therefore have to have the same polarity. Desirably, these two transistors in the same pixel have the same current characteristic. In Embodiment Mode 1, the current characteristic of the current supply transistor 112 and the current characteristic of the current transistor 1405 are deemed as equal for simplification.

Figure 23:
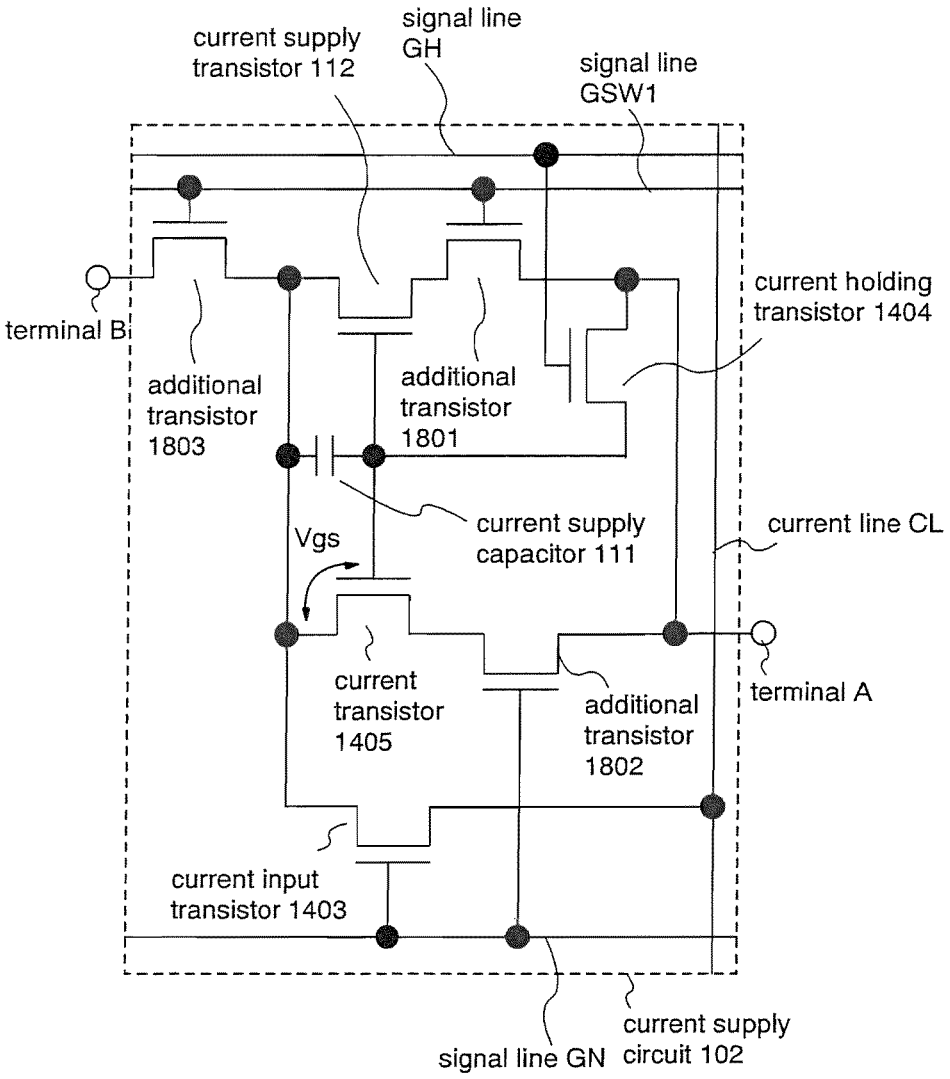
FIG. 23 is a circuit diagram of a current supply circuit in a display device of the present invention.

In the example shown in FIG. 4, the current supply transistor 112 and the current transistor 1405 are p-channel transistors. If n-channel transistors are used for the current supply transistor 112 and the current transistor 1405, follow the structure shown in FIG. 3(C) for easy application. An example thereof is shown in FIG. 23. In FIG. 23, components identical with those in FIG. 4 are denoted by the same symbols. Additional transistors 1801 and 1803 in FIG. 23 are provided to prevent a current from flowing in the current supply transistor 112 during the pixel setting operation. In other words, the additional transistors 1801 and 1803 are nonconductive during the pixel setting operation. On the other hand, the transistors 1801 and 1803 are conductive when an image is displayed. An additional transistor 1802 is provided to prevent a current from flowing in the current transistor 1405 during displaying an image. In other words, the additional transistor 1802 is conductive during the pixel setting operation whereas it is nonconductive when an image is displayed.

The description below takes FIG. 4 as an example. The current input transistor 1403 and the current holding transistor 1404 are n-channel transistors. However, the transistors 1403 and 1404 may be p-channel transistors since they simply operate as switches.

A gate electrode of the current supply transistor 112 is connected to a gate electrode of the current transistor 1405 and to one of electrodes of the current supply capacitor 111. The other electrode of the current supply capacitor 111 is connected to a source terminal of the current supply transistor 112, a source terminal of the current transistor 1405, and to a terminal A of the current supply circuit 102. The gate electrode of the current transistor 1405 is connected to its drain terminal through source-drain terminals of the current holding transistor 1404. A gate electrode of the current holding transistor 1404 is connected to the signal line GH. The drain terminal of the current transistor 1405 is connected to the current line CL through source-drain terminals of the current input transistor 1403. A gate electrode of the current input transistor 1403 is connected to the signal line GN. A drain terminal of the current supply transistor 112 is connected to a terminal B.

In the above structure, the current input transistor 1403 may be placed between the current transistor 1405 and the terminal A. Then the source terminal of the current transistor 1405 may be connected to the terminal A through the source-drain terminals of the current input transistor 1403, and the drain terminal of the current transistor 1405 may be connected to the current line CL.

In the above structure, the gate electrodes of the current transistor 1405 and current supply transistor 112 may be connected to the current line CL without passing through the path between the source and drain terminals of the current input transistor 1403. Then, of the source terminal and drain terminal of the current holding transistor 1404, one that is not connected to the gate electrodes of the current transistor 1405 and current supply transistor 112 may be directly connected to the current line CL. In this case, the source-drain voltage of the current holding transistor 1404 can be reduced by adjusting the electric potential of the current line CL. As a result, leak current of the current holding transistor 1404 can be reduced when the current holding transistor 1404 is in a nonconductive state.

Figure 61:
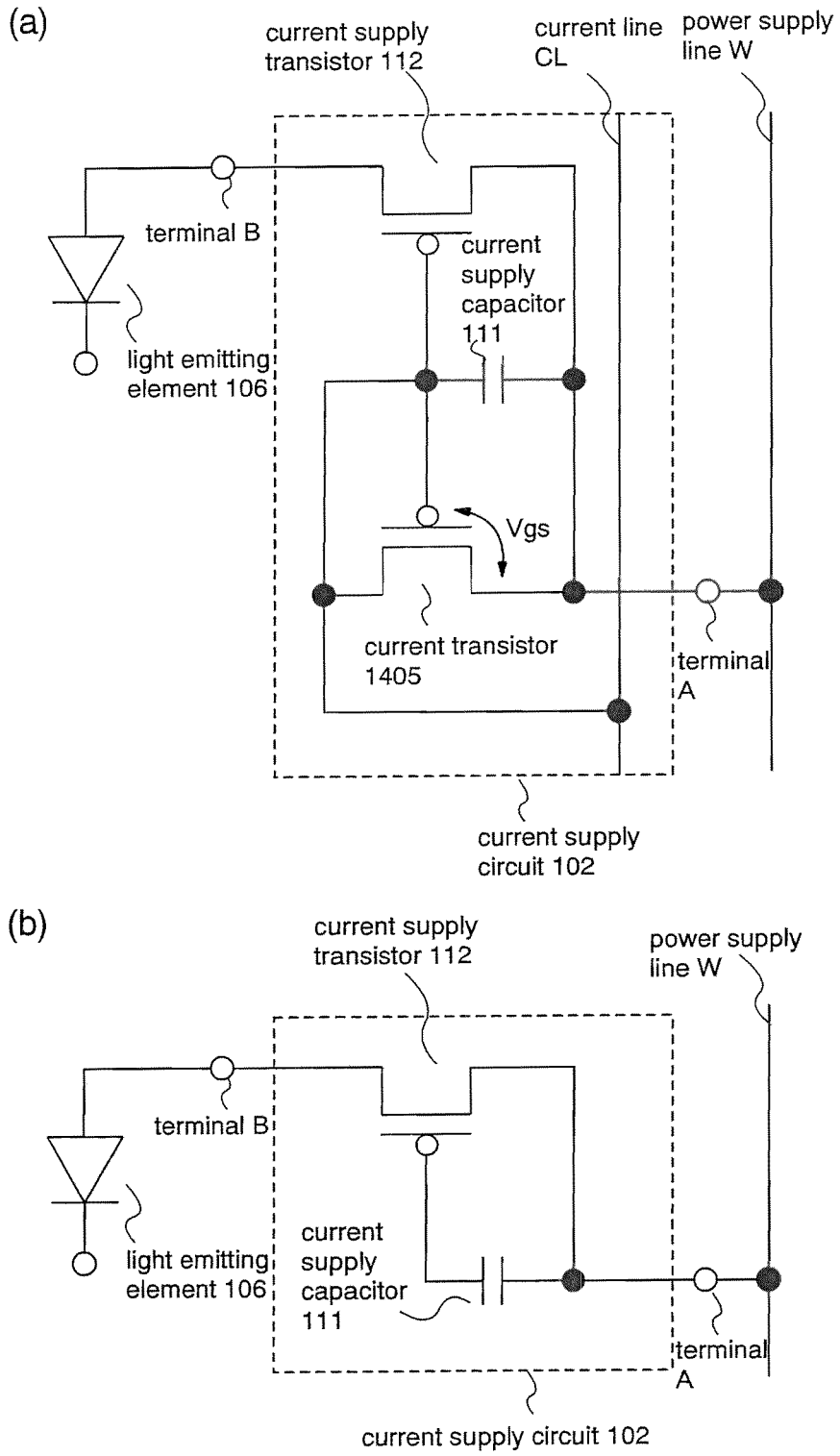
FIG. 61 are schematic diagrams showing states of a pixel in a display device of the present invention.
Figure 67:
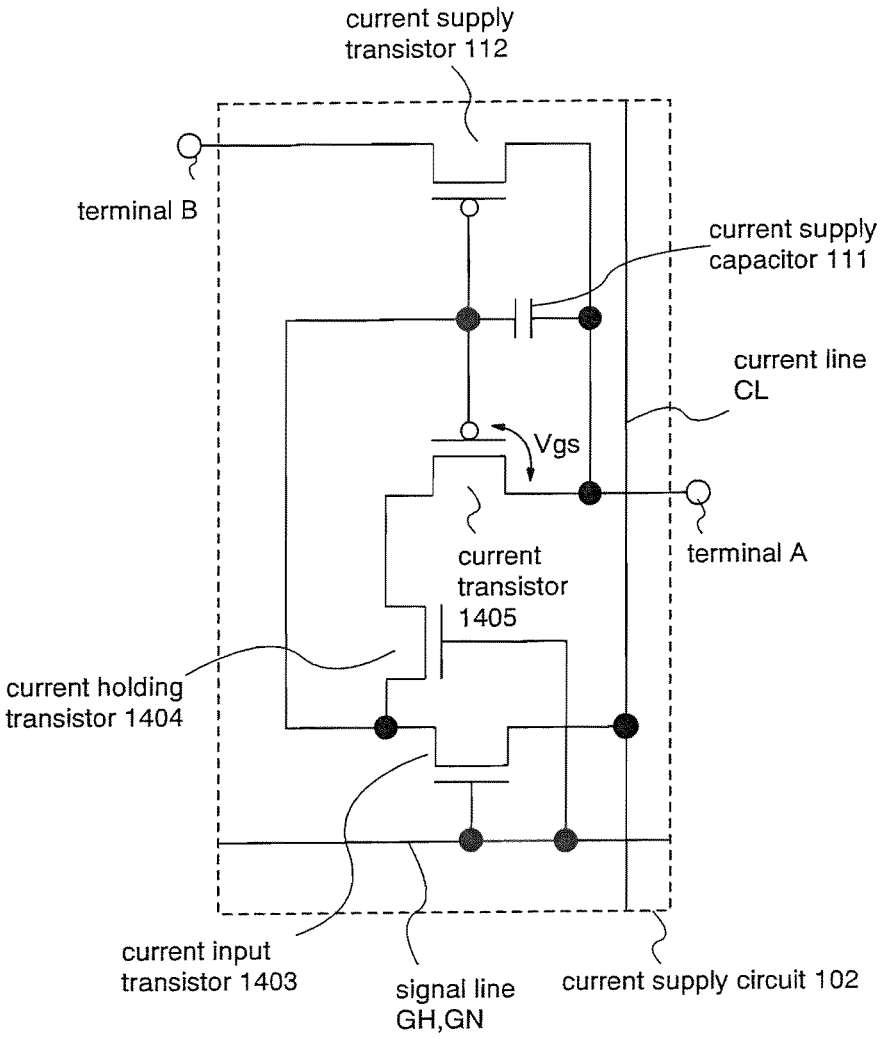
FIG. 67 is a circuit diagram of a current supply circuit of a pixel in a display device of the present invention.

This is not the only way and it is sufficient if the current holding transistor 1404 is connected in a manner that makes the electric potential of the gate electrode of the current transistor 1405 equal to the electric potential of the current line CL when 1404 is made conductive. In other words, it is sufficient if the wirings and switches are connected as shown in FIG. 61(*a*) during the pixel setting operation and as shown in FIG. 61(*b*) during light emission. Accordingly, FIG. 67 is also employable. In FIG. 67, components identical with those in FIG. 4 are denoted by the same symbols and explanations thereof are omitted.

Figure 13:
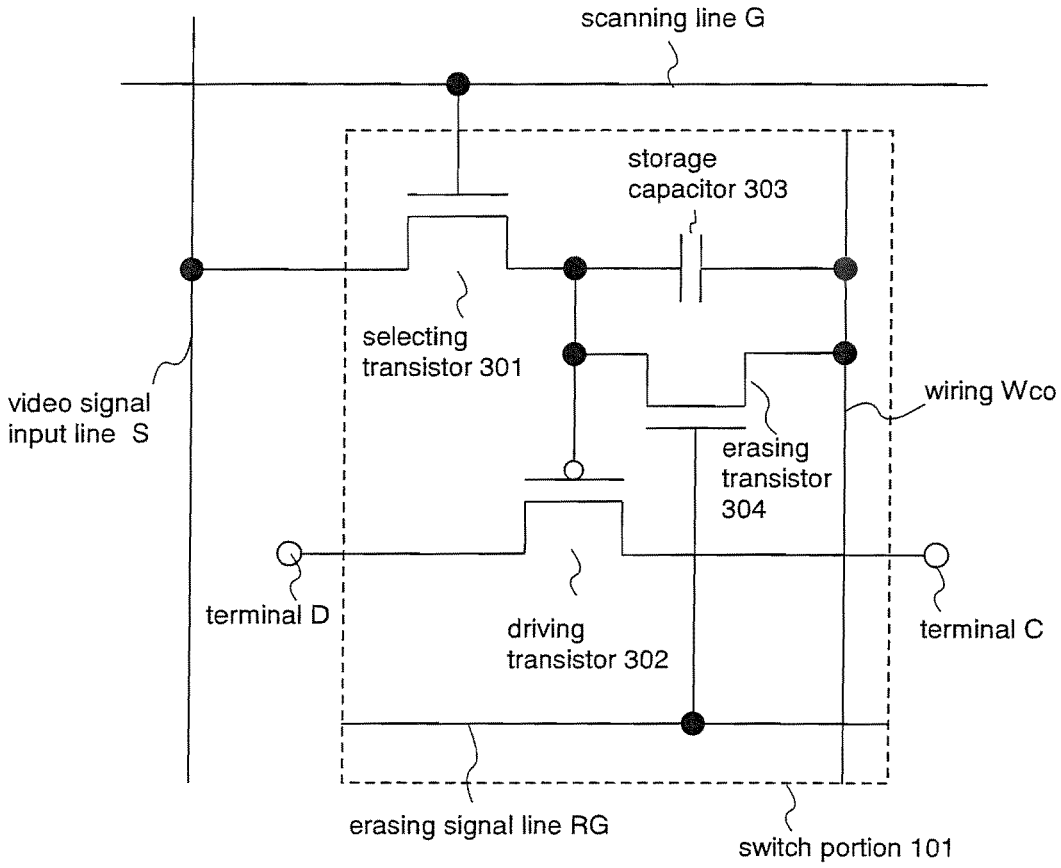
FIG. 13 is a circuit diagram of a switch portion in a display device of the present invention.

Next, a structural example of the switch portion of FIG. 3(A) is shown in FIG. 13. In FIG. 13, components identical with those in FIG. 3 are denoted by the same symbols. A switch portion 101 in FIG. 13 is composed of three transistors (a selecting transistor 301, a driving transistor 302, and an erasing transistor 304) and one capacitor element (storage capacitor 303). The storage capacitor 303 may be omitted if a gate capacitance of a transistor or the like is utilized.

In FIG. 13, the driving transistor 302 is a p-channel transistor whereas the selecting transistor 301 and the erasing transistor 304 are n-channel transistors. However, this is not the only possible structure. The selecting transistor 301 can either be an n-channel transistor or a p-channel transistor since it simply operates as a switch, and the same applies to the driving transistor 302 and the erasing transistor 304.

The driving transistor 302 may operate in a saturation region. By letting the driving transistor 302 operate in a saturation region, the current supply transistor 112 of the current supply circuit which is connected to the driving transistor 302 in series can be compensated for saturation region characteristic. The saturation region characteristic refers to a characteristic with which the drain current is kept constant against the source-drain voltage. To compensate the saturation region characteristic means that the drain current in the current supply transistor 112 operating in a saturation region is also prevented from being increased as the source-drain voltage is raised. In order to obtain the above effect, the driving transistor 302 and the current supply transistor 112 have to have the same polarity.

The effect of compensating the above-mentioned saturation region characteristic is described below. For instance, consider a case where the source-drain voltage of the current supply transistor 112 is increased. The current supply transistor 112 and the driving transistor 302 are connected in series. Therefore a change in source-drain voltage of the current supply transistor 112 changes the electric potential of the source terminal of the driving transistor 302. Thus the I-V curve of the driving transistor 302 is changed as the absolute value of the source-gate voltage of the driving transistor 302 is reduced. This change is directed toward reduction in drain current. In this way, the drain current is reduced in the current supply transistor 112 that is connected in series to the driving transistor 302. Similarly, the drain current of the current supply transistor 112 is increased as the source-drain voltage of the current supply transistor 112 is reduced. The effect of keeping the current flowing in the current supply transistor 112 constant is thus obtained.

A detailed description is given below on the structure of the switch portion of FIG. 13. The gate electrode of the selecting transistor 301 is connected to a scanning line G. Of the source terminal and drain terminal of the selecting transistor 301, one is connected to a video signal input line S and the other is connected to the gate electrode of the driving transistor 302. Of the source terminal and drain terminal of the driving transistor 302, one is connected to the terminal D and the other is connected to the terminal C. One electrode of the storage capacitor 303 is connected to the gate electrode of the driving transistor 302 and the other electrode is connected to a wiring $W_{CO}$. The erasing transistor 304 has a source terminal and a drain terminal one of which is connected to the gate electrode of the driving transistor 302 and the other of which is connected to the wiring $W_{CO}$. A gate electrode of the erasing transistor 304 is connected to an erasing signal line RG.

The source terminal and drain terminal of the erasing transistor 304 are not limited to the above connection structure. Various connection structures can be employed as long as the electric charge held in the storage capacitor 303 is discharged by letting the erasing transistor 304 be conductive. In other words, any connection structure can be employed if the driving transistor 302 is made nonconductive by letting the erasing transistor 304 be conductive or nonconductive.

Next, a description is given on a structure in which the switch portion and erasing transistor 304 of FIG. 13 are arranged differently. FIG. 43(A) shows an example of the switch portion. Components identical with those in FIG. 13 are denoted by the same symbols and explanations thereof are omitted. In FIG. 43(A), the erasing transistor 304 is serially placed on the path of a current to be inputted to the light emitting element, so that a current flow to the light emitting element is forcibly cut by letting the erasing transistor 304 be nonconductive. If this condition is met, the erasing transistor 304 can be placed anywhere. By letting the erasing transistor 304 be nonconductive, every pixel can be brought into a non-light emission state.

FIG. 43(B) shows another structure of the switch portion 101. In FIG. 43(B), a given voltage is applied to the gate electrode of the driving transistor 302 through the source-drain terminals of the erasing transistor 304 to let the driving transistor 302 be nonconductive. Components identical with those in FIG. 13 are denoted by the same symbols and explanations thereof are omitted. In this example, of the source terminal and drain terminal of the erasing transistor 304, one is connected to the gate electrode of the driving transistor 302 and the other is connected to a wiring Wr. The electric potential of the wiring Wr is determined suitably. In this way, the driving transistor 302 is made nonconductive when the electric potential of the wiring Wr is inputted to the gate electrode of the driving transistor 302 through the erasing transistor 304.

In the structure shown in FIG. 43(B), a diode may be used instead of the erasing transistor 304. This structure is shown in FIG. 43(C). The electric potential of the wiring Wr is changed to change the electric potential of one of two electrodes of a diode 3040 that is not connected to the gate electrode of the driving transistor 302. This causes a change in gate voltage of the driving transistor 302 to let the driving transistor 302 be nonconductive. The diode 3040 may be a transistor employing diode connection (its gate electrode and drain terminal are electrically connected). This transistor can be either an n-channel transistor or a p-channel transistor. Instead of the wiring Wr, the scanning line G may be used. FIG. 43(D) shows a structure in which the scanning line G is used instead of the wiring Wr in FIG. 43(B). In this case, the polarity of the selecting transistor 301 has to be chosen carefully by taking the electric potential of the scanning line G into consideration.

Figure 5:
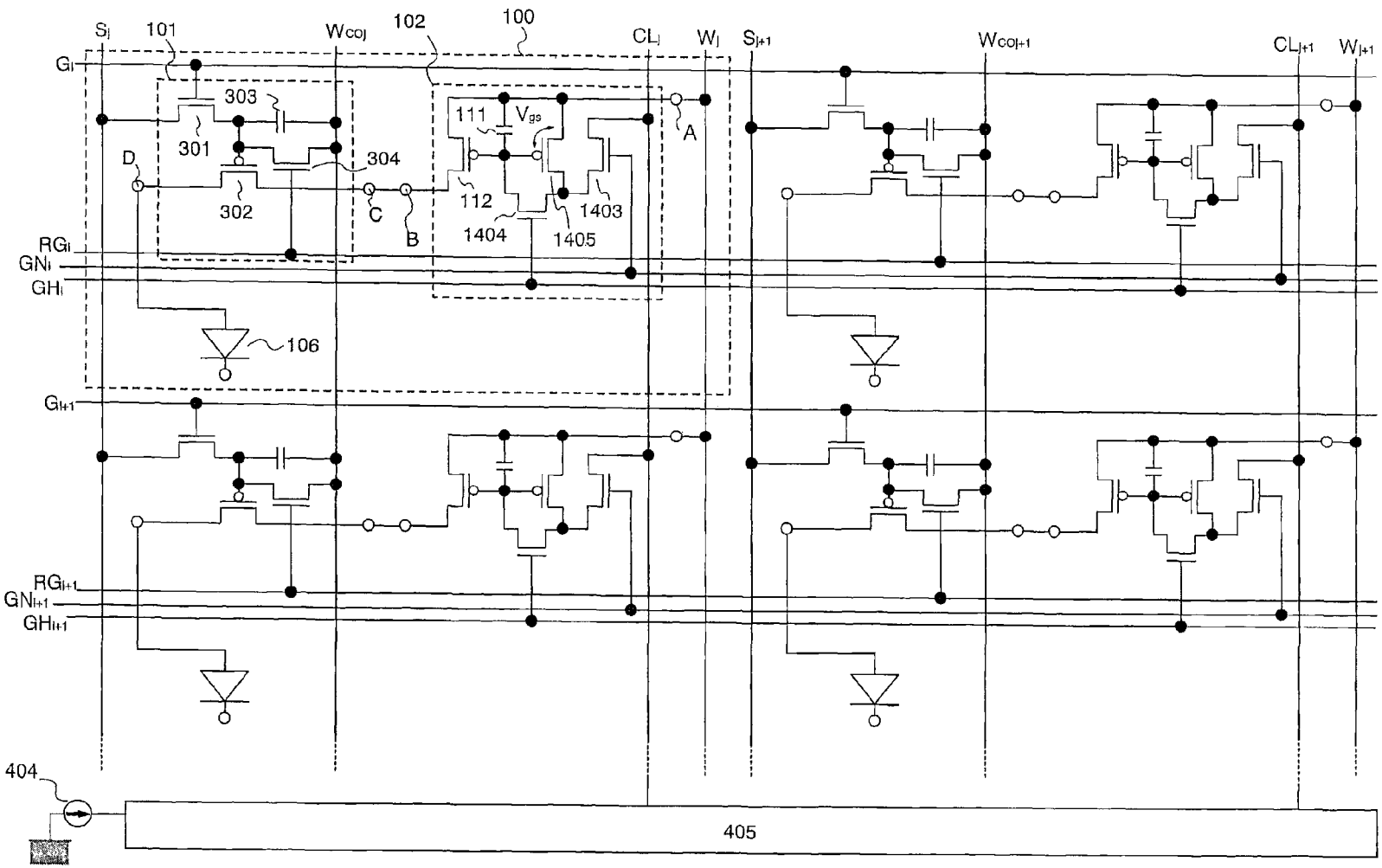
FIG. 5 is a circuit diagram of a pixel portion in a display device of the present invention.

A pixel having a current supply circuit and switch portion structured as described above will be described below. FIG. 5 is a circuit diagram of a part of a pixel region in which x columns x y rows of pixels are arranged to form a matrix pattern. Each of the pixels is denoted by 100 and has a current supply circuit 102 structured as shown in FIG. 4 and a switch portion 101 structured as shown in FIG. 13. In FIG. 5, only four pixels on the i-th (i is a natural number) row and j-th (j is a natural number) column, the (i+1)-th row and j-th column, the i-th row and (j+1)-th column, and the (i+1)-th row and (j+1)-th column are shown as a representative. Components identical with those in FIGS. 4 and 13 are denoted by the same symbols and explanations thereof are omitted.

Scanning lines G, erasing signal lines RG, signal lines GN, and signal lines GH associated with the i-th and (i+1)-th pixel rows are denoted by $G_i$ and $G_{i+1}$, $RG_i$ and $RG_{i+1}$, $GN_i$ and $GN_{i+1}$, and $GH_i$ and $GH_{i+1}$, respectively. Video signal input lines S, power supply lines W, current lines CL, and wirings $W_{CO}$ associated with the j-th and (j+1)-th pixel columns are denoted by $S_j$ and $S_{j+1}$, $W_j$ and $W_{j+1}$, $CL_j$ and $CL_{j+1}$, and $W_{COj}$ and $W_{COj+1}$, respectively. A reference current is inputted to the current lines $CL_j$ and $CL_{j+1}$ from the outside of the pixel region.

Figure 26:
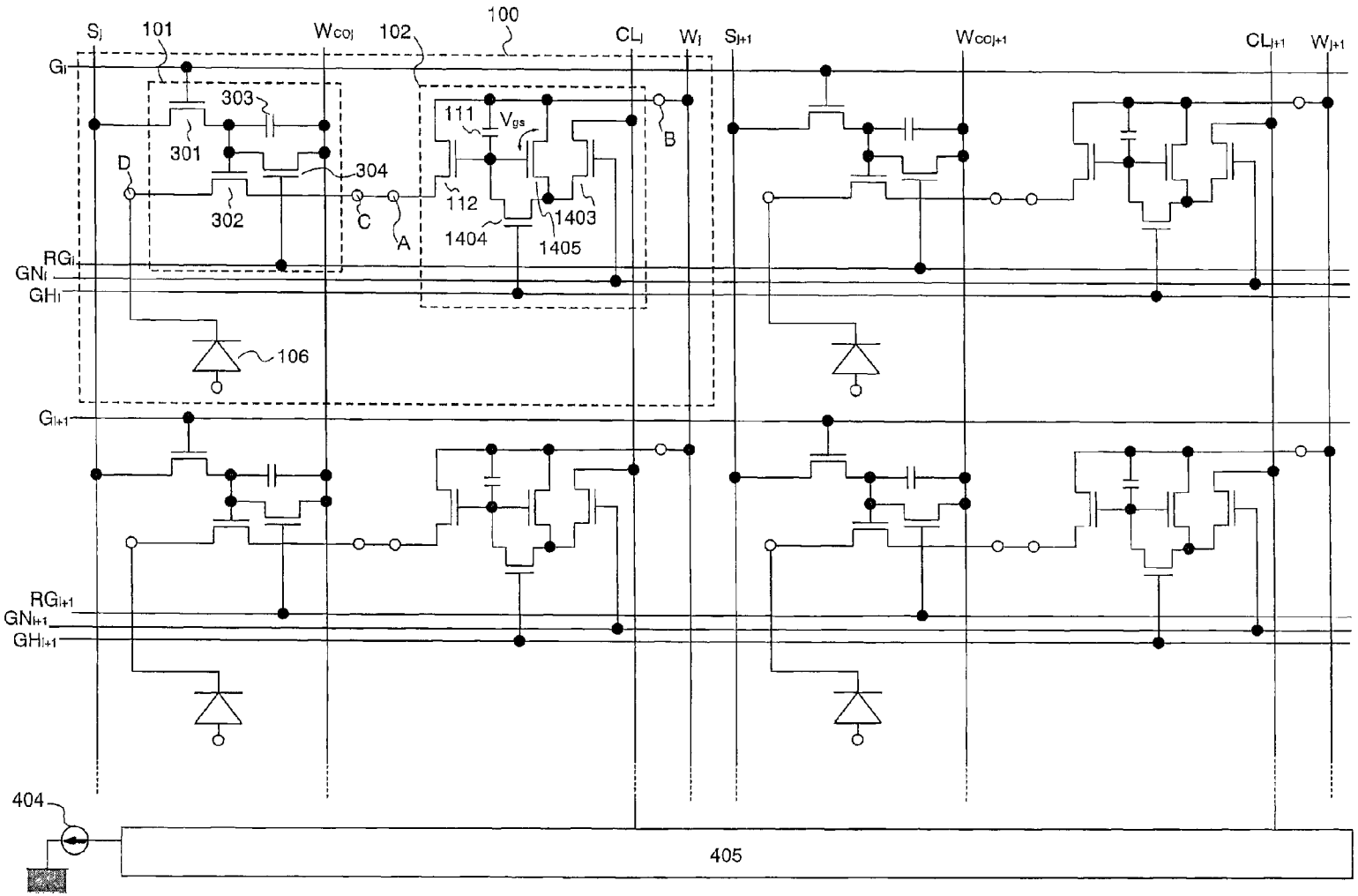
FIG. 26 is a circuit diagram of a pixel portion in a display device of the present invention.
Figure 27:
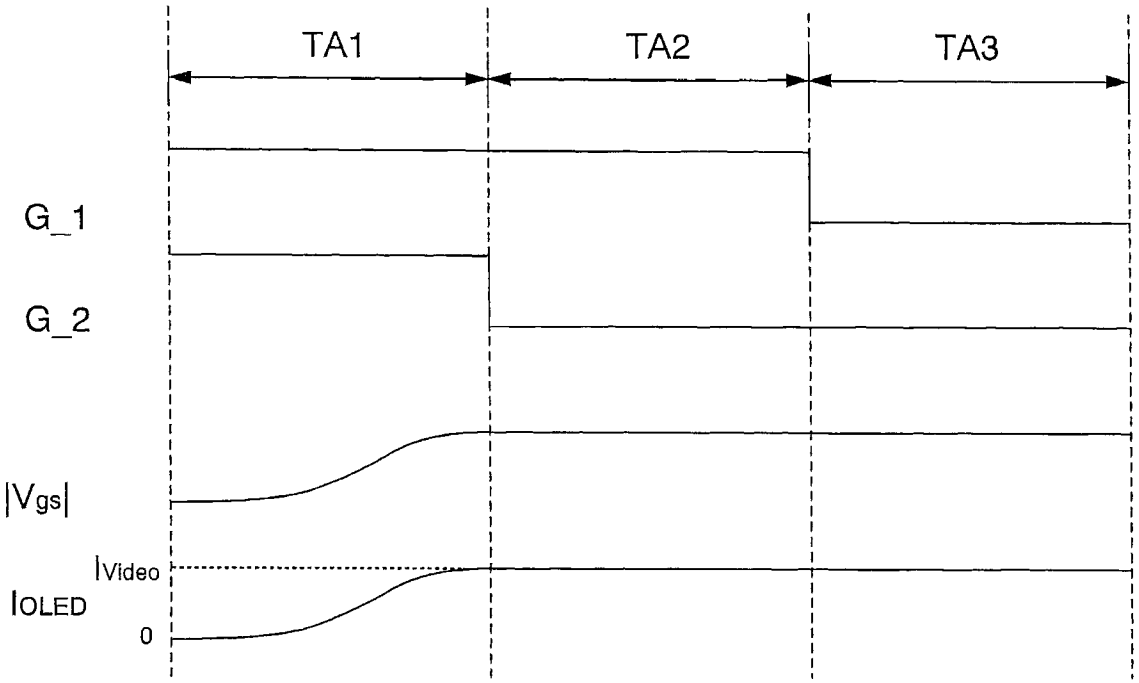
FIG. 27 is a timing chart of a conventional display device driving method.
Figure 28:
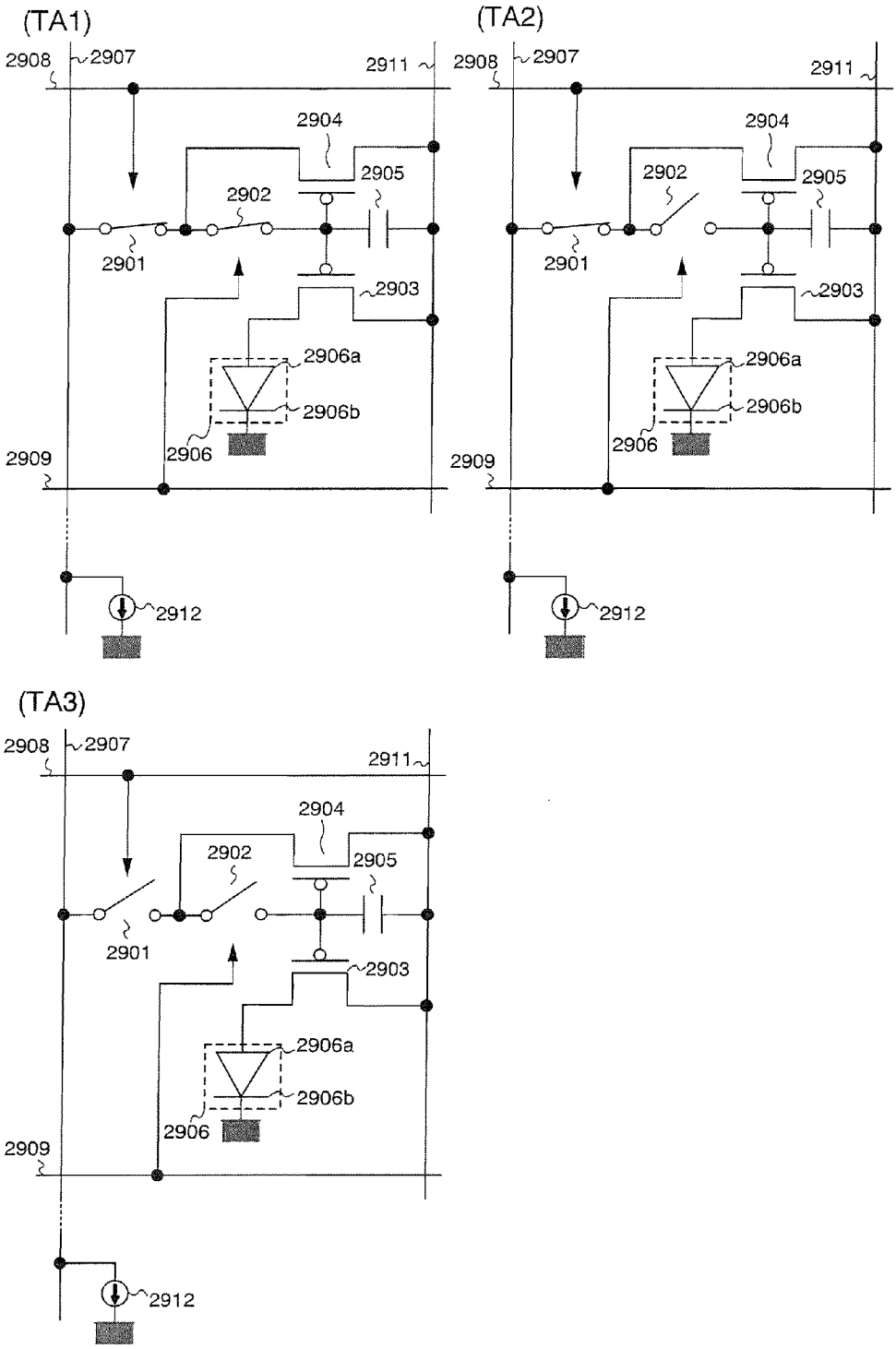
FIG. 28 is a diagram showing a conventional display device driving method.
Figure 29:
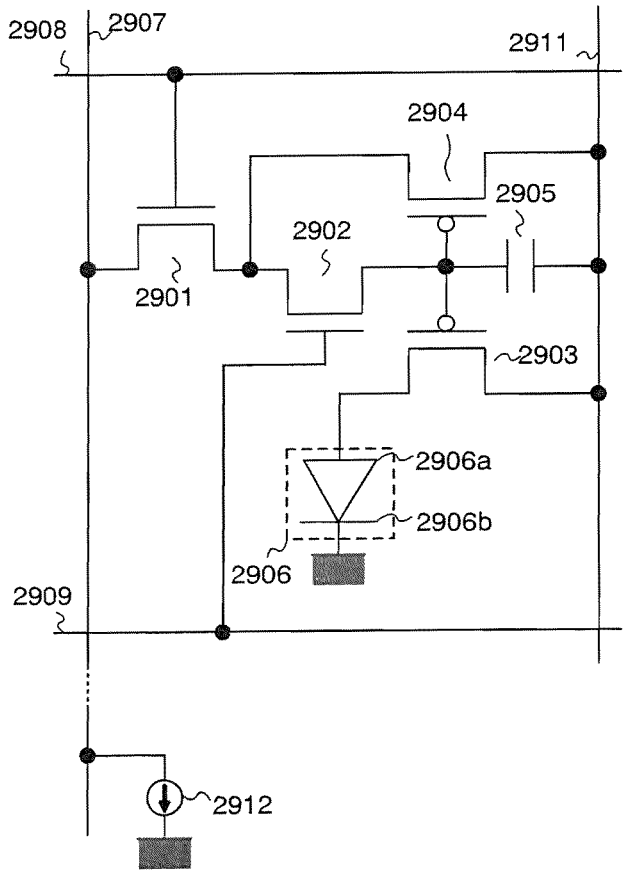
FIG. 29 is a circuit diagram of a pixel in a conventional display device.
Figure 30:
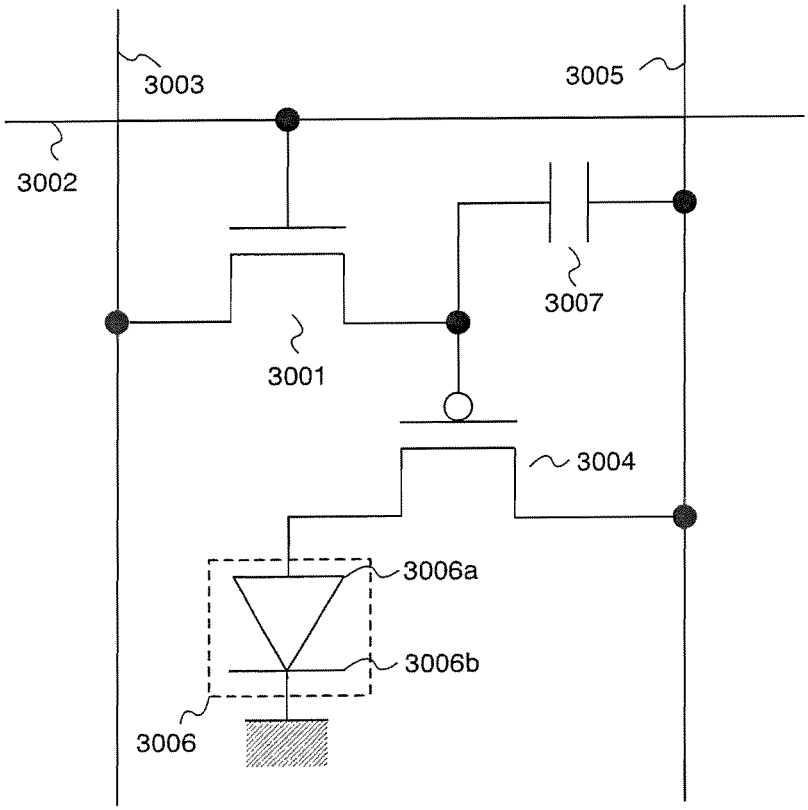
FIG. 30 is a circuit diagram of a pixel in a conventional display device.
Figure 31:
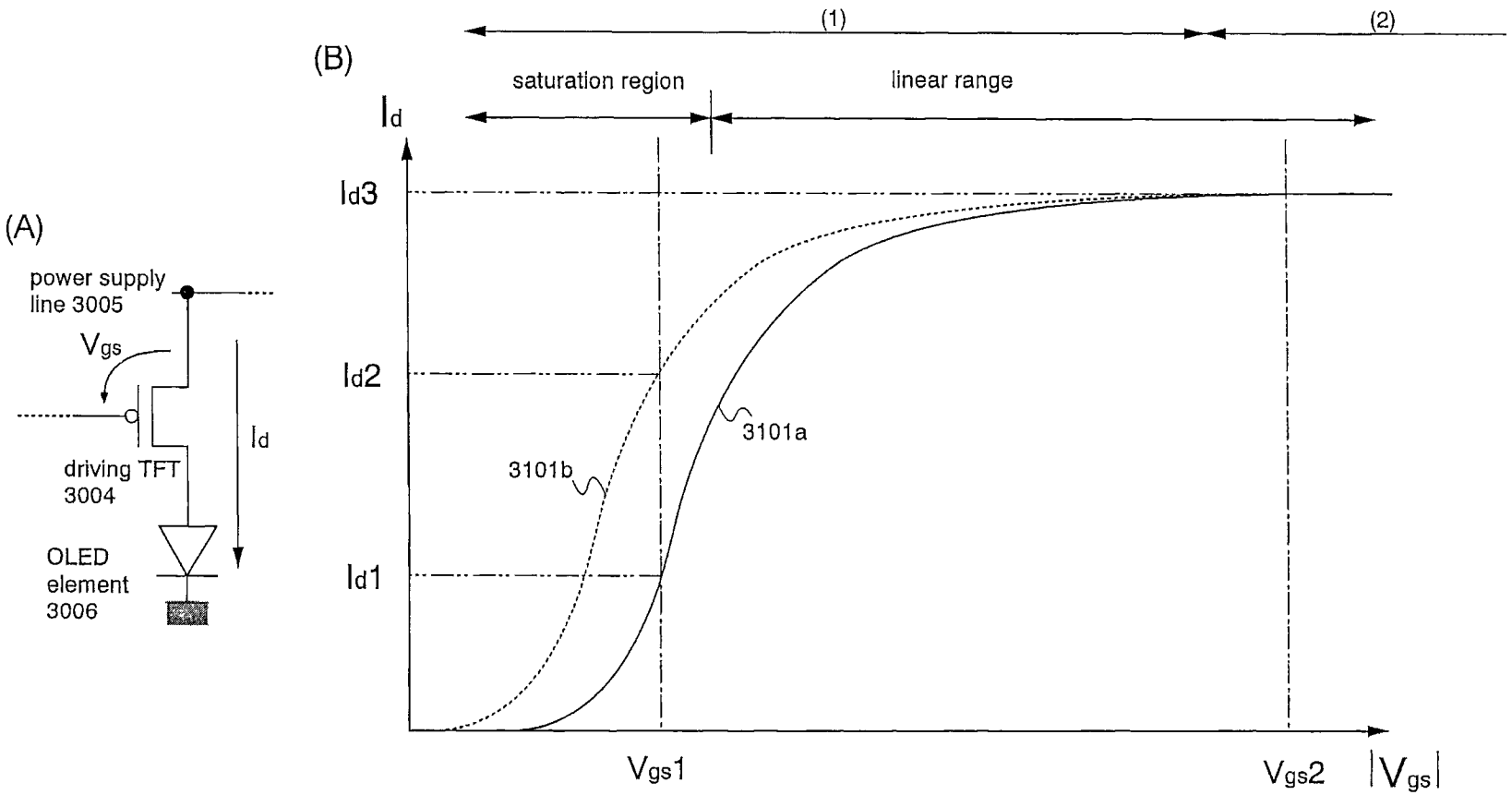
FIG. 31 are diagrams showing an operation range of a driving transistor in a conventional display device.
Figure 32:
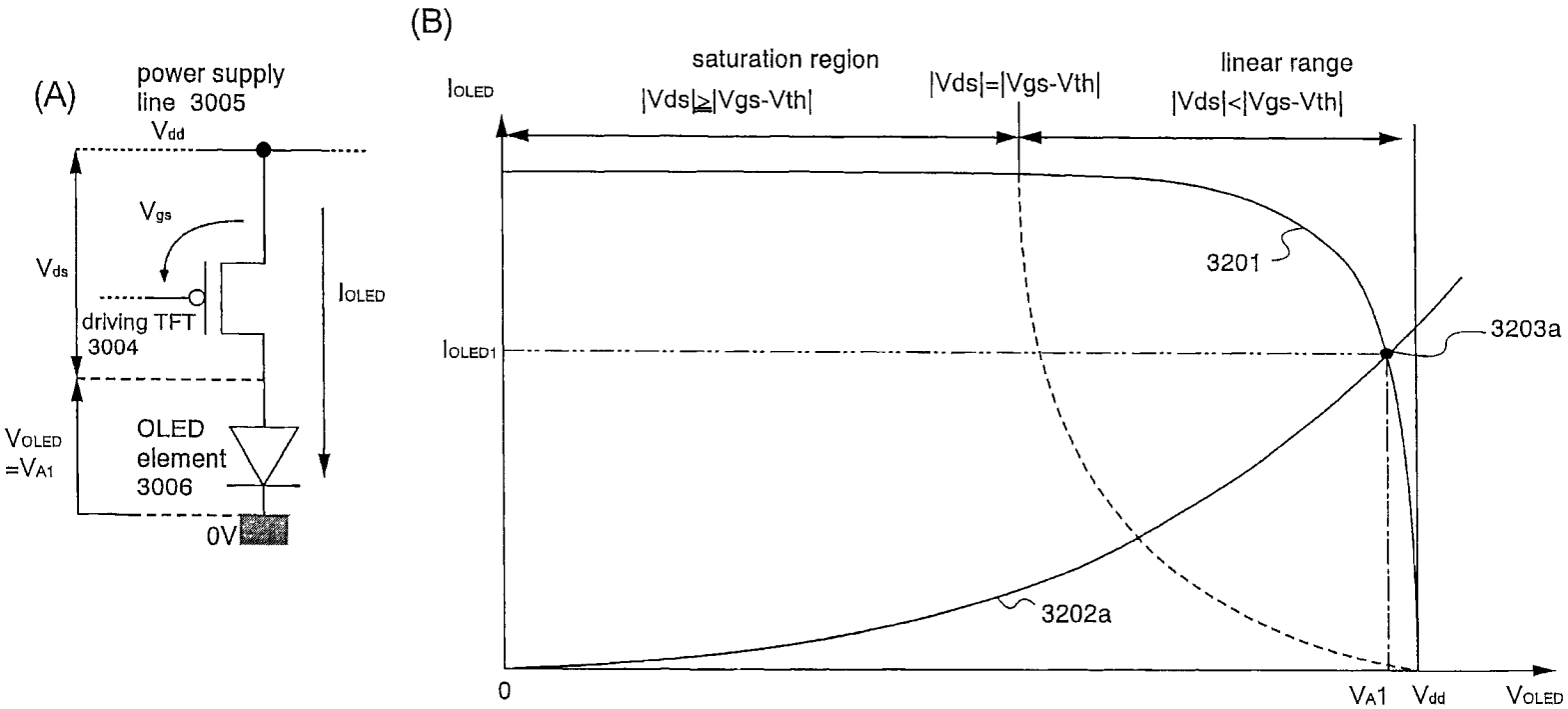
FIG. 32 are diagrams showing an operation point of a driving transistor in a conventional display device.
Figure 33:
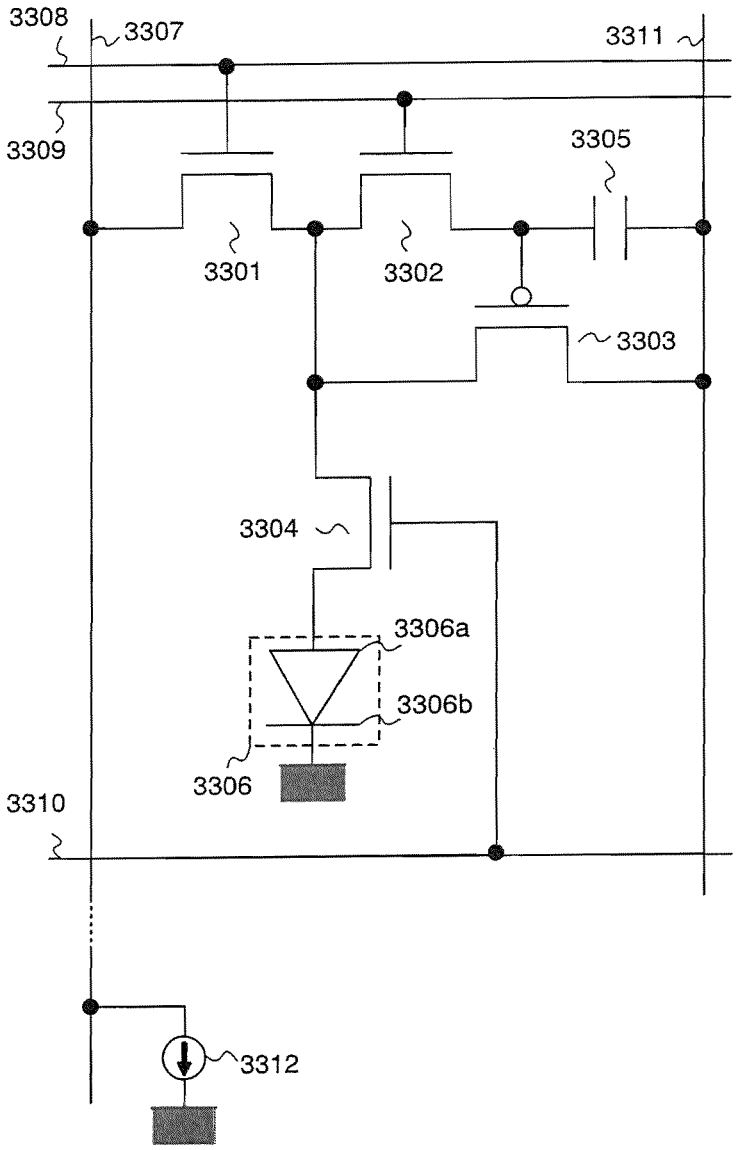
FIG. 33 is a circuit diagram of a pixel in a conventional display device.
Figure 34:
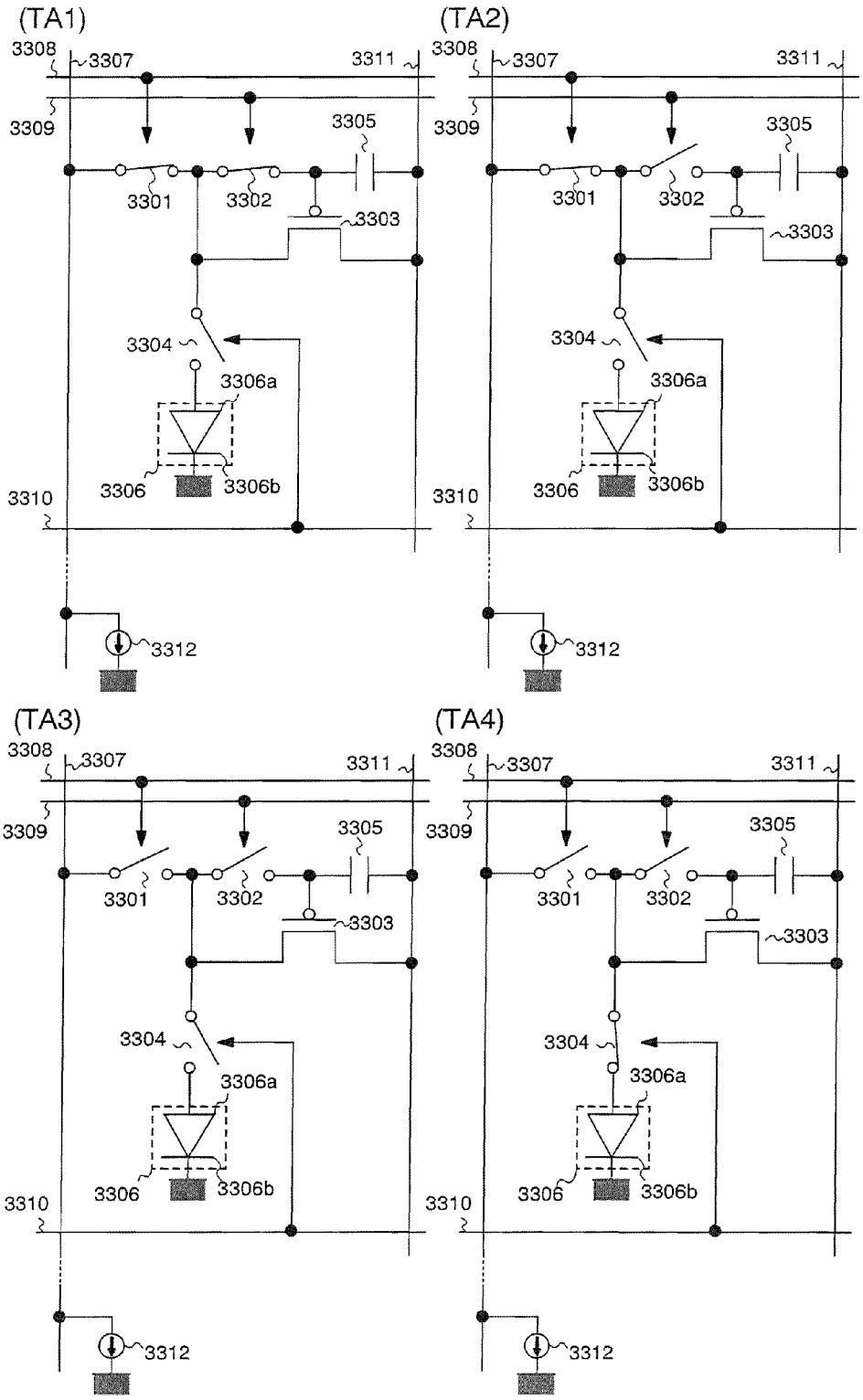
FIG. 34 is a diagram showing a conventional display device driving method.
Figure 35:
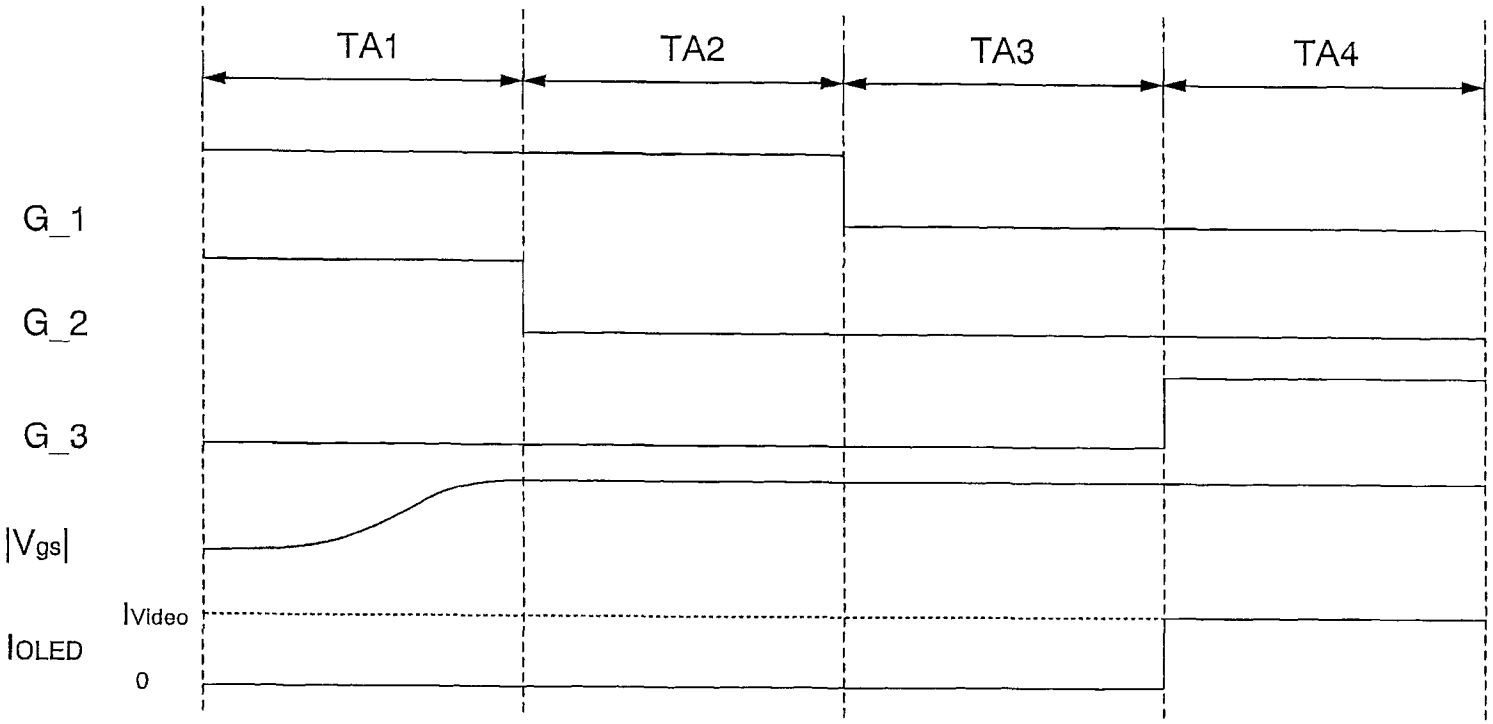
FIG. 35 is a timing chart of a conventional display device driving method.
Figure 36:
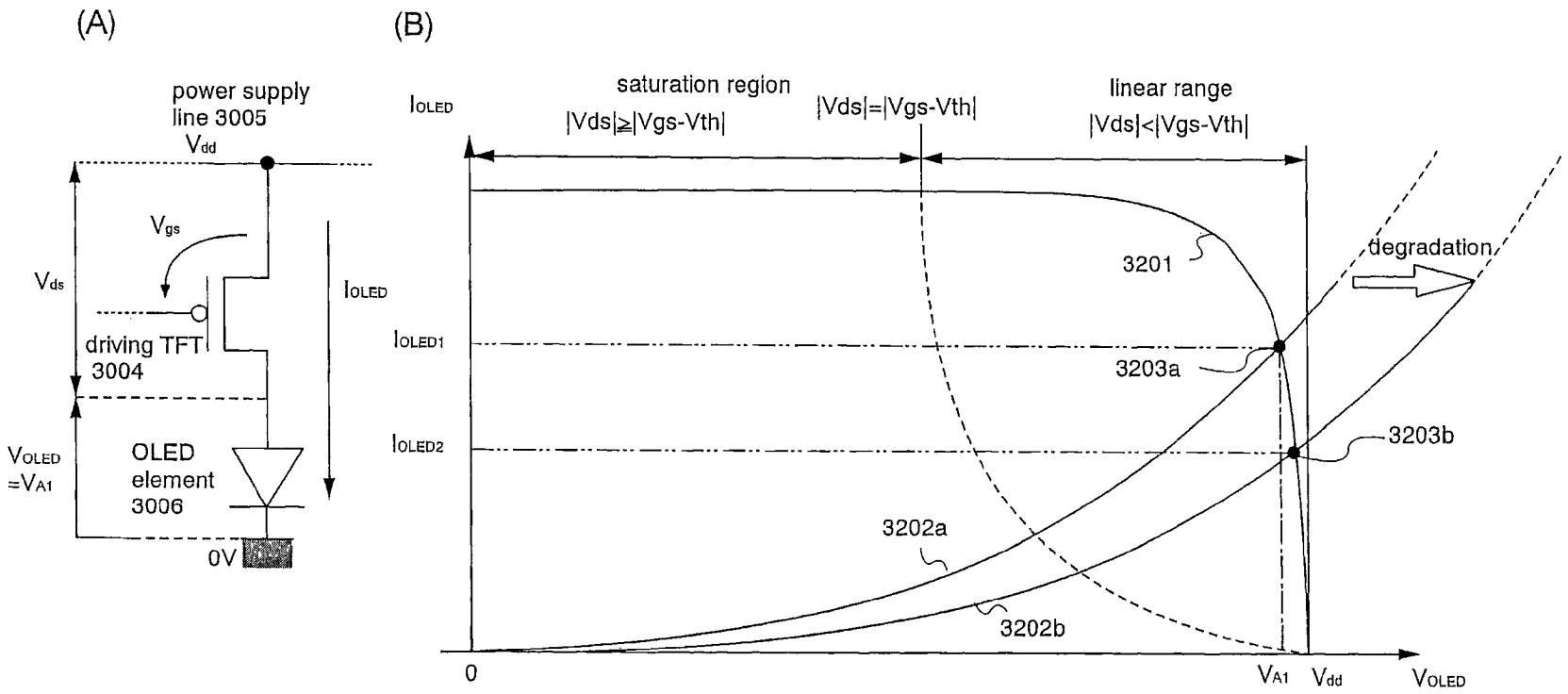
FIG. 36 are diagrams showing a change in operation point of a driving transistor due to degradation of a light emitting element in a conventional display device.
Figure 37:
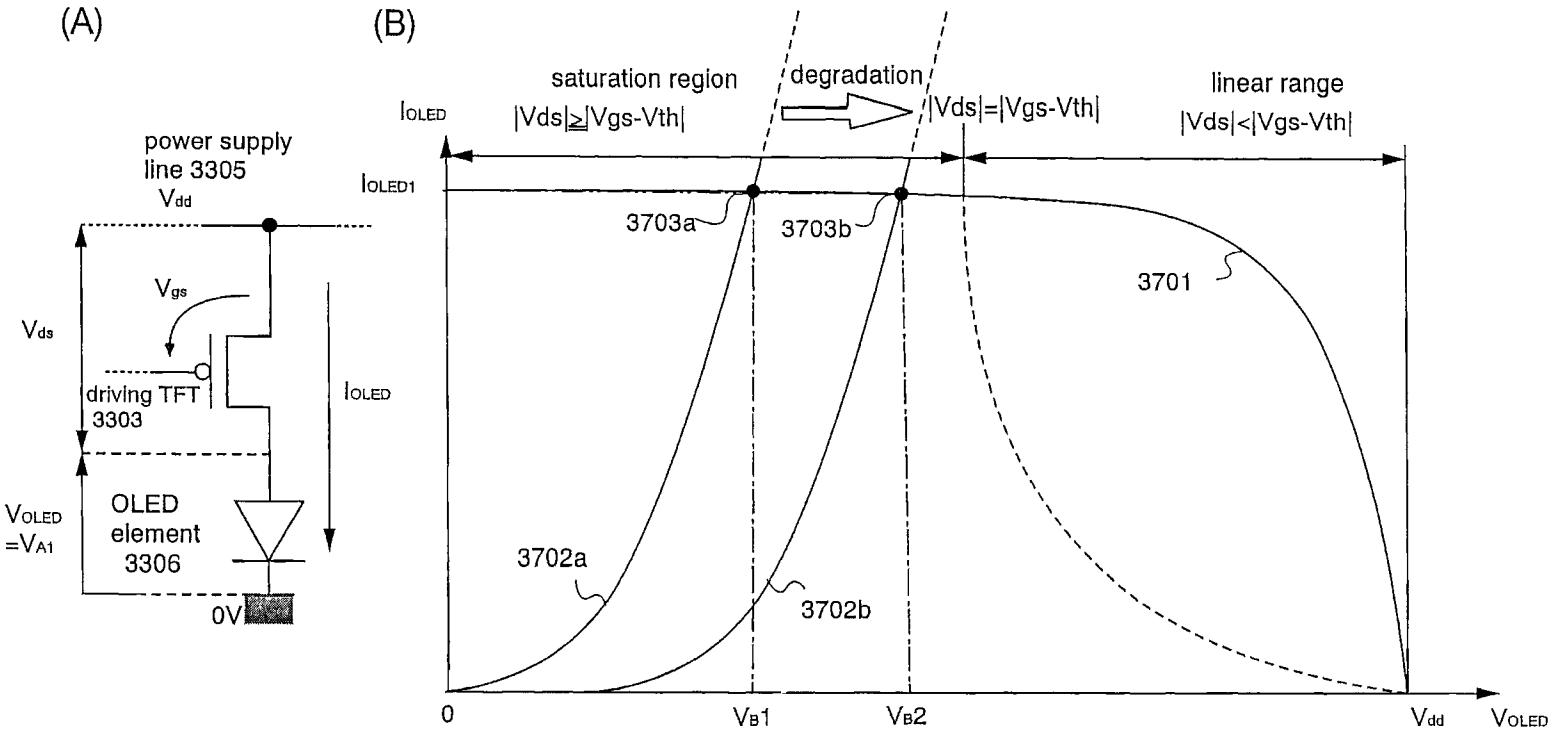
FIG. 37 are diagrams showing a change in operation point of a driving transistor due to degradation of a light emitting element in a conventional display device.

In the structure shown in FIG. 5, the pixel electrode of the light emitting element serves as an anode and the opposite electrode serves as a cathode. In other words, the terminal A of the current supply circuit is connected to the power supply line W and the terminal B is connected to the terminal C of the switch portion 101 in the structure. However, the structure of Embodiment Mode 1 can readily be applied to a display device structured to use the pixel electrode of the light emitting element 106 as a cathode and its opposite electrode as an anode. FIG. 26 shows an example where the pixel structured as shown in FIG. 5 is changed so that the pixel electrode of the light emitting element 106 serves as a cathode and the opposite electrode serves as an anode. Thus application is readily achieved by simply changing the polarity of the transistor. In FIG. 26, components identical with those in FIG. 5 are denoted by the same symbols and explanations thereof are omitted. The current supply transistor 112 and the current transistor 1405 in FIG. 5 are p-channel transistors. On the other hand, the current supply transistor 112 and the current transistor 1405 in FIG. 26 are n-channel transistors. The direction of current flow can be reversed in this way. The terminal A in FIG. 26 is connected to the terminal C of the switch portion and the terminal B is connected to the power supply line W.

The driving transistor 302 simply functions as a switch in FIG. 5 and FIG. 26 and therefore can either be an n-channel transistor or a p-channel transistor. Preferably, the driving transistor 302 operates with the electric potential of its source terminal fixed. Therefore a p-channel transistor is preferred as the driving transistor 302 in the structure where the pixel electrode of the light emitting element 106 serves as an anode and the opposite electrode serves as a cathode as shown in FIG. 5. On the other hand, an n-channel transistor is preferred as the driving transistor 302 in the structure where the pixel electrode of the light emitting element 106 serves as a cathode and the opposite electrode serves as an anode as shown in FIG. 26.

In FIG. 5, the wiring $W_{CO}$ and the power supply line W in each pixel are kept at the same electric potential and therefore one of them can double as the other. Also, different pixels can share the wiring $W_{CO}$, or the power supply line W, or the wiring $W_{CO}$ and the power supply line W. Also, one of GNi and GHi can double as the other. A scanning line of another pixel row may be used in place of the wiring $W_{CO}$ and the wiring $W_j$. This is because the electric potential of the scanning line is kept constant while no video signal is written. For example, a scanning line $G_{j-1}$ of the preceding pixel row may be used in place of the power supply line. In this case, however, the polarity of the selecting transistor 301 has to be chosen by taking the electric potential of the scanning line G into consideration.

Although not shown in FIG. 5, voltage signal output type driving circuits having known structures can be used freely as a driving circuit for inputting a signal to a scanning line G (hereinafter referred to as scanning line driving circuit), a driving circuit for inputting a signal to an erasing signal line RG (hereinafter referred to as erasing signal line driving circuit), and a driving circuit for inputting a signal to a video signal input line S (hereinafter referred to as signal line driving circuit). Voltage signal output type driving circuits having known structures can also be used freely as driving circuits for inputting signals to other signal lines.

A current supply circuit (hereinafter referred to as reference current supply circuit) for determining a reference current that flows in the current lines $CL_j$ and $CL_{j+1}$ is provided outside of a reference current output circuit and is schematically shown by 404. An output current from one reference current supply circuit 404 can be used to determine the reference current flowing in plural current lines CL. Fluctuation in currents flowing in current lines is thus reduced and the current flowing in every current line can be set to the reference current with precision.

Embodiment Mode 1 shows an example of sharing the reference current supply circuit 404 for determining the reference current that flows in all of the current lines $CL_1$ to $CL_X$. A circuit for outputting the reference current to the current lines $CL_1$ to $CL_X$ using a current determined by the reference current supply circuit 404 is called a reference current output circuit and is denoted by 405 in FIG. 5.

Figure 8:
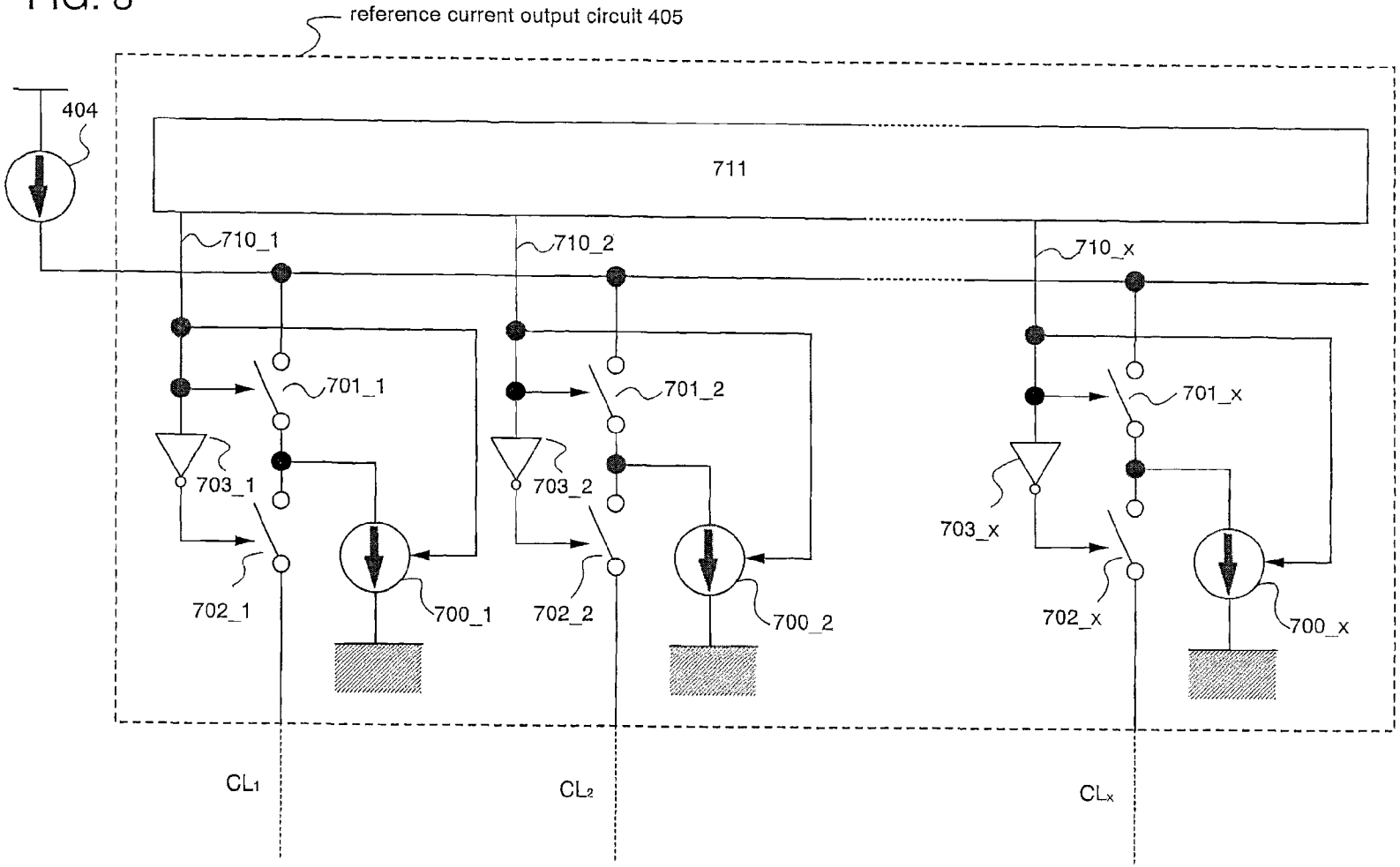
FIG. 8 is a block diagram showing the structure of a reference current input circuit in a display device of the present invention.

A structure of the reference current output circuit 405 is shown in FIG. 8. The reference current output circuit 405 has a pulse output circuit 711 such as a shift register. Sampling pulses from the pulse output circuit 711 are inputted to sampling pulse lines 710_1 to **710_*x*, which are associated with the current lines $CL_1$ to $CL_X$, respectively. A structure for one current line $CL_j$ is described as a representative. Signals from the sampling pulse line 710_*j* are inputted to a current input switch 701_*j* and a current supply circuit 700_*j*. A current output switch 702_*j* receives signals from the sampling pulse line 710_*j* through an inverter 703_*j*. A current supply circuit 700_*j* is connected to the reference current supply circuit 404 through the current input switch 701_*j* and is connected to the current line $CL_j$ through the current output switch 702_*j***.

Figure 9:
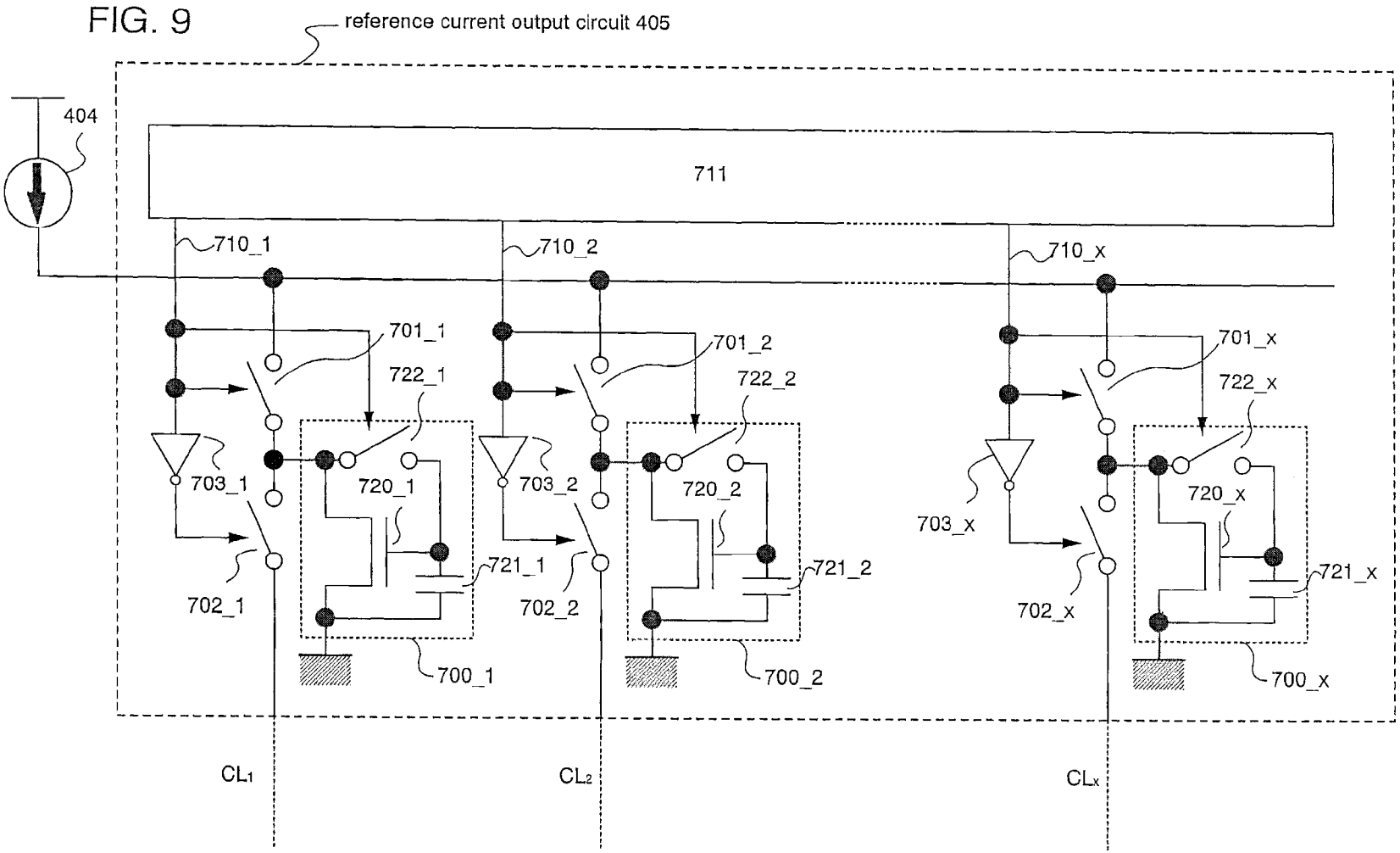
FIG. 9 is a circuit diagram showing the structure of a reference current input circuit in a display device of the present invention.

FIG. 9 shows a specific example of the structure of the current supply circuits 700_1 to **700_*x* in the reference current output circuit 405 of FIG. 8. In FIG. 9, components identical with those in FIG. 8 are denoted by the same symbols. The reference current output circuit 405 is not limited to the circuits of FIGS. 8 and 9. The current supply circuits 700_1 to 700_*x* each have a current supply transistor 720_*j*, a current supply capacitor 721_*j*, and a current holding switch 722_*j*. A gate electrode of the current supply transistor 720_*j* is connected to its source terminal through the current supply capacitor 721_*j*. The gate electrode of the current supply transistor 720_*j* is connected to its drain terminal through the current input switch 722_*j*. Signals of the sampling pulse line 710_*j* are inputted to the current input switch 722_*j*. The electric potential of the source terminal of the current supply transistor 720_*j* is kept constant. The drain terminal thereof is connected to the reference current supply circuit 404 through the current input switch 701_*j* and to the current line $CL_j$ through the current output switch 702_*j***.

Another structure may be employed in which the electric potential of one electrode of the current supply capacitor **721_*j* is kept constant and the other electrode is connected to the reference current supply circuit 404 through the current input switch 701_*j* and to the current line $CL_j$ through the current output switch 702_*j***.

The current supply transistor **720_*j* in FIG. 9 can either be an n-channel transistor or a p-channel transistor. However, the current supply transistor 720_*j* desirably operates with the electric potential of its source terminal fixed. Therefore a p-channel transistor is preferred as the current supply transistor 720_*j* when a current flows from the current supply circuit 700_*j* toward the current line $CL_j$ whereas an n-channel transistor is preferred as the current supply transistor 720_*j* when a current flows from the current line CLj toward the current supply circuit 700_*j*. Whichever polarity the transistor has, it is desirable to connect the current supply capacitor 721_*j*** between the gate and the source.

Figure 10:
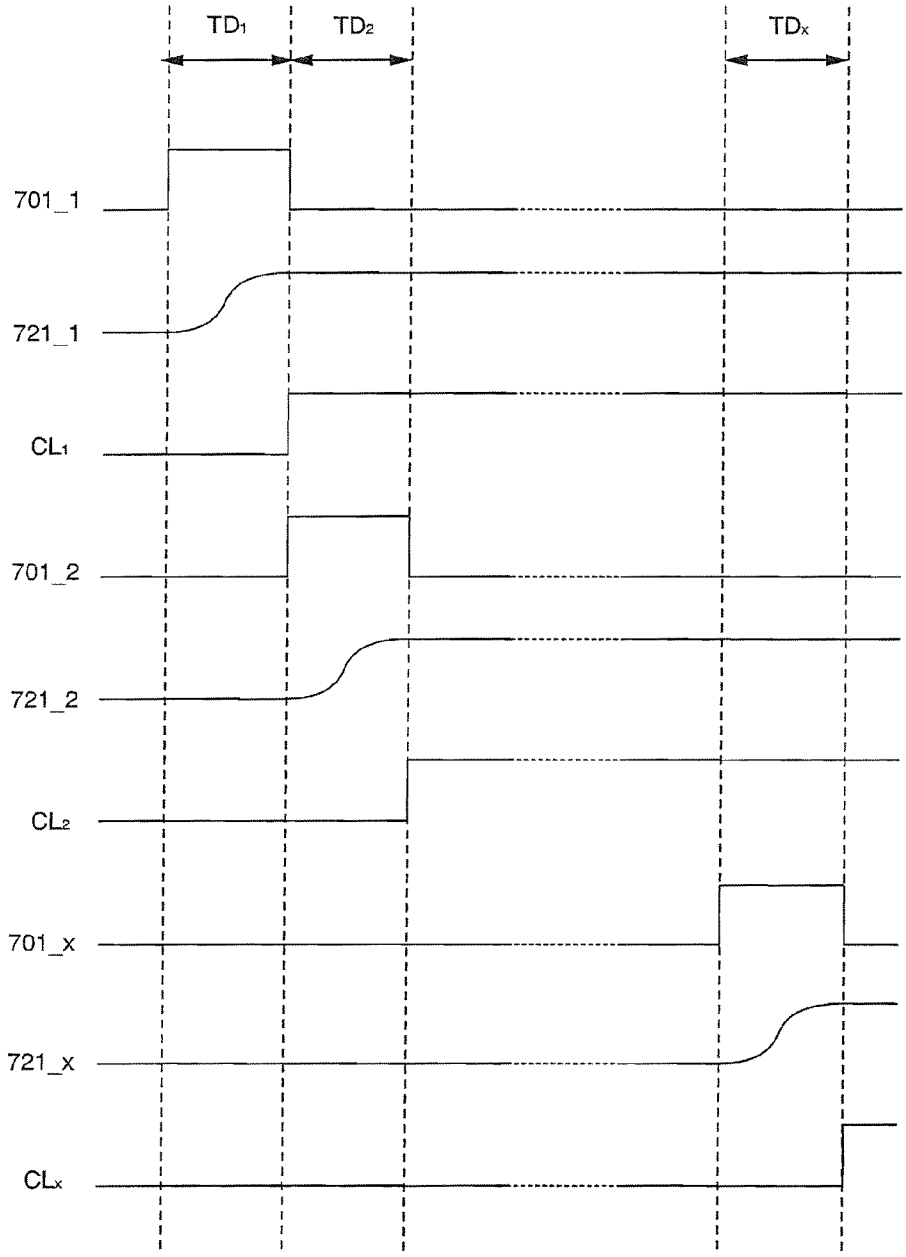
FIG. 10 is a timing chart showing the operation of a reference current input circuit in a display device of the present invention.
Figure 11:
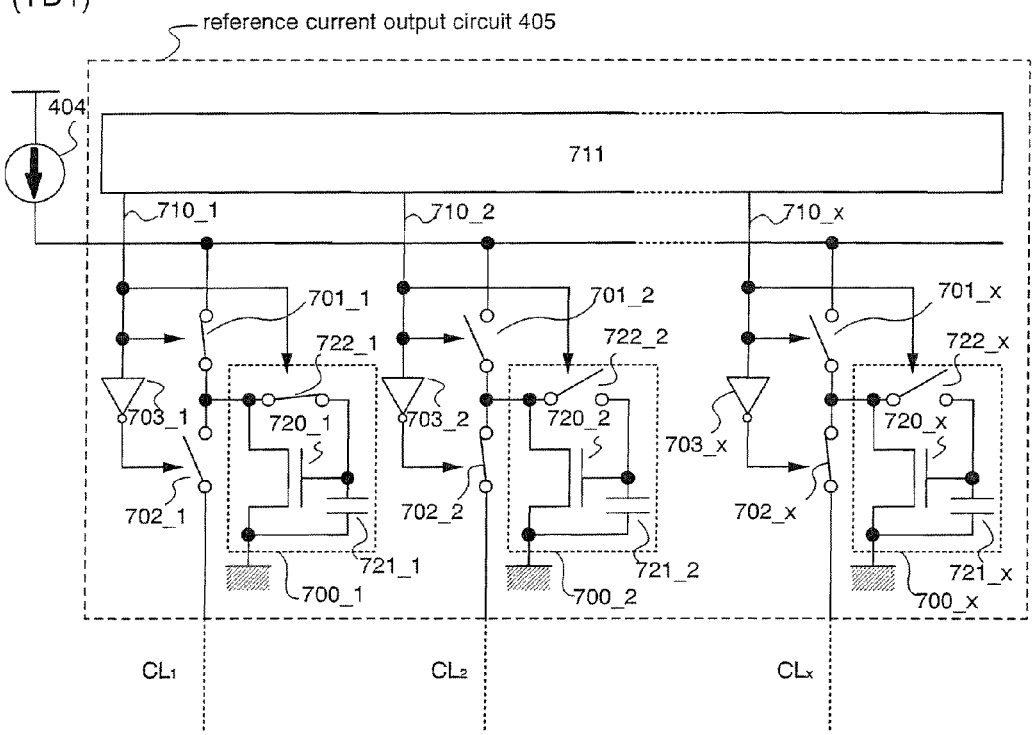
FIG. 11 is a diagram showing a method of operating a reference current input circuit in a display device of the present invention.
Figure 11:
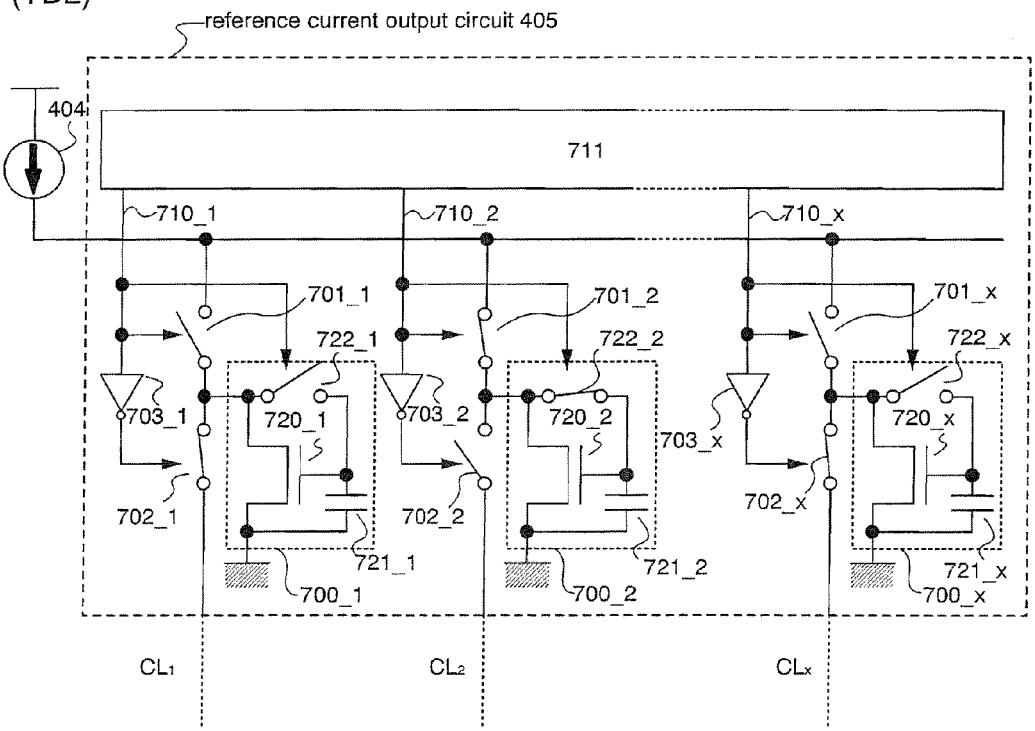

A method of driving the reference current output circuit 405 structured as shown in FIG. 9 is described with reference to FIGS. 10 and 11. FIG. 10 is a timing chart showing a method of driving the reference current output circuit 405. FIG. 11 is a diagram schematically showing a method of driving the reference current output circuit 405. FIG. 11(TD1) and FIG. 11(TD2) are diagrams schematically showing ON and OFF of the switches (current input switches, current output switches, and current holding switches) of the reference current output circuit 405 during a period $TD_1$ and a period $TD_2$ in FIG. 10.

When a pulse is outputted from the pulse output circuit 711 to the sampling pulse line 710_1 in the period TD1, the current input switch 701_1 and the current holding switch 722_1 are turned ON. On the other hand, the current output switch 702_1 receives, through the inverter 703_1, a signal outputted to the sampling pulse line 710_1 and is turned OFF. At this point, a reference current determined by the reference current supply circuit 404 is inputted to the current supply capacitor 721_1 of the current supply circuit 700_1 through the current input switch 701_1 and the current holding switch 722_1. During this, no pulses are outputted to other sampling pulse lines 710_2 to 710_*x*. Therefore the current input switches 701_2 to 701_*x* and the current holding switches 722_2 to 722_*x* are OFF. On the other hand, the current output switches 702_2 to 702_*x* are ON. After some time has passed, electric charges are held in the current supply capacitor 721_1 of the current supply circuit 700_1 and a reference current flows in the current supply transistor 720_1. FIG. 10 shows a change in the amount of electric charges held between the two electrodes of the current supply capacitor 721_1, namely, a voltage change.

Thereafter the period $TD_2$ is started. In the period $TD_2$, the output of the pulse output circuit 711 is changed and a pulse is no longer outputted to the sampling pulse line 710_1. This turns the current holding switch 722_1 and the current input switch 701_1 OFF and turns the current output switch 702_1 ON. Thus the drain current of the current supply transistor 720_1 flows in the current line $CL_1$. The drain current of the current supply transistor 720_1 is determined by the electric charges held in the current supply capacitor 721_1. Therefore, the current flowing in the current line $CL_1$ is set to the reference current. In FIG. 10, $CL_1$ to $CL_x$ represent the current flowing in the current lines $CL_1$ to $CL_x$. At the same time, a pulse is outputted to the sampling pulse line 710_2. In this way, the operation of setting the current flowing in the current supply circuit 700_2 to the reference current is started. Similar operation is conducted for all of the current supply circuits 700_1 to 700_*x* respectively associated with the sampling pulse lines 710_1 to 710_*x* to end the periods $TD_1$ to $TD_x$. Every current flowing in the current lines $CL_1$ to $CL_x$ is thus set to the reference current determined by the reference current supply circuit 404.

The operation of inputting a current to the reference current output circuit 405 to set the current flowing in each of the current lines $CL_1$ to $CL_x$ to the reference current is called a setting operation of the reference current output circuit 405.

In the reference current output circuit 405 structured as shown in FIG. 9, once the current flowing in each of the current supply circuits 700_1 to 700_*x* is set to the reference current by the reference current supply circuit 404, the current flowing in each of the current supply circuits 700_1 to 700_*x* is kept at the reference current unless electric charges held in the current supply capacitors 721_1 to 721_*x* are discharged. In the case where the current supply circuits 700 are identic-transistor method current supply circuits as in FIG. 9, the current inputted from the reference current supply circuit 404 and the reference current flowing in the current lines CL have the same value. If the current supply circuits 700 are current mirror method current supply circuits or multi-gate method current supply circuits, the current inputted from the reference current supply circuit 404 and the reference current flowing in the current lines CL may have different values.

FIG. 10 shows a method of conducting the operation of the periods $TD_1$ to $TD_x$ once when there are no electric charges held in the current supply capacitors 721_1 to 721_*x* to thereby hold given electric charges in each of the current supply capacitors 721_1 to 721_*x* so that the current supply transistors 720_1 to 720_*x* cause a reference current to flow. This method is called a package-writing method.

Alternatively, with no electric charges held in the current supply capacitors 721_1 to 721_*x*, the operation of the periods $TD_1$ to $TD_x$ may be repeated to hold electric charges in the current supply capacitors 721_1 to 721_*x* in small increments. In this method, it is not until the operation of the periods $TD_1$ to $TD_x$ is repeated several times that given electric charges enough for the current supply transistors 720_1 to 720_*x* to cause a reference current to flow are held in each of the current supply capacitors 721_1 to 721_*x*. This method is called a divided-writing method. In the divided-writing method, how many times the periods $TD_1$ to $TD_x$ are repeated to finish holding a given amount of electric charges with no electric charges held in each of the current supply capacitors 721_1 to 721_*x* at the start is called the division number of the divided-writing method.

In the divided-writing method, the switches (the current input switches 701_1 to 701_*x*, the current output switches 702_1 to 702_*x*, and the current holding switches 722_1 to 722_*x*) in the periods $TD_1$ to $TD_x$ are in the same states as in the package-writing method. However, the divided-writing method takes a shorter time to finish the periods $TD_1$ to $TD_x$ once than the time the package-writing method takes to finish $TD_1$ to $TD_x$.

The setting operation of the reference current output circuit 405 may be conducted any number of times in one frame period or may be conducted once in several frame periods. Also the setting operation may be conducted any number of times in one horizontal period or may be conducted once whenever the horizontal period is repeated several times. The interval between the setting operation of the reference current output circuit 405 and the next setting operation of the reference current output circuit 405 can be chosen arbitrarily in accordance with the ability of the current supply capacitors 721 of the reference current output circuit to keep holding electric charges.

The reference current to be inputted to the reference current output circuit 405 may be inputted from the reference current supply circuit 404 as shown in FIGS. 5, 8, 9, and 11. Alternatively, the reference current supply circuit 404 may be omitted and a constant current may be inputted from the outside of the display device to the reference current output circuit 405. Instead, current supply circuits corresponding to the current supply circuits 700 of FIGS. 8 and 9 may be provided outside of the display device. If fluctuation among transistors is small, the setting operation is not necessarily conducted for each of the current supply circuits 700 in the reference current output circuit 405. However, conducting the setting operation for each of them results in output of more accurate current values.

The description given next is about a method of driving a display device that has a pixel structured as shown in FIG. 5. In a pixel structured according to Embodiment Mode 1, the image display operation (the switch portion driving operation) and the current supply circuit setting operation (pixel setting operation) may not be in sync with each other. In other words, the pixel setting operation can be carried out irrespective of whether the terminal C and terminal D of the switch portion are conductive or nonconductive.

Also, the setting operation of the reference current output circuit 405 may be in sync with the image display operation and the pixel setting operation, or may be not. However, it is desirable to conduct the setting operation of the reference current output circuit 405 shown in FIG. 9 when the pixel setting operation is not conducted. This is because, in the reference current output circuit 405 of FIG. 9, a current cannot be outputted to the current line CLj while the setting operation of the circuit 405 is conducted. Accordingly, two current supply circuits 700 are placed for each current line CLj. Then the setting operation of the reference current output circuit 405 is conducted for one current supply circuit while the other current supply circuit outputs a current to the current line CLj. This makes it possible to conduct the setting operation of the reference current output circuit 405 and the pixel setting operation simultaneously. Alternatively, a current mirror circuit is used as the current supply circuit 700_*j* and one of transistors that form a pair to constitute the current mirror circuit outputs a current to the current line CLj while the other transistor performs the setting operation of the reference current output circuit 405. This makes it possible to conduct the setting operation of the reference current output circuit 405 and the pixel setting operation simultaneously.

For simplification, the pixel setting operation and the image display operation will be described separately. The description on the image display operation is given with reference to timing charts of FIG. 7(A) and FIG. 7(B), and the circuit diagram of FIG. 5. A signal is inputted to the scanning line $G_i$ to let the selecting transistor 301 of each pixel on the i-th row be conductive. At this point, video signals are inputted to the video signal input lines $S_1$ to $S_x$ and the video signals are inputted to each pixel on the i-th row. In every pixel whose driving transistor 302 is made conductive by the video signals, the terminal D and the terminal C are made conductive. The gate voltage of the driving transistor 302 is held by the storage capacitor 303. In other words, the conductive state or nonconductive state of the driving transistor 302 is held. The erasing transistor 304 is assumed to be nonconductive at this point. In every pixel where the terminals D and C of the switch portion 101 are thus made conductive, a pixel reference current is inputted from the current supply circuit 102 to the light emitting element 106 to cause the element to emit light.

In this way, a light emission state or a non-light emission state is chosen for each pixel to display gray scales by a digital method. Methods employable as a multi-gray scale method are a gray scale method (time ratio gray scale method) where each fixed period has plural periods in which a light emission state or a non-light emission state is chosen for each pixel and the total amount of time during which a light emission state is chosen is controlled, a gray scale method (area ratio gray scale method) where one pixel is divided into plural sub-pixels and the total area of sub-pixels for which a light emission state is chosen is controlled, and the like. Known methods may also be employed. Here, the time ratio gray scale method is employed as a multi-gray scale method.

The erasing transistor 304 is made conductive to equalize the electric potential of one electrode of the storage capacitor 303 with the electric potential of the other electrode thereof and discharge electric charges held in the storage capacitor 303. This makes every driving transistor 302 nonconductive. In this way, pixels on one row can be brought into a non-light emission state even when video signals are being inputted to pixels on another row. The light emission period of pixels on each row thus can be set arbitrarily.

The switch portion structured as shown in FIG. 13 has the selecting transistor 301 as a first switch and the driving transistor 302 as a second switch, as well as the erasing transistor 304. The gate electrode of the erasing transistor 304 is connected to a wiring different from the video signal input line S and the scanning line G, namely, the erasing signal line RG. This makes it possible to switch the erasing transistor 304 between conductive and nonconductive by a signal inputted to the erasing signal line RG whatever signals are inputted to the selecting transistor 301 and the driving transistor 302. Therefore, the path between the terminal C and terminal D of the switch portion can be made nonconductive irrespective of the states of the first switch and second switch. The above is the basic image display operation.

Figure 7:
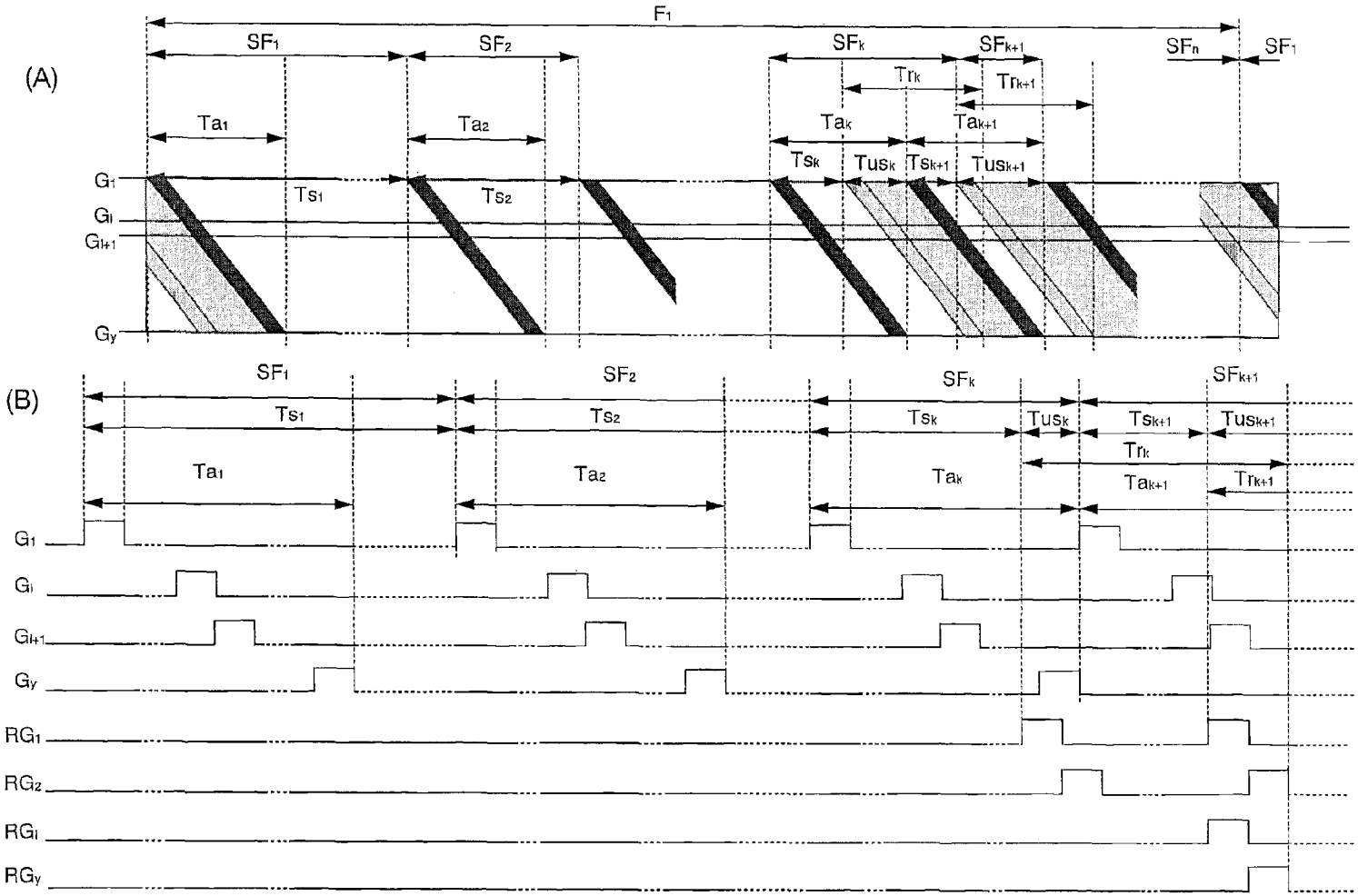
FIG. 7 are timing charts of an image display operation in a display device of the present invention.

FIG. 7 show a driving method using the time ratio gray scale method as a specific example of the gray scale display method. A period for displaying an image of one screen is called one frame period F. One frame period F is divided into plural sub-frame periods $SF_1$ to $SF_n$ (n is a natural number).

In the first sub-frame period $SF_1$, the first scanning line $G_1$ is selected and the selecting transistor 301 whose gate electrode is connected to the scanning line $G_1$ is made conductive. Then signals are inputted to the video signal input lines $S_1$ to $S_x$ at once. At that time, the erasing transistor 304 is in a nonconductive state. By the signals inputted to the video signal input lines $S_1$ to $S_x$, the driving transistor 302 of each pixel on the first row is made conductive or nonconductive and a light emission state or a non-light emission state is chosen for each of the pixels. The gate voltage of the driving transistor 302 is held by the storage capacitor 303. Inputting a video signal to select a conductive state or a nonconductive state for the driving transistor 302 of each pixel is expressed here as writing a video signal in a pixel.

The driving transistor 302 for which a conductive state is chosen is kept conductive until a new signal is inputted to the gate electrode of the driving transistor 302 from the video signal input line S, or until electric charges in the storage capacitor 303 are discharged by the erasing transistor 304. In a pixel for which a light emission state is chosen, the path between the terminal C and terminal D of the switch portion is made conductive and a pixel reference current is inputted to the light emitting element 106 from the current supply circuit 102 to cause light emission. As soon as the operation of writing video signals in pixels on the first row is finished, the scanning line $G_2$ for pixels on the second row is selected and the operation of writing video signals in the pixels on the second row is started. The operation of writing video signals in the pixels is similar to the operation of the pixels on the first row.

The above operation is repeated for all of the scanning lines $G_1$ to $G_y$ to write video signals in all pixels. A period in which video signals are written in all pixels is referred to as an address period Ta. The address period for the m-th sub-frame period $SF_m$ (m is a natural number equal to or less than n) is denoted by $Ta_m$.

In a pixel row in which video signals are written, a light emission state or a non-light emission state is chosen for each of the pixels. A period in which each pixel of each pixel row emits light or does not emit light in accordance with a video signal written is referred to as a display period Ts. In the same sub-frame period, a display period Ts of one pixel row and a display period Ts of another pixel row have the same length although the timing is varied. A display period for the m-th sub-frame period $SF_m$ (m is a natural number equal to or less than n) is denoted by $Ts_m$.

From the first sub-frame period $SF_1$ through the (k−1)-th sub-frame period $SF_{K-1}$ (k is a natural number smaller than n), the display period Ts is set longer than the address period Ta. After the display period $Ts_1$ having a given length, the second sub-frame period $SF_2$ is started. Thereafter, in the second sub-frame period $SF_2$ through the (k−1)-th sub-frame period $SF_{k-1}$, the display device operates in a similar manner in which it operates in the first sub-frame period $SF_1$. The address period Ta of each sub-frame period is set so as not to overlap with another address period because video signals cannot be written in plural pixel rows simultaneously.

On the other hand, from the k-th sub-frame period $SF_k$ through the n-th sub-frame period $SF_n$, the display period Ts is set shorter than the address period Ta. A detailed description will be given below on a method of driving the display device in the k-th sub-frame period $SF_k$ through the n-th sub-frame period $SF_n$.

In the k-th sub-frame period $SF_k$, the first scanning line $G_1$ is selected and the selecting transistor 301 whose gate electrode is connected to the scanning line $G_1$ is made conductive. Then signals are inputted to the video signal input lines $S_1$ to $S_x$ at once. At that time, the erasing transistor 304 is in a nonconductive state. By the signals inputted to the video signal input lines $S_1$ to $S_x$, the driving transistor 302 of each pixel on the first row is made conductive or nonconductive and a light emission state or a non-light emission state is chosen for each of the pixels. The gate voltage of the driving transistor 302 is held by the storage capacitor 303. In a pixel for which a light emission state is chosen, the path between the terminal C and terminal D of the switch portion is made conductive and a pixel reference current is inputted to the light emitting element 106 from the current supply circuit 102 to cause light emission. As the operation of writing video signals in pixels on the first row is finished, the scanning line $G_2$ for pixels on the second row is selected and the operation of writing video signals in the pixels on the second row is started. The operation of writing video signals in the pixels is similar to the operation of the pixels on the first row.

The above operation is repeated for all of the scanning lines $G_1$ to $G_y$ to write video signals in all pixels and end the address period $Ta_k$.

The above operation method in the address period $Ta_k$ of the k-th sub-frame period $SF_k$ is the same as the one in the first sub-frame period $SF_1$ through the (k−1)-th sub-frame period $SF_{k-1}$. The difference is that selection of the erasing signal line $RG_1$ and the like is started before the address period $Ta_k$ is ended. In other words, the erasing signal line $RG_1$ is selected after a given period (the period corresponds to the display period $Ts_k$) passes since the scanning line $G_1$ has been selected. The erasing signal lines $RG_1$ to $RG_y$ are selected in order and the erasing transistor 304 of each pixel row is sequentially made conductive. This brings all pixels into a non-light emission state, one row at a time. A period in which the erasing transistor 304 of every pixel is made conductive is referred to as a reset period Tr. A reset period for the p-th sub-frame period $SF_p$ (p is a natural number equal to or larger than k and equal to or smaller than n) is specifically denoted by $Tr_p$.

As has been described, all pixels on one row can be brought into a non-light emission state while video signals are being inputted to pixels on another row. This makes it possible to control the length of the display period Ts freely. Here, the address period $Ta_p$ and the reset period $Tr_p$ are assumed to have the same length. In other words, the speed of selecting rows in order when writing video signals is the same as the speed of bringing all pixels on one row to a non-light emission state at a time. Therefore, in the same sub-frame period, the display period Ts of pixels on one row and the display period Ts of pixels on another row have the same length although they are started at different timings.

A period in which the erasing transistor 304 of each pixel on each pixel row is made conductive to bring every pixel on each pixel row into a non-light emission state is referred to as a non-display period Tus. In the same sub-frame period, the non-display period Tus of one pixel row and the non-display period Tus of another pixel row have the same length although the timing is varied. A non-display period for the p-th sub-frame period $SF_p$ is specifically denoted by $Tus_p$.

After the non-display period $Tus_k$ having a given length, the (k+1)-th sub-frame period $SF_{k+1}$ is started. The operation in the k-th sub-frame period $SF_k$ is repeated for the (k+1)-th sub-frame period $SF_{k+1}$ through the n-th sub-frame period $SF_n$ to end one frame period F1. The address periods $Ta_1$ to $Ta_n$ of the sub-frame periods $SF_1$ to $SF_n$ have the same length. The display device is operated as described above and the lengths of the display periods $Ts_1$ to $Ts_n$ of the sub-frame periods $SF_1$ to $SF_n$ are set suitably to display gray scales.

Next, how the lengths of the display periods $Ts_1$ to $Ts_n$ are set is described. For example, $Ts_1:Ts_2:\ldots:Ts_{n-1}:Ts_n$ is set to $2^0:2^1:\ldots:2^{-(n-2)}:2^{-(n-1)}$ for display in $2^n$ gray scales. A specific example is given in which 3-bit video signals are inputted when n=3 for display in 8 gray scales. One frame period F is divided into three sub-frame periods $SF_1$ to $SF_3$. The ratio of the lengths of the display periods of the sub-frame periods, $Ts_1:Ts_2:Ts_3$, is set to 4:2:1. If the luminance of a pixel for which a light emission state is chosen in all of the sub-frame periods $SF_1$ to $SF_3$ is 100%, then the luminance is about 57% when a light emission state is chosen in only the first sub-frame period $SF_1$. When a light emission state is chosen in only the second sub-frame period $SF_2$, the luminance is about 29%.

The above-described method, in which sub-frame periods the number of which matches the bit number of video signals are provided in one frame period to display gray scales, is not the only option. For instance, one frame period may have plural sub-frame periods in which a light emission state or a non-light emission state is chosen by a signal corresponding to a certain bit of video signals. In other words, a display period for 1 bit is accumulation of display periods of plural sub-frame periods.

If a display period for a significant bit of video signals is set as accumulation of display periods of plural sub-frame periods and no two sub-frame periods thereof are allowed to appear in succession, then pseudo-contour can be reduced. How the length of the display period Ts of each sub-frame period is set is not limited to the above and any known method can be employed.

The first sub-frame period $SF_1$ through the n-th sub-frame period $SF_n$ appear in order in FIG. 7 but it is not the only way. The order in which each sub-frame period appears can be set arbitrarily. Display in gray scales can be achieved not only by the time ratio gray scale method but also by the area ratio gray scale method and by a combination of the time ratio gray scale method and area ratio gray scale method.

In the driving method shown in Embodiment Mode 1, the reset period Tr and the non-display period Tus are provided only in sub-frame periods where the display period Ts is set shorter than the address period Ta. However, this is not the only way. Also employable is a driving method in which the reset period Tr and the non-display period Tus are provided also in sub-frame periods where the display period Ts is set longer than the address period Ta.

In the structure shown in FIG. 13, electric charges in the storage capacitor 303 are discharged by letting the erasing transistor 304 be conductive. However, this is not the only option. Any structure can be employed as long as the driving transistor 302 is made nonconductive by raising or lowering the electric potential of the side of the storage capacitor 303 that is connected to the gate electrode of the driving transistor 302 by letting the erasing transistor 304 be conductive. This means that the gate electrode of the driving transistor 302 may be connected through the erasing transistor 304 to a wiring to which a signal of an electric potential enough to make the driving transistor 302 nonconductive is inputted.

The above-described structure in which the electric potential of the side of the storage capacitor 303 that is connected to the gate electrode of the driving transistor 302 is changed by letting the erasing transistor 304 be nonconductive may be replaced by a structure in which the erasing transistor 304 and the driving transistor 302 are connected in series and the path between the terminals C and terminal D of the switch portion 101 is made nonconductive by letting the erasing transistor 304 be nonconductive to start a non-display period.

Figure 43:
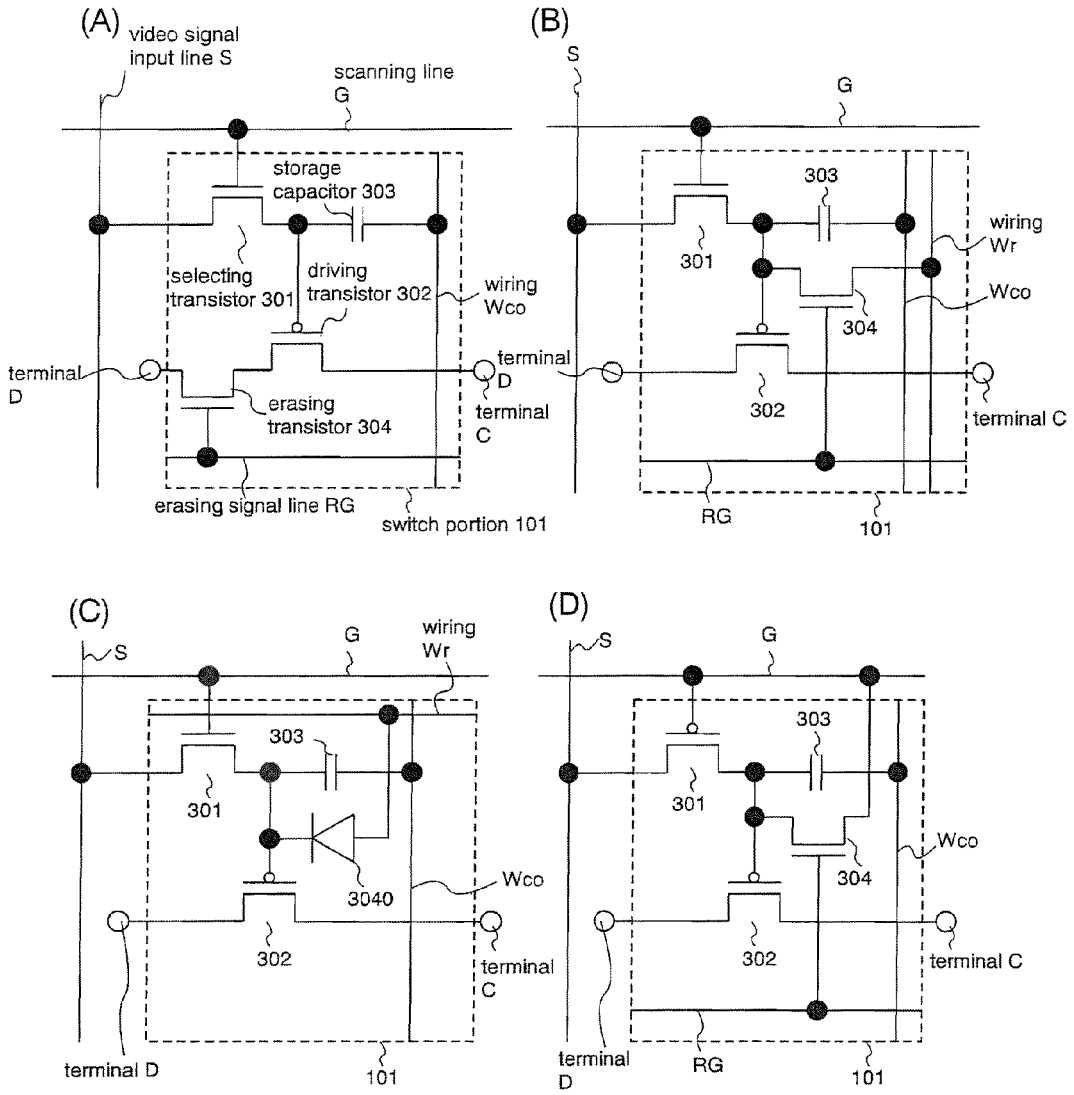
FIG. 43 are circuit diagrams of a switch portion of a pixel in a display device of the present invention.

Alternatively, the method of turning the switch portion OFF, which has been described with reference to FIG. 43, may be used freely to provide a reset period and a non-display period for bringing every pixel to a non-light emission state.

A reset period and a non-display period for bringing every pixel to a non-light emission state may be provided without using the erasing transistor.

Figure 49:
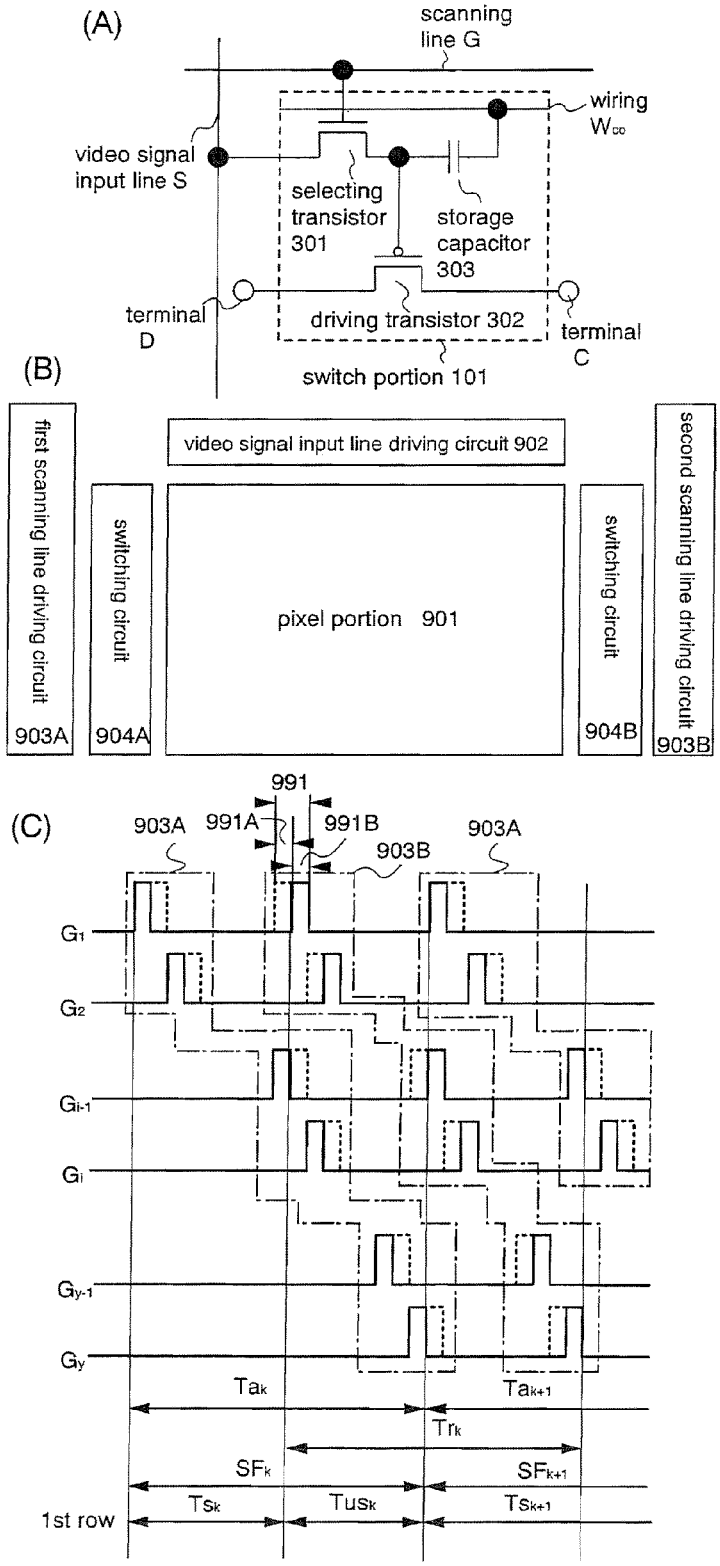
FIG. 49 are timing charts of a method of driving a display device of the present invention.

A first method thereof is to let the driving transistor be nonconductive by changing the electric potential of the electrode of the storage capacitor that is not connected to the gate electrode of the driving transistor. This structure is shown in FIG. 49. The electrode of the storage capacitor 303 that is not connected to the gate electrode of the driving transistor 302 is connected to the wiring $W_{CO}$. A signal of the wiring $W_{CO}$ is changed to change the electric potential of one of the electrodes of the storage capacitor 303. Then, electric charges held in the storage capacitor are stored and therefore the electric potential of the other electrode of the storage capacitor 303 is also changed. The electric potential of the gate electrode of the driving transistor 302 is thus changed to make the driving transistor 302 nonconductive.

A second method divides a period in which one scanning line is selected in half. It is characterized in that a video signal is inputted in the former half (referred to as gate select period former half) whereas an erasing signal is inputted in the latter half (referred to as gate select period latter half). An erasing signal is a signal that makes a driving transistor nonconductive when inputted to a gate electrode of the driving transistor. This makes it possible to set a display period shorter than a writing period. Details of this method and the structure of the entire display device will be described with reference to FIG. 49(B). The display device has a pixel portion 901 with a plurality of pixels forming a matrix pattern, a video signal input line driving circuit 902 for inputting signals to the pixel portion 901, a first scanning line driving circuit 903A, a second scanning line driving circuit 903B, a switching circuit 904A, and a switching circuit 904B. The first scanning line driving circuit 903A is a circuit for outputting signals to scanning lines G in the gate select period former half. The second scanning line driving circuit 903B is a circuit for outputting signals to the scanning lines G in the gate select period latter half. The switching circuit 904A and the switching circuit 904B select a connection between the first scanning line driving circuit 903A and the scanning lines G of the respective pixels or a connection between the second scanning line driving circuit 903B and the scanning lines G of the respective pixels. The video signal input line driving circuit 902 outputs a video signal in the gate select period former half and, in the gate select period latter half, on the other hand, outputs an erasing signal.

Next, a method of driving the display device structured as above is described with reference to FIG. 49(C). Components identical with those in FIG. 7 are denoted by the same symbols and explanations thereof are omitted. In FIG. 49(C), a gate select period 991 is divided into a gate select period former half 991A and a gate select period latter half 991B. The first scanning line driving circuit 903A selects each scanning line and a digital video signal is inputted. A period in which 903A is operated corresponds to a writing period Ta. The second scanning line driving circuit 903B selects each scanning line and an erasing signal is inputted. A period in which 903B is operated corresponds to a reset period Tr. In this way, a display period Ts shorter than an address period Ta can be set. Although an erasing signal is inputted here in a gate select period latter half, a digital video signal of the next sub-frame period may be inputted instead.

A third method is to provide a non-display period by changing the electric potential of the opposite electrode of the light emitting element. This means that the electric potential of the opposite electrode in a display period differs from the electric potential of the power supply line by a given level of electric potential. On the other hand, the electric potential of the opposite electrode in a non-display period is set to almost the same level as the electric potential of the power supply line. Then digital video signals are inputted to all pixels in the non-display period. In other words, an address period is provided at that time. In this way, a pixel can be brought into a non-light emission state whatever digital video signal is inputted to the pixel.

For example, if opposite electrodes in all pixels are electrically connected, the display period Ts starts and ends with the same timing for all of the pixels. After the display period Ts having a given length, the electric potential of the opposite electrode of the light emitting element 106 is again set to almost the same level as the electric potential of the power supply line W. This makes it possible to bring all the pixels into a non-light emission state at once. The non-display period Tus is thus induced. The timing of the non-display period Tus is the same for all of the pixels. When the degree of multi-gray scale required is not so high (when there is no need for a display period Ts shorter than an address period Ta), a driving method may be employed in which a non-display period Tus is not provided in any sub-frame period. If this driving method is employed, no erasing transistor is needed.

Instead of the storage capacitor 303, parasitic capacitance of the gate electrode of the driving transistor 302 may be utilized actively. Similarly, the current supply capacitor 111 may be omitted if parasitic capacitance of the gate electrodes of the current supply transistor 112 and current transistor 1405 is utilized.

Next, two methods regarding the pixel setting operation will be described.

Figure 6:
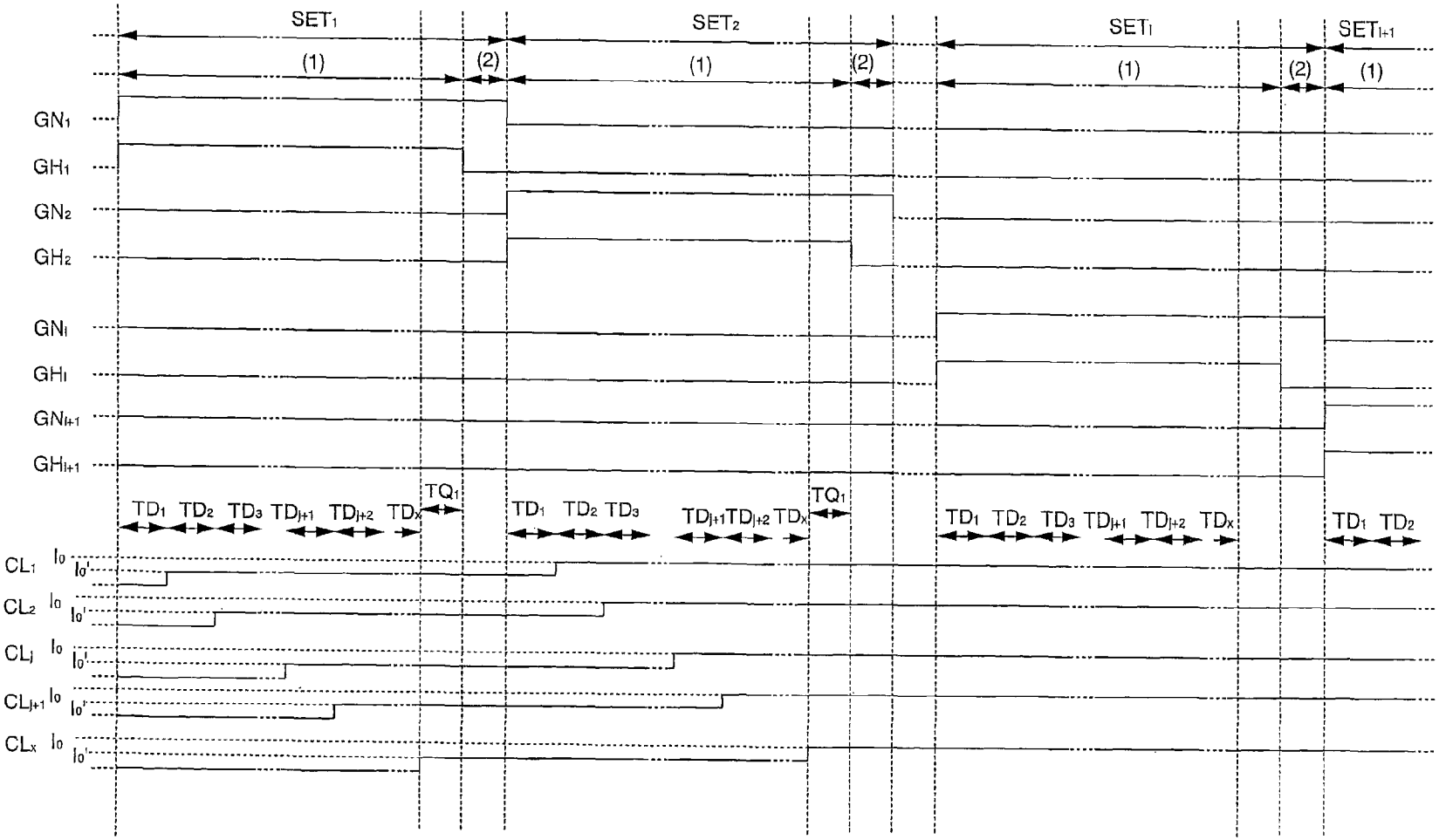
FIG. 6 is a timing chart of a pixel setting operation in a display device of the present invention.

A first method is described with reference to FIG. 6. FIG. 6 is a timing chart showing the setting operation (pixel setting operation) of the current supply circuit 102 placed in each pixel of FIG. 5. The description here is about the first time pixel setting operation after the power of the display device is turned on.

An example is given in which the pixel setting operation is in sync with the setting operation of the reference current output circuit 405 shown in FIG. 8 and others. In the example given here, the reference current output circuit 405 has the structure shown in FIG. 9 and is operated by the divided-writing method in accordance with the timing chart of FIG. 10. For simplification, the division number of the divided-writing method is two in the example. Components operating in the same way as the timing chart of FIG. 10 are denoted by the same symbols and explanations thereof are omitted.

In FIG. 6, a period for the setting operation of pixels on the i-th row is denoted by SETi. In SETi, the setting operation is performed on pixels from the first through the x-th columns on the i-th row. The setting operation for the pixels from the first through the x-th columns on the i-th row is described by dividing it into the operation for a period (1) of SETi in FIG. 6 and the operation for a period (2).

First, in the period (1) of SET1, signals inputted to the signal line $GN_1$ and the signal line $GH_1$ make conductive the current input transistor 1403 and current holding transistor 1404 in each pixel on the first row which are shown in FIG. 5. At this point, the reference current output circuit 405 carries out the operations of the periods $TD_1$ to $TD_x$ in FIG. 10 in order and the current flowing in the current lines $CL_1$ to $CL_x$ is determined in order. As a result, it is decided that a current $I_0'$ flows in each of the current lines $CL_1$ to $CL_x$. Since the reference current output circuit 405 here carries out the setting operation using the divided-writing method, conducting the operations of the periods $TD_1$ to $TD_x$ once is not enough to complete the setting operation. Accordingly, when the reference current is given as $I_0$, the current $I_0'$ is smaller than $I_0$.

The description given next is about the operation of the current supply circuit 102 in each pixel after the current $I_0'$ starts to flow in the current lines $CL_1$ to $CL_x$. The pixel on the first row and the j-th column, for example, is set such that the current $I_0'$ flows in the current line $CL_j$ after the period $TD_j$ is ended. In this way the current $I_0'$ flows in the current transistor 1405 of the pixel on the j-th column. Here, the gate electrode of the current transistor 1405 of the pixel on the first row is connected to its drain terminal through the current holding transistor 1404 that has been made conductive. Therefore, the current transistor 1405 operates with the gate-source voltage (gate voltage) equalized with the source-drain voltage, namely, it operates in the saturation region and a drain current flows. The drain current flowing in the current transistor 1405 of the pixel on the first row and the j-th column is set to the current $I_0'$ flowing in the current line $CL_j$. In this way, the gate voltage of when the current $I_0'$ flows in the current transistor 1405 is held in the current supply capacitor 111.

After the periods $TD_1$ to $TD_x$ are ended and the current supply capacitor 721_*x* finishes holding electric charges according to the current $I_0'$ that flows in the current lines CL, the period (2) is started. In the period (2), the signal of the signal line $GH_1$ is changed to make the current holding transistor 1404 nonconductive. This causes the current supply capacitor 111 in each pixel on the first row to hold electric charges.

A period denoted by $TQ_1$ in the drawing corresponds to a period in which the current $I_0'$ is inputted from the current line $CL_x$ to the current transistor 1405 of the current supply circuit 102 in the pixel on the first row and the x-th column to cause the current supply capacitor 111 to hold electric charges. If the period denoted by $TQ_1$ in the drawing is shorter than the time required for the current flowing in the current transistor 1405 to become stable, the current supply capacitor 111 cannot hold enough electric charges. However, it is assumed here for simplification that $TQ_1$ has enough length.

The setting operation of the pixels on the first row is performed in this way. In the current supply circuit 102 of each pixel, the gate electrode of the current transistor 1405 and the gate electrode of the current supply transistor 112 have the same electric potential. The source terminal of the current transistor 1405 and the source terminal of the current supply transistor 112 have the same electric potential. The current transistor 1405 and the current supply transistor 112 desirably have the same current characteristic. It is assumed here for simplification that the current transistor 1405 and the current supply transistor 112 have the same current characteristic. Therefore, when a voltage is applied between the terminal A and terminal B of the current supply circuit 102, a constant current according to the current $I_0'$ that flows in the current transistor 1405 flows in the current supply transistor 112.

In a display device using the reference current output circuit 405 of divided-writing method, the current $I_0'$ flowing in the current lines $CL_1$ to $CL_x$ in the first SET1 after the power of the display device is turned on does not reach the reference current. Accordingly, the pixel setting operation in this SET1 period is insufficient. To be specific, in the setting operation of pixels on the first row immediately after the power of the display device is turned on, the current supply capacitor 111 of the current supply circuit 102 in each of the pixels on the first row cannot hold a voltage corresponding to the reference current (pixel corresponding reference voltage).

Next, in the period (1) of SET2, signals inputted to the signal line $GN_2$ and the signal line $GH_2$ make conductive the current input transistor 1403 and current holding transistor 1404 of a pixel on the second row. At the same time, the signal inputted to the signal line $GN_1$ is changed to make the current input transistor 1403 of the pixel on the first row nonconductive. In this way, the connection between the current line $CL_1$ and the current transistor 1405 is cut while the gate voltages of the current transistor 1405 and current supply transistor 112 in the pixel on the first row are held.

In the period (1) of SET2, the reference current output circuit 405 carries out the operations of the periods $TD_1$ to $TD_x$ in FIG. 10 in order and the current flowing in the current lines $CL_1$ to $CL_x$ is determined in order. At this point, some electric charges are already held in the current supply capacitors 721_1 to 721_*x* of the reference current output circuit 711 by the operations performed in the periods $TD_1$ to $TD_x$ of the previous SET1 period. When the operations of the periods $TD_1$ to $TD_x$ of SET2 are finished, the operations of the periods $TD_1$ to $TD_x$ are now repeated twice since the power of the display device is turned on.

The division number of the divided-writing method here is set to 2 and therefore electric charges that make the current supply transistors 720_1 to 720_*x* cause the reference current $I_0$ to flow are held in the current supply capacitors 721_1 to 721_*x* of the reference current output circuit 405 as the periods $TD_1$ to $TD_x$ in SET2 are ended. In this way, the current flowing in the current lines $CL_1$ to $CL_x$ is set to the reference current $I_0$.

The value of the current which flows in the current lines $CL_1$ to $CL_x$ and which is determined by the reference current output circuit 405 is thus set to the reference current $I_0$ in the first SET2 after the power of the display is turned on. In other words, sufficient setting operation of the reference current output circuit 405 is achieved in the first SET2 after the power of the display is turned on.

The description given next is about the operation of the current supply circuit of each pixel after the reference current $I_0$ starts to flow in the current lines $CL_1$ to $CL_x$. The pixel on the second row and the j-th column, for example, is set such that the reference current $I_0$ flows in the current line $CL_j$ after the period $TD_j$ is ended. In this way the reference current $I_0$ flows in the current transistor 1405 of the pixel on the j-th column. The gate electrode of the current transistor 1405 of the pixel on the second row is connected to its drain terminal through the current holding transistor 1404 that has been made conductive. Therefore, the current transistor 1405 operates with the gate-source voltage (gate voltage) equalized with the source-drain voltage, namely, it operates in the saturation region and a drain current flows. The drain current flowing in the current transistor 1405 of the pixel on the second row and the j-th column is set to the reference current $I_0$ flowing in the current line $CL_j$. In this way, the gate voltage of when the reference current $I_0$ flows in the current transistor 1405 is held in the current supply capacitor 111.

After the periods $TD_1$ to $TD_x$ are ended and the current supply capacitor 721_$x$ finishes holding electric charges according to the reference current $I_0$ that flows in the current lines CL, the period (2) is started. In the period (2), the signal of the signal line $GH_2$ is changed to make the current holding transistor 1404 nonconductive. This causes the current supply capacitor 111 in the pixel on the second row to hold electric charges.

A period denoted by $TQ_2$ in the drawing corresponds to a period in which the reference current $I_0$ is inputted from the current line $CL_x$ to the current transistor 1405 of the current supply circuit 102 in the pixel on the second row and the x-th column to cause the current supply capacitor 111 to hold electric charges. If the period denoted by $TQ_2$ in the drawing is shorter than the time required for the current flowing in the current transistor 1405 to become stable, the current supply capacitor 111 cannot hold enough electric charges. In other words, the pixel setting operation is insufficient. Here, it is assumed for simplification that $TQ_2$ has enough length.

The setting operation of the pixels on the second row is performed in this way. In the current supply circuit 102 of each pixel, the gate electrode of the current transistor 1405 and the gate electrode of the current supply transistor 112 have the same electric potential. The source terminal of the current transistor 1405 and the source terminal of the current supply transistor 112 have the same electric potential. The current transistor 1405 and the current supply transistor 112 desirably have the same current characteristic. It is assumed for simplification that the current transistor 1405 and the current supply transistor 112 have the same current characteristic. Therefore, when a voltage is applied between the terminal A and terminal B of the current supply circuit 102, a constant current (pixel reference current) according to the reference current $I_0$ that flows in the current transistor 1405 flows between the source and drain of the current supply transistor 112.

As SET2 is ended, the signal inputted to the signal line $GN_2$ is changed to make the current input transistor 1403 of the pixel on the second row nonconductive. In this way, the connection between the current line $CL_2$ and the current transistor 1405 is cut while the gate voltages of the current transistor 1405 and current supply transistor 112 in the pixel on the second row are held.

The operation similar to the one in SET2 is conducted for all rows. However, the setting operation of the reference current output circuit 405 has already been finished in SET2. Therefore, in the operation of SET3 and subsequent periods, a current almost equal to the reference current flows in all of the current lines CL1 to CLx during the period (1) of SETi continuously. Once the setting operation of the reference current output circuit 405 is completed, the current supply capacitor 111 in every pixel on the i-th row concurrently performs the operation of holding the pixel corresponding reference voltage immediately after the period (1) of SETi is started.

As described, electric charges for causing the reference current to flow in each of the current lines $CL_1$ to $CL_x$ are held in the current supply capacitors 721_1 to 721_$x$ of the reference current output circuit 405 at the time SET2 is ended. Therefore, in the periods $TD_1$ to $TD_x$ of SET3 and subsequent periods, an operation of holding again electric charges that have been discharged from the current supply capacitors 721_1 to 721_$x$ is conducted. In SET2 and subsequent periods, the current flowing in the current lines $CL_1$ to $CL_x$ is mostly set to the reference current and the pixel setting operation is sufficient (completed).

When the operations of SET1 to SETy are finished, a first frame period of pixel setting is ended. The first frame period of pixel setting refers to a period in which the signal lines $GN_1$ to $GN_y$ and the signal lines $GH_1$ to $GH_y$ are each selected once and the setting operation of every pixel is carried out once for every pixel.

After the first frame period of pixel setting is ended, a second frame period of pixel setting is started. The operation of the first frame period of pixel setting is repeated in the second frame period of pixel setting. In the first frame period of pixel setting, the setting operation of pixels on the first row was insufficient. On the other hand, the setting operation of the reference current output circuit 405 has been completed in the second frame period of pixel setting. Therefore the pixels on the first row receive a sufficient setting operation through the operation of SET1 in the second frame period of pixel setting. In this way, every pixel receives a sufficient pixel setting operation (the pixel setting operation is completed for every pixel).

Although the division number of the reference current output circuit 405 is set to 2 in the timing chart of FIG. 6, it is not limited thereto and can be set to an arbitrary number. If the division number is larger than the number of pixel rows of the display device, the first time pixel setting operation after the power of the display device is turned on (the first frame period of pixel setting) is insufficient for every pixel row. However, a sufficient pixel setting operation is achieved by repeating the pixel setting operation several times. Alternatively, the setting operation of all pixels may be completed in the second frame period of pixel setting and subsequent periods while the setting operation is insufficient for every pixel in the first frame period of pixel setting.

For example, the pixel setting operation may gradually proceed by setting the length of the period (1) of each setting period SETi short and repeating the operations of SET1 to SETy several times. In the example shown, the setting operation of the reference current output circuit 405 and the pixel setting operation immediately after the power of the display device is turned on are started simultaneously. However, the pixel setting operation may be started after the setting operation of the reference current output circuit 405 becomes sufficient.

Once the pixel setting operation is completed, a pixel operation is conducted in order to recharge the current supply capacitor 111 that has lost some of electric charges held therein due to leak current or the like. When the recharge takes place is varied depending on the discharge speed of the current supply capacitor 111 and the like. Since what is needed in a pixel setting operation conducted after the pixel setting operation is completed is not full recharge of the current supply capacitor 111 but to supplement electric charges that have been discharged from 111, a pixel setting operation after the initial pixel setting operation takes a shorter time to reach a stable state following input of the reference current to each pixel than the initial pixel setting operation. Therefore, compared to the initial pixel setting operation, the drive frequency in the subsequent pixel operations can be set higher for the driving circuits that input signals to signal lines GN and GH and for the reference current output circuit 405.

Figure 15:
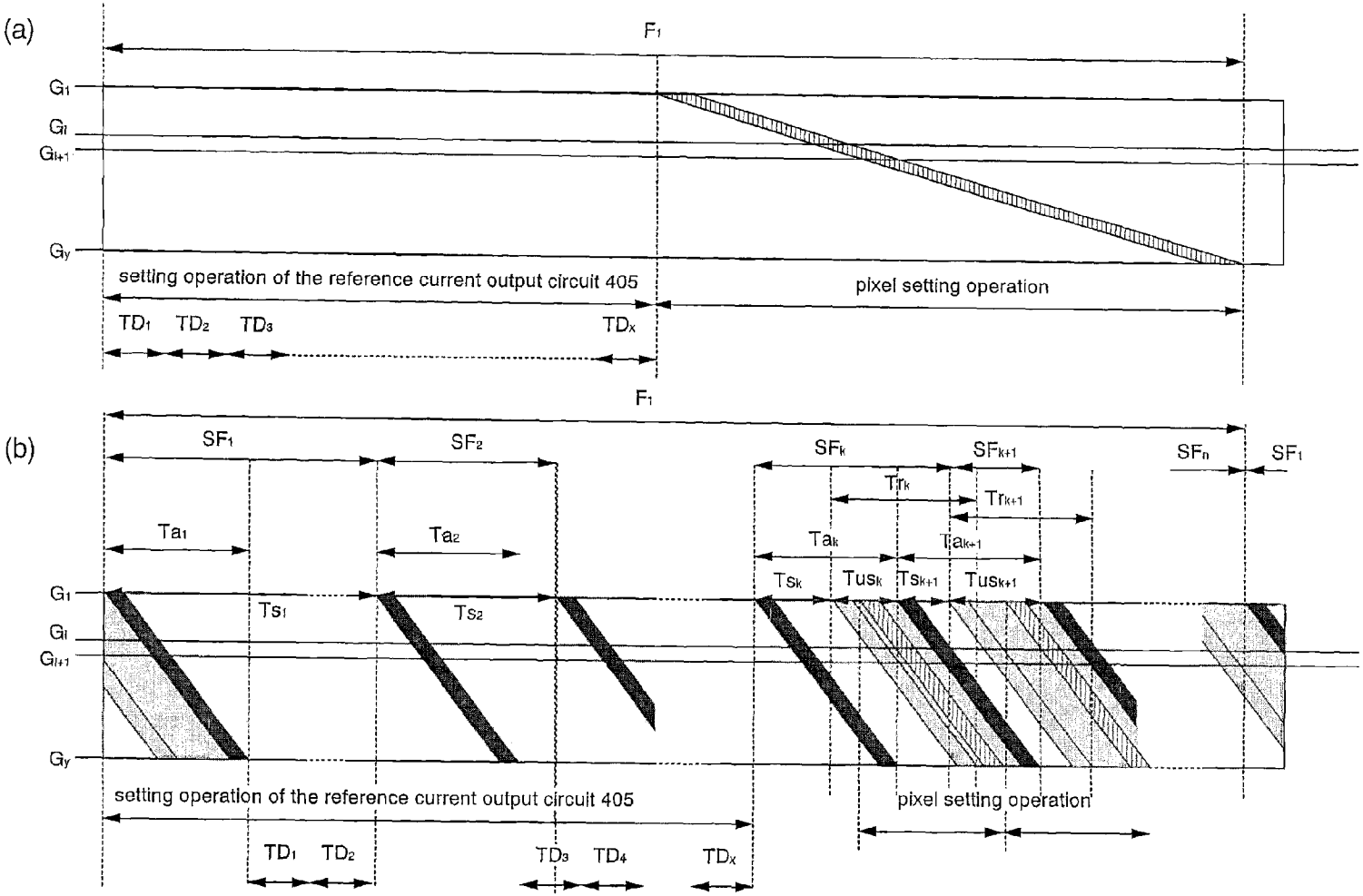
FIG. 15 are timing charts of a pixel setting operation in a display device of the present invention.

Next, a second method of the pixel setting operation is described with reference to FIG. 15. FIG. 15 are timing charts showing the setting operation (pixel setting operation) of the current supply circuit 102 placed in each pixel of FIG. 5. FIG. 15(*a*) shows an example in which the pixel setting operation and the setting operation of the reference current output circuit 405 shown in FIG. 8 and others are separated from each other between the former half and latter half of one frame period. In the example given here, the reference current output circuit 405 has the structure shown in FIG. 9 and is operated in accordance with the timing chart of FIG. 10. Components operating in the same way as the timing chart of FIG. 10 are denoted by the same symbols and explanations thereof are omitted.

First, in the former half of one frame period, the reference current output circuit 405 carries out the operations of the periods $TD_1$ to $TD_x$ in FIG. 10 in order and the current flowing in the current lines $CL_1$ to $CL_x$ is determined in order. The operation of the current supply circuit 102 of each pixel in the latter half of the one frame period is described next focusing on a pixel on the first row. Through the setting operation of the reference current output circuit 405, the reference current is set as the current flowing in all of the current lines CL. Here, the gate electrode of the current transistor 1405 of the pixel on the first row is connected to its drain terminal through the current holding transistor 1404 that has been made conductive. Therefore, the current transistor 1405 operates with the gate-source voltage (gate voltage) equalized with the source-drain voltage, namely, it operates in the saturation region and a drain current flows. The drain current flowing in the current transistor 1405 of the pixel on the first row and the j-th column is set to the reference current flowing in the current line $CL_j$. In this way, the gate voltage of when the reference current flows in the current transistor 1405 is held in the current supply capacitor 111. Next, the signal of the signal line $GH_1$ is changed to make the current holding transistor 1404 nonconductive. This causes the current supply capacitor 111 in the pixel on the first row to hold electric charges.

The setting operation of each pixel on the first row is performed in this way. In the current supply circuit 102 of each pixel, the gate electrode of the current transistor 1405 and the gate electrode of the current supply transistor 112 have the same electric potential. The source terminal of the current transistor 1405 and the source terminal of the current supply transistor 112 have the same electric potential. The current transistor 1405 and the current supply transistor 112 desirably have the same current characteristic. It is assumed here for simplification that the current transistor 1405 and the current supply transistor 112 have the same current characteristic. Therefore, when a voltage is applied between the terminal A and terminal B of the current supply circuit 102, a constant current according to the reference current that flows in the current transistor 1405 flows in the current supply transistor 112.

Next, signals inputted to the signal line $GN_2$ and the signal line $GH_2$ make conductive the current input transistor 1403 and current holding transistor 1404 of the pixel on the second row. At the same time, the signal inputted to the signal line $GN_1$ is changed to make the current input transistor 1403 of the pixel on the first row nonconductive. In this way, the connection between the current line $CL_1$ and the current transistor 1405 is cut while the gate voltages of the current transistor 1405 and current supply transistor 112 in the pixel on the first row are held. A pixel setting operation similar to the one for the first row is performed on pixels on the second row. Then the same operation is repeated for pixels on the third row, pixels on the fourth row, and so on in order. When the pixel setting operation is finished for all rows, one frame period is ended. As the next frame period is started, the setting operation of the reference current output circuit 405 is conducted in the former half and the pixel setting operation is conducted in the latter half in a similar manner. Once the pixel setting operation is completed, a pixel operation is conducted in order to recharge the current supply capacitor 111 that has lost some of electric charges held therein due to leak current or the like. When the recharge takes place varies depending on the discharge speed of the current supply capacitor 111 and the like.

Similarly, once the reference current output circuit 405 finishes the setting operation, a setting operation is conducted in order to recharge the capacitors 721 that have lost some of electric charges held therein. When the recharge takes place varies and setting operations of pixels and the reference current output circuit 405 can be carried out irrespective of the image display operation. They can be carried out irrespective of the address periods Ta, display periods Ts, and non-display periods Tus in FIG. 7. This is because setting operations of pixels and the reference current output circuit 405 do not influence the image display operation and vice versa. Therefore, setting operations may be performed as shown in FIG. 15(*b*) instead of FIG. 15(*a*). In FIG. 15(*b*), the setting operation of the reference current output circuit 405 is conducted during a period in which the signal line driving circuit does not operate and the pixel setting operation is conducted in the rest of the periods. The timing and number of setting operations are thus completely arbitrary. Also it is not necessary to conduct the pixel setting operation in order one row at a time and it is not necessary to conduct the setting operation of the reference current output circuit 405 in order one column at a time.

In a structure where one of the source terminal and drain terminal of the current holding transistor 1404 that is not connected to the gate electrodes of the current transistor 1405 and current supply transistor 112 is connected directly to a current line CL, a constant electric potential is given to the current line CL when the current input transistor 1403 of every pixel is made nonconductive. This constant electric potential is set to or around the average of the gate electric potential of the current transistor 1405 when the pixel corresponding reference voltage is held in the current supply capacitor 111 in each of plural pixels of the display device. In this way, the voltage between the source and drain terminals of the current holding transistor 1404 is reduced and electric charges accumulated in the current supply capacitor 111 are prevented from being discharged due to leak current of the current holding transistor 1404. Whether a constant current is given to the current line CL or the reference current flows in the current line CL may be determined and carried out by the reference current output circuit 405.

The value of the pixel reference current can be changed with respect to the value of the reference current by changing the gate length-gate width ratio of the current supply transistor 112 with respect to the gate length-gate width ratio of the current transistor 1405. For instance, if the reference current is set large with respect to the pixel reference current, the time required for the current supply capacitor 111 to hold the pixel corresponding reference voltage can be shortened and influence of noises can be reduced.

It is possible to set the reference current having different current values to suit characteristics of light emitting elements of pixels respectively associated with the current lines $CL_1$ to $CL_x$. For instance, different current values can be set for the reference current flowing in current lines of pixels different from one another in that one has a light emitting element that emits red light, another has a light emitting element that emits green light, and still another has a light emitting element that emits blue light. This makes it possible to balance the light emission luminance among light emitting elements of three colors. The light emission luminance may be balanced among three colors by varying the length of the lighting period, or by combining this with varying the current value of the reference current inputted to pixels of different colors. Alternatively, it may be balanced by varying the gate length-gate width ratio of the current supply transistor 112 to the gate length-gate width ratio of the current transistor 1405 depending on the color.

The description given next is about the relation between the image display operation and the pixel setting operation. Various starting points are considerable for the image display operation and the pixel setting operation.

One of them is to wait till sufficient setting operation is completed once for all pixels before conducting the first time image display operation since power of the display device is turned on. In this case, a light emitting element of a pixel for which a light emission state is chosen by a video signal starts to emit light at a given luminance from the first image display operation.

Another option is to conduct the first time image display operation since power of the display device is turned on at the same time the pixel setting operation is conducted. In this case, a light emitting element of a pixel for which a light emission state is chosen by a video signal does not reach a given light emission luminance in an image display operation that is conducted during a period required to complete the pixel setting operation. Therefore accurate gray scale display begins after a sufficient pixel setting operation is performed on all of the pixels.

In the pixel portion structure shown in FIG. 5, the signal lines GN, the signal lines GH, the scanning lines G, and the erasing signal lines RG may be shared by taking drive timing and the like into consideration. For example, one of the signal line $GH_i$ and the signal line $GN_i$ can double as the other. The current holding transistor 1404 is made nonconductive at exactly the same time the current input transistor 1403 is made nonconductive and therefore no problem arises regarding the pixel setting operation.

Embodiment Mode 2

Figure 12:
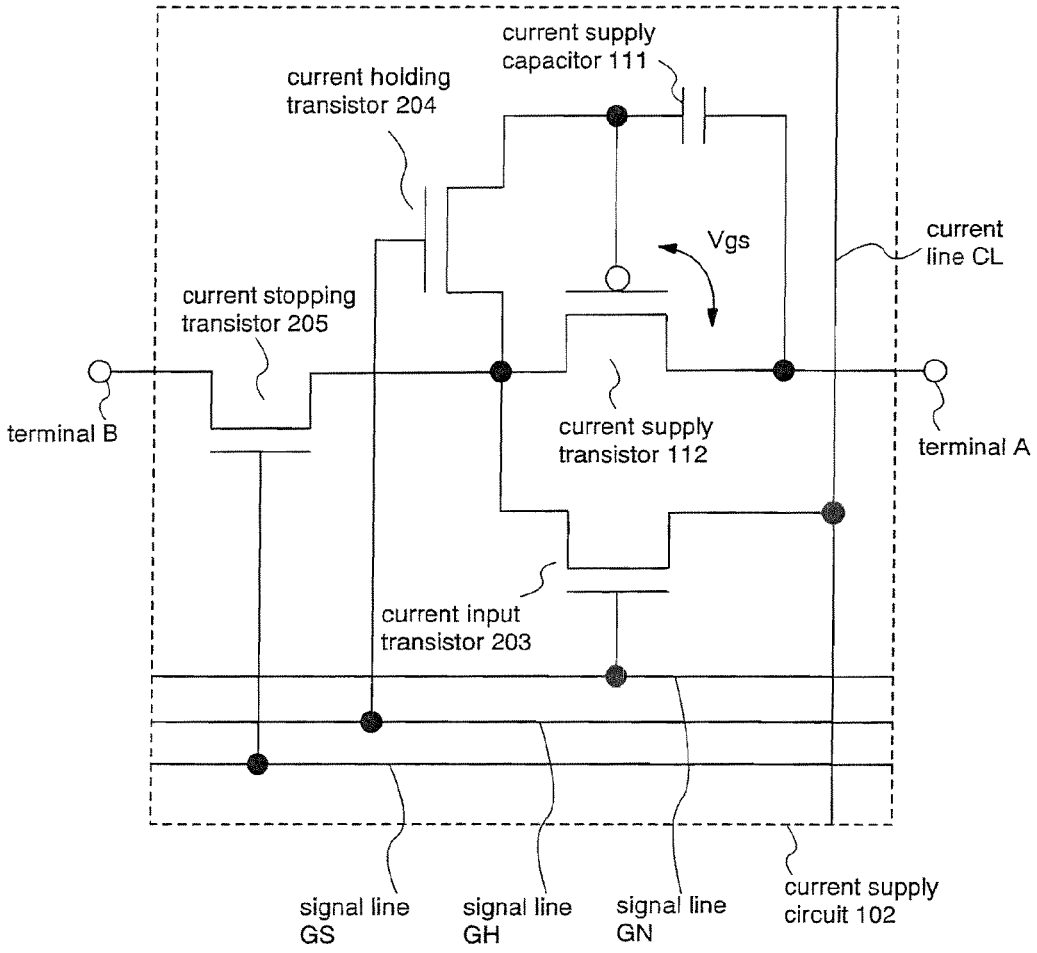
FIG. 12 is a circuit diagram of a current supply circuit in a display device of the present invention.

This embodiment mode shows a structural example of an identic-transistor method current supply circuit with reference to FIG. 12. The description here is mainly about a difference between this embodiment mode and Embodiment Mode 1 and explanations for things that overlap will be omitted. Accordingly, components in FIG. 12 that are identical with those in FIG. 3 are denoted by the same symbols.

Figure 24:
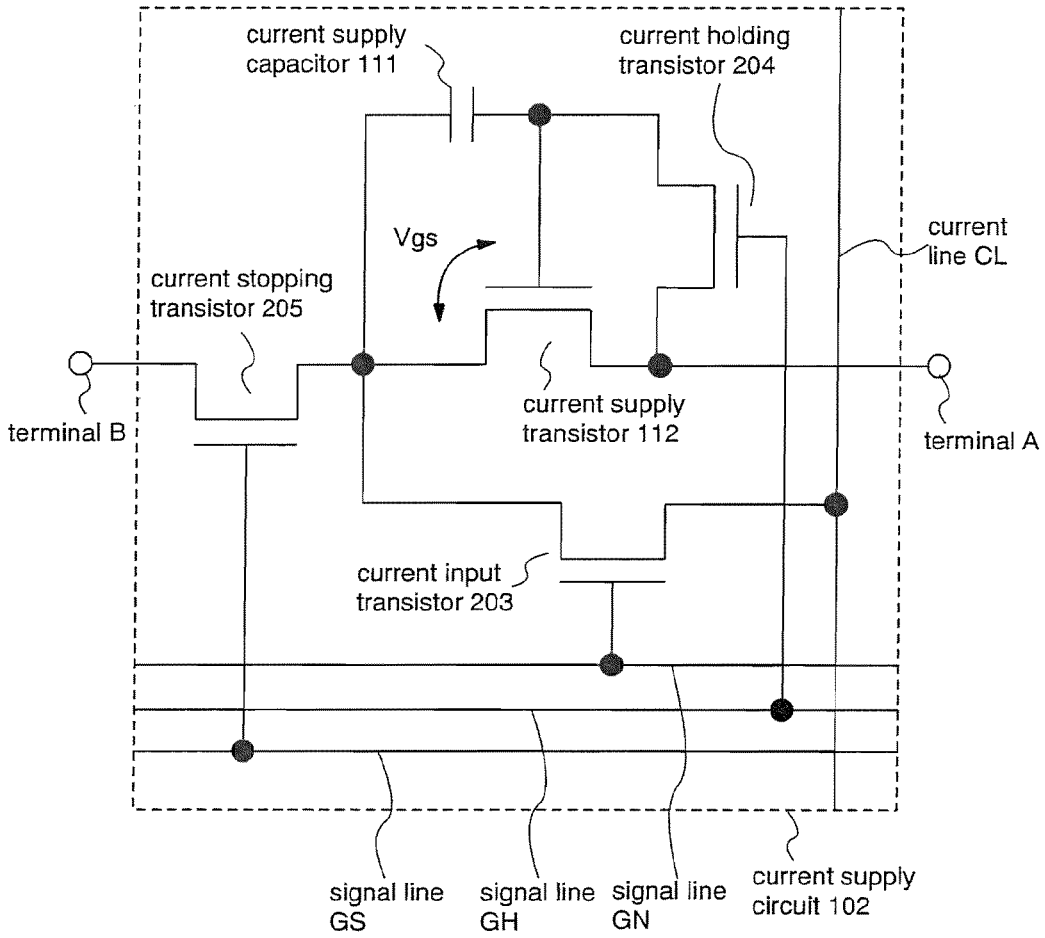
FIG. 24 is a circuit diagram of a current supply circuit in a display device of the present invention.

In FIG. 12, a current supply circuit 102 is composed of a current supply capacitor 111, a current supply transistor 112, a current input transistor 203, a current holding transistor 204, a current stopping transistor 205, a current line CL, a signal line GN, a signal line GH, and a signal line GS. The current supply transistor 112 is a p-channel transistor in the example shown. If an n-channel transistor is used for the current supply transistor 112, follow the structure shown in FIG. 3(C) for easy application. An example thereof is shown in FIG. 24. Components identical with those in FIG. 12 are denoted by the same symbols.

In FIG. 12, the current input transistor 203, the current holding transistor 204, and the current stopping transistor 205 are n-channel transistors but may be p-channel transistors since they simply operate as switches. However, the current holding transistor 204 is desirably a p-channel transistor if the current holding transistor 204 is connected between a gate and drain of the current supply transistor 112 in FIG. 12. This is because the electric potential of a terminal B could be greatly lowered by using an n-channel transistor and it also lowers the source electric potential of the current holding transistor 204. As a result, making the current holding transistor 204 nonconductive could become difficult to achieve. The current holding transistor 204 having the p-channel polarity is free of this fear.

A gate electrode of the current supply transistor 112 is connected to one of electrodes of the current supply capacitor 111. The other electrode of the current supply capacitor 111 is connected to a source terminal of the current supply transistor 112. The source terminal of the current supply transistor 112 is connected to a terminal A of the current supply circuit 102. The gate electrode of the current supply transistor 112 is connected to its drain terminal through source-drain terminals of the current holding transistor 204. A gate electrode of the current holding transistor 204 is connected to the signal line GH. The drain terminal of the current supply transistor 112 is connected to the current line CL through source-drain terminals of the current input transistor 203. A gate electrode of the current input transistor 203 is connected to the signal line GN. The drain terminal of the current supply transistor 112 is connected to the terminal B through source-drain terminals of the current stopping transistor 205. A gate electrode of the current stopping transistor 205 is connected to the signal line GS.

Figure 62:
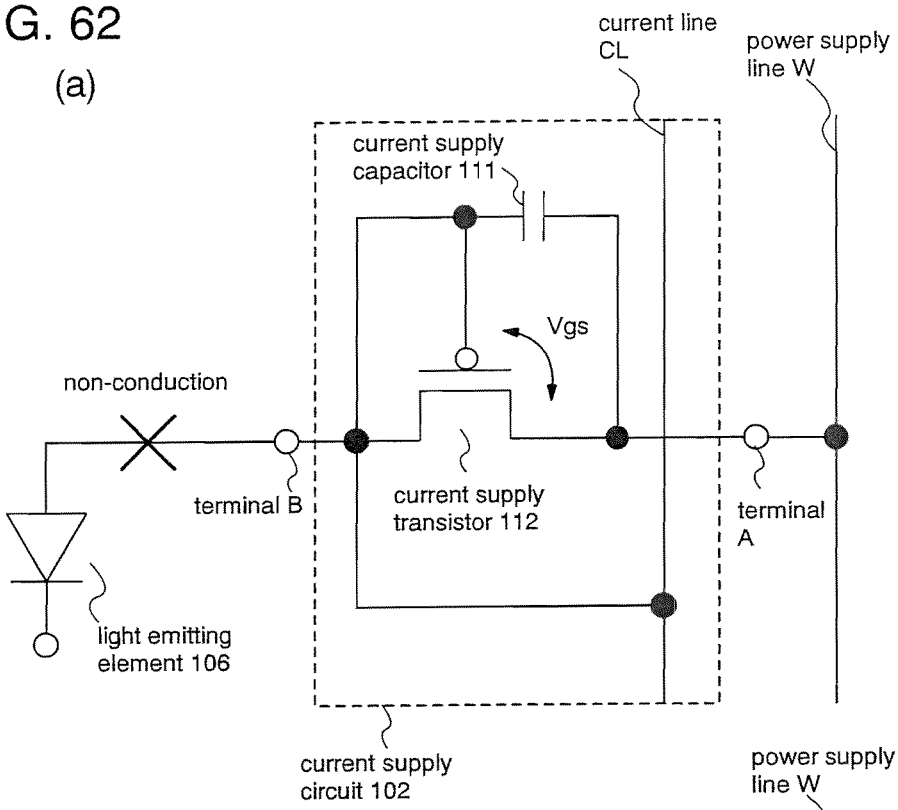
FIG. 62 are schematic diagrams showing states of a pixel in a display device of the present invention.
Figure 62:
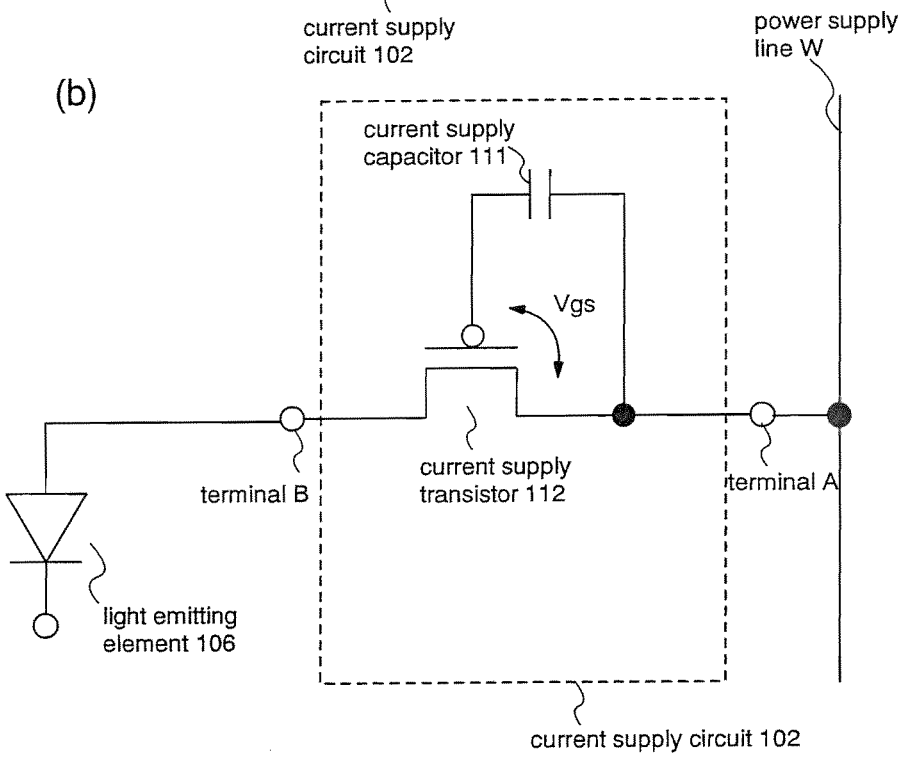
Figure 72:
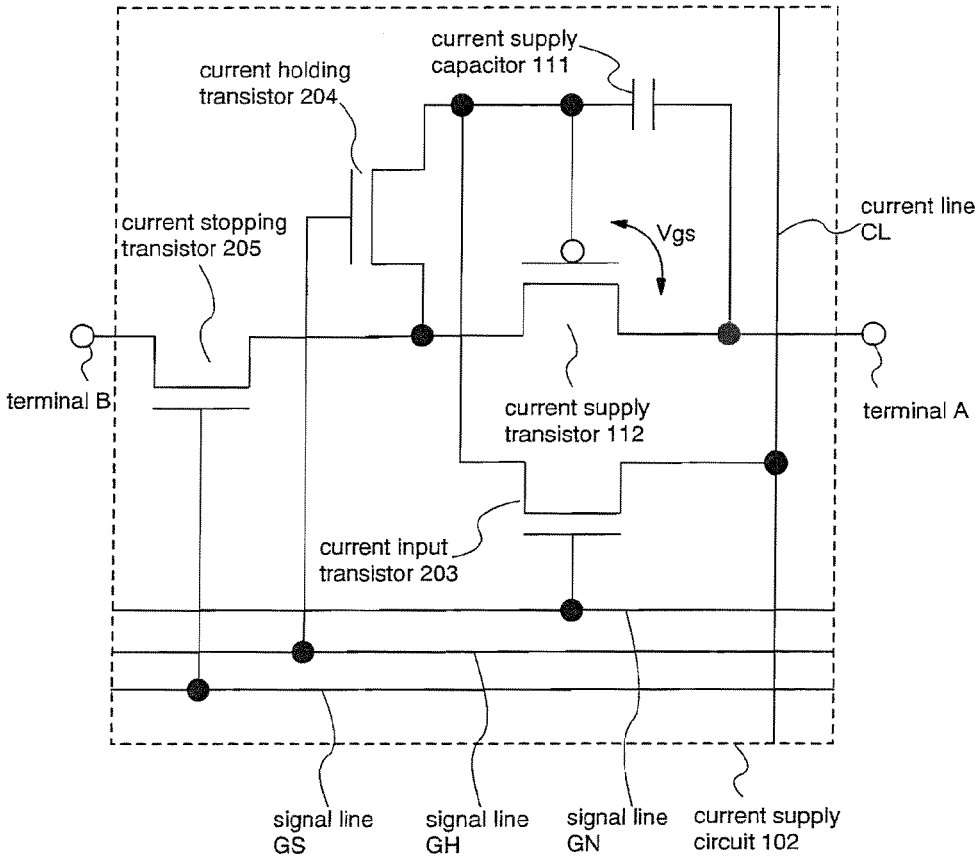
FIG. 72 is a circuit diagram of a current supply circuit of a pixel in a display device of the present invention.

In the above structure, the gate electrode of the current supply transistor 112 may be connected to the current line CL without passing through the path between the source and drain terminals of the current input transistor 203. Then, of the source terminal and drain terminal of the current holding transistor 204, one that is not connected to the gate electrode of the current supply transistor 112 is directly connected to the current line CL. In this case, the source-drain voltage of the current holding transistor 204 can be reduced by adjusting the electric potential of the current line CL. As a result, leak current of the current holding transistor 204 is reduced when the current holding transistor 204 is in a nonconductive state. This is not the only way and it is sufficient if the current holding transistor 204 is connected in a manner that makes the electric potential of the gate electrode of the current supply transistor 112 equal to the electric potential of the current line CL when the current holding transistor 204 is made conductive. In other words, it is sufficient if the wirings and switches are connected as shown in FIG. 62(*a*) during the pixel setting operation and as shown in FIG. 62(*b*) during light emission. Accordingly, the structure of the current supply circuit may be as shown in FIG. 72.

In the structure where one of the source terminal and drain terminal of the current holding transistor 204 that is not connected to the gate electrode of the current supply transistor 112 is connected directly to the current line CL, a constant electric potential is given to the current line CL when the current input transistor 203 of every pixel is made nonconductive. This constant electric potential is set to or around the average of the gate electric potential of the current supply transistor 112 when the pixel corresponding reference voltage is held in the current supply capacitor 111 in each of plural pixels of the display device. In this way, the voltage between the source and drain terminals of the current holding transistor 204 is reduced and electric charges accumulated in the current supply capacitor 111 are prevented from being discharged due to leak current of the current holding transistor 204.

Whether a constant current is given to the current line CL or the reference current flows in the current line CL may be determined and carried out by the reference current output circuit 405. When the current holding transistor 204 is connected between the gate of the current supply transistor 112 and the current line CL, the current holding transistor 204 can take any polarity. The current holding transistor 204 having the n-channel polarity does not cause excessive lowering in electric potential of the current line CL and therefore there is no difficulty in letting the current holding transistor 204 be nonconductive.

The switch portion has the same structure as the one described in Embodiment Mode 1 and various structures can be employed. An example thereof is the structure shown in FIG. 13 and explanations are omitted.

Figure 14:
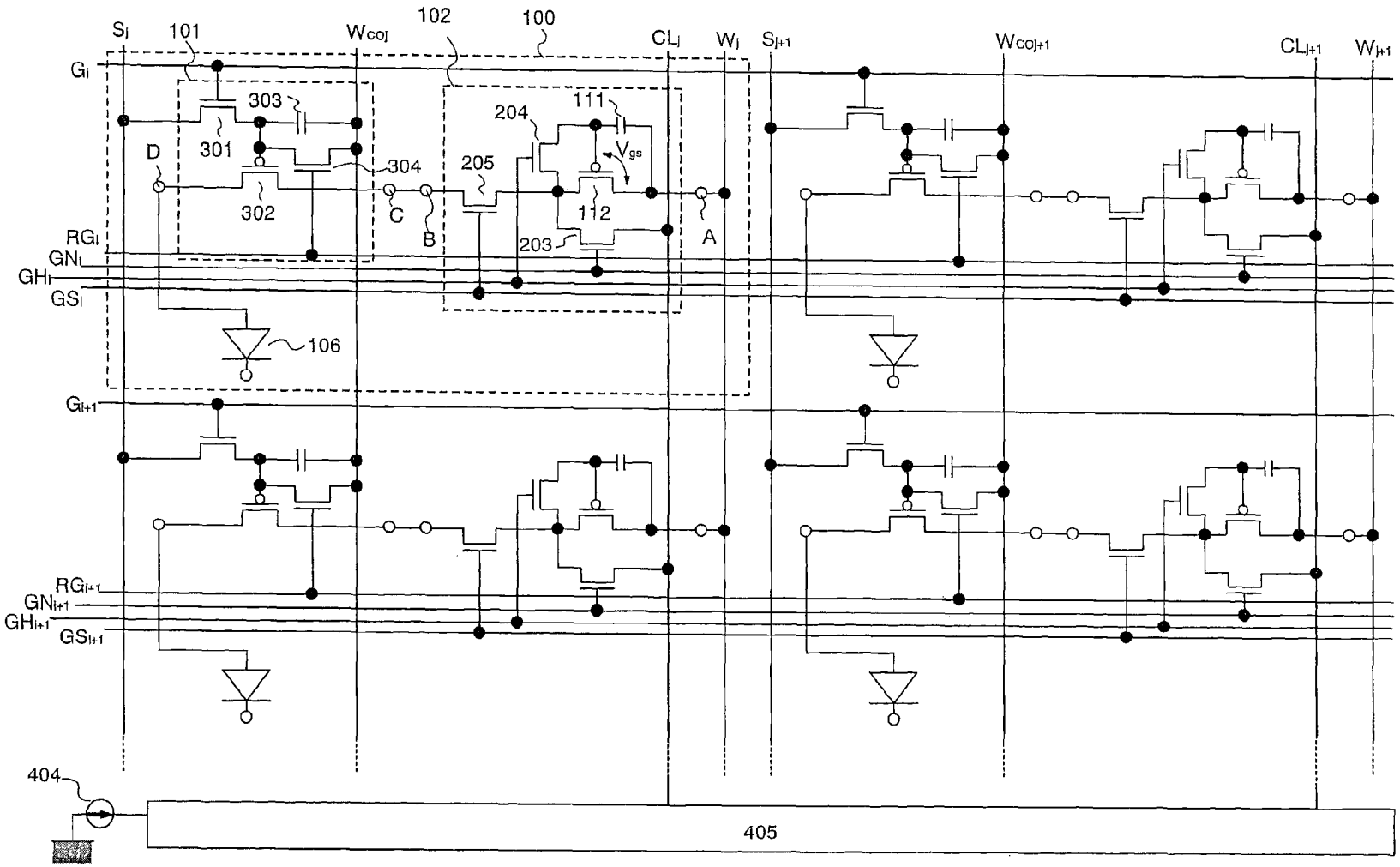
FIG. 14 is a circuit diagram of a pixel portion in a display device of the present invention.

FIG. 14 is a circuit diagram of a part of a pixel region in which pixels are arranged to form a matrix pattern. Each of the pixels is denoted by 100 and has a current supply circuit 102 structured as shown in FIG. 12 and a switch portion 101 structured as shown in FIG. 13. In FIG. 14, only four pixels on the i-th row and j-th column, the (i+1)-th row and j-th column, the i-th row and (j+1)-th column, and the (i+1)-th row and (j+1)-th column are shown as a representative. Components identical with those in FIGS. 12 and 13 are denoted by the same symbols and explanations thereof are omitted. Scanning lines, erasing signal lines, signal lines GN, signal lines GH, and signal lines GS associated with the i-th and (i+1)-th pixel rows are denoted by $G_j$ and $G_{i+1}$, $RG_i$ and $RG_{i+1}$, $GN_i$ and $GN_{i+1}$, $GH_i$ and $GH_{i+1}$, and $GS_i$ and $GS_{i+1}$, respectively. Video signal input lines S, power supply lines W, current lines CL, and wirings $W_{CO}$ associated with the j-th and (j+1)-th pixel columns are denoted by $S_j$ and $S_{j+1}$, $W_j$ and $W_{j+1}$, $CL_j$ and $CL_{j+1}$, and $W_{COj}$ and $W_{COj+1}$, respectively. A reference current is inputted to the current lines $CL_j$ and $CL_{j+1}$ from the outside of the pixel region.

Figure 50:
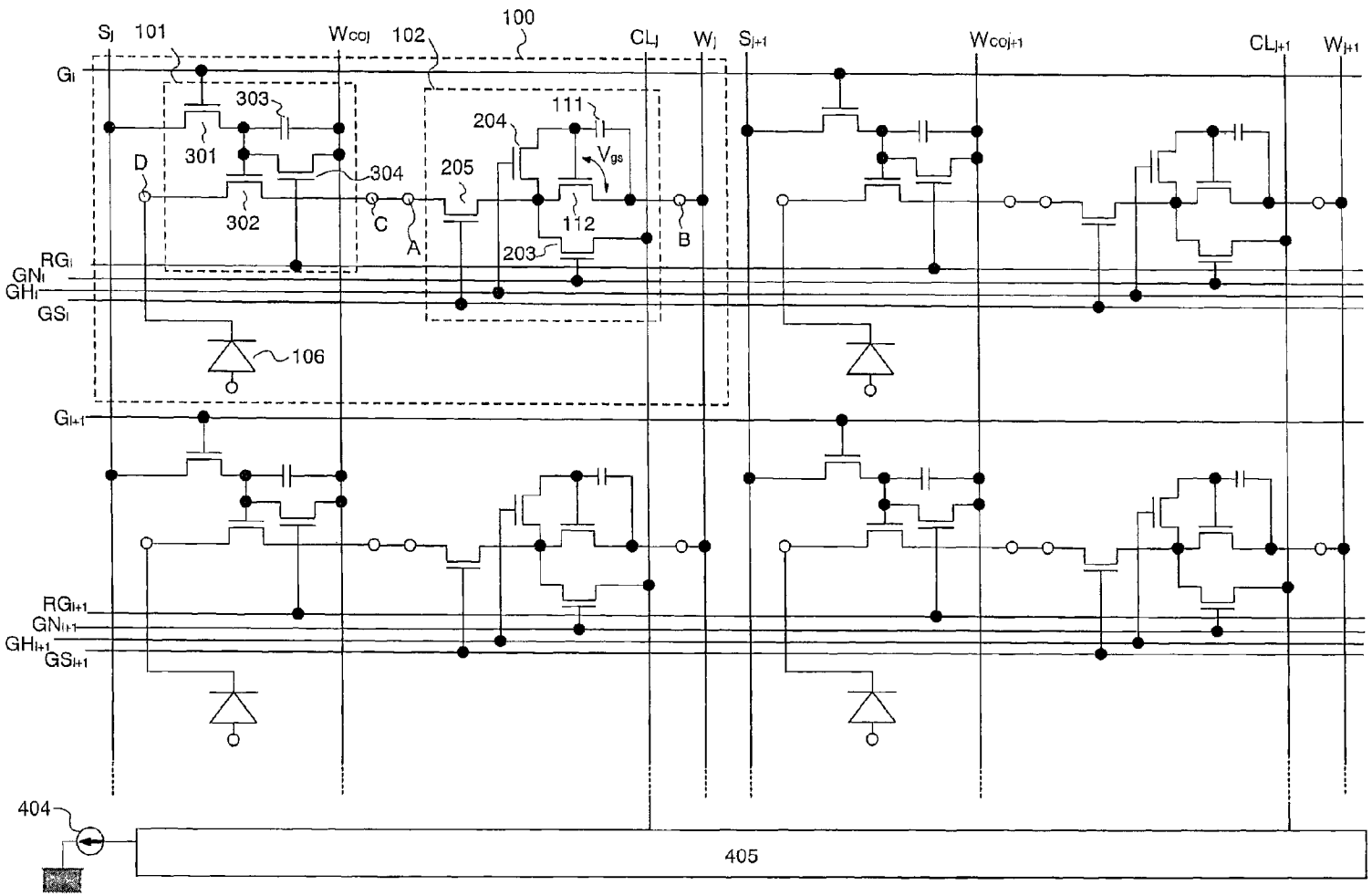
FIG. 50 is a diagram showing the structure of a pixel portion in a display device of the present invention.

A pixel electrode of a light emitting element 106 is connected to a terminal D and an opposite electrode thereof is given an opposite electric potential. In the structure shown in FIG. 14, the pixel electrode of the light emitting element serves as an anode and the opposite electrode serves as a cathode. In other words, the terminal A of the current supply circuit is connected to the power supply line W and the terminal B is connected to the terminal C of the switch portion 101 in the structure. However, the structure of Embodiment Mode 2 can readily be applied to a display device structured to use the pixel electrode of the light emitting element 106 as a cathode and its opposite electrode as an anode. FIG. 50 shows an example where the pixel structured as shown in FIG. 14 is changed so that the pixel electrode of the light emitting element 106 serves as a cathode and the opposite electrode serves as an anode. In FIG. 50, components identical with those in FIG. 14 are denoted by the same symbols and explanations thereof are omitted.

The current supply transistor 112 in FIG. 14 is a p-channel transistor. On the other hand, the current supply transistor 112 in FIG. 50 is an n-channel transistor. The direction of current flow can be reversed in this way. The terminal A in FIG. 50 is connected to the terminal C of the switch portion and the terminal B is connected to the power supply line W.

A driving transistor 302 simply functions as a switch in FIG. 14 and FIG. 50 and therefore can either be an n-channel transistor or a p-channel transistor. Preferably, the driving transistor 302 operates with the electric potential of its source terminal fixed. Therefore a p-channel transistor is preferred as the driving transistor 302 in the structure where the pixel electrode of the light emitting element 106 serves as an anode and the opposite electrode serves as a cathode as shown in FIG. 14. On the other hand, an n-channel transistor is preferred as the driving transistor 302 in the structure where the pixel electrode of the light emitting element 106 serves as a cathode and the opposite electrode serves as an anode as shown in FIG. 50. In FIG. 14, the wiring $W_{CO}$ and the power supply line W in each pixel may be kept at the same electric potential and therefore one of them can double as the other. Also, different pixels can share the wiring $W_{CO}$, or the power supply line W, or the wiring $W_{CO}$ and the power supply line W.

In the pixel portion structure shown in FIG. 14, the signal lines GN, the signal lines GH, the signal lines GS, the scanning lines G, and the erasing signal lines RG may be shared by taking drive timing and the like into consideration. For example, one of the signal line $GH_i$ and the signal line $GN_i$ can double as the other. In this case, the current holding transistor 204 is made nonconductive at exactly the same time the current input transistor 203 is made nonconductive and therefore no problem arises regarding the pixel setting operation. In another example, one of the signal line $GS_i$ and the signal line $GN_i$ doubles as the other. In this case, the current stopping transistor 205 having a polarity different from the polarity of the current input transistor 203 is used. In this way, one of the transistors 203 and 205 can be made conductive whereas the other is made nonconductive when the same signal is inputted to the gate electrode of the current input transistor 203 and the gate electrode of the current stopping transistor 205. Furthermore, one of the erasing signal line RG and the signal line GS can double as the other.

Moreover, a scanning line of another pixel row may be used in place of the wiring $W_{CO}$ and the wiring $W_j$. This is because the electric potential of the scanning line is kept constant while no video signal is written. For example, a scanning line $G_{i-1}$ of the preceding pixel row may be used in place of the power supply line. In this case, however, the polarity of a selecting transistor 301 has to be chosen by taking the electric potential of the scanning line G into consideration.

The current stopping transistor 205 and an erasing transistor 304 may be integrated so that one of them is omitted. In the pixel setting operation, accurate setting cannot be achieved if leak current flows into the driving transistor 302 and the light emitting element 106. Therefore, during the pixel setting operation, either the current stopping transistor 205 is made nonconductive or the erasing transistor 304 is made conductive to make the driving transistor 302 nonconductive. Alternatively, both of them are carried out. Similarly, in a non-display period, the current stopping transistor 205 is made nonconductive or the erasing transistor 304 is made conductive. From the above, either the current transistor 205 or the erasing transistor 304 can be omitted.

Figure 73:
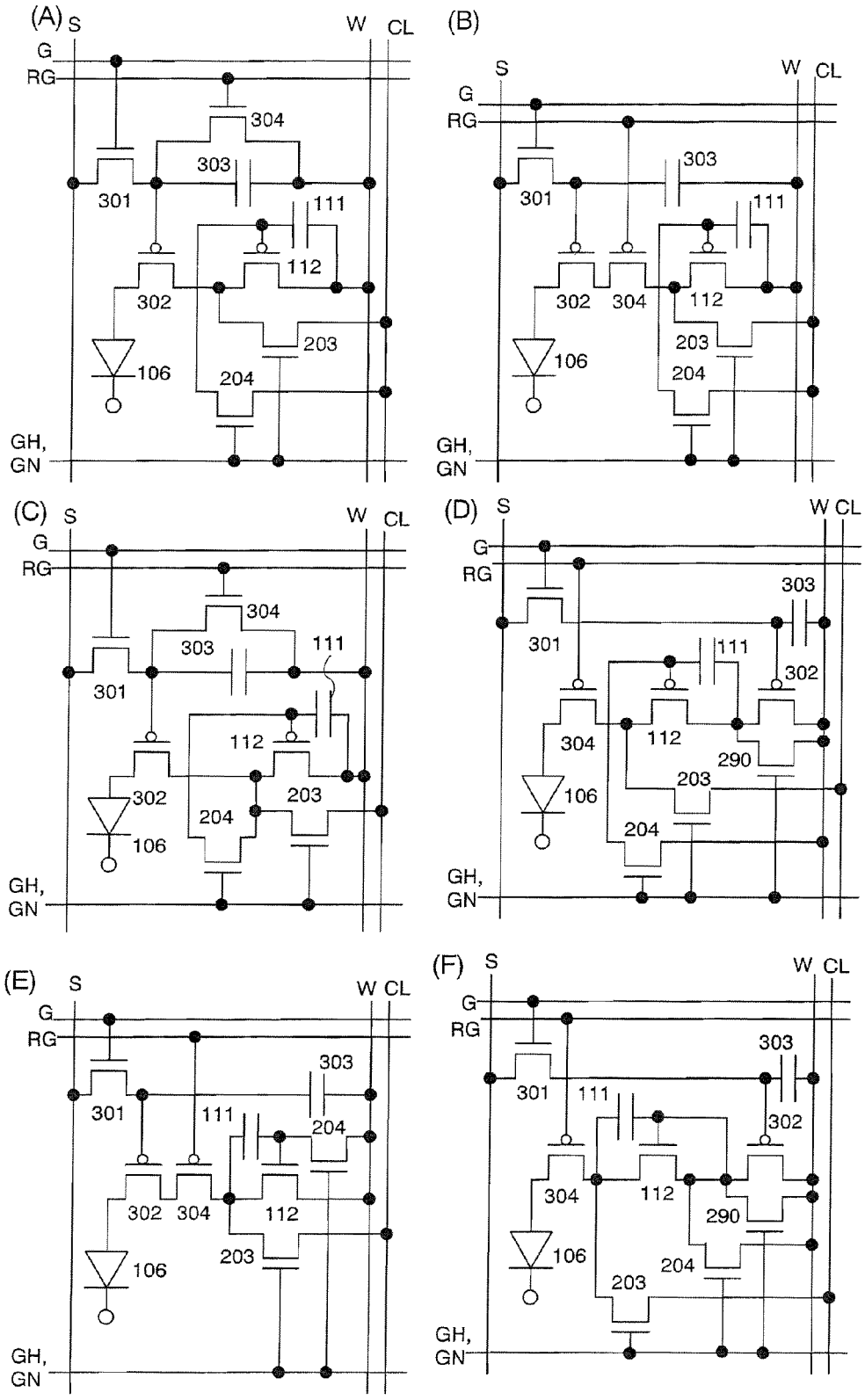
FIG. 73 are circuit diagrams each showing the structure of a pixel in a display device of the present invention.

FIG. 73 show specific examples of sharing wirings in a pixel that has a switch portion and current supply circuit structured as above. In FIGS. 73(A) to 73(F), one of the signal line GN and the signal line GH doubles as the other and one of the wiring $W_{CO}$ and the power supply line W doubles as the other. The current stopping transistor 205 is omitted. In FIG. 73(A), in particular, one of the source terminal and drain terminal of the current holding transistor 204 that is not connected to one of the electrodes of the current supply capacitor 111 is connected directly to the current line CL. In FIG. 73(B), the erasing transistor 304 is connected to the current supply transistor 112 and the driving transistor 302 in series. In FIG. 73(D), the power supply line W is connected to the light emitting element 106 through the driving transistor 302 of the switch portion 101 and the current supply transistor 112 of the current supply circuit 102 in order. In this structure, an additional transistor 290 is provided. The additional transistor 290 connects the power supply line W with the source terminal of the current supply transistor 112, so that the pixel setting operation can be conducted when the switch portion is OFF, in other words, when the driving transistor 302 is in a nonconductive state. The current supply transistor in FIG.

73(E) is an n-channel transistor. In this case, one of the source terminal and drain terminal of the current holding transistor 204 that is not connected to one of the electrodes of the current supply capacitor 111 is connected directly to the power supply line W. FIG. 73(F) is a structural example in which FIG. 73(D) is changed to give the current supply transistor 112 the n-channel polarity. As described, various circuits can be obtained easily by sharing wirings, sharing transistors, changing the polarities and positions of transistors, changing the positions of the switch portion and the current supply circuit, changing the internal structures of the switch portion and current supply circuit, and by changing combination of these parameters.

A method of driving a display device that has a pixel structured as shown in FIG. 14 is described. The description is given with reference to FIG. 16. The structures and operations of the reference current output circuit 405 and reference current supply circuit 404 are identical with those described in Embodiment Mode 1. Accordingly, explanations thereof are omitted.

First, the image display operation is similar to the one described in Embodiment Mode 1 referring to FIG. 7. The difference is the operation of the current stopping transistor 205. When the current stopping transistor 205 is present, the current stopping transistor 205 has to be conductive during a lighting period. If the current stopping transistor 205 is nonconductive at that time, no current flows in the light emitting element even though the driving transistor 302 is conductive. Therefore the current stopping transistor 205 has to be conductive during a lighting period. The transistor can be conductive or nonconductive during a non-lighting period. The operation is identical with the one in Embodiment Mode 1 except the above point. Detailed explanations are therefore omitted.

The pixel setting operation is described next. As shown in Embodiment Mode 1, the image display operation and the pixel setting operation can be out of sync with each other in a display device having the structure of FIG. 5, namely, in the case where the current mirror method is used for a current supply circuit of a pixel. On the other hand, it is desirable for the image display operation and the pixel setting operation to be in sync with each other in Embodiment Mode 2 where the display device is structured as shown in FIG. 14, namely, in the case where the identic-transistor method is used for a current supply circuit of a pixel.

When the pixel setting operation is performed on each pixel, it is necessary to set a situation that makes the reference current flowing in the current line CL as the drain current of the current supply transistor 112 in order to cause the current supply capacitor 111 to hold the pixel corresponding reference voltage. Accordingly, if some of the current flowing in the current supply transistor 112 flows from the current supply circuit 102 into the light emitting element 106 during the pixel setting operation, the drain current of the current supply transistor 112 takes a value different from the reference current that flows in the current line CL and the current supply capacitor 111 cannot hold the pixel corresponding reference voltage accurately. To avoid this, it is necessary to block a current flow to a light emitting element of a pixel while the pixel setting operation is performed on the pixel.

Accordingly, no image can be displayed during the pixel setting operation. The pixel setting operation therefore has to be conducted in a period in which the image display operation is not conducted, or in a period which is provided in the middle of the image display operation and in which no image is displayed. It is therefore desirable for the image display operation and the pixel setting operation to be in sync with each other.

In the display device structured as shown in FIG. 14, the current stopping transistor 205 is made nonconductive while the current supply transistor 112 in each pixel is electrically connected to the current line CL. In this way, input of current to the light emitting element 106 is prevented even though the path between the terminal C and terminal D of the switch portion is conductive, and an accurate pixel setting operation is conducted.

Alternatively, in the display device structured as shown in FIG. 14, the pixel setting operation may be conducted only when the path between the terminal C and terminal D of the switch portion in each pixel is nonconductive, namely, when the driving transistor 302 is nonconductive. In this case, the current stopping transistor 205 is not necessary. Then the drain terminal of the current supply transistor 112 is connected directly to the terminal B. The driving transistor 302 can be made nonconductive by making the erasing transistor 304 conductive or other methods. This means that the current stopping transistor 205 is not necessary if the pixel setting operation is conducted only during a non-lighting period.

Examples of when the pixel setting operation is conducted are shown next. Roughly speaking, there are two options. One option is to conduct the pixel setting operation in a display period. In this case, however, light emission is impossible during the pixel setting operation. Accordingly, a period in which no light is emitted is inserted in a display period. If there is no change in signal held in the capacitance of the storage capacitor 303 of FIG. 13 after the pixel setting operation is finished, the display operation can be restarted swiftly. The other option is to conduct the pixel setting operation in a non-display period Tus during the image display operation. In this case, a light emitting element is not emitting light and therefore the pixel setting operation can readily be conducted. Next, how long it takes to complete the pixel setting operation for all pixels is described. Two cases are given as examples. In one case, the pixel setting operation for all of pixels is completed in one frame period. In the other case, the pixel setting operation for one row of pixels is completed in one frame period. In this case, plural claim periods pass before the pixel setting operation is finally completed for all of the pixels. Case One will be described first in detail.

Figure 16:
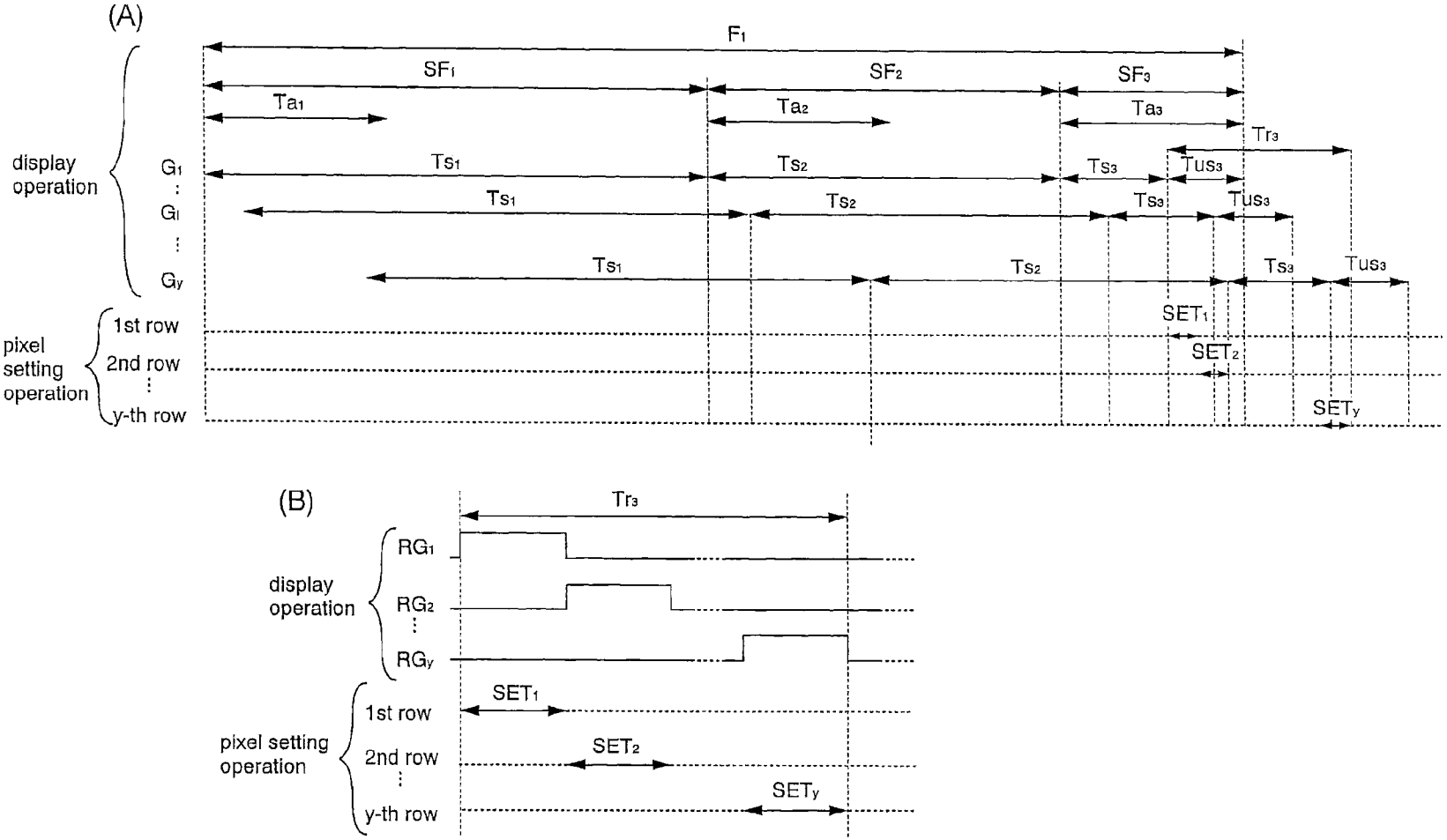
FIG. 16 are a diagram showing an image display operation in a display device of the present invention and a timing chart thereof.

The description is given with reference to timing charts of FIG. 16. Components operating in the same way as the timing charts of FIG. 7 are denoted by the same symbols. For simplification, one frame period is divided into three sub-frame periods $SF_1$ to $SF_3$ in the example used. In a driving method of the example, a display period $Ts_3$ shorter than an address period $Ta_3$ has to be set in the sub-frame period $SF_3$, and a reset period $Tr_3$ and a non-display period $Tus_3$ are provided. The pixel setting operation is conducted in the non-display period $Tus_3$.

In FIG. 16(A), the first sub-frame period $SF_1$ and the second sub-frame period $SF_2$ do not have a non-display period Tus and therefore the pixel setting operation is not conducted in these sub-frame periods. On the other hand, the pixel setting operation for the first row is conducted at the same time the reset period $Tr_3$ of the third sub-frame period $SF_3$ is started. A period in which the pixel setting operation for the k-th row is conducted is referred to as SETk. As SET1 is ended, SET2 is started to conduct the pixel setting operation for the second row. When SET1 to SETy are ended, the pixel setting operation is finished for all pixels. The operations of SET1 to SETy are thus carried out in the reset period $Tr_3$. Similar operation is repeated in the subsequent frame periods.

However, there is no need to conduct the pixel setting operation for every frame period. It is determined in accordance with the holding ability of current supply capacitors of pixels.

FIG. 16(B) is a timing chart showing in detail the operation in the reset period of the third sub-frame period $SF_3$ in FIG. 16(A). As the image display operation in FIG. 16(B) shows, SET1 to SETy can be carried out in sync with scanning of the erasing signal lines RG1 to RGy in the reset period $Tr_3$. When SET1 to SETy are carried out in sync with scanning of the erasing signal lines $RG_1$ to $RG_y$, the frequencies of the signal lines $GN_1$ to $GN_y$, signal lines $GH_1$ to $GH_y$, and signal lines $GS_1$ to $GS_y$ shown in FIG. 14 can be made equal to the frequency of the signal of the erasing signal lines $RG_1$ to $RG_y$. This makes it possible to share all or some of driving circuits for inputting signals to these signal lines (the erasing signal lines $RG_1$ to $RG_y$, the signal lines $GN_1$ to $GN_y$, the signal lines $GH_1$ to $GH_y$, and the signal lines $GS_1$ to $GS_y$).

If SET1 to SETy are carried out in sync with scanning of the erasing signal lines $RG_1$ to $RG_y$ as shown in FIG. 16(B), the frequency of a sampling pulse outputted from the pulse output circuit 711 can be made equal to the frequency of the signal line driving circuit that inputs signals to the video signal input lines $S_1$ to $S_x$ of pixels. This makes it possible for the signal line driving circuit and the reference current output circuit 405 to share some of their parts.

Figure 40:
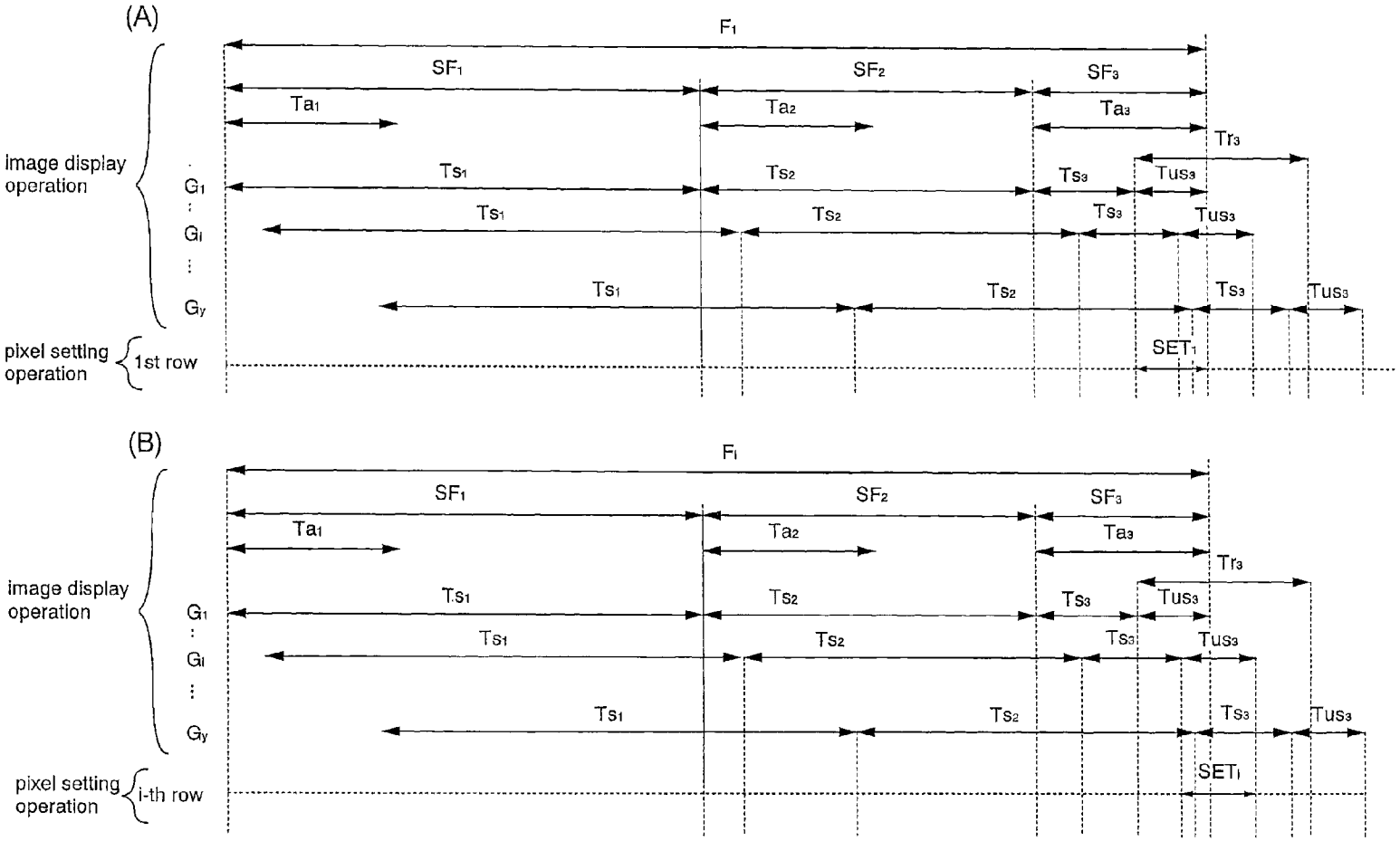
FIG. 40 are a diagram showing an image display operation in a display device of the present invention and a timing chart thereof.

Next, the case of conducting the pixel setting operation for one row of pixels in one frame period is described. The description is given with reference to FIG. 40. Components operating in the same way as the timing charts of FIG. 7 are denoted by the same symbols. FIG. 40(A) is a timing chart showing the operation of the first frame period F1. FIG. 40(B) is a timing chart showing the operation of the i-th frame period Fi.

In FIG. 40(A), the first sub-frame period $SF_1$ and the second sub-frame period $SF_2$ do not have a non-display period Tus and therefore the pixel setting operation is not conducted in these sub-frame periods. On the other hand, SET1 is started and the pixel setting operation for the first row is conducted at the same time the reset period $Tr_3$ of the third sub-frame period $SF_3$ is started. The operation of SET1 is conducted in a non-display period $Tus_1$ of the pixels on the first row using the entire length of $Tus_1$. Then the second frame period F2 is started and the pixel setting operation for the second row is conducted. Similar operation is conducted in periods that follow F2.

For example, the operation for performing the pixel setting operation on pixels on the i-th row is described referring to FIG. 40(B). The pixel setting operation for the i-th row is carried out in the i-th frame period Fi. As in other frame periods, the first sub-frame period $SF_1$ and the second sub-frame period $SF_2$ in the i-th frame period Fi do not have a non-display period Tus and therefore the pixel setting operation is not conducted in these sub-frame periods. On the other hand, SETi is started and the pixel setting operation for the i-th row is conducted at the same time the reset period $Tr_3$ of the third sub-frame period $SF_3$ is started and a non-display period $Tus_i$ of the pixels on the i-th row is started. The operation of SETi is conducted in the non-display period $Tus_i$ of the pixels on the i-th row using the entire length of $Tus_i$. When the first frame period F1 to the y-th frame period Fy are ended, the pixel setting operation is finished for all pixels. Similar operation is repeated in the subsequent frame periods. However, there is no need to conduct the pixel setting operation for every frame period. It is determined in accordance with the holding ability of current supply capacitors of pixels.

The case where the pixel setting operation for one row is conducted in one frame period as this has a merit in that the pixel setting operation is achieved accurately. In other words, a sufficient setting operation is achieved because the pixel setting operation is conducted over a long period of time. This makes an accurate setting operation possible even when the reference current is in a low level. Usually, an accurate setting operation is difficult to achieve when the reference current is in a low level because it prolongs the time required to charge cross capacitance of wirings and the like. However, a lengthened period for the setting operation makes an accurate setting operation possible. In the case where the setting operation has to be conducted for all rows of pixels in one frame period, the pixel setting period per row is short and therefore accurate setting is difficult. If a current supply circuit of a pixel is of the current mirror method as in Embodiment Mode 1, the reference current can be increased in level and therefore a short pixel setting period does not hinder accurate setting. On the other hand, in the case where a current supply circuit of a pixel is of the identic-transistor method as in this embodiment mode, the reference current cannot be increased in level and therefore accurate setting is difficult. Accordingly, lengthening the setting period is effective. The pixel setting operation and the image display operation thus can be conducted in sync with each other by the driving methods shown in FIGS. 16 and 40.

The driving methods shown in FIGS. 16 and 40 are for the case where a non-display period is provided only in one sub-frame period of one frame period. However, the display device driving method according to the present invention is not limited thereto. The present invention can also be applied to a driving method in which a non-display period is provided in each of plural sub-frame periods of one frame period. In this driving method, the pixel setting operation may be conducted in every non-display period Tus in plural sub-frame periods of one frame period. Alternatively, the pixel setting operation in this driving method may be conducted in only some non-display periods Tus in plural sub-frame periods of one frame period.

Once the setting operation is completed for all pixels, when to repeat the pixel setting operation can be determined arbitrarily in accordance with the electric charge holding ability of current supply capacitors of current supply circuits in pixels. This means that no setting operation may be conducted for over several frame periods.

Now, a brief description is given on how the setting operation is performed on a pixel on a certain row. Focus on a pixel on the first row as an example. First, signals inputted to the signal line $GN_1$ and the signal line $GH_1$ make conductive the current input transistor 203 and current holding transistor 204 of a pixel on the first row which are shown in FIG. 14. The current stopping transistor 205 in the pixel on the first row is made nonconductive by a signal of the signal line $GS_1$. If the current stopping transistor 205 is not provided, the driving transistor 302 is made nonconductive by turning the erasing transistor 304 conductive or other methods.

Then the reference current flows in the current line CL. The reference current thus flows in the current supply transistor 112. Here, the gate electrode of the current supply transistor 112 of the pixel on the first row is connected to its drain terminal through the current holding transistor 204 that has been made conductive. Therefore, the current supply transistor 112 operates with the gate-source voltage (gate voltage) equalized with the source-drain voltage, namely, it operates in the saturation region and a drain current flows. The drain current flowing in the current supply transistor 112 of the pixel on the first row is set to the reference current flowing in the current line CL. In this way, the gate voltage of when the reference current flows in the current supply transistor 112 is held in the current supply capacitor 111. During this, the current stopping transistor 205 is in a nonconductive state. Accordingly leakage of reference current does not take place.

Next, the signal of the signal line $GH_1$ is changed to make the current holding transistor 204 nonconductive. This causes the current supply capacitor 111 of the pixel on the first row to hold electric charges. Thereafter the signal of the signal line $GN_1$ is changed to make the current input transistor 203 nonconductive. In this way, the connection between the current line $CL_1$ and the current supply transistor 112 of the pixel on the first row is cut while the gate voltage is held. After that, the signal of the signal line $GS_1$ is changed and the current stopping transistor 205 may be made conductive or nonconductive. It is sufficient if the current stopping transistor 205 is conductive during a lighting period.

The setting operation is performed on each pixel on the first row in this way. Accordingly, from now on, a current in the same level as the reference current starts to flow between the source and drain of the current supply transistor 112 when a voltage is applied between the terminal A and terminal B of the current supply circuit 102 in each pixel.

Embodiment Mode 3

This embodiment mode describes a multi-gate method current supply circuit. The description here is mainly about a difference between this embodiment mode and Embodiment Modes 1 and 2, and explanations for things that are common will be omitted.

Figure 57:
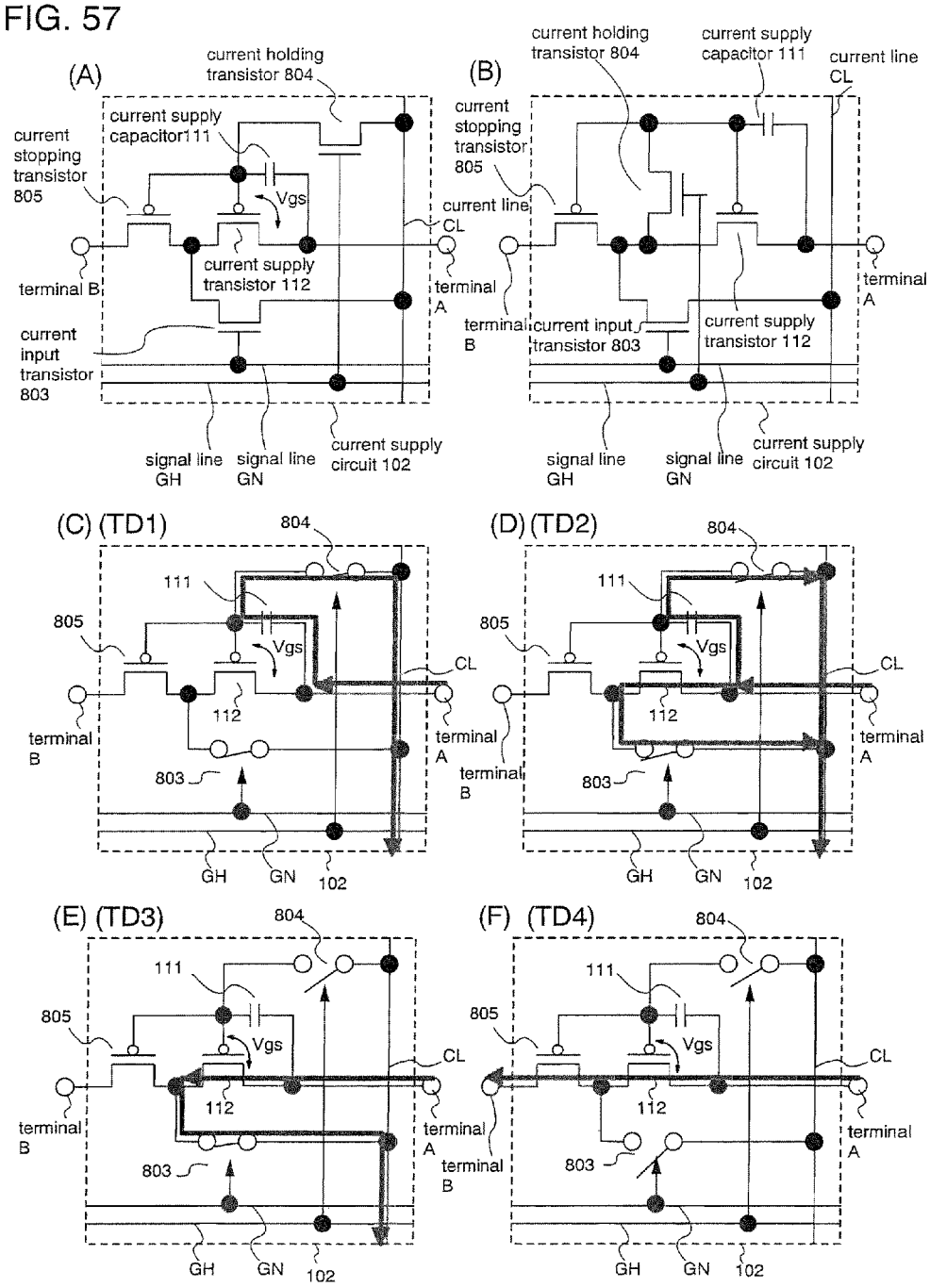
FIG. 57 are diagrams showing the structure of a current supply circuit in a display device of the present invention.

The structure of a current supply circuit using a multi-gate method 1 is described with reference to FIG. 57. Components identical with those in FIG. 3 are denoted by the same symbols. The current supply circuit of multi-gate method 1 has a current supply transistor 112 and a current stopping transistor 805. The circuit also has a current input transistor 803 and current holding transistor 804 that function as switches. The current supply transistor 112 can either be a p-channel transistor or an n-channel transistor and the same applies to the current stopping transistor 805, the current input transistor 803, and the current holding transistor 804. However, the current supply transistor 112 and the current stopping transistor 805 have to have the same polarity. In the example shown here, the current supply transistor 112 and the current stopping transistor 805 are p-channel transistors. Also, the current supply transistor 112 and the current stopping transistor 805 desirably have the same current characteristic. The circuit also has a current supply capacitor 111 for holding the gate electric potential of the current supply transistor 112. The circuit also has a signal line GN for inputting a signal to a gate electrode of the current input transistor 803 and a signal line GH for inputting a signal to a gate electrode of the current holding transistor 804. Furthermore, the circuit has a current line CL to which a control signal is inputted. The current supply capacitor 111 may be omitted by utilizing gate capacitance of the transistors or the like.

A source terminal of the current supply transistor 112 is connected to a terminal A. The gate electrode of the current supply transistor 112 is connected to its source terminal through the current supply capacitor 111. The gate electrode of the current supply transistor 112 is connected to a gate electrode of the current stopping transistor 805, and is connected through the current holding transistor 804 to the current line CL. A drain terminal of the current supply transistor 112 is connected to a source terminal of the current stopping transistor 805, and is connected through the current input transistor 803 to the current line CL. A drain terminal of the current stopping transistor 805 is connected to a terminal B.

The current holding transistor 804 may be repositioned in FIG. 57(A) to obtain a circuit structure that is shown in FIG. 57(B). In FIG. 57(B), the current holding transistor 804 is connected between the gate electrode and drain terminal of the current supply transistor 112.

Next, a method of setting the above current supply circuit of multi-gate method 1 will be described. The setting operation in FIG. 57(A) is identical with the setting operation in FIG. 57(B). Here, the circuit shown in FIG. 57(A) is taken as an example and the setting operation thereof is described. The description will be given with reference to FIGS. 57(C) to 57(F). In the current supply circuit of multi-gate method 1, the setting operation is conducted moving through the states of FIGS. 57(C) to 57(F) in order. For simplification, the current input transistor 803 and the current holding transistor 804 are treated as switches in the description. In the example shown, a control signal for setting the current supply circuit is a control current.

In a period TD1 shown in FIG. 57(C), the current input transistor 803 and the current holding transistor 804 are made conductive. At this point, the current stopping transistor 805 is in a nonconductive state. This is because the electric potential of a source terminal of the current stopping transistor 805 is kept equal to the electric potential of its gate electrode by the current input transistor 803 and current holding transistor 804 that are made conductive. This means that the current stopping transistor 805 can automatically be made nonconductive in the period TD1 if a transistor that becomes nonconductive when the source-gate voltage is zero is used as the current stopping transistor 805. In this way, a current flows from the path shown in the drawing and electric charges are held in the current supply capacitor 111.

In a period TD2 shown in FIG. 57(D), the electric charges held raise the gate-source voltage of the current supply transistor 112 up to or above the threshold voltage. This causes the drain current to flow in the current supply transistor 112.

In a period TD3 shown in FIG. 57(E), after enough time passes to reach a stable state, the drain current of the current supply transistor 112 is set to the control current. In this way, a gate voltage of when the control current is set as the drain current is held in the current supply capacitor 111. Thereafter, the current holding transistor 804 is made nonconductive. This causes distribution of the electric charges held in the current supply capacitor 111 to a gate electrode of the current stopping transistor 805. The current stopping transistor 805 is thus automatically made conductive at the same time the current holding transistor 804 is made nonconductive.

In a period TD4 shown in FIG. 57(F), the current input transistor 803 is made nonconductive. This stops input of the control current to the pixel. Preferably, the current holding transistor 804 is made nonconductive before or at the same time the current input transistor 803 is made nonconductive. This is to prevent electric charges held in the current supply capacitor 111 from being discharged. After the period TD4, if a voltage is applied between the terminal A and the terminal B, a constant current is outputted through the current supply transistor 112 and the current stopping transistor 805. In other words, the current supply transistor 112 and the current stopping transistor 805 function like one multi-gate type transistor when the current supply circuit 102 outputs a control current. Therefore, the value of the constant current outputted can be set small with respect to the control current inputted, namely, reference current. The reference current can accordingly be increased and therefore the setting operation of the current supply circuit can be finished more quickly. For that reason, the current stopping transistor 805 and the current supply transistor 112 have to have the same polarity. Also, the current stopping transistor 805 and the current supply transistor 112 desirably have the same current characteristic. This is because the output current is fluctuated if the characteristic of the current stopping transistor 805 does not match the characteristic of the current supply transistor 112 in each of the current supply circuits 102 of the multi-gate method 1.

In the current supply circuit of the multi-gate method 1, the current from the current supply circuit 102 is outputted using not only the current stopping transistor 805 but also a transistor to which a control current is inputted to convert it into a corresponding gate voltage (the current supply transistor 112). On the other hand, in the current mirror method current supply circuit shown in Embodiment Mode 1, a transistor to which a control current is inputted to convert it into a corresponding gate voltage (the current transistor) is an utterly separate transistor from a transistor that converts the gate voltage into a drain current (the current supply transistor 112). Therefore, it is possible that fluctuation in current characteristic between transistors affects an output current of the current supply circuit 102 less in the current supply circuit of multi-gate method 1 than in the current mirror method current supply circuit.

Each signal line of the current supply circuit of multi-gate method 1 can be shared. For example, no operational problem arises if the current input transistor 803 and the current holding transistor 804 are switched between a conductive state and a nonconductive state at the same time and therefore the current input transistor 803 and the current holding transistor 804 are given the same polarity so that one of the signal line GH and the signal line GN can double as the other.

Figure 63:
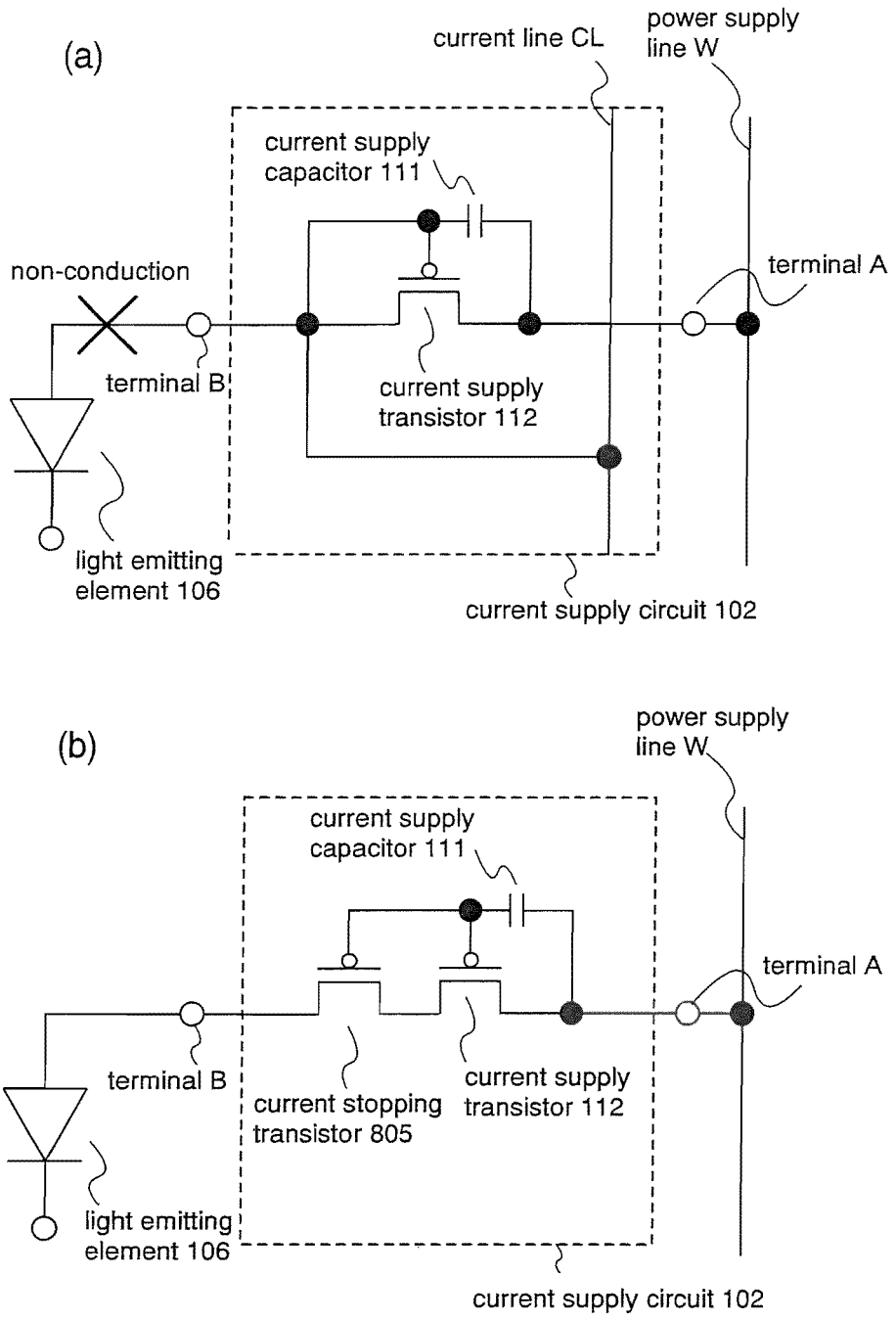
FIG. 63 are schematic diagrams showing states of a pixel in a display device of the present invention.
Figure 68:
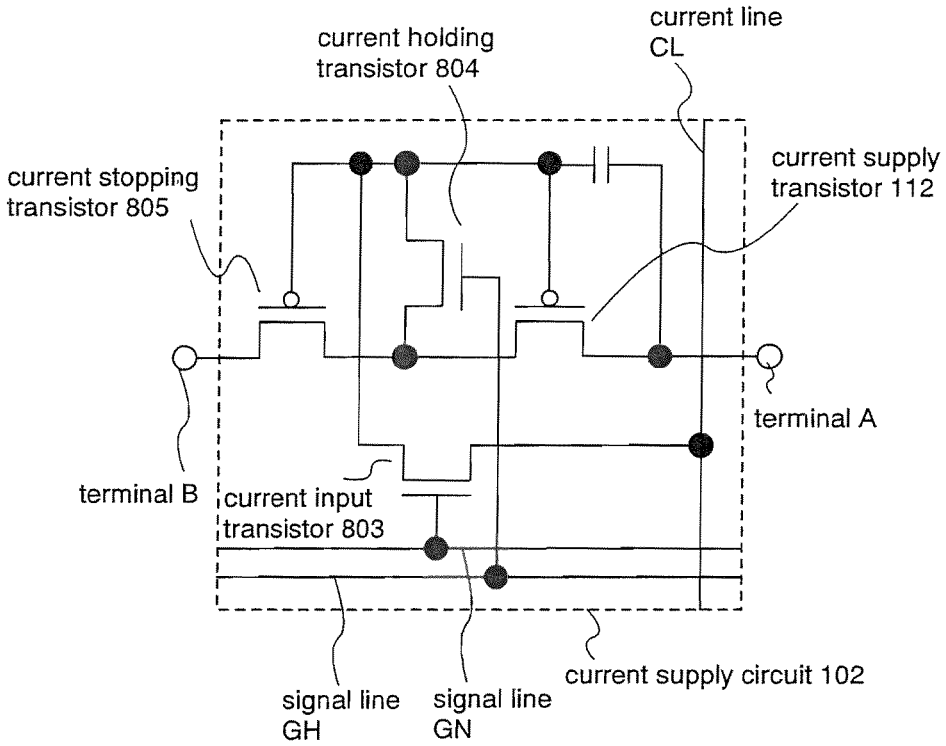
FIG. 68 is a circuit diagram of a current supply circuit of a pixel in a display device of the present invention.

In the multi-gate method 1, it is sufficient if the current supply circuit is as shown in FIG. 63(*a*) during the pixel setting operation and as shown in FIG. 63(*b*) during light emission. In other words, it is sufficient if wirings and switches are connected as such. For example, they may be connected as shown in FIG. 68.

Figure 74:
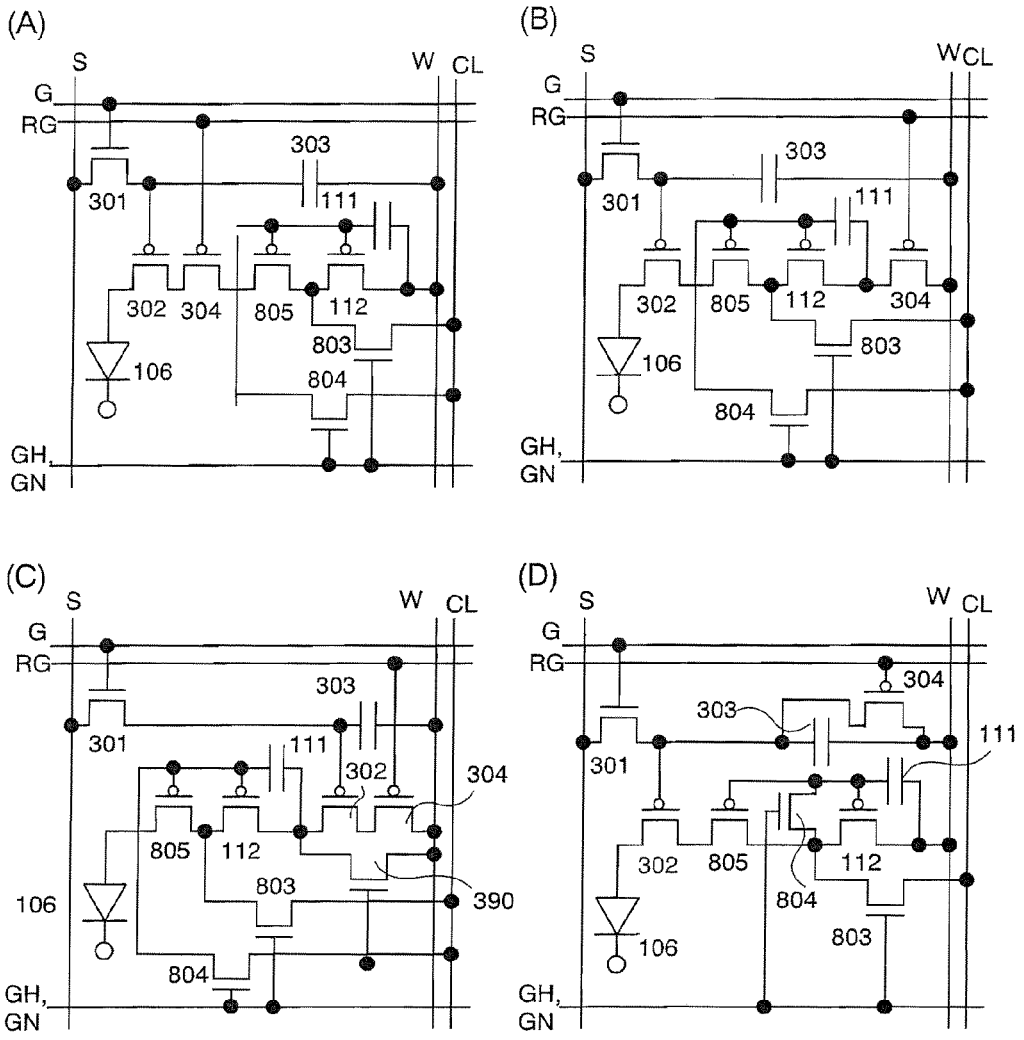
FIG. 74 are circuit diagrams each showing the structure of a pixel in a display device of the present invention.

FIG. 74 show specific examples of sharing wirings in a pixel that has a switch portion and current supply circuit structured as above. In FIGS. 74(A) to 74(D), one of the signal line GN and the signal line GH doubles as the other and one of the wiring $W_{CO}$ and the power supply line W doubles as the other. In FIG. 74(A), in particular, one of the source terminal and drain terminal of the current holding transistor 804 that is not connected to one of the electrodes of the current supply capacitor 111 is connected directly to the current line CL. Also, the erasing transistor 304 is connected to the current supply transistor 112 and the driving transistor 302 in series. In FIG. 74(B), the erasing transistor 304 is connected at a position where a connection between the source terminal of the current transistor 112 and the power supply line W is chosen. In FIG. 74(C), the power supply line W is connected to the light emitting element 106 through the switch portion 101 and the current supply circuit 102 in order. In this structure, an additional transistor 390 is provided. The additional transistor 390 connects the power supply line W with the source terminal of the current supply transistor 112, so that the pixel setting operation can be conducted when the switch portion is OFF, in other words, when the driving transistor 302 is in a nonconductive state. In FIG. 74(D), the current holding transistor 804 is connected between the gate and drain of the current supply transistor 112. The erasing transistor 304 is connected in parallel to the storage capacitor 303. During the pixel setting operation, a current does not flow into the driving transistor 302 whatever state the driving transistor 302 is in. This is because the gate-source voltage of the current stopping transistor 805 becomes zero and the current stopping transistor 805 automatically moves into an OFF state.

In the current mirror method current supply circuit shown in Embodiment Mode 1, a signal inputted to a light emitting element is a current obtained by increasing or reducing a control current inputted to the pixel at a given power. This makes it possible to set the control current large to a certain degree and finish the setting operation of the current supply circuit of each pixel quickly. However, it has a problem of fluctuation in image display caused by fluctuation in current characteristic among transistors that constitute the current mirror circuit of the current supply circuit. On the other hand, in a current supply circuit of identic-transistor method, a signal inputted to a light emitting element equals to the current value of the control current inputted to the pixel. In the identic-transistor method current supply circuit, a transistor to which the control current is inputted is at the same time a transistor that outputs a current to the light emitting element. Therefore uneven display due to fluctuation in current characteristic among transistors is reduced.

In contrast to this, in a multi-gate method current supply circuit, a signal inputted to a light emitting element is a current obtained by increasing or reducing a control current inputted to the pixel at a given power. This makes it possible to set the control current large to a certain degree and finish the setting operation of the current supply circuit of each pixel quickly. Furthermore, a transistor to which the control current is inputted and a transistor that outputs a current to the light emitting element share some of their parts. Therefore uneven display due to fluctuation in current characteristic among transistors is reduced compared to a current mirror method current supply circuit.

Described next is the relation between the setting operation and the operation of a switch portion in a multi-gate method current supply circuit. In a multi-gate method current supply circuit, a constant current cannot be outputted while a control current is inputted. Therefore it is necessary to conduct the operation of the switch portion and the setting operation of the current supply circuit in sync with each other. For example, the setting operation of the current supply circuit may be conducted only when the switch portion is OFF. In other words, this is almost identical with the identic-transistor method. Accordingly, the image display operation (driving operation of the switch portion) and the setting operation of the current supply circuit (pixel setting operation) are also nearly identical with those in the identic-transistor method. Explanations are therefore omitted.

Embodiment 1

This embodiment gives an example of a pixel structure which has a current mirror method current supply circuit and which uses the current supply circuit with a structure different from the structures of the current supply circuits shown in FIG. 4 in Embodiment Mode 1.

Figure 17:
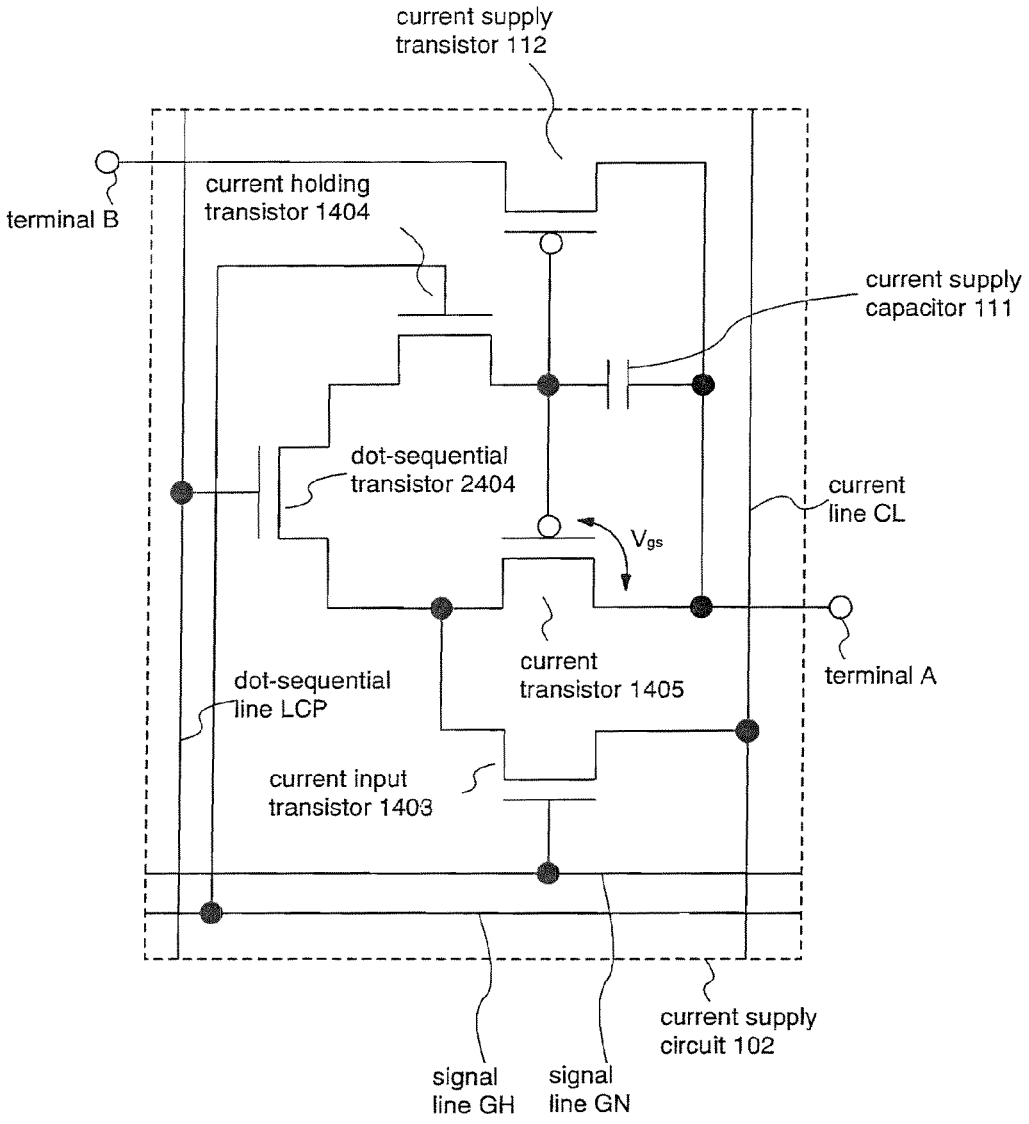
FIG. 17 is a circuit diagram of a current supply circuit in a display device of the present invention.

FIG. 17 shows a structural example of a current supply circuit placed in each pixel. In FIG. 17, components identical with those in FIG. 4 are denoted by the same symbols and explanations thereof are omitted. The current supply circuit 102 in FIG. 17 has, in addition to the current supply capacitor 111, the current supply transistor 112, the current transistor 1405, the current input transistor 1403, the current holding transistor 1404, the current line CL, the signal line GN, and the signal line GH, a dot-sequential transistor 2404 and a dot-sequential line CLP. FIG. 17 is different from FIG. 4 in that the dot-sequential transistor 2404 is added. The dot-sequential transistor 2404 is an n-channel transistor but may be a p-channel transistor since it simply operates as a switch.

A gate electrode of the current supply transistor 112 is connected to a gate electrode of the current transistor 1405 and to one of electrodes of the current supply capacitor 111. The other electrode of the current supply capacitor 111 is connected to a source terminal of the current supply transistor 112, a source terminal of the current transistor 1405, and to a terminal A of the current supply circuit 102. The gate electrode of the current transistor 1405 is connected to its drain terminal through source-drain terminals of the current holding transistor 1404 and source-drain terminals of the dot-sequential transistor 2404 in order. A gate electrode of the current holding transistor 1404 is connected to the signal line GH. A gate electrode of the dot-sequential transistor 2404 is connected to the dot-sequential line CLP. The drain terminal of the current transistor 1405 is connected to the current line CL through source-drain terminals of the current input transistor 1403. A gate electrode of the current input transistor 1403 is connected to the signal line GN. A drain terminal of the current supply transistor 112 is connected to a terminal B.

In the above structure, the current input transistor 1403 may be placed between the current transistor 1405 and the terminal A. Then the source terminal of the current transistor 1405 is connected to the terminal A through the source-drain terminals of the current input transistor 1403, and the drain terminal of the current transistor 1405 is connected to the current line CL. In either case, it is sufficient if the current supply circuit is as shown in FIG. 61(*a*) during the pixel setting operation and as shown in FIG. 61(*b*) during light emission.

In the above structure, the gate electrodes of the current transistor 1405 and current supply transistor 112 may be connected to the current line CL without passing through the path between the source and drain terminals of the current input transistor 1403. Then, of the source terminal and drain terminal of the dot-sequential transistor 2404, one that is not connected to the source terminal or drain terminal of the current holding transistor 1404 is directly connected to the current line CL. This is not the only way and it is sufficient if the current holding transistor 1404 and the dot-sequential 2404 are connected in a manner that makes the electric potential of the gate electrode of the current transistor 1405 equal to the electric potential of the current line CL when both of 1404 and 2404 are made conductive.

The current holding transistor 1404 and the dot-sequential transistor 2404 may switch their positions. That is, the gate electrode of the current transistor 1405 may be connected to its drain terminal through the source-drain terminals of the current holding transistor 1404 and the source-drain terminals of the dot-sequential transistor 2404 in this order, or the gate electrode of the current transistor 1405 may be connected to its drain terminal through the source-drain terminals of the dot-sequential transistor 2404 and the source-drain terminals of the current holding transistor 1404 in this order.

Figure 18:
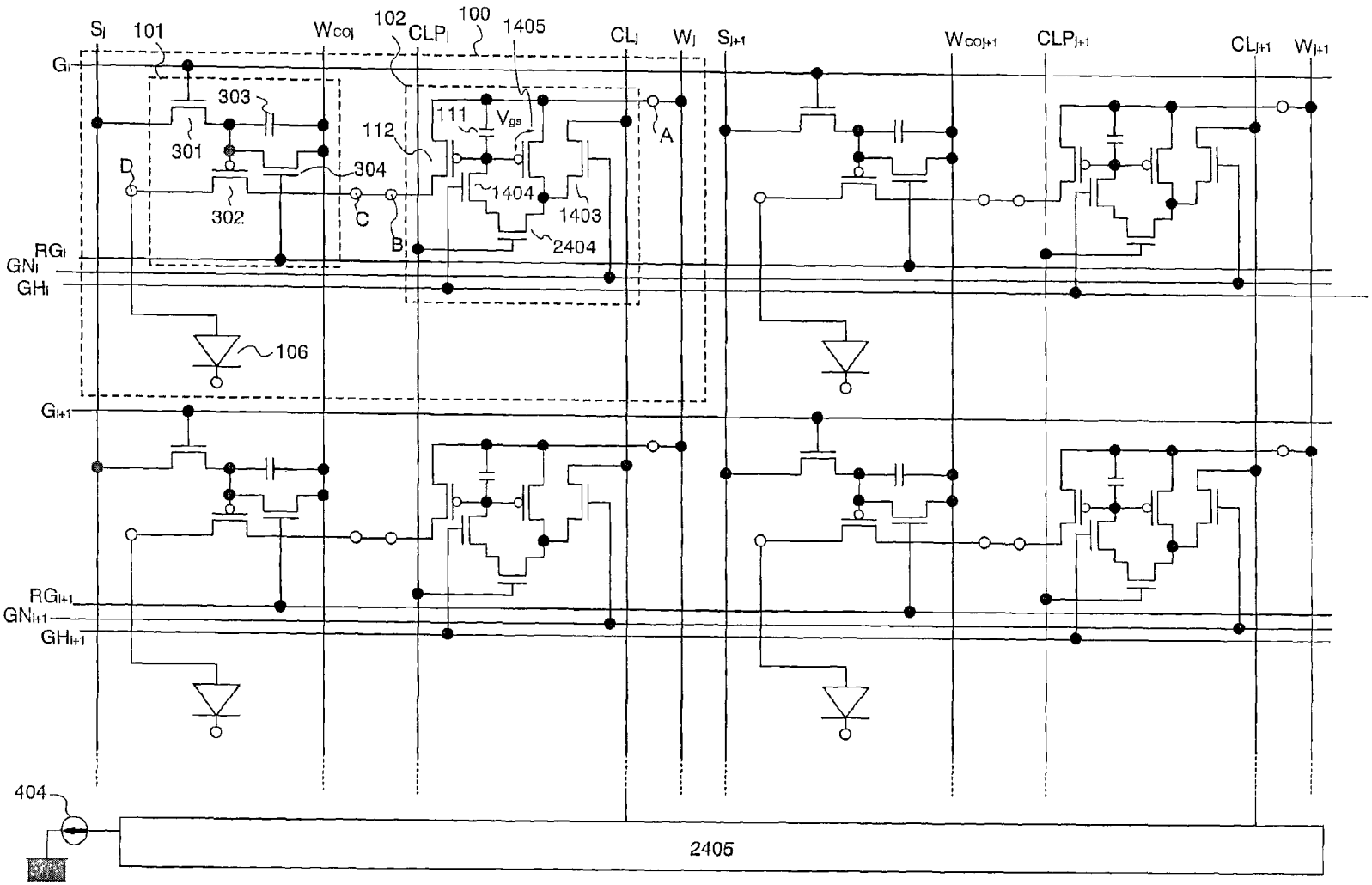
FIG. 18 is a circuit diagram of a pixel portion in a display device of the present invention.

In FIG. 17, the dot-sequential transistor 2404 is added to FIG. 4 and the dot-sequential transistor 2404 is connected to the current holding transistor 1404 in series. With this structure, the current supply capacitor 111 holds electric charges unless the current holding transistor 1404 and the dot-sequential transistor 2404 are both made conductive. By adding the dot-sequential transistor 2404 in this way, the pixel setting operation can be conducted in a dot-sequential fashion instead of the linear-sequential fashion of FIG. 4. FIG. 18 is a circuit diagram of a part of a pixel region in which x columns x y rows of pixels are arranged to form a matrix pattern. Each of the pixels is denoted by 100 and has a current supply circuit 102 structured as shown in FIG. 17 and a switch portion 101 structured as shown in FIG. 13.

In FIG. 18, only four pixels on the i-th (i is a natural number) row and j-th (j is a natural number) column, the (i+1)-th row and j-th column, the i-th row and (j+1)-th column, and the (i+1)-th row and (j+1)-th column are shown as a representative. Components identical with those in FIGS. 17 and 13 are denoted by the same symbols and explanations thereof are omitted. Scanning lines G, erasing signal lines, signal lines GN, and signal lines GH associated with the i-th and (i+1)-th pixel rows are denoted by $G_i$ and $G_{i+1}$, $RG_i$ and $RG_{i+1}$, $GN_i$ and $GN_{i+1}$, and $GH_i$ and $GH_{i+1}$, respectively. Video signal input lines S, power supply lines W, current lines CL, wirings $W_{CO}$, and dot-sequential lines CLP associated with the j-th and (j+1)-th pixel columns are denoted by $S_j$ and $S_{j+1}$, $W_j$ and $W_{j+1}$, $CL_j$ and $CL_{j+1}$, $W_{COj}$ and $W_{COj+1}$, and $CLP_j$ and $CLP_{j+1}$, respectively. A reference current is inputted to the current lines $CL_j$ and $CL_{j+1}$ from the outside of the pixel region.

The pixel electrode of the light emitting element 106 is connected to the terminal D and its opposite electrode is given an opposite electric potential. In the structure shown in FIG. 18, the pixel electrode of the light emitting element serves as an anode and the opposite electrode serves as a cathode. In other words, the terminal A of the current supply circuit is connected to the power supply line and the terminal B is connected to the terminal C of the switch portion 101 in the structure. However, the structure of this embodiment can readily be applied to a display device structured to use the pixel electrode of the light emitting element 106 as a cathode and its opposite electrode as an anode.

A current supply (hereinafter referred to as reference current supply circuit) for setting the reference current flowing in the current lines $CL_j$ and $CL_{j+1}$ is provided outside of the pixel region and is schematically shown by 404. An output current from one reference current supply circuit 404 can be used to make the reference current flow in the current lines CL. Fluctuation in current flowing in the current lines is thus reduced and the current flowing in every current line can be set to the reference current with precision.

Figure 20:
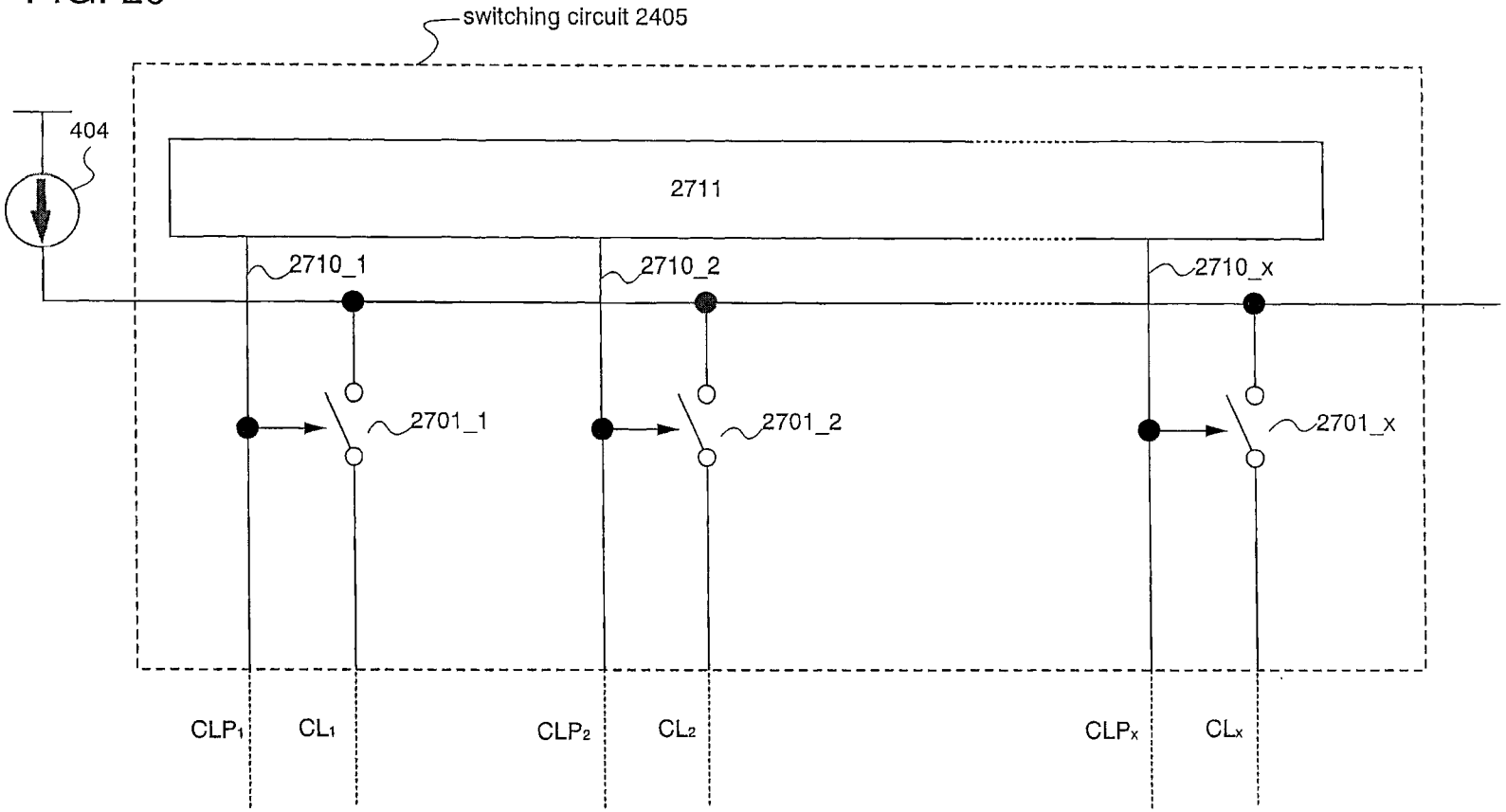
FIG. 20 is a diagram showing the structure of a switching circuit of a reference current supply circuit in a display device of the present invention.

A circuit for inputting to the current lines $CL_1$ to $CL_x$ the reference current determined by the reference current supply circuit 404 is called a switching circuit and is denoted by 2405 in FIG. 18. A structural example of the switching circuit 2405 is shown in FIG. 20. The switching circuit 2405 has a pulse output circuit 2711, sampling pulse lines 2710_1 to 2710_*x*, and switches 2701_1 to 2701_*x*.

Pulses outputted from the pulse output circuit 2711 (sampling pulses) are inputted to the sampling pulse lines 2710_1 to 2710_*x*. Signals inputted to the sampling pulse lines 2710_1 to 2710_*x* turn the switches 2701_1 to 2701_*x* ON in order. Through the switches 2701_1 to 2701_*x* that are turned ON, the reference current supply circuit 404 is connected to the current lines $CL_1$ to $CL_x$. At the same time, the sampling pulses are inputted to the dot-sequential lines $CLP_1$ to $CLP_x$. For example, a sampling pulse inputted to the j-th sampling pulse line 2710_*j* connects the current line $CL_j$ with the reference current supply circuit 404 and the sampling pulse is outputted to the dot-sequential line $CLP_j$ at the same time.

Here, in the pixel where the dot-sequential transistor 2404 is connected to the dot-sequential line $CLP_j$, signals inputted to the signal lines GN and GH of a certain row turn conductive the current input transistor 1403 and current holding transistor 1404 that are connected to those signal lines GN and GH when the dot-sequential transistor 2404 is conductive. Then a signal can be inputted to the current supply capacitor 111 only in a pixel where the current transistor 1404 and the dot-sequential transistor 2404 are both conductive. This makes it possible to conduct the pixel setting operation in a dot-sequential fashion.

Figure 19:
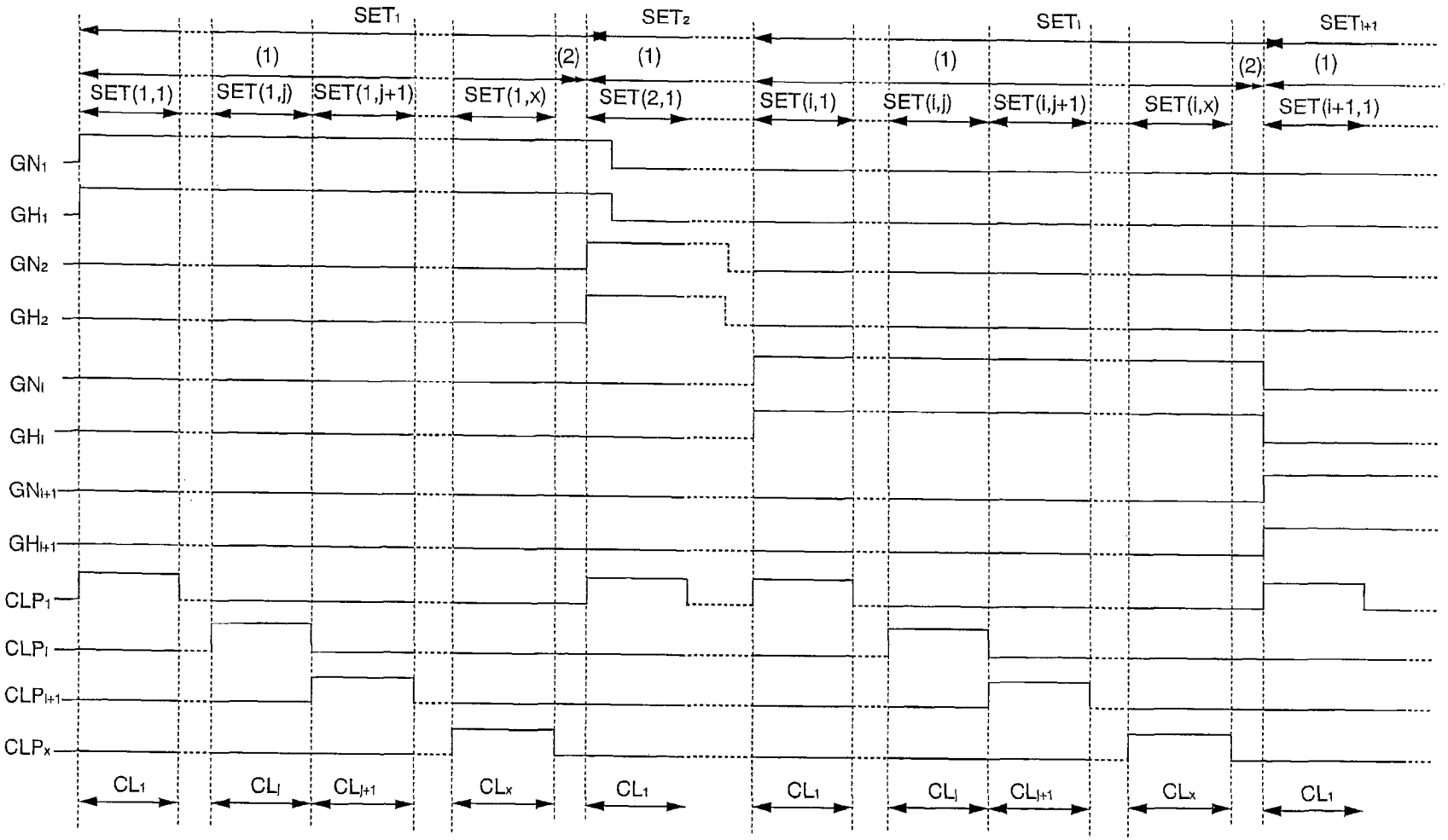
FIG. 19 is a timing chart of a pixel setting operation in a display device of the present invention.

FIG. 19 is a timing chart showing the setting operation (pixel setting operation) of the current supply circuit 102 placed in each pixel of FIG. 18. In FIG. 19, a period for the setting operation of pixels on the i-th row is referred to as SETi. In SETi, the setting operation is performed on pixels from the first through the x-th columns on the i-th row. The setting operation for the pixels from the first through the x-th columns on the i-th row is described by dividing it into the operation for a period (1) of SETi in FIG. 19 and the operation for a period (2).

In the period (1) of SETi, signals inputted to the signal line $GN_i$ and the signal line $GH_i$ turn conductive the current input transistor 1403 and current holding transistor 1404 in a pixel on the i-th row which are shown in FIG. 18. Thereafter, the CLPs and switches 2701 of the respective columns are selected in order one column at a time. As an example, the setting operation of the pixel on the i-th row and the j-th column is described. In the period (1) of SETi, a period in which the setting operation is performed on the pixel on the i-th row and the j-th column is denoted by SET(i, j). In SET(i, j), the current line $CL_j$ is connected to the reference current supply circuit 404 by the switching circuit 2405. The reference current thus flows in the current line $CL_j$. At the same time, a signal inputted from the switching circuit 2405 to the dot-sequential line $CLP_j$ turns the dot-sequential transistor 2404 conductive. In the timing chart of FIG. 19, the period denoted by $CL_j$ represents a period in which the current line $CL_j$ and the reference current output circuit 404 are connected to each other. In this way, the current holding transistor 1404, dot-sequential transistor 2404, and current input transistor 1403 of the pixel on the i-th row and the j-th column are made conductive in SET(i, j). Therefore, the current transistor 1405 of the pixel on the i-th row and the j-th column operates with the gate-source voltage (gate voltage) equalized with the source-drain voltage, namely, it operates in the saturation region and a drain current flows. After enough time passes to reach a stable state, signals are accumulated in the current supply capacitor 111 and the drain current flowing in the current transistor 1405 is set to the reference current that flows in the current line $CL_j$.

Thereafter, when SET(i, j) is ended, the dot-sequential transistor of the pixel on the i-th row and the j-th column is made nonconductive. The current supply capacitor 111 of the pixel on the i-th row and the j-th column thus holds a gate voltage of when the reference current flows in the current transistor 1405. The above operation is repeated one column at a time.

When SET(i, 1) to SET(i, x) are ended, electric charges according to the reference current that flows in the current lines CL are held in the current supply capacitor 111 of every pixel on the i-th row. Thereafter the period (2) is started. When the period (2) is ended, the signals of the signal lines $GN_i$ and $GH_i$ are changed to turn nonconductive the current input transistor 1403 and current holding transistor 1404 of the pixel on the i-th row. Note that, the current holding transistor 1404 and the dot-sequential transistor 2404 may switch their positions in a display device that has the pixel structure shown in FIG. 18. However, when the display device having the pixel structure of FIG. 18 is driven in accordance with the timing chart shown in FIG. 19, the dot-sequential transistor 2404 of each pixel is switched between a conductive state and a nonconductive state more often than the current holding transistor 1404. Therefore it is preferred that the current holding transistor 1404 that is switched between a conductive state and a nonconductive state less frequently be connected to the current supply capacitor 111 so as not to affect electric charges held in the current supply capacitor 111.

Embodiment 2

This embodiment gives an example of a pixel structure which has a identic-transistor method current supply circuit and which uses the current supply circuit with a structure different from the structures of the current supply circuits shown in FIG. 12 in Embodiment Mode 2.

Figure 21:
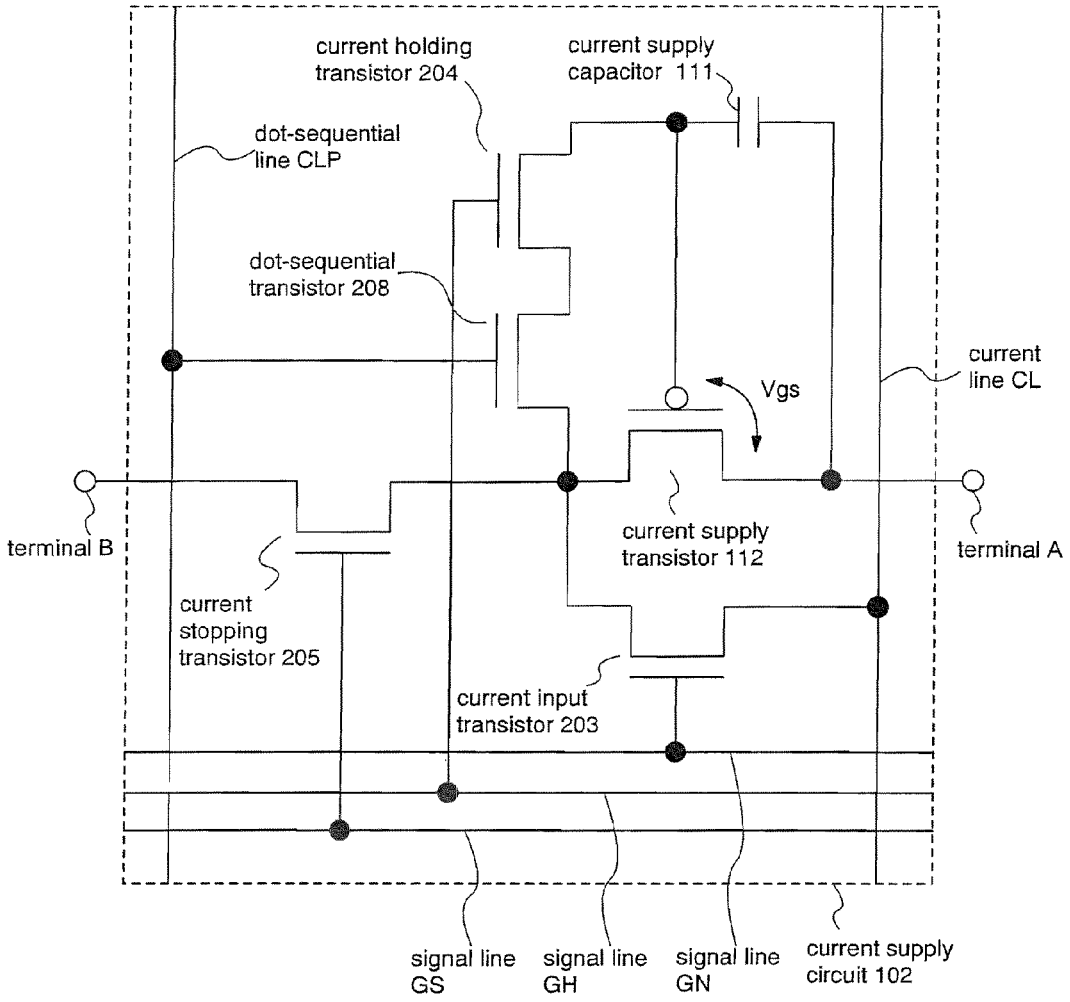
FIG. 21 is a circuit diagram of a current supply circuit in a display device of the present invention.

First, a structural example of a current supply circuit according to this embodiment is shown in FIG. 21. In FIG. 21, components identical with those in FIG. 12 are denoted by the same symbols. Similar to Embodiment 1, this embodiment is about the case where the pixel setting operation can be conducted in a dot-sequential fashion.

The current supply circuit 102 in FIG. 21 has, in addition to the current supply capacitor 111, the current supply transistor 112, the current input transistor 203, the current holding transistor 204, the current stopping transistor 205, the current line CL, the signal line GN, the signal line GH, and the signal line GS, a dot-sequential transistor 208 and a dot-sequential line CLP. FIG. 21 is different from FIG. 12 in that the dot-sequential transistor 208 is added. The dot-sequential transistor 208 is an n-channel transistor but may be a p-channel transistor since it simply operates as a switch.

A gate electrode of the current supply transistor 112 is connected to one of electrodes of the current supply capacitor 111. The other electrode of the current supply capacitor 111 is connected to a source terminal of the current supply transistor 112. The source terminal of the current supply transistor 112 is connected to a terminal A of the current supply circuit 102.

A gate electrode of the current supply transistor 112 is connected to its drain terminal through source-drain terminals of the current holding transistor 204 and source-drain terminals of the dot-sequential transistor 208 in order. A gate electrode of the current holding transistor 204 is connected to the signal line GH. A gate electrode of the dot-sequential transistor 208 is connected to the dot-sequential line CLP. The drain terminal of the current supply transistor 112 is connected to the current line CL through source-drain terminals of the current input transistor 203. A gate electrode of the current input transistor 203 is connected to the signal line GN. The drain terminal of the current supply transistor 112 is connected to a terminal B through source-drain terminals of the current stopping transistor 205. A gate electrode of the current stopping transistor 205 is connected to the signal line GS.

Further, in the above structure, the gate electrodes of the current supply transistor 112 may be connected to the current line CL without passing through the path between the source and drain terminals of the current input transistor 203. Then, of the source terminal and drain terminal of the dot-sequential transistor 208, one that is not connected to the source terminal or drain terminal of the current holding transistor 204 is directly connected to the current line CL. This is not the only way and it is sufficient if the current holding transistor 204 and the dot-sequential 208 are connected in a manner that makes the electric potential of the gate electrode of the current supply transistor 112 equal to the electric potential of the current line CL when both of 204 and 208 are made conductive.

Here, the current holding transistor 204 and the dot-sequential transistor 208 may switch their positions. Then the gate electrode of the current supply transistor 112 may be connected to its drain terminal through the source-drain terminals of the current holding transistor 204 and the source-drain terminals of the dot-sequential transistor 208 in this order, or the gate electrode and the drain terminal of the current supply transistor 112 may be connected to its drain terminal through the source-drain terminals of the dot-sequential transistor 208 and the source-drain terminals of the current holding transistor 204 in this order.

In FIG. 21, the dot-sequential transistor 208 is added to FIG. 12 and the dot-sequential transistor 208 is connected to the current holding transistor 204 in series. This makes sure that the current supply capacitor 111 holds electric charges unless the current holding transistor 204 and the dot-sequential transistor 208 are both made conductive. By adding the dot-sequential transistor 208 in this way, the pixel setting operation can be conducted in a dot-sequential fashion instead of the linear-sequential fashion of FIG. 12.

Figure 22:
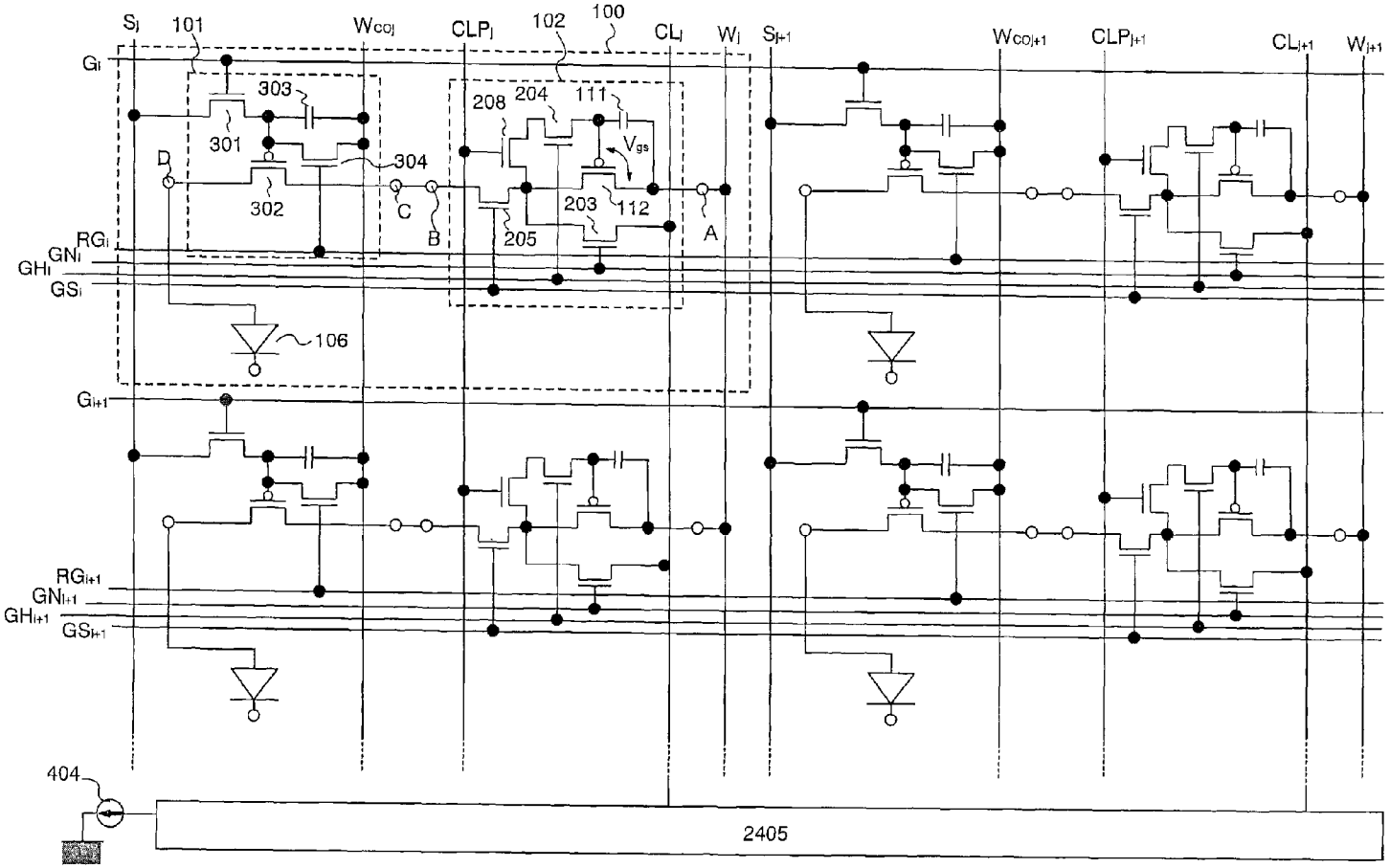
FIG. 22 is a circuit diagram of a pixel portion in a display device of the present invention.

FIG. 22 is a circuit diagram of a part of a pixel region in which x columns x y rows of pixels are arranged to form a matrix pattern. Each of the pixels is denoted by 100 and has a current supply circuit 102 structured as shown in FIG. 21 and a switch portion 101 structured as shown in FIG. 13. In FIG. 22, only four pixels on the i-th row and j-th column, the (i+1)-th row and j-th column, the i-th row and (j+1)-th column, and the (i+1)-th row and (j+1)-th column are shown as a representative. Components identical with those in FIGS. 21 and 13 are denoted by the same symbols and explanations thereof are omitted.

Scanning lines G, erasing signal lines RG, signal lines GN, signal lines GH, and signal lines GS associated with the i-th and (i+1)-th pixel rows are denoted by $G_i$ and $G_{i+1}$, $RG_i$ and $RG_{i+1}$, $GN_i$ and $GN_{i+1}$, $GH_i$ and $GH_{i+1}$, and $GS_i$ and $GS_{i+1}$, respectively. Video signal input lines S, power supply lines W, current lines CL, wirings $W_{CO}$, and dot-sequential lines CLP associated with the j-th and (j+1)-th pixel columns are denoted by $S_j$ and $S_{j+1}$, $W_j$ and $W_{j+1}$, $CL_j$ and $CL_{j+1}$, $W_{COj}$ and $W_{COj+1}$, and $CLP_j$ and $CLP_{j+1}$, respectively. A reference current is inputted to the current lines $CL_j$ and $CL_{j+1}$ from the outside of the pixel region.

The pixel electrode of the light emitting element 106 is connected to the terminal D and its opposite electrode is given an opposite electric potential. In the structure shown in FIG. 22, the pixel electrode of the light emitting element serves as an anode and the opposite electrode serves as a cathode. In other words, the terminal A of the current supply circuit is connected to the power supply line W and the terminal B is connected to the terminal C of the switch portion 101 in the structure. However, the structure of this embodiment can readily be applied to a display device structured to use the pixel electrode of the light emitting element 106 as a cathode and its opposite electrode as an anode.

A current supply (hereinafter referred to as reference current supply circuit) for setting the reference current flowing in the current lines $CL_j$ and $CL_{j+1}$ is provided outside of the pixel region and is schematically shown by 404. An output current from one reference current supply circuit 404 can be used to make the reference current flow in the current lines CL. Fluctuation in current flowing in the current lines is thus reduced and the current flowing in every current line can be set to the reference current with precision. A circuit for inputting to the current lines $CL_1$ to $CL_x$ the reference current determined by the reference current supply circuit 404 is called a switching circuit and is denoted by 2405 in FIG. 22. A structural example of the switching circuit 2405 may be the same as that shown in FIG. 20 in Embodiment 1. Explanations with regard to the structure and setting operation of the switching circuit 2405 are omitted.

The current holding transistor 204 and the dot-sequential transistor 208 may switch their positions in the display device having the pixel structure of FIG. 22. However, the dot-sequential transistor 208 of each pixel is switched between a conductive state and a nonconductive state more often than the current holding transistor 204. Then it is preferred that the current holding transistor 204 that is switched between a conductive state and a nonconductive state less frequently be connected to the current supply capacitor 111 so as not to affect electric charges held in the current supply capacitor 111. Note that, although this embodiment shows a structural example of an identic-transistor method current supply circuit, application to a multi-gate method current supply circuit is also possible. In this case, a dot-sequential transistor is positioned serially with respect to the current holding transistor 804 in FIGS. 57(A) and 57(B).

Embodiment 3

This embodiment shows an example of sharing a line between the current line CL and the signal line S in the pixel structure that is shown in FIG. 14 in accordance with Embodiment Mode 2.

Figure 51:
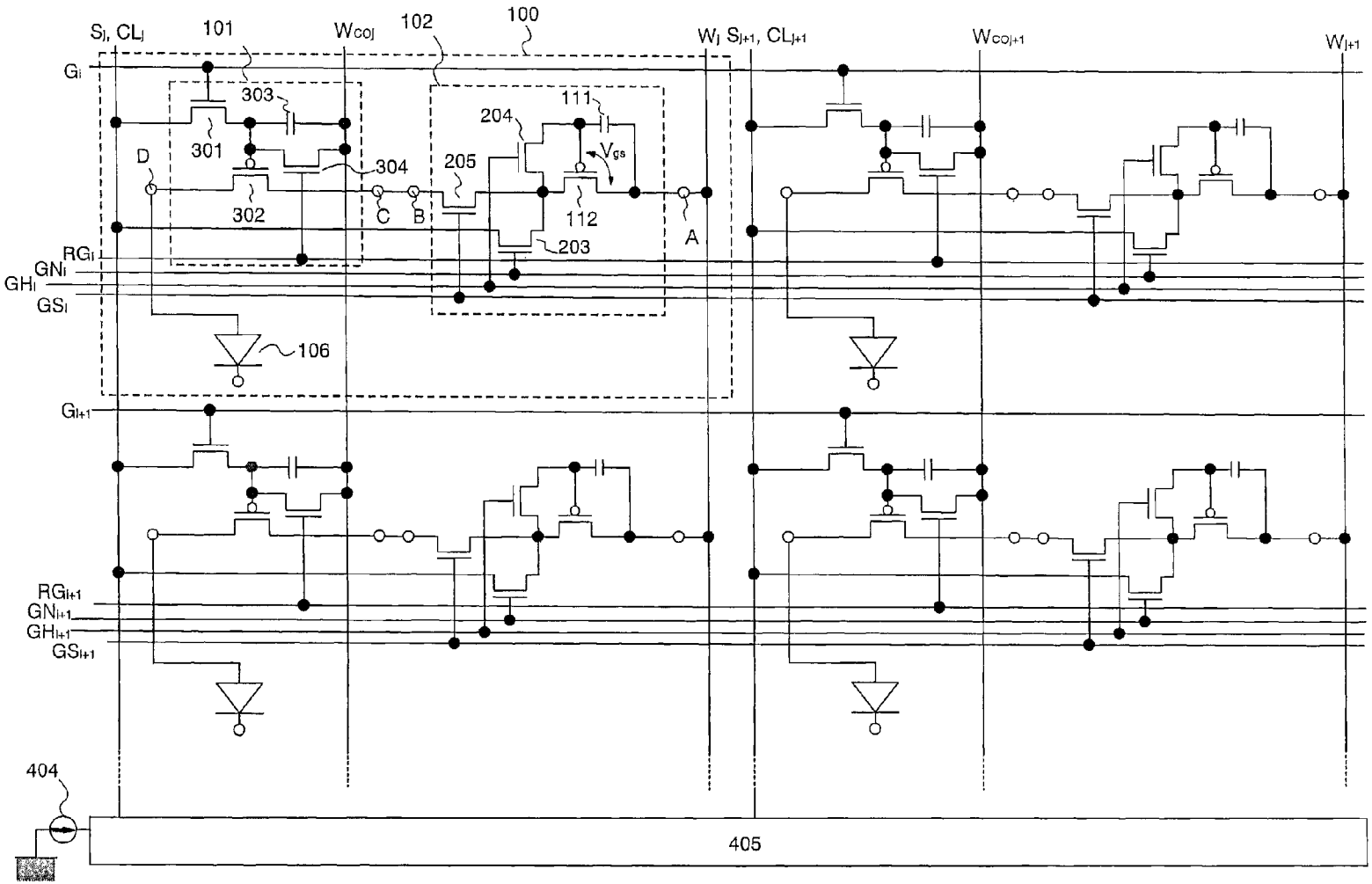
FIG. 51 is a diagram showing the structure of a pixel portion in a display device of the present invention.

FIG. 51 is a circuit diagram showing a structure in which one of the current line CL and the signal line S doubles as the other in each pixel of FIG. 14. In FIG. 51, components identical with those in FIG. 14 are denoted by the same symbols and explanations thereof are omitted. Unlike FIG. 14, the current input transistor 203 in FIG. 51 is connected between a signal line/current line (denoted by $S_j$, $CL_j$ in the drawing) and the drain terminal of the current supply transistor 112. The signal line/current line ($S_j$, $CL_j$) receives signals inputted from the reference current output circuit 405 and the signal line driving circuit (not shown in the drawing). Connection between the signal line/current line ($S_j$, $CL_j$) and the reference current output circuit 405 is switched to connection between the signal line/current line ($S_j$, $CL_j$) and the signal line driving circuit, and vice versa.

The driving method (image display operation and pixel setting operation) of a display device that has the pixel structure of FIG. 51 is basically the same as the methods shown in Embodiment Mode 2 referring to the timing charts of FIGS. 7, 16, and 40.

However, in the pixel structure shown in FIG. 51, one of the signal line S and the current line CL doubles as the other in each pixel and this makes it impossible to perform the pixel setting operation on any row while a video signal is inputted, namely, during an address period Ta. Therefore the display device of this embodiment uses a driving method in which a non-display period Tus is provided also in a sub-frame period SF that has a display period Ts longer than an address period Ta. Then the pixel setting operation is conducted in a non-display period Tus that does not overlap an address period Ta.

In the display device shown in this embodiment and having the structure of FIG. 51, a signal line and a current line are integrated into one in each pixel. In this way, the number of wirings of a pixel can be reduced and the aperture ratio of the display device can be raised compared to the display device shown in Embodiment Mode 2 and having the structure of FIG. 14. Integration of the signal line S and the current line CL is applicable to other embodiments and embodiment modes.

Embodiment 4

This embodiment gives an example of a pixel structure which has a current mirror method current supply circuit and which uses for the current supply circuit a structure different from the structures of the current supply circuits shown in Embodiment Mode 1 and Embodiment 1. Therefore the description is mainly about the difference from FIG. 4. Explanations of similar components are omitted.

Figure 38:
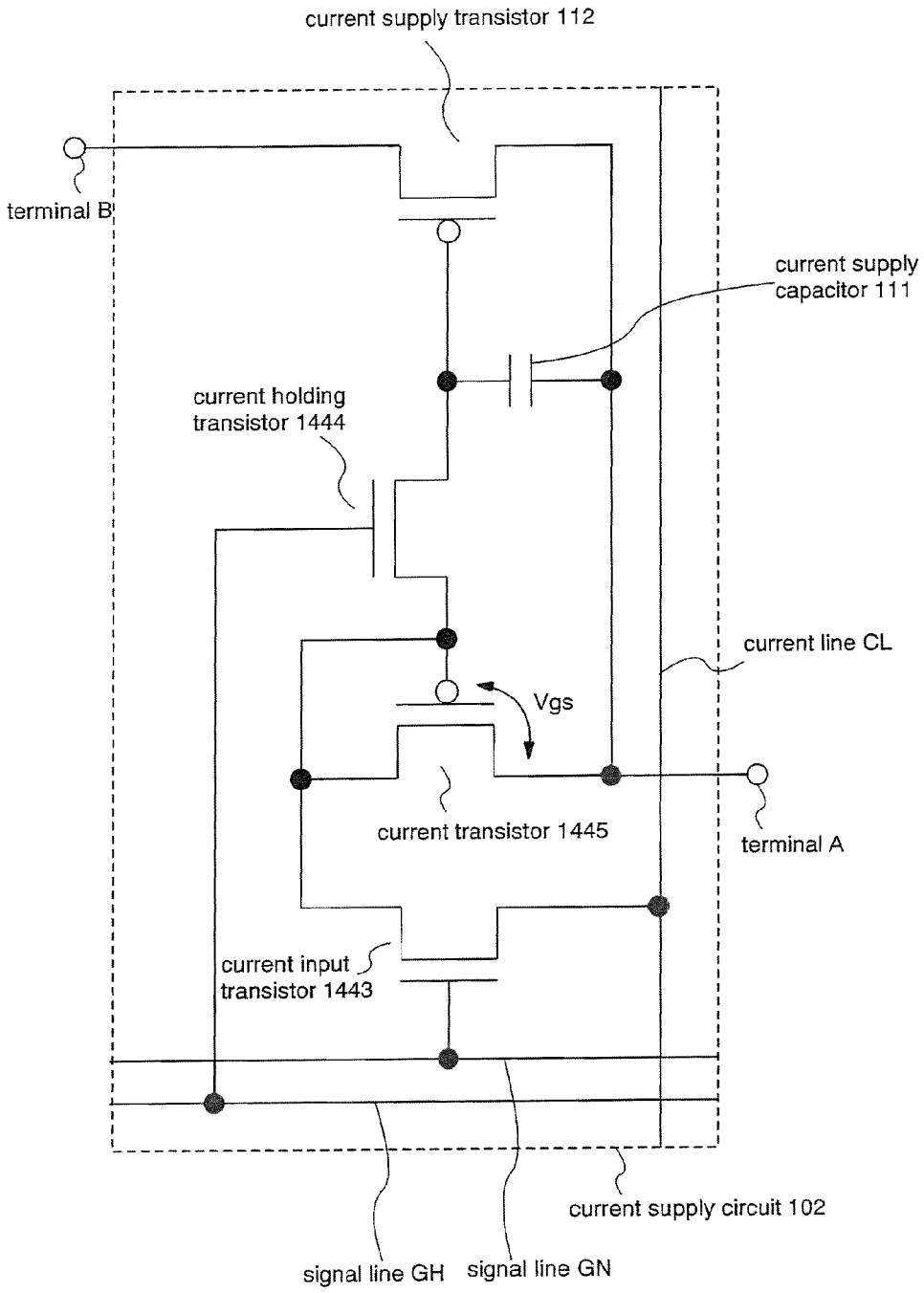
FIG. 38 is a diagram showing the structure of a current supply circuit in a display device of the present invention.

FIG. 38 shows a structural example of a current supply circuit placed in each pixel. In FIG. 38, components identical with those in FIG. 3 are denoted by the same symbols. A current supply circuit 102 in FIG. 38 is composed of a current supply capacitor 111, a current supply transistor 112, a current transistor 1445, a current input transistor 1443, a current holding transistor 1444, a current line CL, a signal line GN, and a signal line GH.

A gate electrode of the current supply transistor 112 is connected to a gate electrode of the current transistor 1445 through source-drain terminals of the current holding transistor 1444. The gate electrode of the current supply transistor 112 is connected to one of electrodes of the current supply capacitor 111. The other electrode of the current supply capacitor 111 is connected to a source terminal of the current supply transistor 112, a source terminal of the current transistor 1445, and a terminal A of the current supply circuit 102. The gate electrode of the current transistor 1445 is connected to its drain terminal. A gate electrode of the current holding transistor 1444 is connected to the signal line GH. The drain terminal of the current transistor 1445 is connected to the current line CL through source-drain terminals of the current input transistor 1443. A gate electrode of the current input transistor 1443 is connected to the signal line GN. A drain terminal of the current supply transistor 112 is connected to a terminal B.

In the above structure, the current input transistor 1443 may be placed between the current transistor 1445 and the terminal A. That is, the source terminal of the current transistor 1445 is connected to the terminal A through the source-drain terminals of the current input transistor 1443, and the drain terminal of the current transistor 1445 may be connected to the current line CL.

Figure 70:
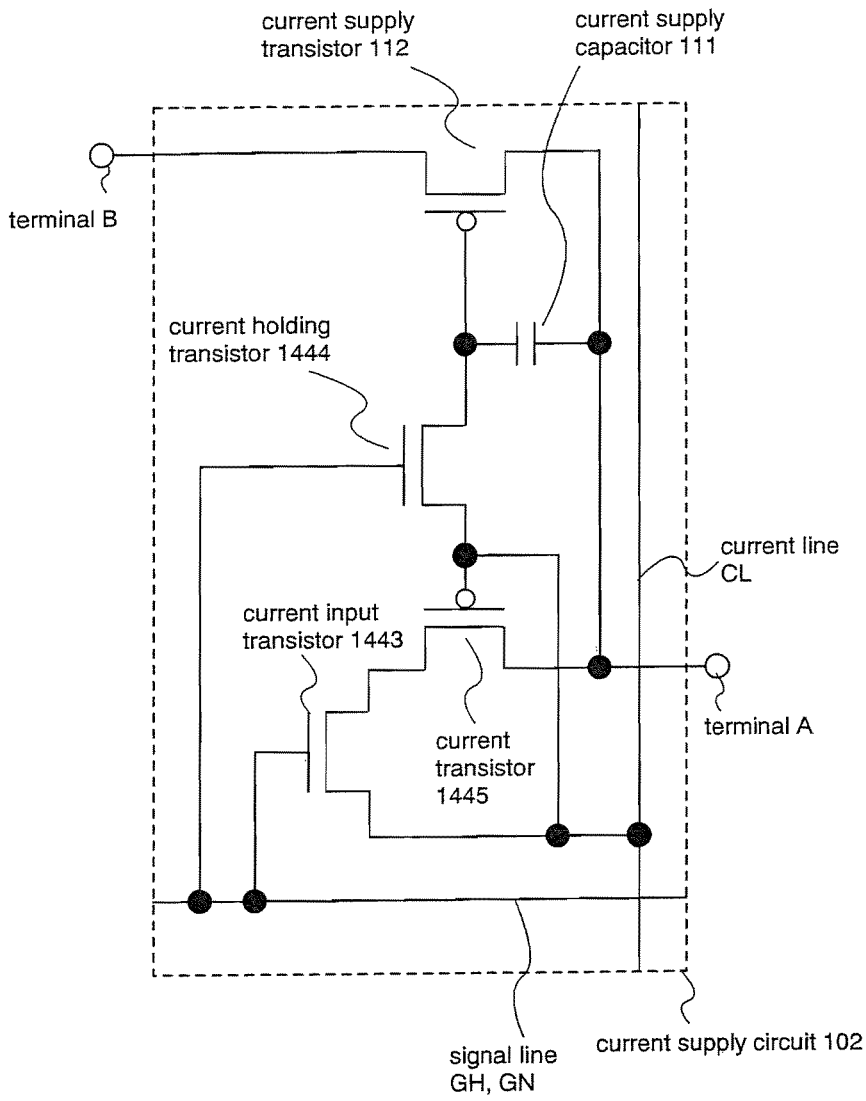
FIG. 70 is a circuit diagram of a current supply circuit of a pixel in a display device of the present invention.

As described, FIG. 38 and FIG. 4 are identical with each other except that the gate of the current transistor 1445 is connected to its drain terminal in series in one and not in the other and that the gate of the current supply transistor 112 is connected directly to the gate of the current transistor 1445 in one and not in the other. That is, a portion corresponding to the current supply circuit is as shown in FIG. 61(*a*) during the pixel setting operation and as shown in FIG. 61(*b*) during light emission. In other words, wirings and switches may be connected as such. Therefore it may be as shown in FIG. 70.

Figure 39:
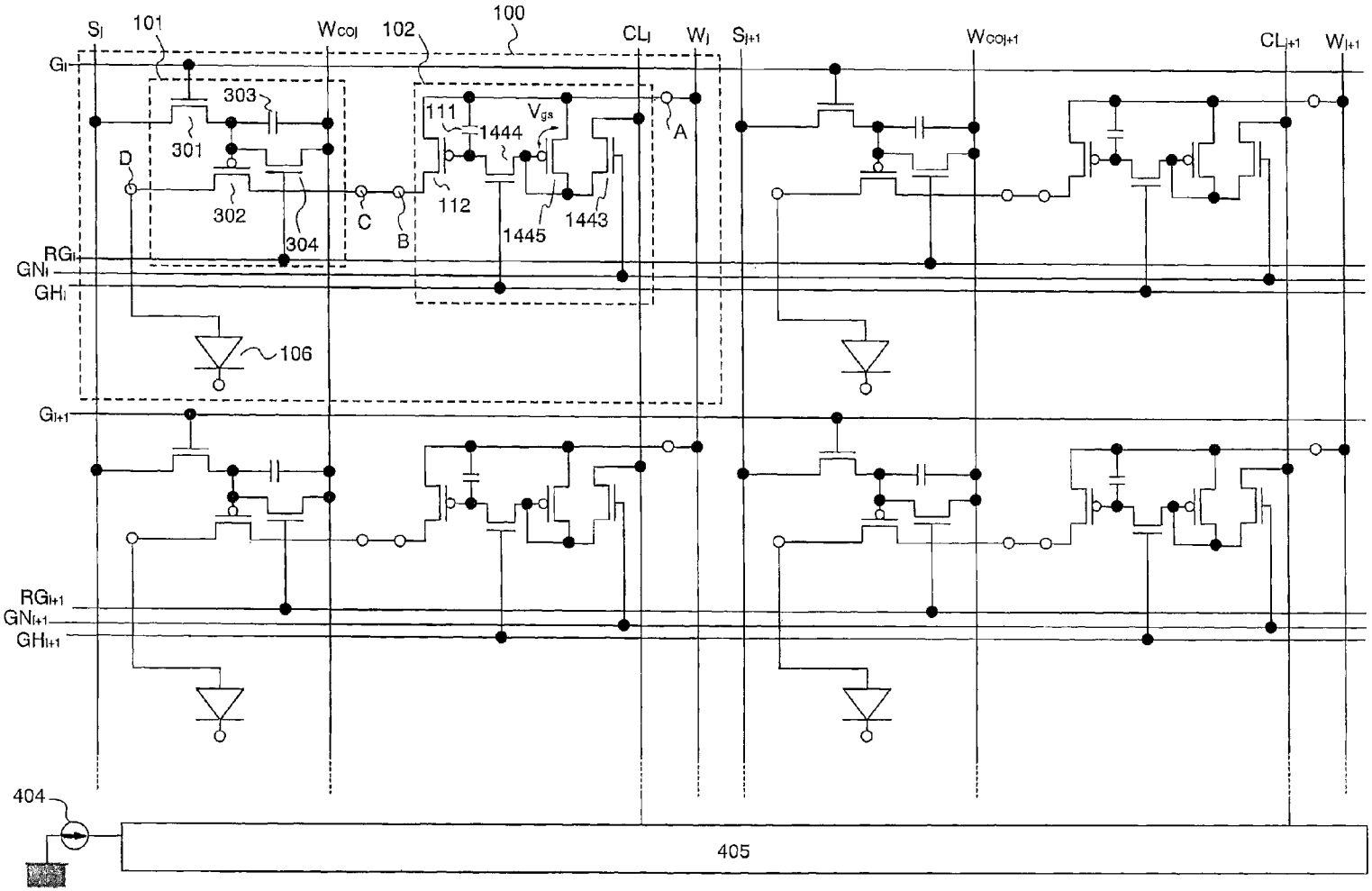
FIG. 39 is a diagram showing the structure of a pixel portion in a display device of the present invention.

FIG. 39 is a circuit diagram of a part of a pixel region in which x columns x y rows of pixels are arranged to form a matrix pattern. Each of the pixels is denoted by 100 and has a current supply circuit 102 structured as shown in FIG. 38 and a switch portion 101 structured as shown in FIG. 13. In FIG. 39, only four pixels on the i-th (i is a natural number) row and j-th (j is a natural number) column, the (i+1)-th row and j-th column, the i-th row and (j+1)-th column, and the (i+1)-th row and (j+1)-th column are shown as a representative. Components identical with those in FIGS. 39 and 13 are denoted by the same symbols and explanations thereof are omitted.

Scanning lines G, erasing signal lines, signal lines GN, and signal lines GH associated with the i-th and (i+1)-th pixel rows are denoted by $G_i$ and $G_{i+1}$, $RG_i$ and $RG_{i+1}$, $GN_i$ and $GN_{i+1}$, and $GH_i$ and $GH_{i+1}$, respectively. Video signal input lines S, power supply lines W, current lines CL, and wirings $W_{CO}$ associated with the j-th and (j+1)-th pixel columns are denoted by $S_j$ and $S_{j+1}$, $W_j$ and $W_{j+1}$, $CL_j$ and $CL_{j+1}$, and $W_{COj}$ and $W_{COj+1}$, respectively. A reference current is inputted to the current lines $CL_j$ and $CL_{j+1}$ from the outside of the pixel region. A pixel electrode of a light emitting element 106 is connected to a terminal D and its opposite electrode is given an opposite electric potential.

Embodiment 5

This embodiment gives an example of a pixel structure which has a current mirror method current supply circuit and which uses for the current supply circuit a structure different from the structures of the current supply circuits shown in Embodiment Mode 1 and Embodiments 1 and 4. This embodiment makes it possible to conduct the pixel setting operation in a dot-sequential fashion by adding a dot-sequential transistor to the circuit of Embodiment 4. Therefore explanations of components similar to those in Embodiments 1 and 4 are omitted.

Figure 44:
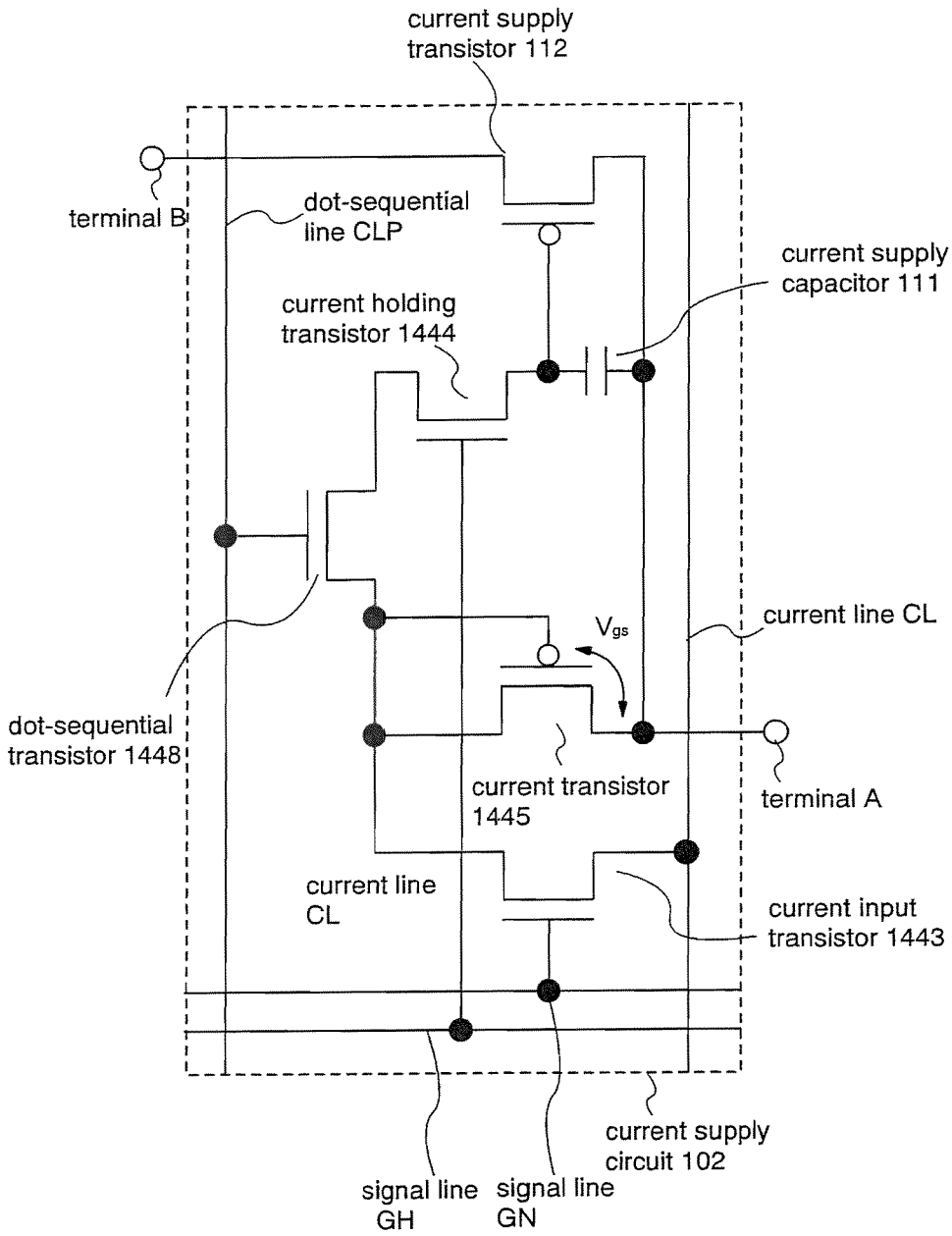
FIG. 44 is a diagram showing the structure of a current supply circuit in a display device of the present invention.

A structural example of the current supply circuit placed in each pixel is shown in FIG. 44. In FIG. 44, components identical with those in FIG. 38 are denoted by the same symbols and explanations thereof are omitted. The current supply circuit 102 in FIG. 44 has, in addition to the current supply capacitor 111, the current supply transistor 112, the current transistor 1445, the current input transistor 1443, the current holding transistor 1444, the current line CL, the signal line GN, and the signal line GH, a dot-sequential transistor 1448 and a dot-sequential line CLP. The dot-sequential transistor 1448 is an n-channel transistor but may be a p-channel transistor since it simply operates as a switch.

A gate electrode of the current supply transistor 112 is connected to a gate electrode of the current transistor 1445 through source-drain terminals of the current holding transistor 1444 and source-drain terminals of the dot-sequential transistor 1448 in order. A gate electrode of the current holding transistor 1444 is connected to the signal line GH. A gate electrode of the dot-sequential transistor 1448 is connected to the dot-sequential line CLP. The gate electrode of the current supply transistor 112 is connected to one of electrodes of the current supply capacitor 111. Then, the gate electrode of the current transistor 1445 is connected to its drain terminal. The other electrode of the current supply capacitor 111 is connected to a source terminal of the current supply transistor 112, a source terminal of the current transistor 1445, and a terminal A of the current supply circuit 102. A drain terminal of the current supply transistor 112 is connected to a terminal B. The drain terminal of the current transistor 1445 is connected to the current line CL through source-drain terminals of the current input transistor 1443. A gate electrode of the current input transistor 1443 is connected to the signal line GN.

The current holding transistor 1444 and the dot-sequential transistor 1448 may switch their positions. Then the gate electrode of the current transistor 1445 may be connected to the current supply capacitor 111 through the source-drain terminals of the current holding transistor 1444 and the source-drain terminals of the dot-sequential transistor 1448 in this order, or the gate electrode of the current transistor 1445 may be connected to the current supply capacitor 111 through the source-drain terminals of the dot-sequential transistor 1448 and the source-drain terminals of the current holding transistor 1444 in this order.

Figure 45:
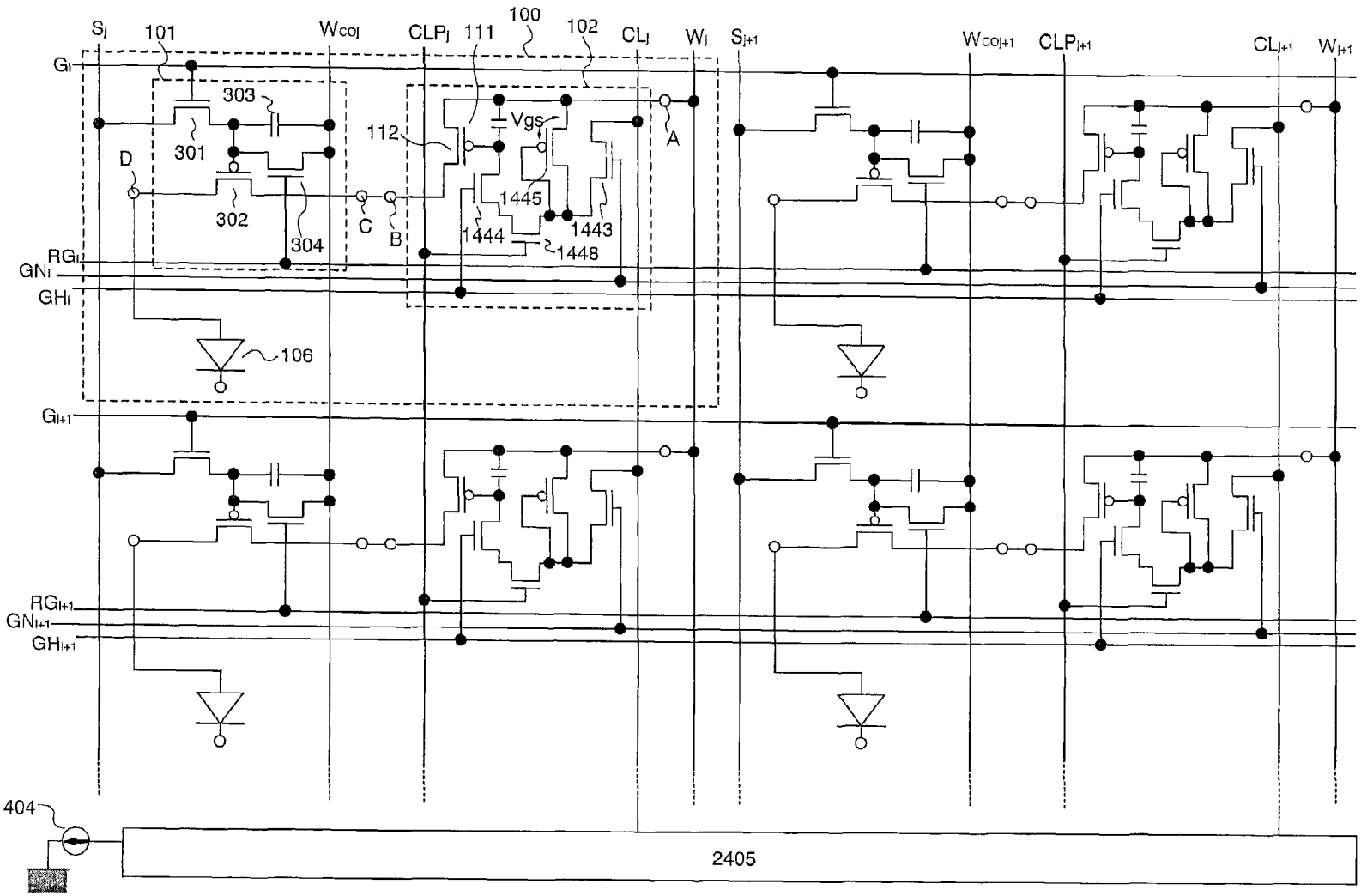
FIG. 45 is a diagram showing the structure of a pixel portion in a display device of the present invention.

FIG. 45 is a circuit diagram of a part of a pixel region in which x columns x y rows of pixels are arranged to form a matrix pattern. Each of the pixels is denoted by 100 and has a current supply circuit 102 structured as shown in FIG. 44 and a switch portion 101 structured as shown in FIG. 13. In FIG. 45, only four pixels on the i-th (i is a natural number) row and j-th (j is a natural number) column, the (i+1)-th row and j-th column, the i-th row and (j+1)-th column, and the (i+1)-th row and (j+1)-th column are shown as a representative. Components identical with those in FIGS. 44 and 13 are denoted by the same symbols and explanations thereof are omitted.

Scanning lines G, erasing signal lines RG, signal lines GN, and signal lines GH associated with the i-th and (i+1)-th pixel rows are denoted by $G_i$ and $G_{i+1}$, $RG_i$ and $RG_{i+1}$, $GN_i$ and $GN_{i+1}$, and $GH_i$ and $GH_{i+1}$, respectively. Video signal input lines S, power supply lines W, current lines CL, wirings $W_{CO}$, and dot-sequential lines CLP associated with the j-th and (j+1)-th pixel columns are denoted by $S_j$ and $S_{j+1}$, $W_j$ and $W_{j+1}$, $CL_j$ and $CL_{j+1}$, $W_{COj}$ and $W_{COj+1}$, and $CLP_j$ and $CLP_{j+1}$, respectively. A reference current is inputted to the current lines $CL_j$ and $CL_{j+1}$ from the outside of the pixel region. A pixel electrode of a light emitting element is connected to a terminal D and its opposite electrode is given an opposite electric potential.

Embodiment 6

This embodiment gives an example of a pixel structure which has an identic-transistor method current supply circuit and which uses the current supply circuit with a structure different from the structures of the current supply circuits shown in Embodiment Mode 2. Therefore the description is mainly about the difference from Embodiment Mode 2. Explanations of similar components are omitted.

Figure 41:
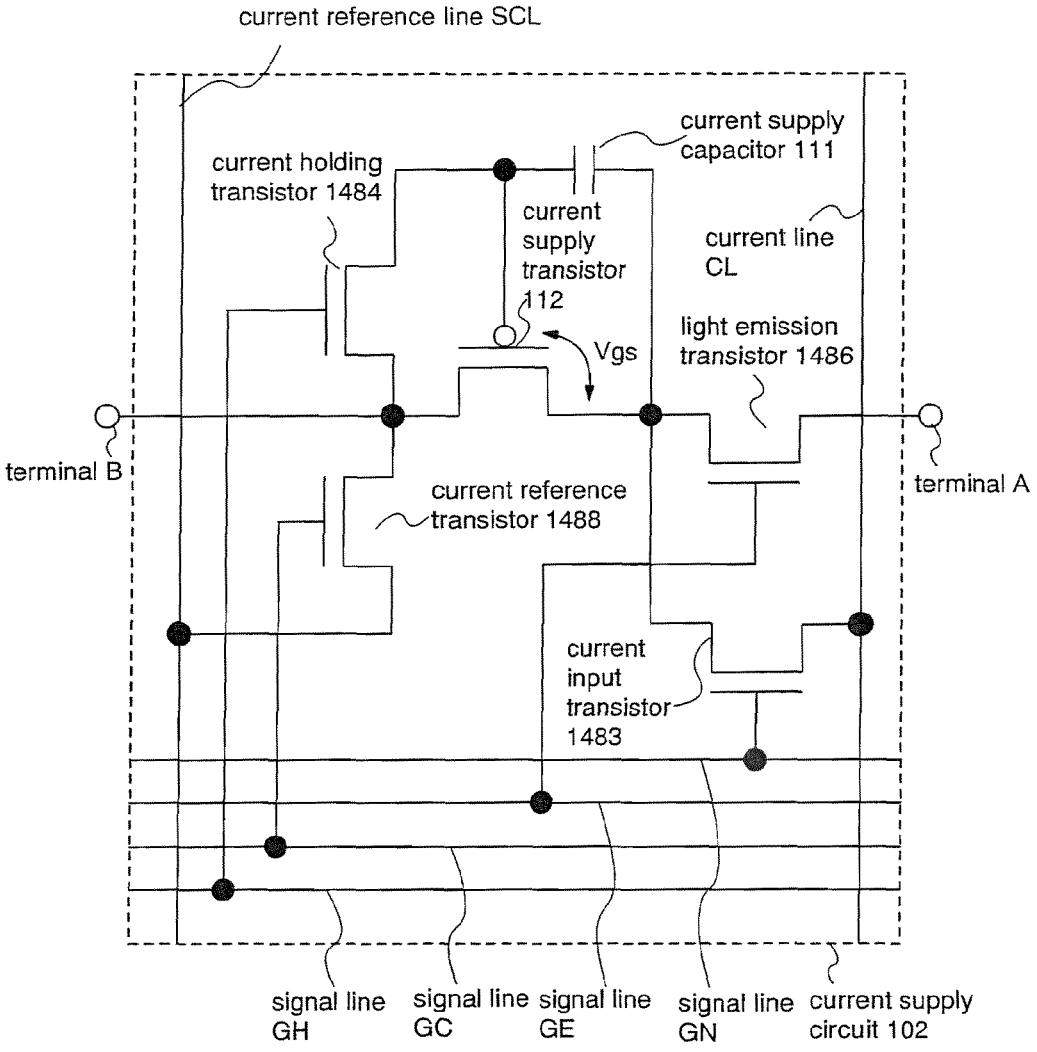
FIG. 41 is a diagram showing the structure of a current supply circuit in a display device of the present invention.

FIG. 41 shows a structural example of a current supply circuit placed in each pixel. In FIG. 41, components identical with those in FIG. 3 are denoted by the same symbols. A current supply circuit 102 in FIG. 41 is composed of a current supply capacitor 111, a current supply transistor 112, a current input transistor 1483, a current holding transistor 1484, a current reference transistor 1488, a light emission transistor 1486, a current line CL, a signal line GN, a signal line GH, a signal line GC, a signal line GE, and a current reference line SCL.

Figure 25:
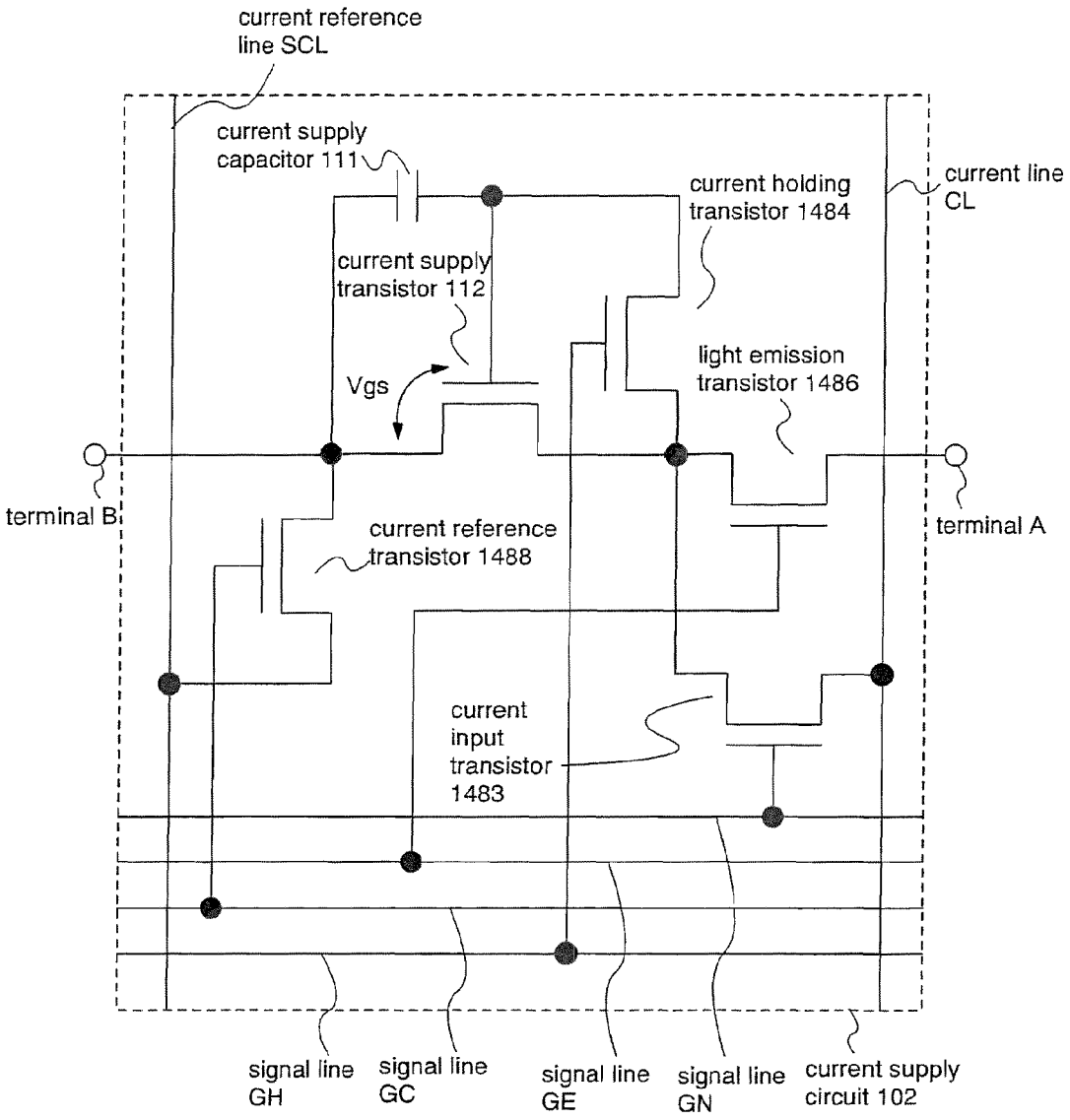
FIG. 25 is a circuit diagram of a current supply circuit in a display device of the present invention.

In the example shown in FIG. 41, the current supply transistor 112 is a p-channel transistor. If an n-channel transistor is used for the current supply transistor 112, follow the structure shown in FIG. 3(C) for easy application. A circuit diagram thereof is shown in FIG. 25. The current input transistor 1483, the current holding transistor 1484, the current reference transistor 1488, and the light emission transistor 1486 are n-channel transistors but may be p-channel transistors since they simply operate as switches.

In FIG. 41, a gate electrode of the current supply transistor 112 is connected to one of electrodes of the current supply capacitor 111. The other electrode of the current supply capacitor 111 is connected to a source terminal of the current supply transistor 112. The source terminal of the current supply transistor 112 is connected to a terminal A of the current supply circuit 102 through source-drain terminals of the light emission transistor 1486.

The gate electrode of the current supply transistor 112 is connected to its drain terminal through source-drain terminals of the current holding transistor 1484. A gate electrode of the current holding transistor 1484 is connected to the signal line GH. The drain terminal of the current supply transistor 112 is connected to the current reference line SCL through source-drain terminals of the current reference transistor 1488. A gate electrode of the current reference transistor 1488 is connected to the signal line GC. The source terminal of the current supply transistor 112 is connected to the current line CL through source-drain terminals of the current input transistor 1483. A gate electrode of the current input transistor 1483 is connected to the signal line GN. The drain terminal of the current supply transistor 112 is connected to the terminal B.

In the above structure, one of the source terminal and drain terminal of the current holding transistor 1484 that is not connected to the gate electrode of the current supply transistor 112 may be directly connected to the current reference line SCL. This is not the only way and it is sufficient if the current holding transistor 1484 is connected in a manner that makes the electric potential of the gate electrode of the current supply transistor 112 equal to the electric potential of the current reference line SCL when 1484 is made conductive.

Figure 65:
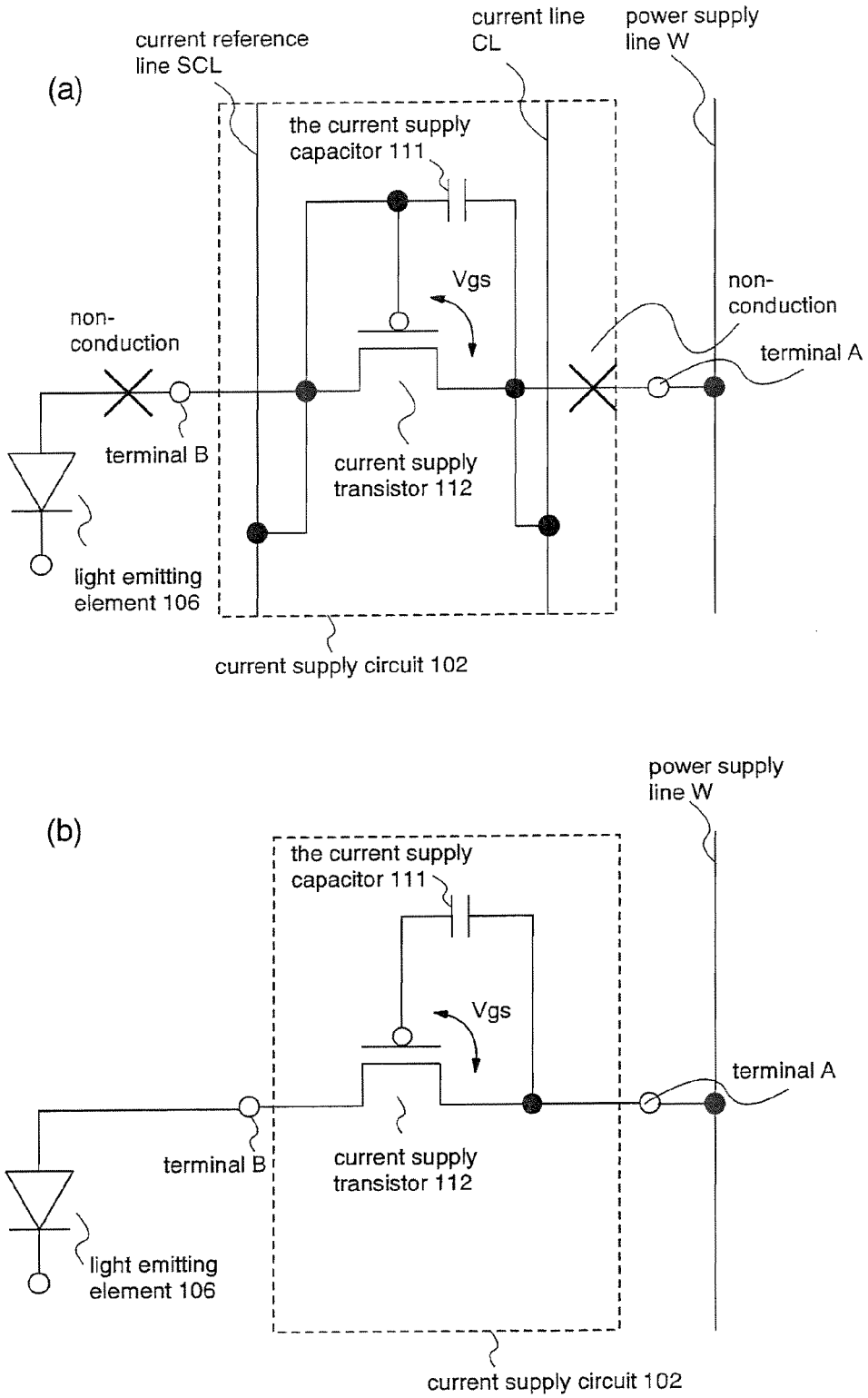
FIG. 65 are schematic diagrams showing states of a pixel in a display device of the present invention.
Figure 71:
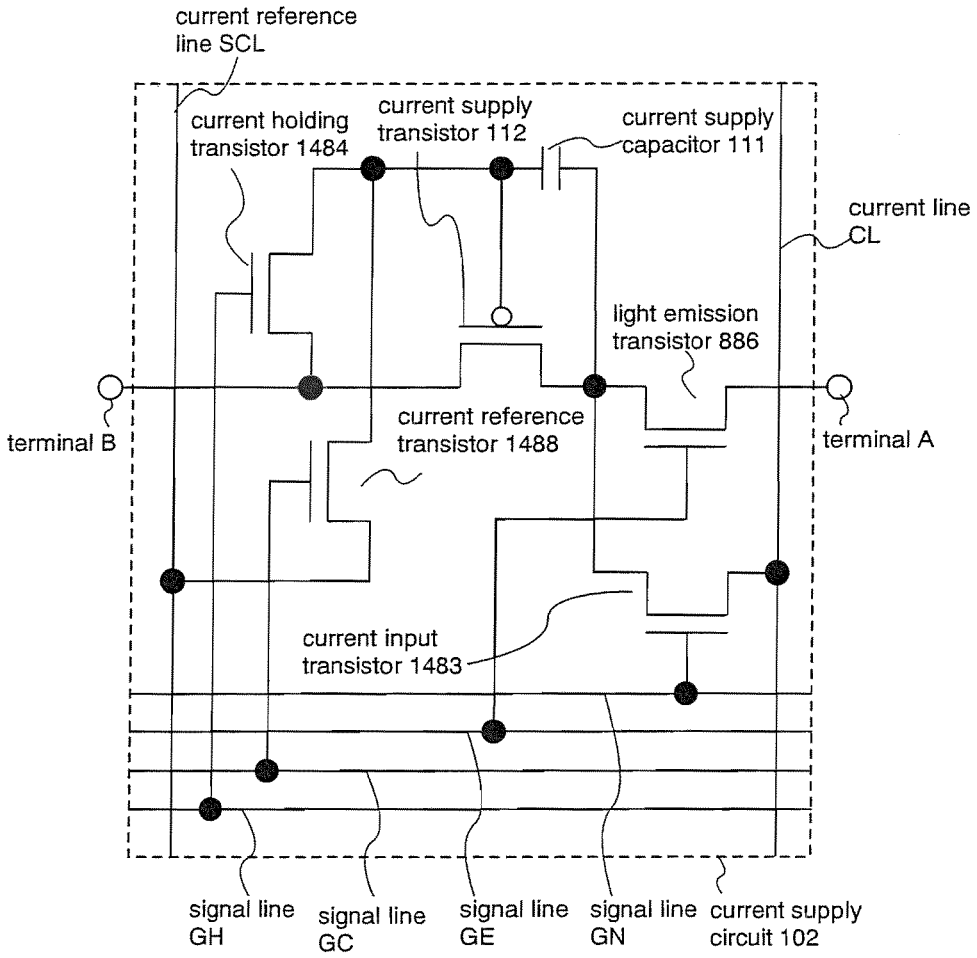
FIG. 71 is a circuit diagram of a current supply circuit of a pixel in a display device of the present invention.

In other words, it is sufficient if the wirings and switches are connected as shown in FIG. 65(*a*) during the pixel setting operation and as shown in FIG. 65(*b*) during light emission. Accordingly, it may be as shown in FIG. 71.

Alternatively, the current supply transistor 112 may be connected to the terminal B through a new transistor (called a current stopping transistor here). This transistor is made nonconductive when the current reference transistor 1488 is conductive and is made conductive when 1488 is nonconductive. It is also possible to omit the current reference transistor 1488 and the current reference line SCL. In this case, a current flows into a light emitting element 106 through the terminal B during the pixel setting operation.

The structure of a switch portion of this embodiment is described next. The switching portion has a structure similar to the one shown in FIG. 13 and other drawings in accordance with Embodiment Mode 1 and thus, explanations thereof are omitted. However, the erasing transistor 304 may double as another transistor, for example, the light emission transistor 1486 or a current stopping transistor.

Figure 42:
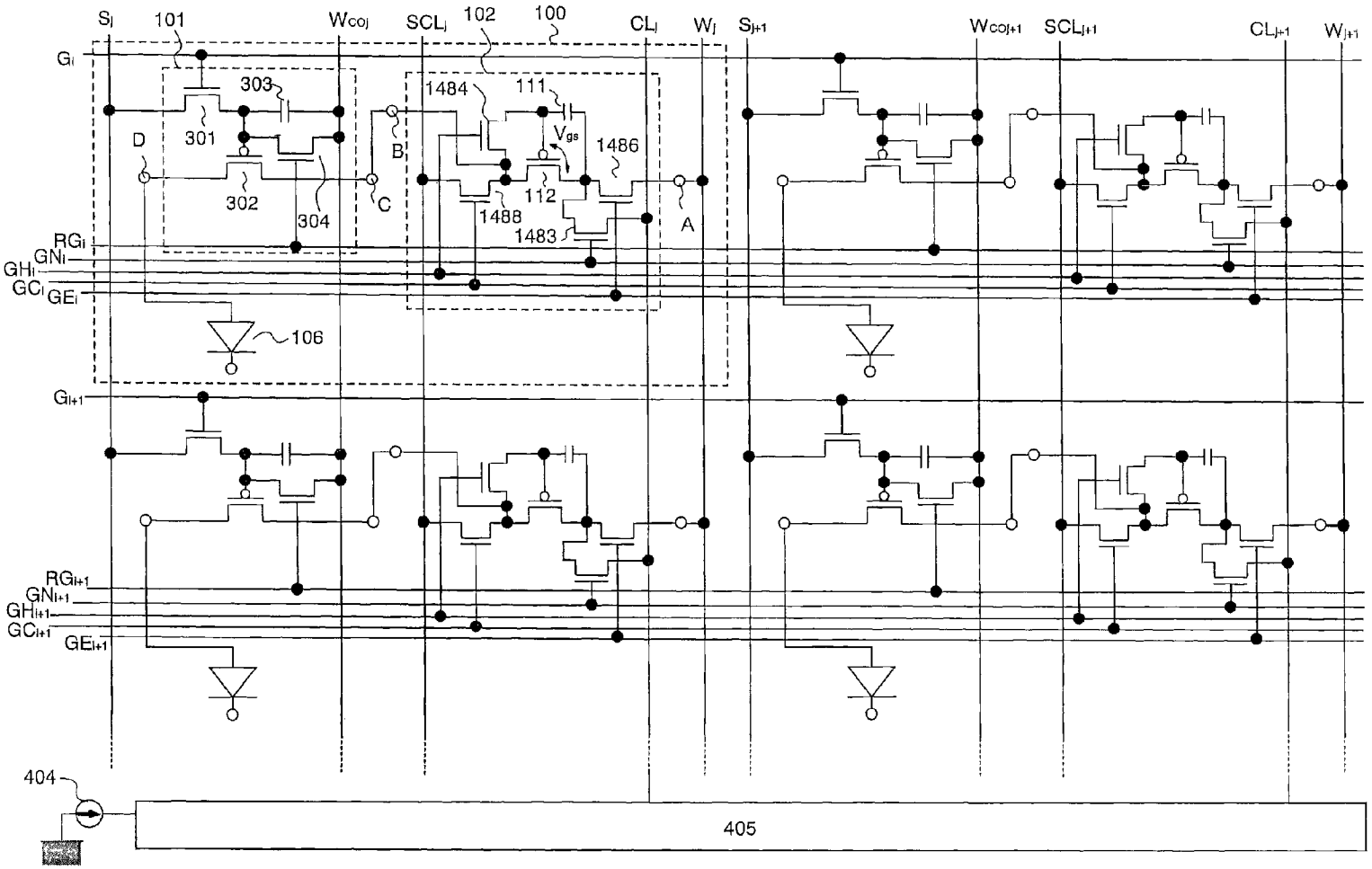
FIG. 42 is a diagram showing the structure of a pixel portion in a display device of the present invention.

FIG. 42 is a circuit diagram of a part of a pixel region in which pixels are arranged to form a matrix pattern. Each of the pixels is denoted by 100 and has a current supply circuit 102 structured as shown in FIG. 41 and a switch portion 101 structured as shown in FIG. 13. In the present invention, connection of the current supply circuit and connection of the switch portion may be switched in FIG. 1. In other words, the power supply line may be connected to the switch portion 101 to connect the current supply circuit 102 thereto. Therefore it is not limited to a connection method of FIG. 41 where the power supply line-current supply circuit-switch portion-light emitting element are connected, but it may be one in which the current supply line-switch portion-current supply circuit-light emitting element are connected, for example.

In FIG. 42, only four pixels on the i-th row and j-th column, the (i+1)-th row and j-th column, the i-th row and (j+1)-th column, and the (i+1)-th row and (j+1)-th column are shown as a representative. Components identical with those in FIGS. 41 and 13 are denoted by the same symbols and explanations thereof are omitted. Scanning lines, erasing signal lines, signal lines GN, signal lines GH, signal lines GC, and signal lines GE associated with the i-th and (i+1)-th pixel rows are denoted by $G_i$ and $G_{i+1}$, $RG_i$ and $RG_{i+1}$, $GN_i$ and $GN_{i+1}$, $GH_i$ and $GH_{i+1}$, $GC_i$ and $GC_{i+1}$, and $GE_i$ and $GE_{i+1}$, respectively. Video signal input lines S, power supply lines W, current lines CL, current reference lines SCL, and wirings $W_{CO}$ associated with the j-th and (j+1)-th pixel columns are denoted by $S_j$ and $S_{j+1}$, $W_j$ and $W_{j+1}$, $CL_j$ and $CL_{j+1}$, $SCL_j$ and $SCL_{j+1}$, and $W_{COj}$ and $W_{COj+1}$, respectively. A reference current is inputted to the current lines $CL_j$ and $CL_{j+1}$ from the outside of the pixel region.

A pixel electrode of a light emitting element 106 is connected to a terminal D and an opposite electrode thereof is given an opposite electric potential. In the structure shown in FIG. 42, the pixel electrode of the light emitting element serves as an anode and the opposite electrode serves as a cathode. In other words, the terminal A of the current supply circuit is connected to the power supply line W and the terminal B is connected to the terminal C of the switch portion 101 in the structure. However, the structure of this embodiment can readily be applied to a display device structured to use the pixel electrode of the light emitting element 106 as a cathode and its opposite electrode as an anode.

A driving transistor 302 simply functions as a switch in FIG. 42 and therefore can either be an n-channel transistor or a p-channel transistor. Preferably, the driving transistor 302 operates with the electric potential of its source terminal fixed. Therefore a p-channel transistor is preferred as the driving transistor 302 in the structure where the pixel electrode of the light emitting element 106 serves as an anode and the opposite electrode serves as a cathode as shown in FIG. 42. On the other hand, an n-channel transistor is preferred as the driving transistor 302 in the structure where the pixel electrode of the light emitting element 106 serves as a cathode and the opposite electrode serves as an anode. In FIG. 42, the wiring $W_{CO}$ and the power supply line W in each pixel may be kept at the same electric potential and therefore one of them can double as the other. Also, different pixels can share the wiring $W_{CO}$, or the power supply line W, or the wiring $W_{CO}$ and the power supply line W.

A current reference line SCL may be removed if another wiring such as a signal line or a scanning line doubles as SCL. In this case, it can either be a wiring on the same row as SCL or a wiring on another row. This means that any wiring can double as a current reference line SCL as long as the wiring is at a certain constant electric potential during serving as a current reference line SCL (during the pixel setting operation) even though a pulse signal, for example, is inputted thereto when it does not serve as a current reference line SCL (when the pixel setting operation is not conducted).

Figure 76:
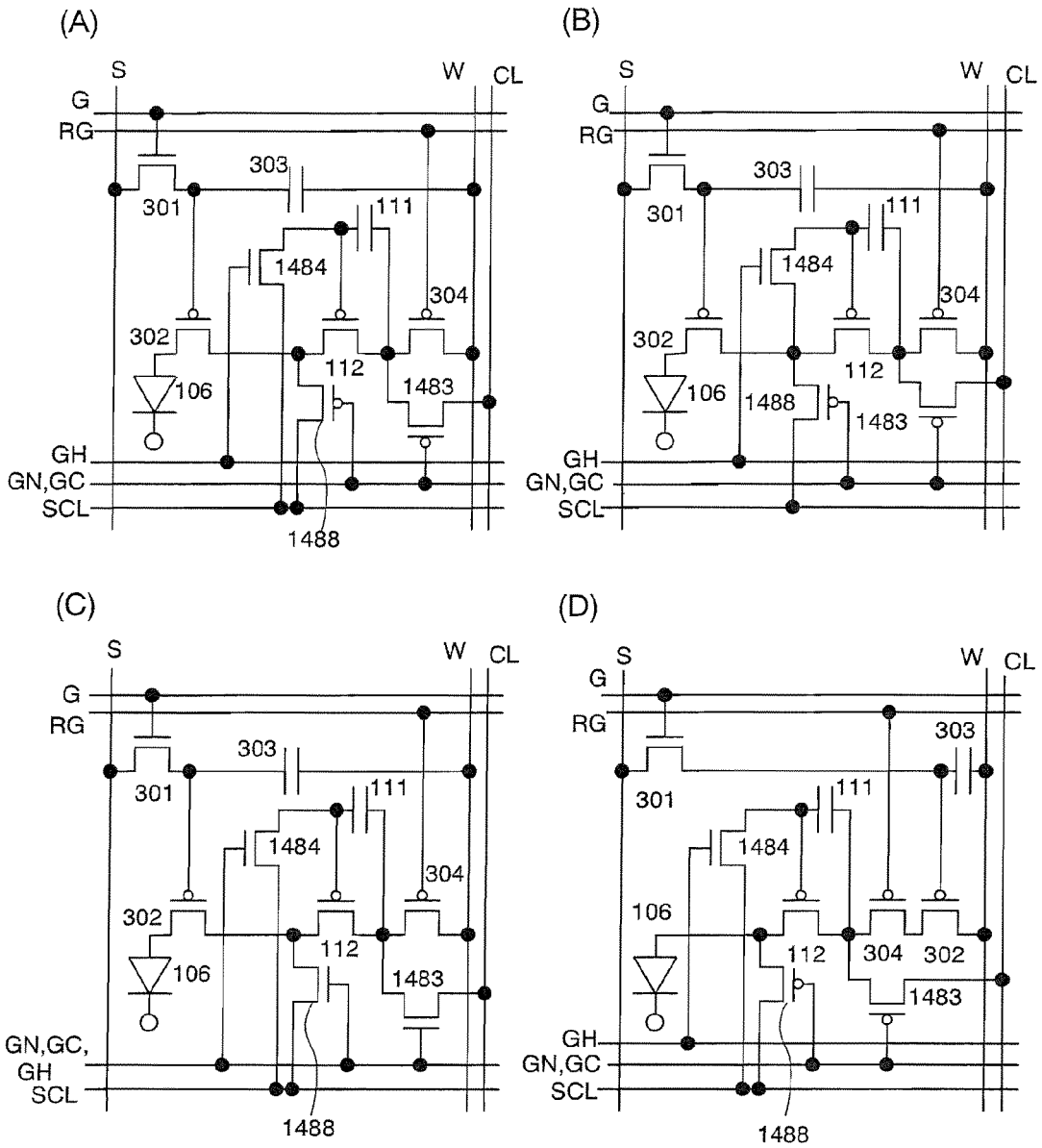
FIG. 76 are circuit diagrams each showing the structure of a pixel in a display device of the present invention.
Figure 77:
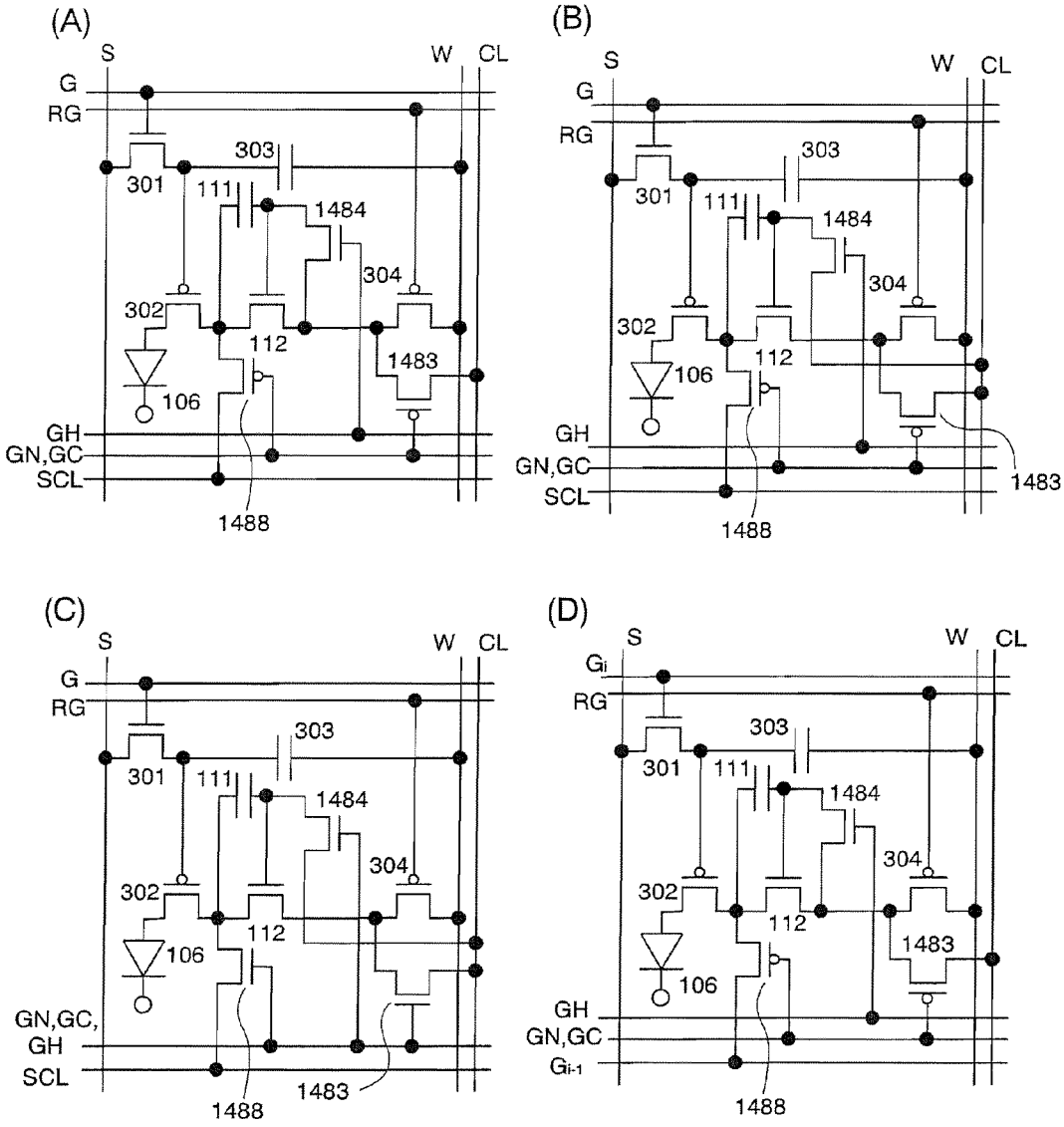
FIG. 77 are circuit diagrams each showing the structure of a pixel in a display device of the present invention.

FIGS. 76 and 77 show specific examples of sharing wirings in a pixel that has a switch portion and current supply circuit structured as above. In FIGS. 76(A) to 76(D) and FIGS. 77(A) to 77(D), one of the signal line GN and the signal line GC doubles as the other and one the wiring $W_{CO}$ and the power supply line W doubles as the other. The light emission transistor 1486 is omitted by using the erasing transistor 304. In FIG. 76(A), in particular, one of the source terminal and drain terminal of the current holding transistor 1484 that is not connected to one of the electrodes of the current supply capacitor 111 is connected directly to the current reference line SCL. The erasing transistor 304 is connected to the current supply transistor 112 and the driving transistor 302 in series. In FIG. 76(C), the polarity of the current reference transistor 1488 and the polarity of the current input transistor 1483 are different from those in the structure shown in FIG. 76(A). The signal line GH also shares the line that the signal line GC and the signal line GN share. In FIG. 76(D), the power supply line W is connected to the light emitting element 106 through the switch portion 101 and the current supply circuit 102 in order. In FIG. 77(A), the current supply transistor 112 is an n-channel transistor. The current supply transistor 112 in FIG. 77(B) is an n-channel transistor. Of the source terminal and drain terminal of the current holding transistor 1484, one that is not connected to one of the electrodes of the current supply capacitor 111 is connected directly to the current line CL. In FIG. 7(C), the polarity of the current reference transistor 1488 and the polarity of the current input transistor 1483 are different from those in the structure shown in FIG. 77(B). The signal line GH also shares the line that the signal line GC and the signal line GN share. In FIG. 77(D), the preceding scanning line $G_{i-1}$ is used in place of the current reference line SCL. As described, various circuits can be obtained easily by sharing wirings, sharing transistors, changing the polarities and positions of transistors, changing the positions of the switch portion and the current supply circuit, changing the internal structures of the switch portion and current supply circuit, and by changing a combination of these parameters. Accordingly various circuit examples can be built without being limited by the circuit examples of FIGS. 76 and 77.

The reference current output circuit 405 and the reference current supply circuit 404 are identical with those described in Embodiment Mode 1 and explanations thereof are omitted.

A method of driving a display device that has a pixel structured as shown in FIG. 42 is described. The image display operation is similar to the one described in Embodiment Mode 1 referring to FIG. 7. The difference is the operations regarding the light emission transistor 1486, the current input transistor 1483, and the current reference transistor 1488.

During a lighting period, the light emission transistor 1486 is made conductive and the current input transistor 1483 is nonconductive. During a pixel setting period, the light emission transistor 1486 is nonconductive and the current input transistor 1483 is made conductive. During a non-lighting period (excluding the pixel setting period), the current input transistor 1483 is nonconductive and the light emission transistor 1486 can be in either state. The light emission transistor 1486 may double as an erasing transistor and the light emission transistor 1486 may be made nonconductive. If the current reference transistor 1488 is provided, the current reference transistor 1488 has to be nonconductive during a lighting period. This is because otherwise a current undesirably flows into the current reference line SCL to change the amount of current flowing into the light emitting element.

The current reference transistor 1488 may be conductive or nonconductive during a non-lighting period. However, a reverse bias voltage can be applied to the light emitting element 106 by adjusting the voltage of the current reference line SCL and the voltage of the opposite electrode of the light emitting element 106.

If there is a new transistor (called a current stopping transistor here) is between the current supply transistor 112 and the terminal B, the current stopping transistor has to be conductive during a lighting period. This is because no current flows into the light emitting element 106 if the current stopping transistor is nonconductive. During a pixel setting period, the current stopping transistor is made nonconductive. During a non-lighting period, the current stopping transistor may be conductive or nonconductive, though it can double as an erasing transistor if made nonconductive. This embodiment is identical with Embodiment Mode 1 except the above points.

Next, the pixel setting operation is described. The operation is mostly the same as Embodiment Mode 2. As an example, the setting operation is performed on a pixel on the i-th row. A reference current $I_0$ flows in the current line CL. The reference current $I_0$ flows between the current line CL and the current reference line SCL through the current input transistor 1483, the current supply transistor 112, and the current reference transistor 1488 that have been made conductive. At this point, the light emission transistor 1486 is in a nonconductive state. Also, a current flows no further than the terminal B in the present state. Alternatively, if a current stopping transistor is provided, it is made nonconductive to prevent a current from flowing further than the terminal B. In this way, the reference current $I_0$ flows in the current supply transistor 112. The gate electrode of the current supply transistor 112 is connected to its drain terminal through the current holding transistor 1484 that has been made conductive. Therefore, the current supply transistor 112 operates with the gate-source voltage (gate voltage) equalized with the source-drain voltage, namely, it operates in the saturation region and a drain current flows. The drain current flowing in the current supply transistor 112 is set to the reference current $I_0$ flowing in the current line CL. In this way, the gate voltage of when the reference current $I_0$ flows in the current supply transistor 112 is held in the current supply capacitor 111.

In the case where the current reference line SCL and the current reference transistor 1488 are not provided, $I_0$ flows first from the terminal B. Then the current flows into the light emitting element 106. If this current flow continues for a long period of time, the luminance is affected and this is undesirable. Also, it takes longer to change the electric potential of the light emitting element 106 when $I_0$ flows into the light emitting element 106. As a result, the pixel setting operation takes time, too.

After the current supply capacitor 111 finishes holding electric charges according to the reference current $I_0$ that flows in the current line CL, the signal of the signal line $GH_i$ is changed to turn the current holding transistor 1484 nonconductive. This causes the current supply capacitor 111 of the pixel to hold electric charges. Thereafter, the signals of the signal line $GN_i$ and the signal line $GC_i$ are changed to turn the current input transistor 1483 and current reference transistor 1488 of the pixel on the i-th row nonconductive. In this way, the connection of the current supply transistor 112 of the pixel on the i-th row with the current line CL and the current reference line SCL is cut while the gate voltage is held. At the same time, the signal of the signal line $GE_i$ is changed to turn the light emission transistor 1486 conductive.

The setting operation is performed on each pixel on the i-th row in this way. Thereafter, the reference current (pixel reference current) flows between the source and drain of the current supply transistor 112 when a voltage is applied between the terminal A and terminal B of the current supply circuit 102 in each pixel.

In the pixel portion structure shown in FIG. 42, the signal lines GN, the signal lines GH, the signal lines GC, the signal lines GE, the scanning lines G, and the erasing signal lines RG may be shared taking drive timing and the like into consideration. For example, one of the signal line $GH_i$ and the signal line $GN_i$ can double as the other. In this case, the current holding transistor 1484 is made nonconductive at exactly the same time the current input transistor 1483 is made nonconductive and therefore no problem arises regarding the pixel setting operation.

In another example, one of the signal line $GE_i$ and the signal line $GN_i$ doubles as the other. In this case, the light emission transistor 1486 having a polarity different from the polarity of the current input transistor 1483 is used. In this way, one of the transistors 1483 and 1486 can be made conductive whereas the other is made nonconductive when the same signal is inputted to the gate electrode of the current input transistor 1483 and the gate electrode of the light emission transistor 1486. If a current stopping transistor is added, wirings can be shared by giving the current stopping transistor a polarity reverse to the polarity of the current reference transistor 1488 and connecting their gate electrodes to each other.

Embodiment 7

Figure 58:
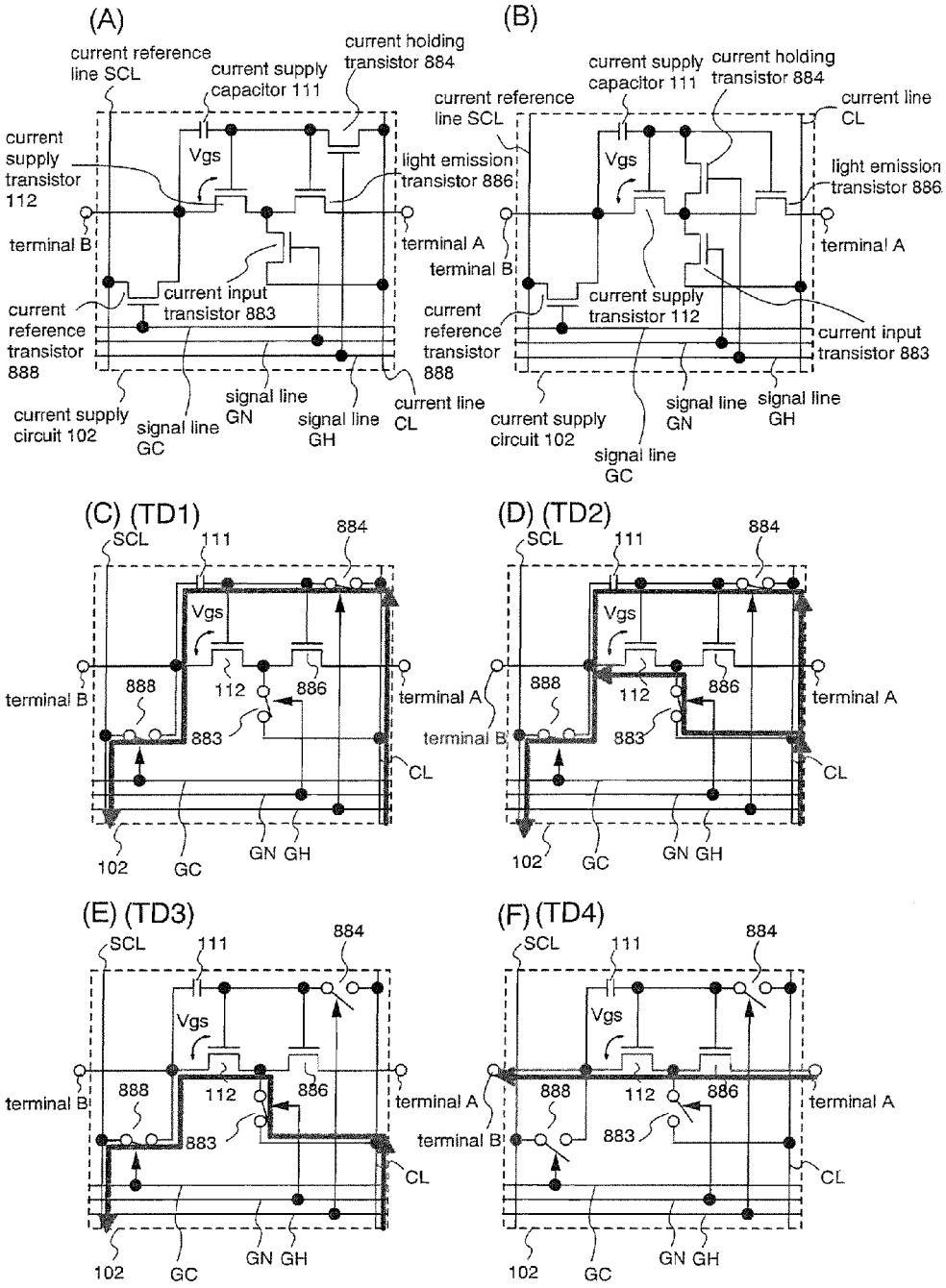
FIG. 58 are diagrams showing the structure of a current supply circuit in a display device of the present invention.

A current supply circuit using a multi-gate method 2 is described. The description is given with reference to FIG. 58. In FIG. 58(A), components identical with those in FIG. 3 are denoted by the same symbols.

Structural components of a current supply circuit of multi-gate method 2 are described. The current supply circuit of multi-gate method 2 has a current supply transistor 112 and a light emission transistor 886. The circuit also has a current input transistor 883, current holding transistor 884, and current reference transistor 888 that function as switches. The current supply transistor 112 can either be a p-channel transistor or an n-channel transistor and the same applies to the light emission transistor 886, the current input transistor 883, the current holding transistor 884, and the current reference transistor 888. However, the current supply transistor 112 and the light emission transistor 886 have to have the same polarity. In the example shown here, the current supply transistor 112 and the light emission transistor 886 are n-channel transistors. Also, the current supply transistor 112 and the light emission transistor 886 desirably have the same current characteristic. The circuit also has a current supply capacitor 111 for holding the gate electric potential of the current supply transistor 112. The circuit also has a signal line GN for inputting a signal to a gate electrode of the current input transistor 883 and a signal line GH for inputting a signal to a gate electrode of the current holding transistor 884. Furthermore, the circuit has a current line CL to which a control signal is inputted and a current reference line SCL that is kept at a certain electric potential. The current supply capacitor 111 may be omitted by utilizing gate capacitance of the transistors or the like.

The connection relation of these structural components is described. A source terminal of the current supply transistor 112 is connected to a terminal B. The source terminal of the current supply transistor 112 is connected to the current reference line SCL through the current reference transistor 888. A drain terminal of the current supply transistor 112 is connected to a source terminal of the light emission transistor 886. The drain terminal of the current supply transistor 112 is connected through the current input transistor 883 to the current line CL. The gate electrode of the current supply transistor 112 is connected to its source terminal through the current supply capacitor 111. The gate electrode of the current supply transistor 112 is connected to a gate electrode of the light emission transistor 886, and they are connected to the current line CL through the current holding transistor 884. A drain terminal of the light emission transistor 886 is connected to a terminal A.

The current holding transistor 884 may be repositioned in FIG. 58(A) to obtain a circuit structure that is shown in FIG. 58(B). In FIG. 58(B), the current holding transistor 884 is connected between the gate electrode and drain terminal of the current supply transistor 112.

Next, a method of setting the above current supply circuit of multi-gate method 2 will be described. The setting operation in FIG. 58(A) is identical with the setting operation in FIG. 58(B). Here, the circuit shown in FIG. 58(A) is taken as an example and the setting operation thereof is described. The description will be given with reference to FIGS. 58(C) to 58(F). In the current supply circuit of multi-gate method 2, the setting operation is conducted moving through the states of FIGS. 58(C) to 58(F) in order. For simplification, the current input transistor 883, the current holding transistor 884, and the current reference transistor 888 are treated as switches in the description. In the example shown, a control signal for setting the current supply circuit is a control current. In the drawings, a path that a current takes is indicated by a bold arrow.

In a period TD1 shown in FIG. 58(C), the current input transistor 883, the current holding transistor 884, and the current reference transistor 888 are made conductive. At this point, the light emission transistor 886 is in a nonconductive state. This is because the electric potential of a source terminal of the light emission transistor 886 is kept equal to the electric potential of its gate electrode by the current input transistor 883 and current holding transistor 884 that are made conductive. This means that the light emission transistor 886 can automatically be made nonconductive in the period TD1 if a transistor that becomes nonconductive when the source-gate voltage is zero is used as the light emission transistor 886. In this way, a current flows from the path shown in the drawing and electric charges are held in the current supply capacitor 111.

In a period TD2 shown in FIG. 58(D), the electric charges held raise the gate-source voltage of the current supply transistor 112 up to or above the threshold voltage. This causes the drain current to flow in the current supply transistor 112.

In a period TD3 shown in FIG. 58(E), after enough time passes to reach a stable state, the drain current of the current supply transistor 112 is set to the control current. In this way, a gate voltage of when the control current is set as the drain current is held in the current supply capacitor 111. Thereafter, the current holding transistor 884 is made nonconductive to causes distribution of the electric charges held in the current supply capacitor 111 to a gate electrode of the light emission transistor 886. The light emission transistor 886 is thus automatically made conductive at the same time the current holding transistor 884 is made nonconductive.

In a period TD4 shown in FIG. 58(F), the current reference transistor 888 and the current input transistor 883 are made nonconductive. This stops input of the control current to the pixel. Preferably, the current holding transistor 884 is made nonconductive before or at the same time the current input transistor 883 is made nonconductive. This is to prevent electric charges held in the current supply capacitor 111 from being discharged. After the period TD4, if a voltage is applied between the terminal A and the terminal B, a constant current is outputted through the current supply transistor 112 and the light emission transistor 886. In other words, the current supply transistor 112 and the light emission transistor 886 function like one multi-gate type transistor when the current supply circuit 102 outputs a control current. Therefore, the value of the constant current outputted can be set small with respect to the control current inputted. The setting operation of the current supply circuit thus can be finished more quickly. For that reason, the light emission transistor 886 and the current supply transistor 112 have to have the same polarity. Desirably, the light emission transistor 886 and the current supply transistor 112 have the same current characteristic. This is because the output current is fluctuated if the characteristic of the light emission transistor 886 does not match the characteristic of the current supply transistor 112 in each current supply circuit 102 of multi-gate method 2.

In the current supply circuit of multi-gate method 2, the current from the current supply circuit 102 is outputted using also a transistor to which a control current is inputted to convert it into a corresponding gate voltage (the current supply transistor 112). In a current mirror method current supply circuit, a transistor to which a control current is inputted to convert it into a corresponding gate voltage (a current transistor) is an utterly separate transistor from a transistor that converts the gate voltage into a drain current (a current supply transistor). Therefore, fluctuation in current characteristic between transistors affects an output current of the current supply circuit 102 less than in a current mirror method current supply circuit.

The current reference line SCL and the current reference transistor 888 are unnecessary if a current is allowed to flow to the terminal B in the periods TD1 to TD3 during the setting operation. Alternatively, the current reference line SCL may be removed if another wiring such as a scanning line doubles as SCL. In this case, it can either be a wiring on the same row as SCL or a wiring on another row. This means that any wiring can double as the current reference line SCL as long as the wiring is at a certain constant electric potential while serving as the current reference line SCL (during the pixel setting operation) even though a pulse signal, for example, is inputted thereto when it does not serve as the current reference line SCL (when the pixel setting operation is not conducted).

Signal lines of the current supply circuit of multi-gate method 2 can be shared. For example, no operational problem arises if the current input transistor 883 and the current holding transistor 884 are switched between a conductive state and a nonconductive state at the same time and therefore the current input transistor 883 and the current holding transistor 884 are given the same polarity so that one of the signal line GH and the signal line GN can double as the other. Also, no operational problem arises if the current reference transistor 888 and the current input transistor 883 are switched between a conductive state and a nonconductive state at the same time and therefore the current reference transistor 888 and the current input transistor 883 are given the same polarity so that one of the signal line GN and the signal line GC can double as the other.

Figure 64:
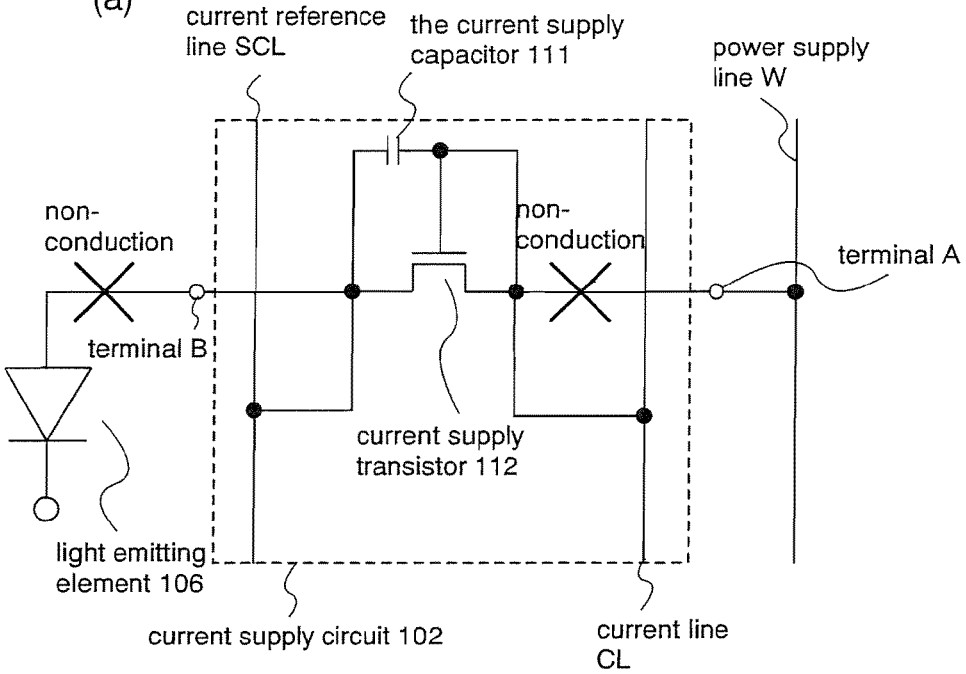
FIG. 64 are schematic diagrams showing states of a pixel in a display device of the present invention.
Figure 64:
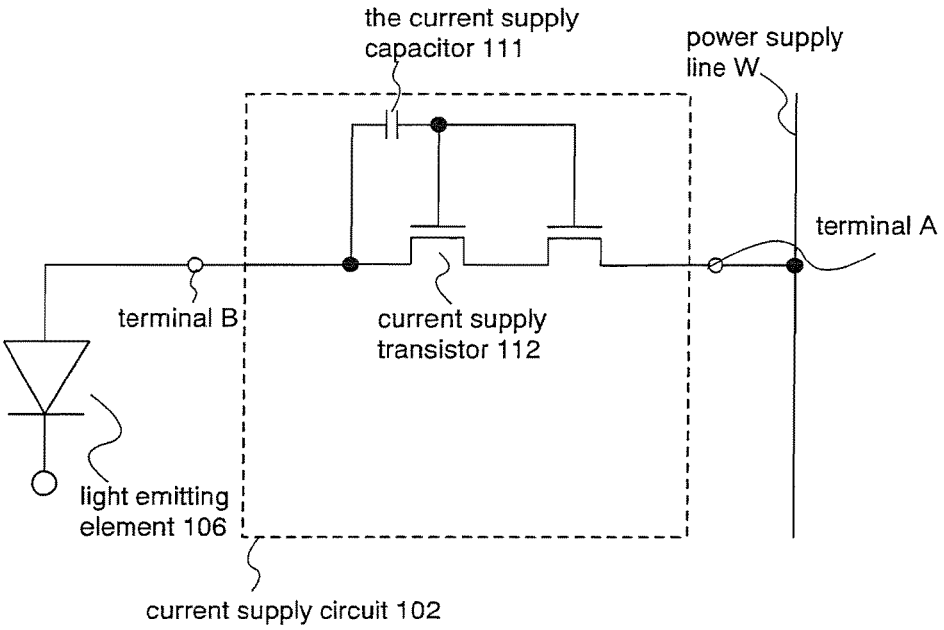
Figure 69:
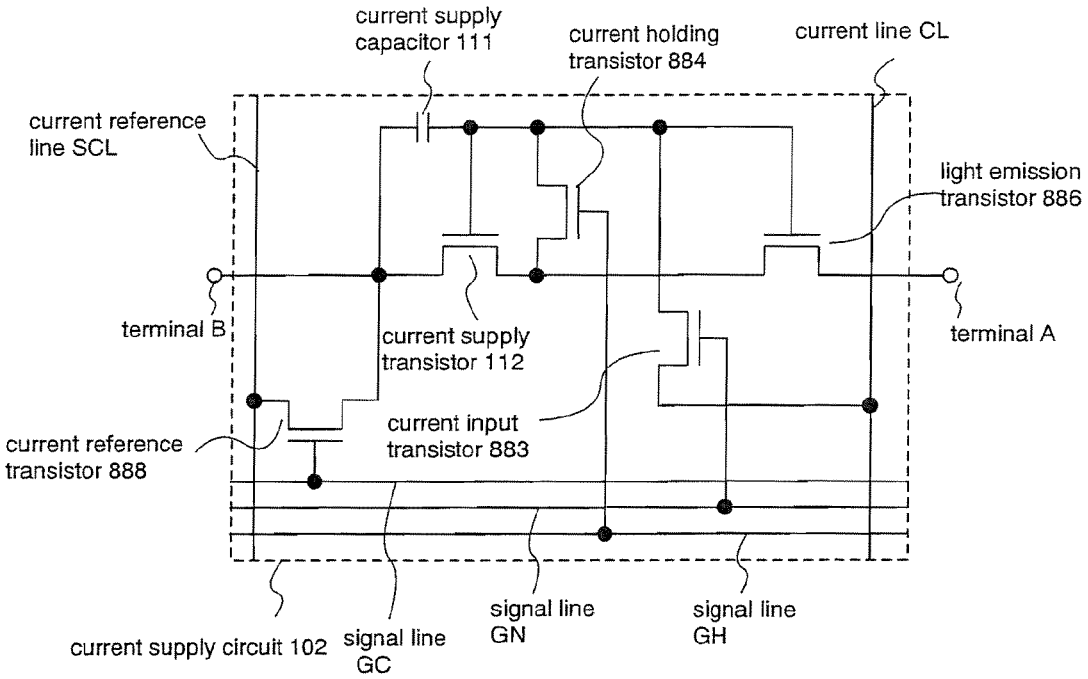
FIG. 69 is a circuit diagram of a current supply circuit of a pixel in a display device of the present invention.
Figure 75:
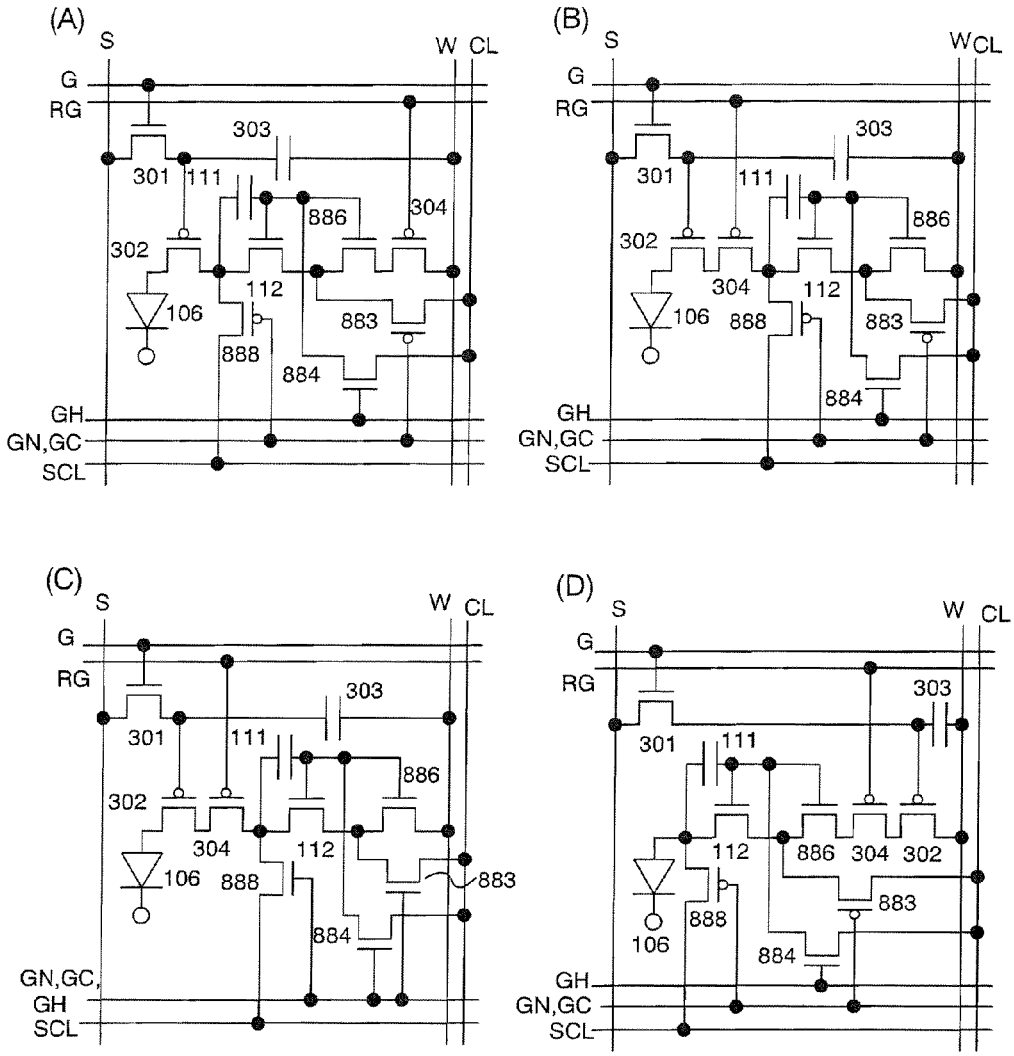
FIG. 75 are circuit diagrams each showing the structure of a pixel in a display device of the present invention.

In the multi-gate method 2, it is sufficient if the current supply circuit is as shown in FIG. 64(*a*) during the pixel setting operation and as shown in FIG. 64(*b*) during light emission. In other words, it is sufficient if wirings and switches are connected as such. Accordingly, it may be as shown in FIG. 69. FIG. 75 show specific examples of sharing wirings in a pixel that has a switch portion and current supply circuit structured as above. In FIGS. 75(A) to 75(D), one of the signal line GN and the signal line GC doubles as the other and one of the wiring $W_{CO}$ and the power supply line W doubles as the other. In FIG. 75(A), in particular, one of the source terminal and drain terminal of the current holding transistor 884 that is not connected to one of the electrodes of the current supply capacitor 111 is connected directly to the current line CL. Also, the erasing transistor 304 is connected to the current supply transistor 112 and the driving transistor 302 in series. In FIG. 75(B), the erasing transistor 304 is connected at a position where a connection between the source terminal of the current supply transistor 112 and the source terminal or drain terminal of the driving transistor 302 is chosen. In FIG. 75(C), the polarity of the current input transistor 883 and the polarity of the current reference transistor 888 are different from those of the structure shown in FIG. 75(B). The signal line GH also shares the line that the signal line GC and the signal line GN share. In FIG. 75(D), the power supply line W is connected to the light emitting element 106 through the switch portion 101 and the current supply circuit 102 in order. By adjusting the electric potential of the current reference line SCL, a reverse bias voltage can be applied to the light emitting element 106 when the current reference transistor 888 is ON. As described, various circuits can be obtained easily by sharing wirings, sharing transistors, changing the polarities and positions of transistors, changing the positions of the switch portion and the current supply circuit, changing the internal structures of the switch portion and current supply circuit, and by changing combination of these parameters.

In the current mirror method current supply circuit shown in Embodiment Mode 1, a signal inputted to a light emitting element is a current obtained by increasing or reducing a control current inputted to the pixel at a given power. This makes it possible to set the control current large to a certain degree and finish the setting operation of the current supply circuit of each pixel quickly. However, it has a problem of fluctuation in image display caused by fluctuation in current characteristic among transistors that constitute the current mirror circuit of the current supply circuit.

On the other hand, in a current supply circuit of identic-transistor method, a signal inputted to a light emitting element equals to the current value of the control current inputted to the pixel. In the identic-transistor method current supply circuit, a transistor to which the control current is inputted is at the same time a transistor that outputs a current to the light emitting element. Therefore, uneven display due to fluctuation in current characteristic among transistors is reduced.

In contrast to this, in a multi-gate method current supply circuit, a signal inputted to a light emitting element is a current obtained by increasing or reducing a control current inputted to the pixel at a given power. This makes it possible to set the control current large to a certain degree and finish the setting operation of the current supply circuit of each pixel quickly. Furthermore, a transistor to which the control current is inputted and a transistor that outputs a current to the light emitting element share some of their parts. Therefore, uneven display due to fluctuation in current characteristic among transistors is reduced compared to a current mirror method current supply circuit.

Described next is the relation between the setting operation and the operation of a switch portion in a multi-gate method current supply circuit. In a multi-gate method current supply circuit, a constant current cannot be outputted while a control current is inputted. Therefore, it is necessary to conduct the operation of the switch portion and the setting operation of the current supply circuit in sync with each other. For example, the setting operation of the current supply circuit can be conducted only when the switch portion is OFF. This is almost identical with the identic-transistor method. Accordingly, the image display operation (driving operation of the switch portion) and the setting operation of the current supply circuit (pixel setting operation) are also nearly identical with those in the identic-transistor method. Explanations are therefore omitted.

Embodiment 8

This embodiment describes a case of adapting the circuit described in Embodiment 6 to a dot-sequential fashion in a pixel structure having an identic-transistor method current supply circuit. Therefore, explanations of things that overlap will be omitted.

Figure 47:
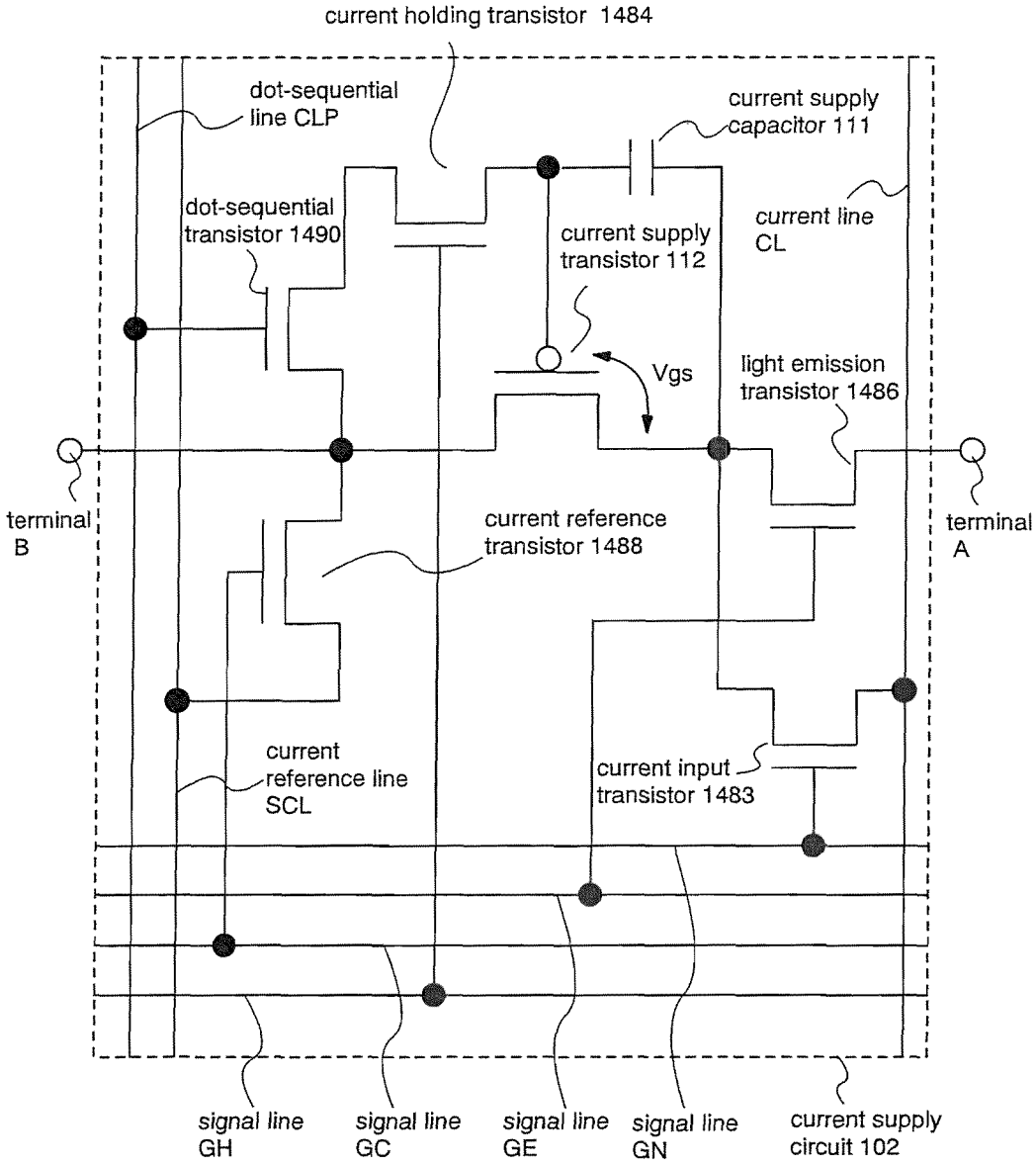
FIG. 47 is a diagram showing the structure of a current supply circuit in a display device of the present invention.

A structural example of the current supply circuit placed in each pixel is shown in FIG. 47. In FIG. 47, components identical with those in FIG. 41 are denoted by the same symbols and explanations thereof are omitted. The current supply circuit 102 in FIG. 47 has, in addition to the current supply capacitor 111, the current supply transistor 112, the current input transistor 1483, the current holding transistor 1484, the current reference transistor 1488, the light emission transistor 1486, the current line CL, the signal line GN, the signal line GH, the signal line GC, the signal line GE, and the current reference line SCL, a dot-sequential transistor 1490 and a dot-sequential line CLP. The dot-sequential transistor 1490 is an n-channel transistor but may be a p-channel transistor since it simply operates as a switch.

A gate electrode of the current supply transistor 112 is connected to one of electrodes of the current supply capacitor 111. The other electrode of the current supply capacitor 111 is connected to a source terminal of the current supply transistor 112. The source terminal of the current supply transistor 112 is connected to a terminal A of the current supply circuit 102 through source-drain terminals of the light emission transistor 1486.

The gate electrode of the current supply transistor 112 is connected to its drain terminal through source-drain terminals of the current holding transistor 1484 and source-drain terminals of the dot-sequential transistor 1490 in order. A gate electrode of the current holding transistor 1484 is connected to the signal line GH. A gate electrode of the dot-sequential transistor 1490 is connected to the dot-sequential line CLP. The drain terminal of the current supply transistor 112 is connected to the current reference line SCL through source-drain terminals of the current reference transistor 1488. A gate electrode of the current reference transistor 1488 is connected to the signal line GC. The source terminal of the current supply transistor 112 is connected to the current line CL through source-drain terminals of the current input transistor 1483. A gate electrode of the current input transistor 1483 is connected to the signal line GN. The drain terminal of the current supply transistor 112 is connected to a terminal B.

In the above structure, of the source terminal and drain terminal of the dot-sequential transistor 1490, one that is not connected to the source and drain terminals of the current holding transistor 1484 may be connected directly to the current reference line SCL. This is not the only way and it is sufficient if the current holding transistor 1484 and the dot-sequential transistor 1490 are connected in a manner that makes the electric potential of the gate electrode of the current supply transistor 112 equal to the electric potential of the current reference line SCL when both of 1484 and 1490 are made conductive.

The current holding transistor 1484 and the dot-sequential transistor 1490 may switch their positions. Then, the current supply capacitor 111 may be connected to the drain terminal of the current supply transistor 112 through the source-drain terminals of the current holding transistor 1484 and the source-drain terminals of the dot-sequential transistor 1490 in this order, or the current supply capacitor 111 may be connected to the drain terminal of the current supply transistor 112 through the source-drain terminals of the dot-sequential transistor 1490 and the source-drain terminals of the current holding transistor 1484 in this order.

Figure 48:
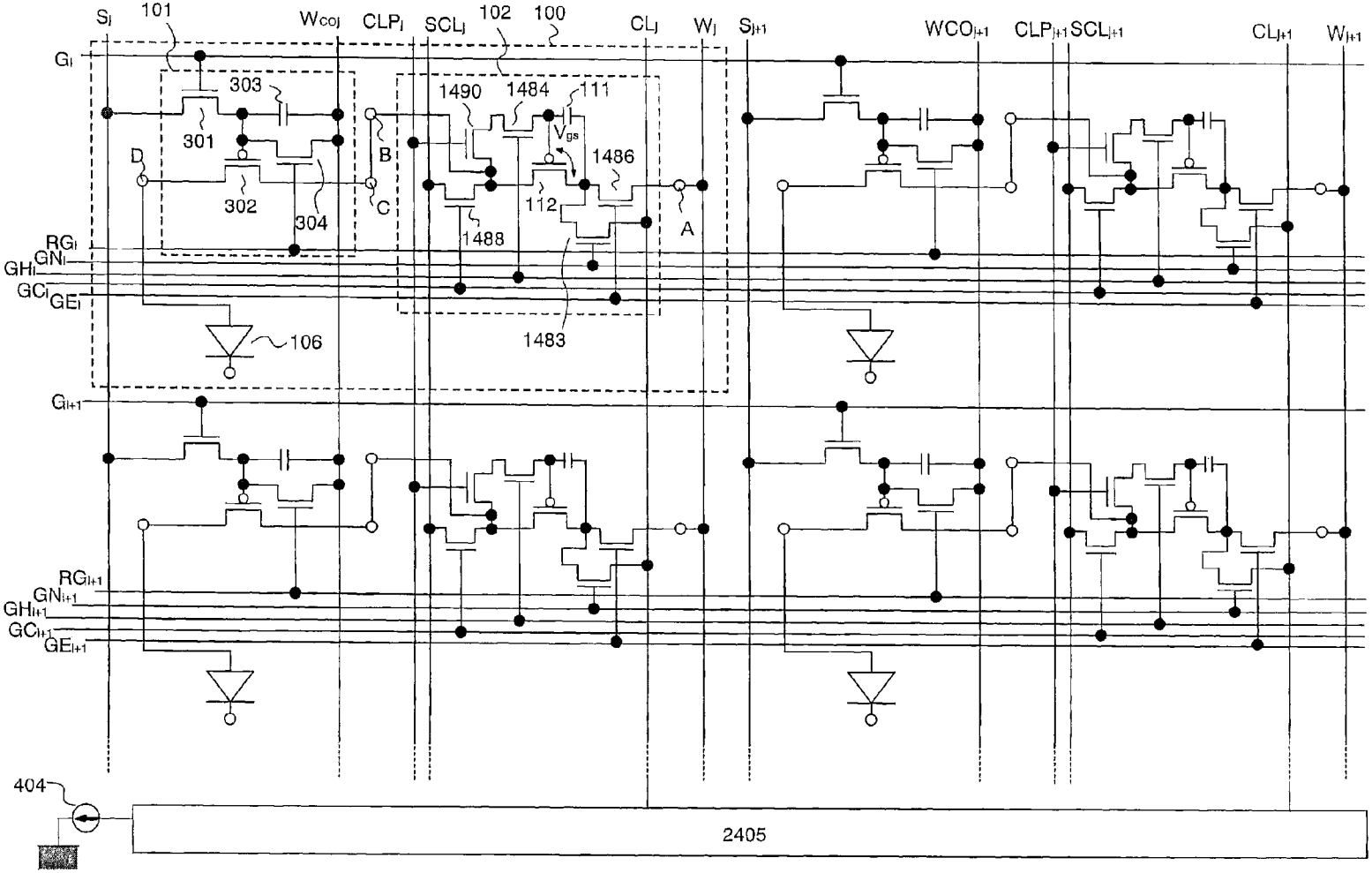
FIG. 48 is a diagram showing the structure of a pixel portion in a display device of the present invention.

FIG. 48 is a circuit diagram of a part of a pixel region in which x columns x y rows of pixels are arranged to form a matrix pattern. Each of the pixels is denoted by 100 and has a current supply circuit 102 structured as shown in FIG. 47 and a switch portion 101 structured as shown in FIG. 13. In FIG. 48, only four pixels on the i-th row and j-th column, the (i+1)-th row and j-th column, the i-th row and (j+1)-th column, and the (i+1)-th row and (j+1)-th column are shown as a representative. Components identical with those in FIGS. 41 and 13 are denoted by the same symbols and explanations thereof are omitted.

Scanning lines, erasing signal lines, signal lines GN, signal lines GH, signal lines GC, and signal lines GE associated with the i-th and (i+1)-th pixel rows are denoted by $G_i$ and $G_{i+1}$, $RG_i$ and $RG_{i+1}$, $GN_i$ and $GN_{i+1}$, $GH_i$ and $GH_{i+1}$, $GC_i$ and $GC_{i+1}$, and $GE_i$ and $GE_{i+1}$, respectively. Video signal input lines S, power supply lines W, current lines CL, current reference lines SCL, wirings $W_{CO}$, and dot-sequential lines CLP associated with the j-th and (j+1)-th pixel columns are denoted by $S_j$ and $S_{j+1}$, $W_j$ and $W_{j+1}$, $CL_j$ and $CL_{j+1}$, $SCL_j$ and $SCL_{j+1}$, $W_{COj}$ and $W_{COj+1}$, and $CLP_j$ and $CLP_{j+1}$, respectively. A reference current is inputted to the current lines $CL_j$ and $CL_{j+1}$ from the outside of the pixel region. Denoted by 106 is a light emitting element. A pixel electrode of the light emitting element 106 is connected to the terminal D and an opposite electrode of 106 is given an opposite electric potential. This embodiment shows a structural example of an identic-transistor method current supply circuit but application to a multi-gate current supply circuit is also possible. Then, a dot-sequential transistor is positioned serially with respect to the current holding transistor 884 in FIGS. 58(A) and 58(B).

Embodiment 9

This embodiment shows an example in which an n-channel transistor is used as the current supply transistor 112 of each pixel in the pixel structure shown in FIG. 14 in accordance with Embodiment Mode 2. In the example shown here, the pixel electrode of the light emitting element 106 serves as an anode and the opposite electrode serves as a cathode. Accordingly, explanations of things that overlap with Embodiment Mode 2 are omitted.

Figure 52:
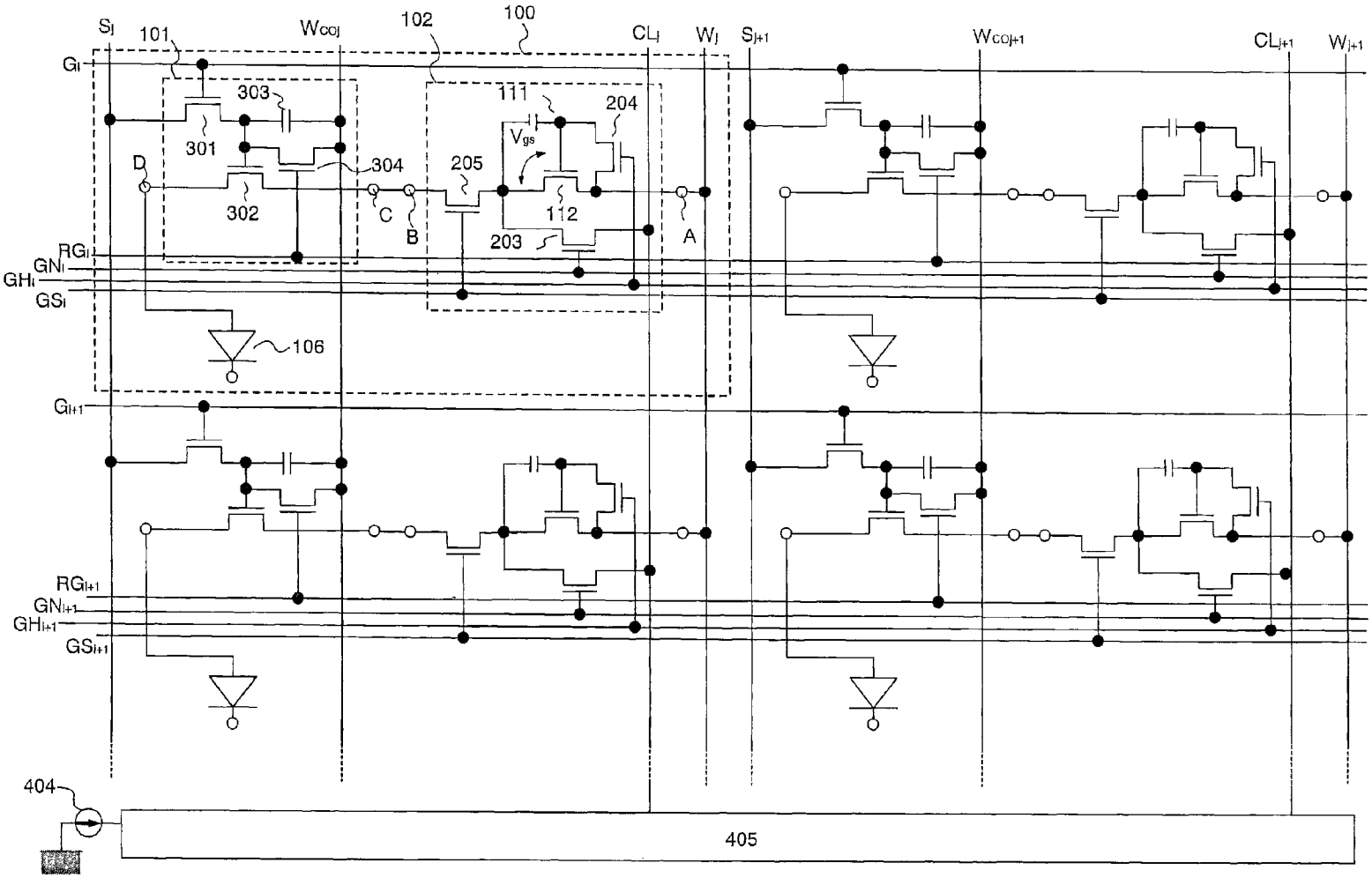
FIG. 52 is a diagram showing the structure of a pixel portion in a display device of the present invention.

FIG. 52 is a circuit diagram showing a pixel structure of this embodiment. Components in FIG. 52 that are identical with those in FIG. 14 are denoted by the same symbols. In FIG. 52, a current supply circuit 102 is composed of a current supply capacitor 111, a current supply transistor 112, a current input transistor 203, a current holding transistor 204, a current stopping transistor 205, a current line CL, signal line GN, a signal line GH, and a signal line GS.

A gate electrode of the current supply transistor 112 is connected to one of electrodes of the current supply capacitor 111. The other electrode of the current supply capacitor 111 is connected to a source terminal of the current supply transistor 112. The source terminal of the current supply transistor 112 is connected to a terminal B of the current supply circuit 102 through the current stopping transistor 205. A gate electrode of the current stopping transistor 205 is connected to the signal line GS.

The gate electrode of the current supply transistor 112 is connected to its drain terminal through source-drain terminals of the current holding transistor 204. A gate electrode of the current holding transistor 204 is connected to the signal line GH. The source terminal of the current supply transistor 112 is connected to the current line CL through source-drain terminals of the current input transistor 203. A gate electrode of the current input transistor 203 is connected to the signal line GN. The drain terminal of the current supply transistor 112 is connected to the terminal A.

Figure 66:
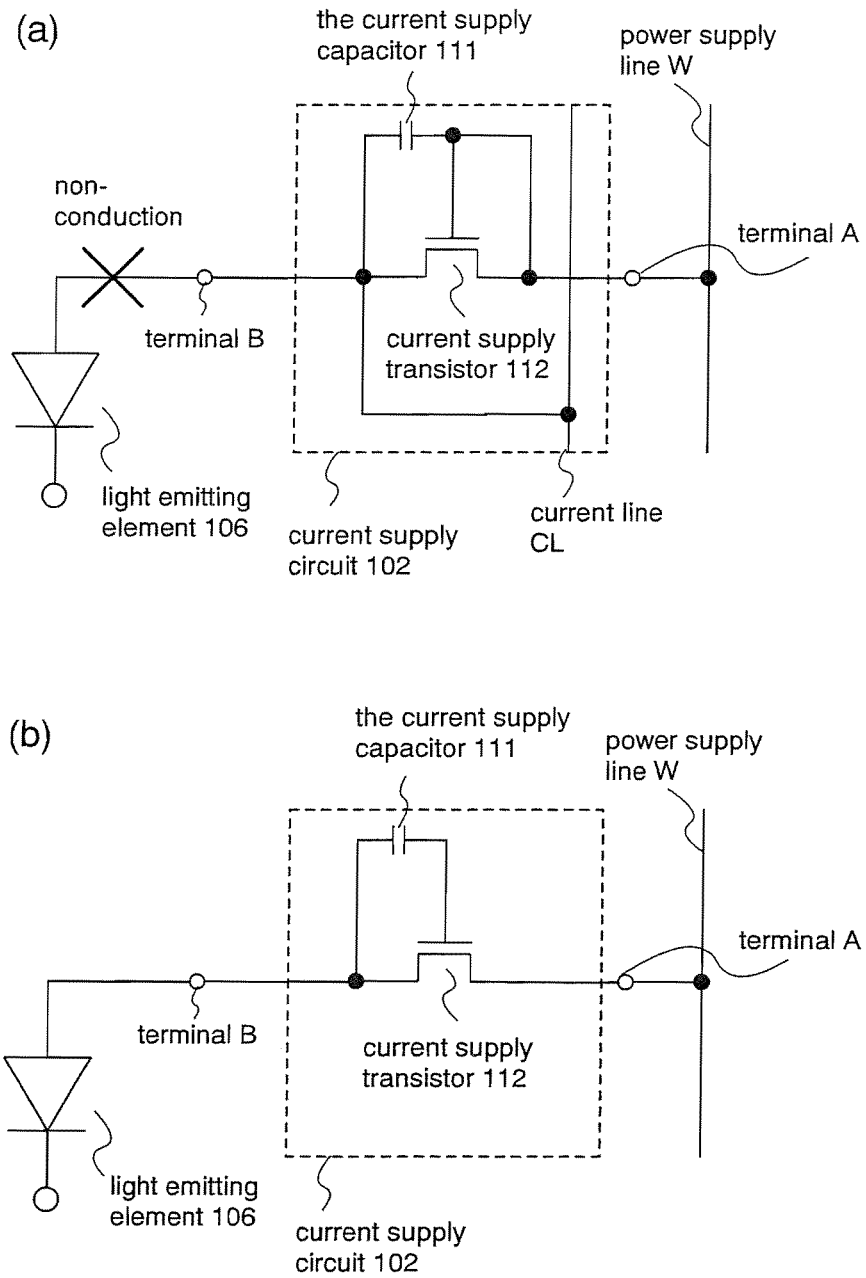
FIG. 66 are schematic diagrams showing states of a pixel in a display device of the present invention.

This may be changed so that the current supply capacitor 111 is connected to other components as illustrated in FIG. 3. It is sufficient if the current supply capacitor 111 is connected such that Vgs held in the current supply capacitor 111 by the pixel setting operation matches Vgs of when light is actually emitted. An example thereof is to connect the current supply capacitor 111 between the gate electrode and source terminal of the current supply transistor 112. In other words, it is sufficient if the current supply circuit is as shown in FIG. 66(*a*) during the pixel setting operation and as shown in FIG. 66(*b*) during light emission.

The switch portion 101 in FIG. 52 is mostly identical with the structure shown in FIG. 13 in accordance with Embodiment Mode 1, only it uses an n-channel transistor as its driving transistor 302. As this, all transistors that constitute a pixel can be n-channel transistors in the pixel structure shown in FIG. 52 in accordance with this embodiment. In this way, if a circuit is composed of transistors that have the same polarity, steps of manufacturing the transistors can be reduced and the cost can be lowered.

This embodiment may be combined freely with other embodiments and embodiment modes.

Embodiment 10

This embodiment shows an example of sharing among plural pixels the current transistor 1405, which is placed in each pixel in the pixel structure shown in FIG. 5 in accordance with Embodiment Mode 1.

Figure 53:
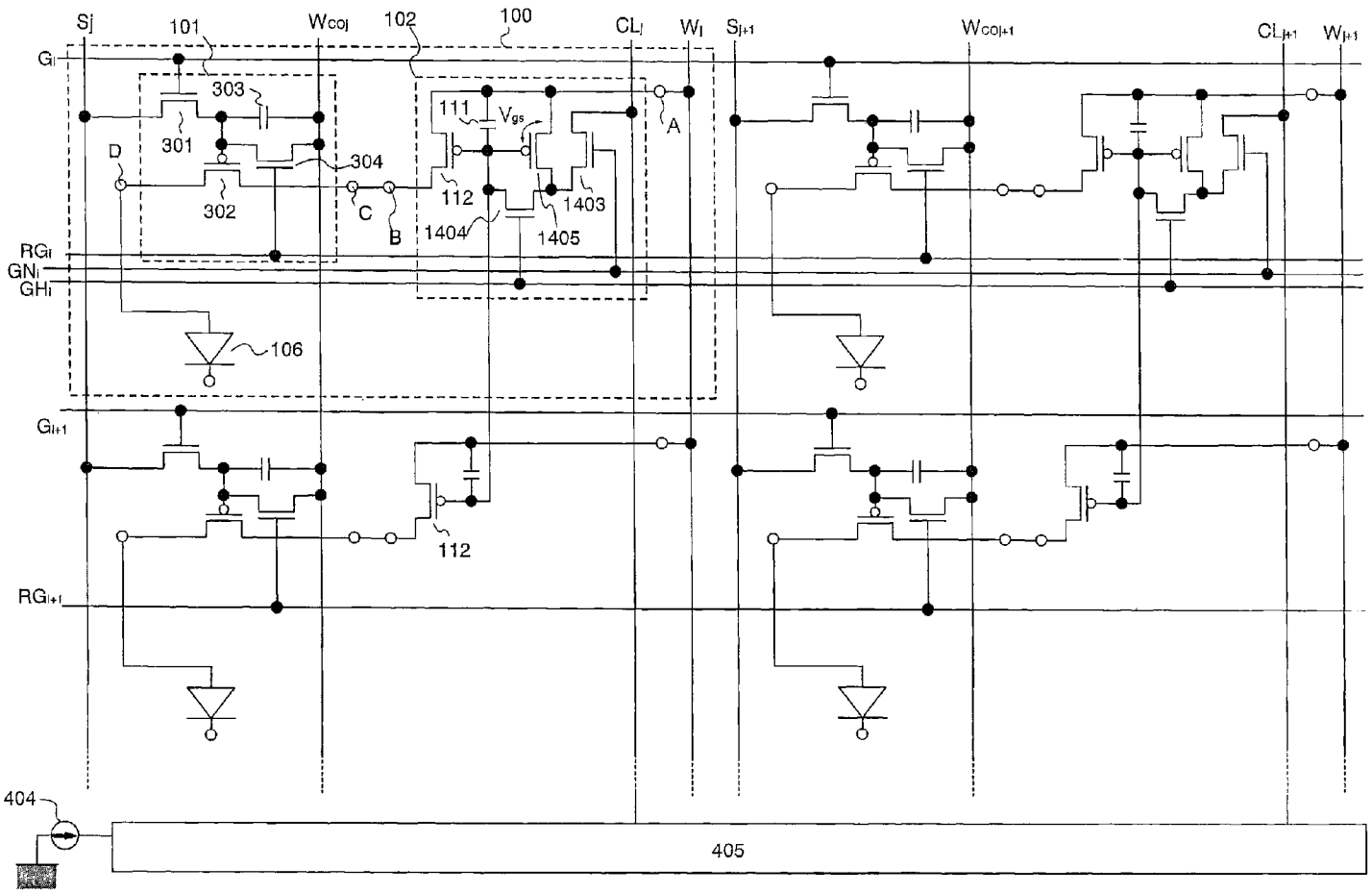
FIG. 53 is a diagram showing the structure of a pixel portion in a display device of the present invention.

FIG. 53 is a circuit diagram showing a pixel structure of this embodiment. Components in FIG. 53 that are identical with those in FIG. 5 are denoted by the same symbols and explanations thereof are omitted. In FIG. 53, one current transistor 1405 is shared between the pixel on the i-th row and the j-th column and the pixel on the (i+1)-th row and the j-th column. Another current transistor 1405 is shared between the pixel on the i-th row and the (j+1)-th column and the pixel on the (i+1)-th row and the (j+1)-th column.

In the example shown in FIG. 53, one current transistor 1405 is shared between two pixels. This is not the only way and, in general, one current transistor 1405 can be shared among plural pixels. The above structure makes it possible to reduce in number transistors and signal lines per pixel. In this way, a display device having high aperture ratio can be obtained.

This embodiment may be combined freely with other embodiments and embodiment modes.

Embodiment 11

Figure 54:
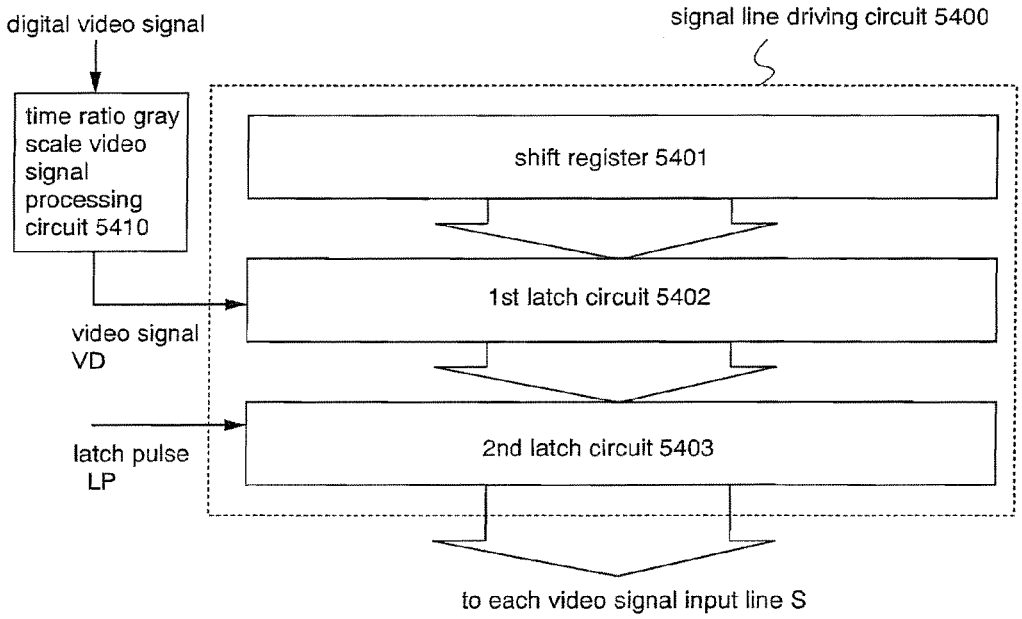
FIG. 54 is a block diagram showing the structure of a signal line driving circuit in a display device of the present invention.

This embodiment shows an example of structures of driving circuits for inputting signals to pixels of a display device of the present invention. FIG. 54 is a block diagram showing the structure of a signal line driving circuit. In FIG. 54, a signal line driving circuit 5400 is composed of a shift register 5401, a first latch circuit 5402, and a second latch circuit 5403. The first latch circuit 5402 holds video signals VD in accordance with sampling pulses outputted from the shift register 5401. Video signals VD inputted to the first latch circuit 5402 are signals obtained by processing digital video signals that have been inputted to the display device for time ratio gray scale display. Digital video signals inputted to the display device are converted by a time ratio gray scale video signal processing circuit 5410 into video signals VD, which are then inputted to the first latch circuit 5402 of the signal line driving circuit 5400. When video signals VD for one horizontal period are held in the first latch circuit 5402, latch pulses LP are inputted to the second latch circuit 5403. In this way, the second latch circuit 5403 holds video signals VD for one horizontal period at once and simultaneously outputs them to a video signal input line S of each pixel.

Figure 55:
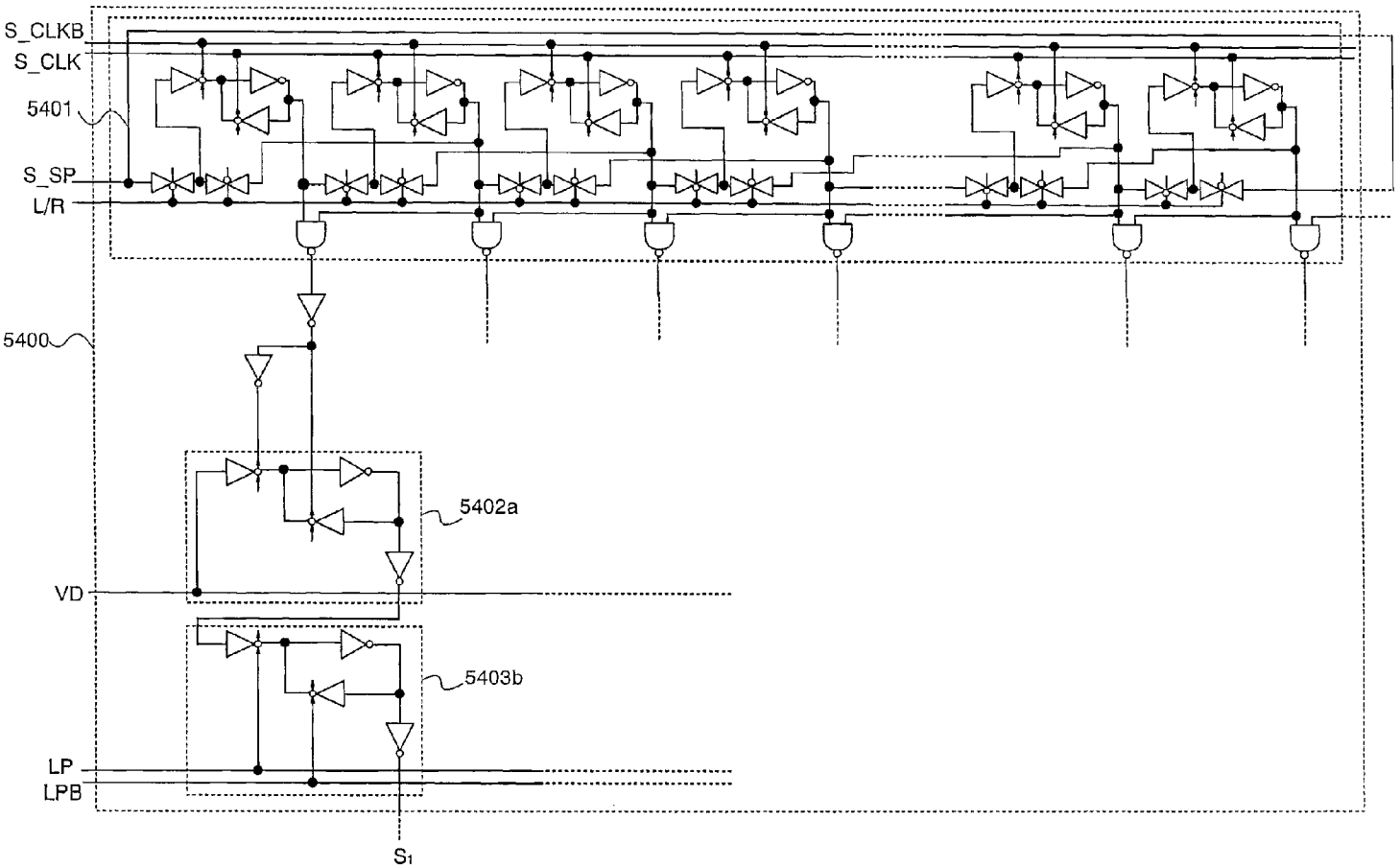
FIG. 55 is a diagram showing the structure of a signal line driving circuit in a display device of the present invention.

A structural example of the signal line driving circuit 5400 is shown in FIG. 55. Components in FIG. 55 that are identical with those in FIG. 54 are denoted by the same symbols. FIG. 55 only shows as a representative 5402*a* and 5403*a* which are a part of the first latch circuit 5402 and a part of the second latch circuit 5403, respectively, and which are associated with a video signal input line $S_1$ on the first column. The shift register 5401 is composed of plural clocked inverters, inverters, switches, and NAND circuits. Clock pulses S_CLK, inverted clock pulses S_CLKB obtained by inverting the polarity of clock pulses S_CLK, start pulses S_SP, and scanning direction switching signals L/R are inputted to the shift register 5401. The shift register 5401 thus outputs pulses sequentially shifted by the plural NAND circuits (sampling pulses). A sampling pulse outputted from the shift register 5401 is inputted to the first latch circuit 5402*a*. As the sampling pulse is inputted, the first latch circuit 5402*a* holds a video signal VD. When the first latch circuit 5402 holds video signals VD to be inputted to all video signal input lines S (video signals for one horizontal period), latch pulses LP and inverted latch pulses LPB obtained by inverting the polarity of latch pulses LP are inputted to the second latch circuit 5403. In this way, the second latch circuit 5403 outputs video signals VD to all video signal input lines S at once.

Figure 56:
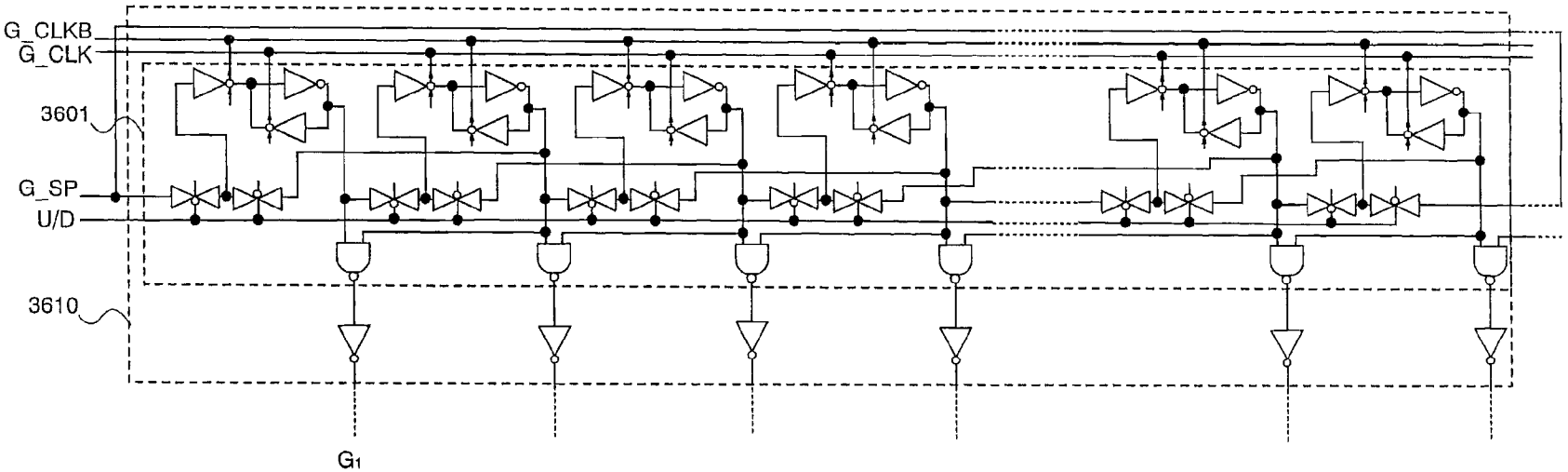
FIG. 56 is a diagram showing the structure of a scanning line driving circuit in a display device of the present invention.

FIG. 56 is a circuit diagram showing a structural example of a scanning line driving circuit. In FIG. 56, a scanning line driving circuit 3610 has a shift register 3601 that is composed of plural clocked inverters, inverters, switches, and NAND circuits. Clock pulses G_CLK, inverted clock pulses G_CLKB obtained by inverting the polarity of clock pulses G_CLK, start pulses G_SP, and scanning direction switching signals U/D are inputted to the shift register 3601. The shift register 3601 thus outputs pulses sequentially shifted by the plural NAND circuits (sampling pulses). Sampling pulses are outputted to scanning lines G through a buffer. Signals are thus inputted to the scanning lines G.

Although the signal line driving circuit and the scanning line driving circuit have shift registers in this embodiment, they may use decoders or the like. A driving circuit having a known structure can be used freely as a driving circuit of a display device of the present invention.

Embodiment 12

This embodiment shows an example of the pixel setting operation in the case where the display operation is performed in accordance with the time ratio gray scale method.

In a reset period, pixel rows are sequentially selected to start a non-display period. The setting operation can be performed on pixel rows at a frequency that is used to select scanning lines in order. For instance, focus on a case in which a switch portion structured as shown in FIG. 13 is used. Each pixel row is selected and the pixel setting operation is conducted at a frequency that is used to select the scanning lines G and the erasing signal lines RG in order. However, it is difficult in some cases to achieve sufficient pixel setting operation within a length of a selection period for one row. In this case, the pixel setting operation may be carried out at a slow pace using selection periods for plural rows. Conducting the pixel setting operation at a slow pace refers to spending a long time on the operation of accumulating a given amount of electric charges in a current supply capacitor of a current supply circuit.

Thus each row is selected using selection periods for plural rows and the same frequency as the one used to select the erasing signal lines RG and the like in a reset period. Therefore, for each row that is selected, there are rows that are skipped. Accordingly, in order to perform the pixel setting operation on all rows, the setting operation has to be conducted in plural non-display periods.

Figure 59:
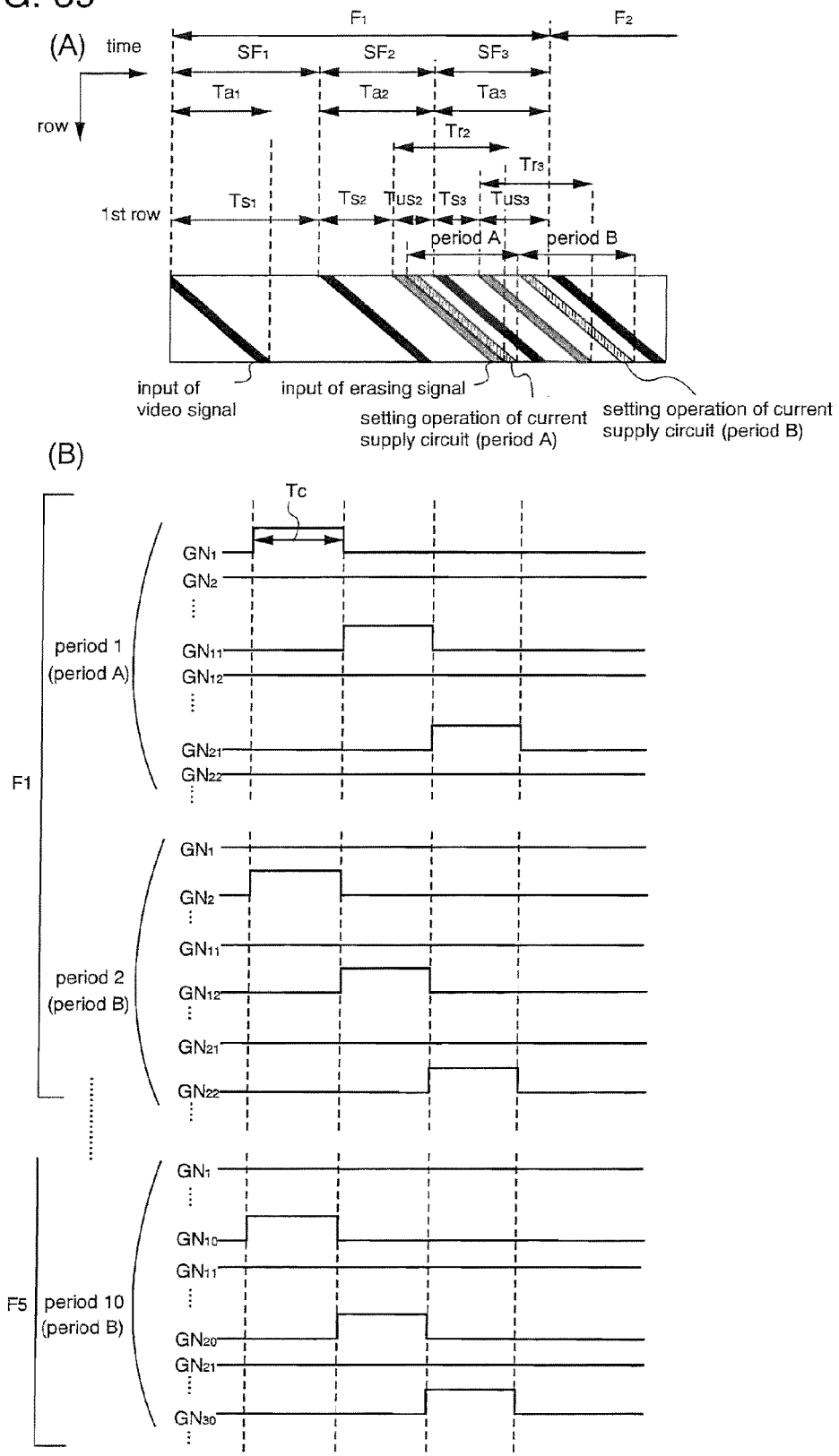
FIG. 59 are timing charts of a pixel setting operation in a display device of the present invention.

Next, the structure and driving method of a display device when using the method described above will be described in detail. First, a description is given with reference to FIG. 59 on a driving method for conducting the pixel setting operation of the first row in a period matching in length periods where plural scanning lines are selected. FIG. 59 show as an example timing charts for conducting the pixel setting operation of the first row in periods where ten scanning lines are selected.

FIG. 59(A) shows the operation of each row in each frame period. Components that are identical with those shown in the timing charts of FIG. 7 in accordance with Embodiment Mode 1 are denoted by the same symbols and explanations thereof are omitted. In the example shown here, one frame period is divided into three sub-frame periods $SF_1$ to $SF_3$. The sub-frame periods $SF_2$ and $SF_3$ each have a non-display period Tus. The pixel setting operation is conducted in a non-display period Tus (a period A and a period B in the drawing).

Next, a detailed description is given on the operation in the periods A and B. The description is given referring to FIG. 59(B). In the drawing, a period in which the pixel setting operation is conducted is shown as a period in which a signal line GN is selected. To generalize, the signal line GN of pixels on the i-th (i is a natural number) row is denoted by $GN_i$. First, in the period A of the first frame period $F_1$, $GN_1$, $GN_{11}$, $GN_{21}$, . . . are selected skipping signal lines in between. The pixel setting operation is thus conducted on the first row, the eleventh row, the twenty-first row, . . . (Period 1). Next, in the period B of the first frame period $F_1$, $GN_2$, $GN_{12}$, $GN_{22}$, . . . are selected. The pixel setting operation is thus conducted on the second row, the twelfth row, the twenty-second row, . . . (Period 2). By repeating the above operation for five frame periods, the setting operation is conducted for every pixel once.

Here, a period that can be used for the setting operation of one row of pixels is denoted by Tc. When the above driving method is used, Tc can be set ten times longer than a select period of a scanning line G. This lengthens the time that can be used for the setting operation per pixel and the pixel setting operation can be performed with efficiency and accuracy. The above operation can be repeated several times if conducting the setting operation once is insufficient. The pixel setting operation may proceed gradually in this manner.

Figure 60:
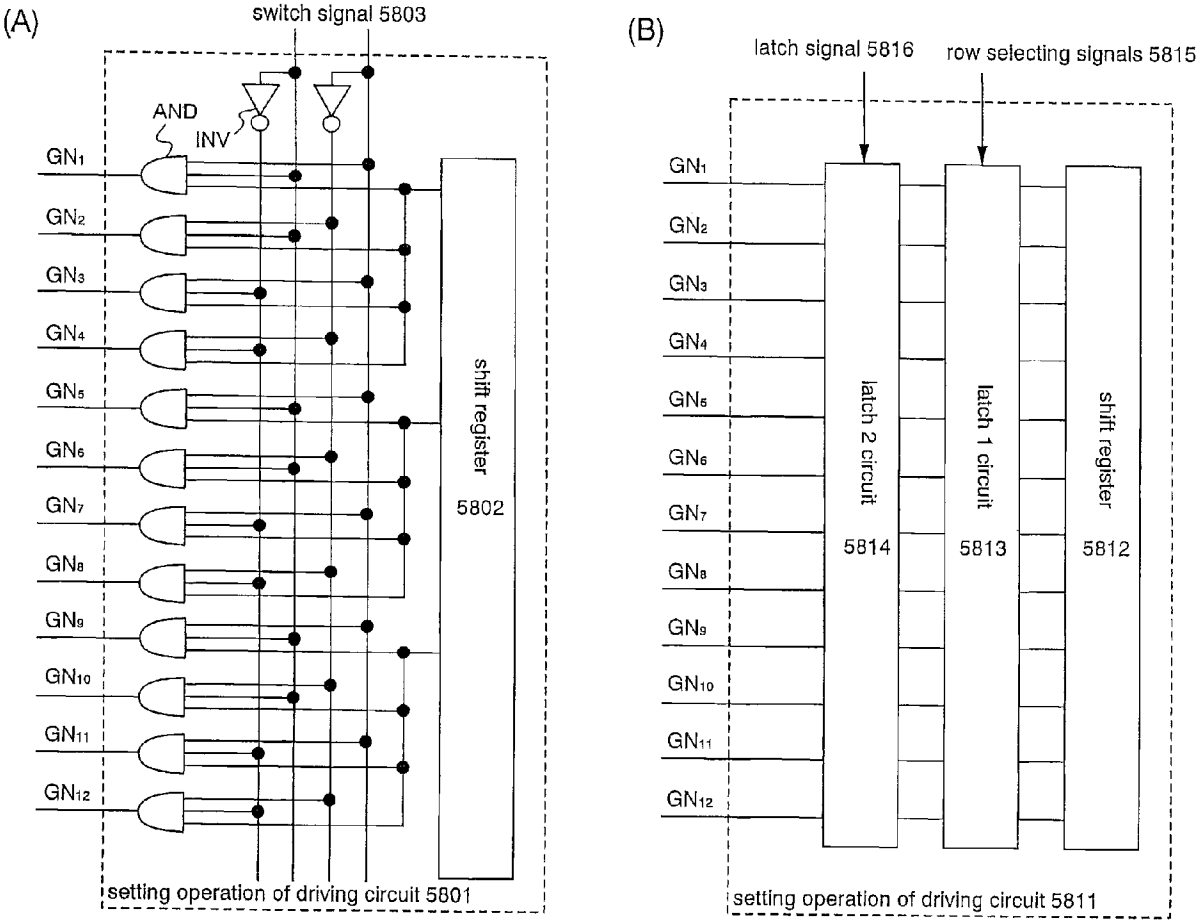
FIG. 60 are diagrams showing the structure of a scanning line driving circuit in a display device of the present invention.

Described next is the structure of the driving circuit when the above driving method is used. The description is given with reference to FIG. 60. FIG. 60 each show a driving circuit for inputting a signal to a signal line GN. However, the same applies to signals that are inputted to other signal lines of the current supply circuit. Two structural examples of the driving circuit for carrying out the pixel setting operation will be given.

The first example is a driving circuit structured to switch an output of a shift register by a switch signal and to output it to a signal line GN. A structural example of this driving circuit (setting operation driving circuit) is shown in FIG. 60(A). A setting operation driving circuit 5801 is composed of a shift register 5802, AND circuits, inverter circuits (INV), and others. In the example shown here, the driving circuit is structured to select one signal line GN for a period four times longer than a pulse output period of the shift register 5802. The operation of the setting operation driving circuit 5801 is described. An output of the shift register 5802 is selected by a switch signal 5803 and is outputted to a signal line GN through an AND circuit.

The second example is a driving circuit structured to use an output of a shift register in order to latch a signal for selecting a specific row. A structural example of this driving circuit (setting operation driving circuit) is shown in FIG. 60(B). A setting operation driving circuit 5811 has a shift register 5812, a latch 1 circuit 5813, and a latch 2 circuit 5814.

The operation of the setting operation driving circuit 5811 is described. In accordance with the output of the shift register 5812, the latch 1 circuit 5813 sequentially holds row selecting signals 5815. The row selecting signals 5815 are signals for selecting arbitrary rows. Signals held in the latch 1 circuit 5813 are transferred to the latch 2 circuit 5814 in response to a latch signal 5816. In this way, a signal is inputted to a specific signal line GN. The setting operation of the current supply circuit thus can be conducted in a non-display period.

If the current supply circuit is of the current mirror method, the setting operation can be conducted also in a display period. An identic-transistor method current supply circuit and a multi-gate method current supply circuit may employ a driving method in which a display period is interrupted to conduct the setting operation of the current supply circuit and then the display period is resumed.

This embodiment may be combined freely with Embodiment Modes 1 to 3 and Embodiments 1 to 11.

Embodiment 13

This embodiment describes a different method regarding the pixel setting operation from ones in other embodiments.

In Embodiment Mode 1 and others, pixels are selected one row at a time for the pixel setting operation, or the pixel setting operation is conducted selecting some rows and skipping other rows. In either case, the pixel setting operation is not conducted for pixels on one row while the pixel setting operation is performed on another row. This embodiment gives a description on a method of pixel setting operation which is different from the methods described above. To be specific, the pixel setting operation can be performed on plural pixels simultaneously in a certain instant using one current line. In this case, a current averaged in current supply circuits of plural pixels flows in the current supply circuit of each pixel. Therefore, if characteristic is fluctuated among current supply circuits of plural pixels to which the current is inputted, the value of the current set to flow in the current supply circuit of each of the pixels is fluctuated due to the characteristic fluctuation. However, when the pixel setting operation is performed on plural pixels concurrently, the value of the current flowing in one current line has to be increased by a level corresponding to the number of pixels that are connected to the one current line. Since the value of the current flowing in a current line is increased as this, the pixel setting operation can be finished quickly. Rows on which the pixel setting operation is performed concurrently may overlap. For instance, the setting operation may be conducted for the first row and the second row simultaneously, then the second row and the third row simultaneously, and then the third row and the fourth row simultaneously.

Rows on which the pixel setting operation is performed concurrently may be changed at intervals set arbitrarily. For instance, at one point, the setting operation is performed on a dummy row and the first row simultaneously, then the second row and the third row simultaneously, and then the fourth row and the fifth row simultaneously, whereas in another time the pixel setting operation is performed on the first row and the second row simultaneously, then the third row and the fourth row simultaneously, and then the fifth row and the sixth row simultaneously. This method makes it possible to average characteristic fluctuation time-wise.

The pixel setting operation method shown in this embodiment is independent of the structure of a current supply circuit, and therefore is applicable to every structure.

Embodiment 14

This embodiment describes a different structure regarding current lines from ones in other embodiments. In other embodiments except Embodiment 13, one current line is arranged for one column of pixels. In this case, the setting operation can be performed on only one pixel per current line at a time. Alternatively, plural current lines may be provided for one column of pixels.

For example, pixels on even-numbered rows are connected to the first current line and pixels on odd-numbered rows are connected to the second current line. Then the setting operation can be conducted for two rows of pixels, namely, an even-numbered row and an odd-numbered row, simultaneously. Accordingly, this makes it possible to lengthen the period for conducting the pixel setting operation for one pixel or to shorten the period required to conduct the pixel setting operation for all pixels.

As another option, the screen is divided into plural regions and one current line is connected only to pixels in one region. As a result, the pixel setting operation can be performed on pixels on plural rows simultaneously. Accordingly, this makes it possible to lengthen the period for conducting the pixel setting operation for one pixel or to shorten the period required to conduct the pixel setting operation for all pixels.

For example, the screen is divided length-wise into two. The upper half has a reference current output circuit and a current line that is connected to the reference current output circuit. The lower half has a reference current output circuit and a current line that is connected to the reference current output circuit. The current line placed in the upper half and the current line placed in the lower half are not connected to each other. As a result, the pixel setting operation can be performed on pixels in the upper half while the pixel setting operation is performed on pixels on the lower half concurrently.

This embodiment is independent of the structure of a current supply circuit, and therefore is applicable to every structure.

Embodiment 15

Figure 78:
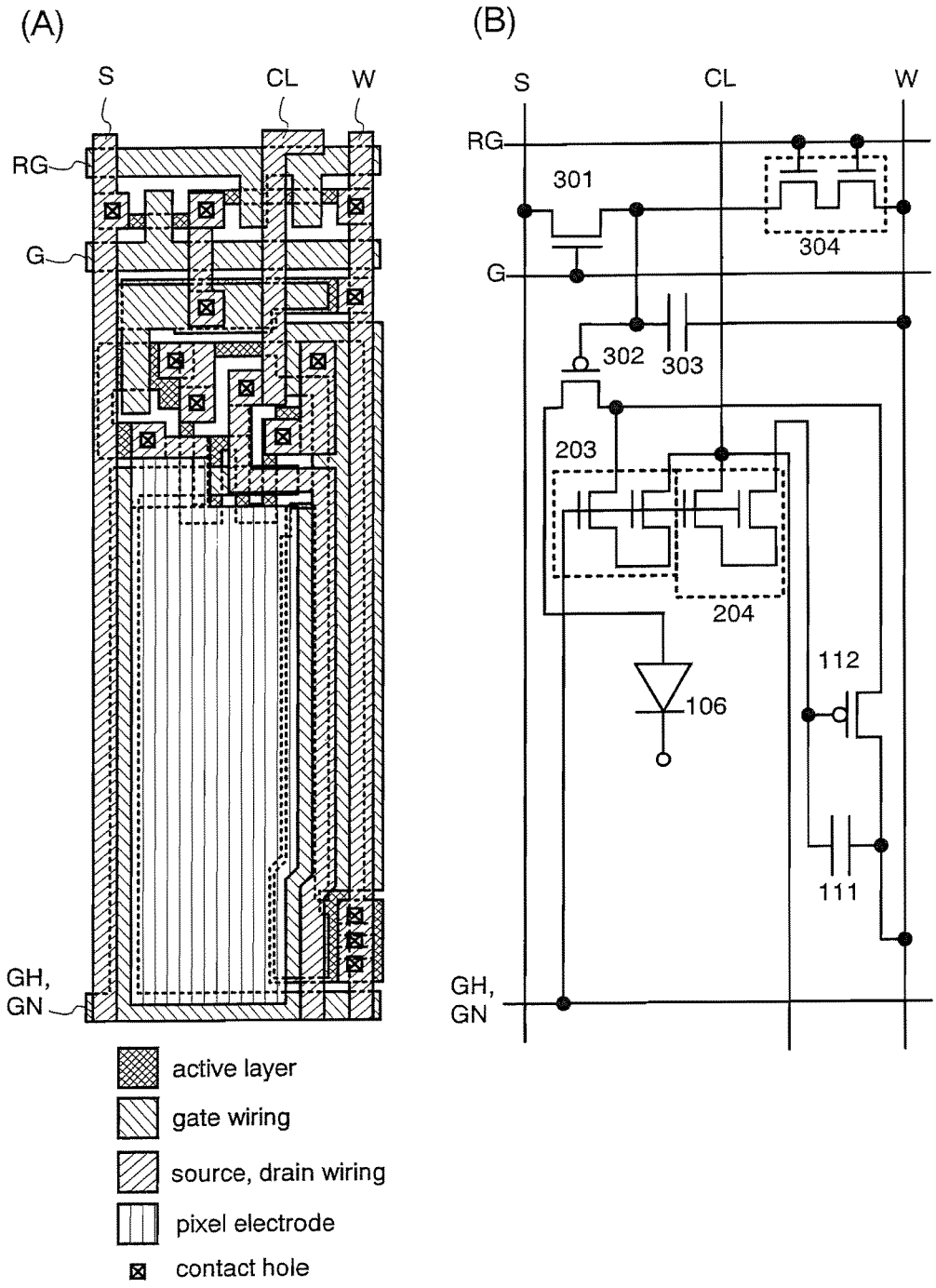
FIG. 78(A) is a top view showing the structure of a pixel in a display device of the present invention and FIG. 78(B) is a circuit diagram thereof.

Referring to FIG. 78, this embodiment shows an example of actually manufacturing a pixel that has the structure shown in FIG. 73(A) in accordance with Embodiment Mode 2. FIG. 78(A) is a top view of the pixel actually manufactured. FIG. 78(B) is a circuit diagram corresponding to FIG. 78(A). Components identical with those in FIG. 73(A) are denoted by the same symbols and explanations thereof are omitted. In FIG. 78(A), a pixel electrode alone is shown as a light emitting element 106. An erasing transistor 304, a current holding transistor 204, and a current input transistor 203 in FIG. 78 are double gate transistors.

Embodiment 16

Figure 79:
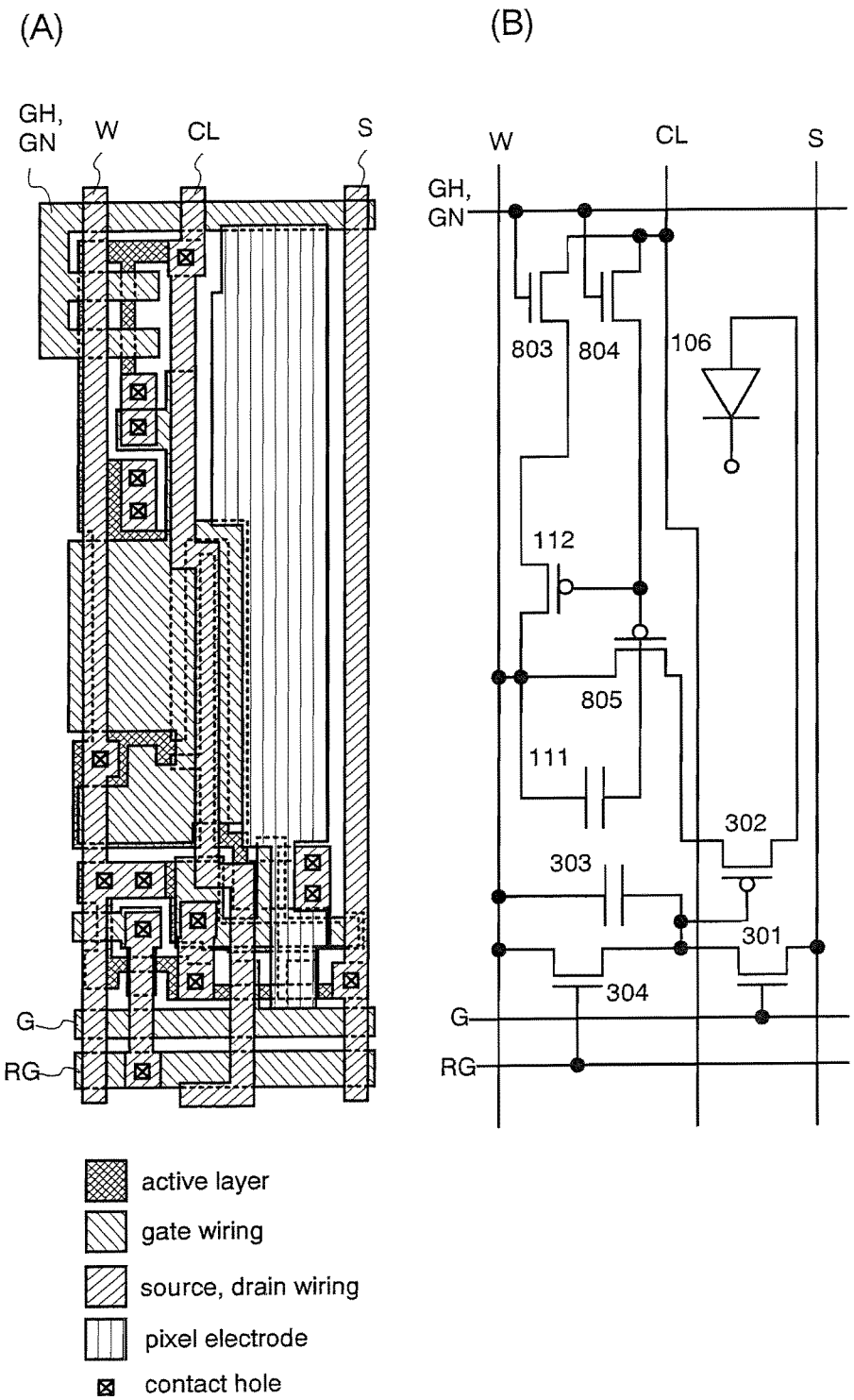
FIG. 79(A) is a top view showing the structure of a pixel in a display device of the present invention and FIG. 79(B) is a circuit diagram thereof.

Referring to FIG. 79, this embodiment shows an example of manufacturing a pixel that has a current supply circuit structured as shown in FIG. 57(A) or FIG. 57(B) in accordance with Embodiment Mode 3. FIG. 79(A) is a top view of the pixel and an equivalent circuit diagram corresponding thereto is shown in FIG. 79(B). Components identical with those in FIG. 74 are denoted by the same symbols and explanations thereof are omitted. Unlike FIG. 74(A), an erasing transistor 304 in FIG. 79 is connected in parallel to a storage capacitor 303. Also, of a source terminal and drain terminal of a current stopping transistor 805, one that is not connected to a source terminal or drain terminal of a driving transistor 302 is connected directly to a power supply line W.

Embodiment 17

This embodiment describes the structure of a driving circuit for inputting a control current to each pixel in a display device of the present invention. When the control current inputted to pixels is fluctuated, the current value of the current outputted from a current supply circuit of each pixel is also fluctuated. Therefore, a driving circuit structured to output a generally constant current to each current line is necessary. Examples of such driving circuit are given below. A signal line driving circuit structured as shown in, for example, Japanese Patent Application No. 2001-333462, or 2001-333466, or 2001-333470, or 2001-335917, or 2001-335918 can be used. In other words, an output current of this signal line driving circuit can be inputted as a control current to each pixel. In a display device of the present invention, a generally constant control current can be inputted to each pixel by employing the above signal line driving circuit. In this way, fluctuation in image luminance can be reduced further.

This embodiment may be combined freely with other embodiments and embodiment modes.

Embodiment 18

This embodiment describes a display system to which the present invention is applied. Here, a display system includes a memory for storing video signals inputted to a display device, circuits for outputting control signals (such as clock pulses and start pulses) that are to be inputted to driving circuits of the display device, a controller for controlling the memory and the circuits, and others.

Figure 2:
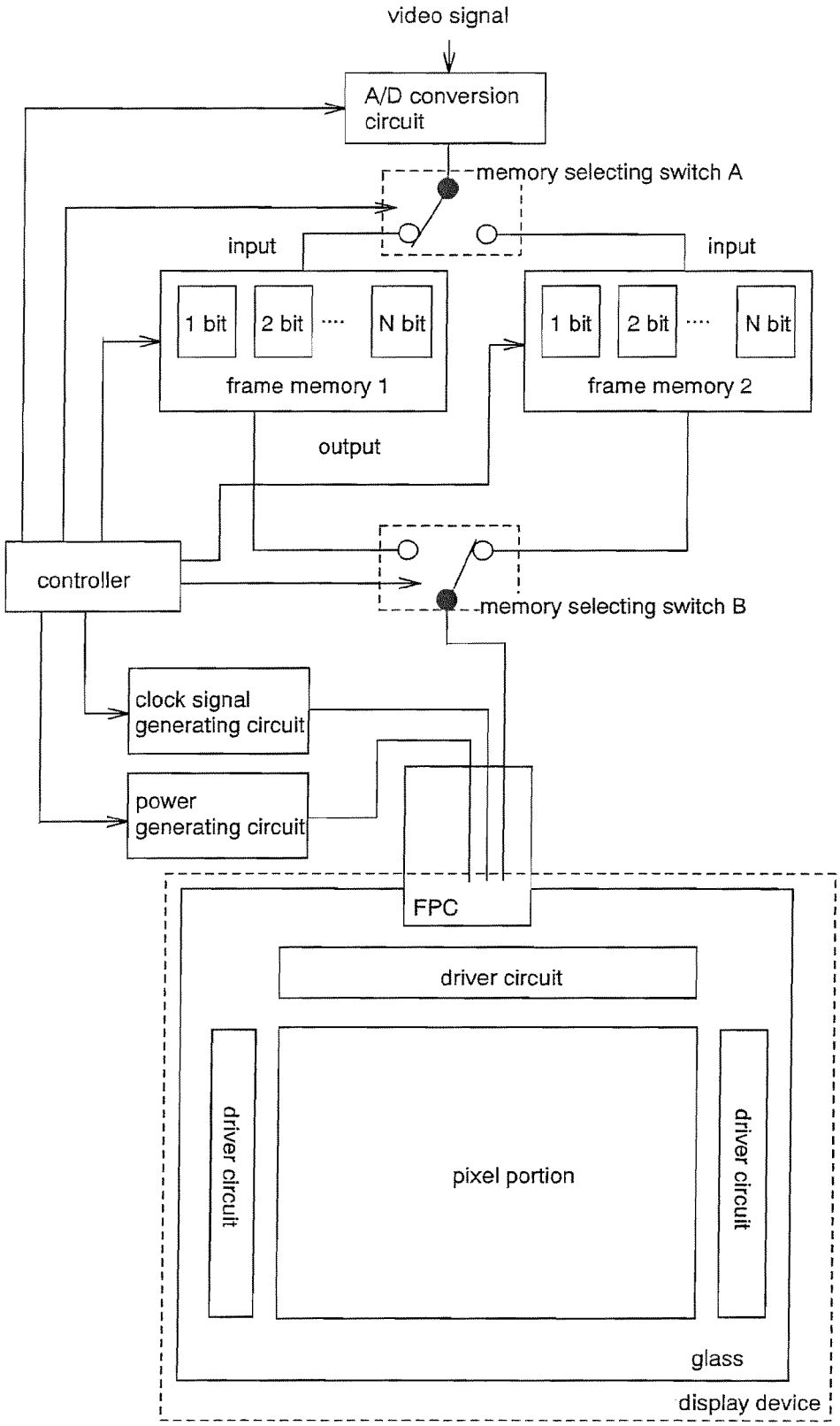
FIG. 2 is a diagram showing a display system that uses a display device of the present invention.

An example of the display system is shown in FIG. 2. The display system has, in addition to a display device, an A/D converter circuit, a memory selecting switch A, a memory selecting switch B, a frame memory 1, a frame memory 2, a controller, a clock signal generating circuit, and a power generating circuit.

The operation of the display system is described. The A/D converter circuit converts a video signal inputted to the display system into a digital video signal. The frame memory A or the frame memory B stores the digital video signal. If the frame memory A and the frame memory B alternate each time a new period (a frame period or a sub-frame period) is started, signals can be written in a memory and read out of a memory in good time. The frame memory A and the frame memory B are alternated by using the controller to switch between the memory selecting switch A and the memory selecting switch B. The clock generating circuit generates clock signals and the like in response to signals from the controller. The power generating circuit generates a given power in response to signals from the controller. Signals read out of the memories, clock signals, power, and the like are inputted to the display device through an FPC.

The display system to which the present invention is applied is not limited to the structure shown in FIG. 2, and the present invention is applicable to a display system of every known structure.

This embodiment may be combined freely with other embodiments and embodiment modes.

Embodiment 19

Figure 46:
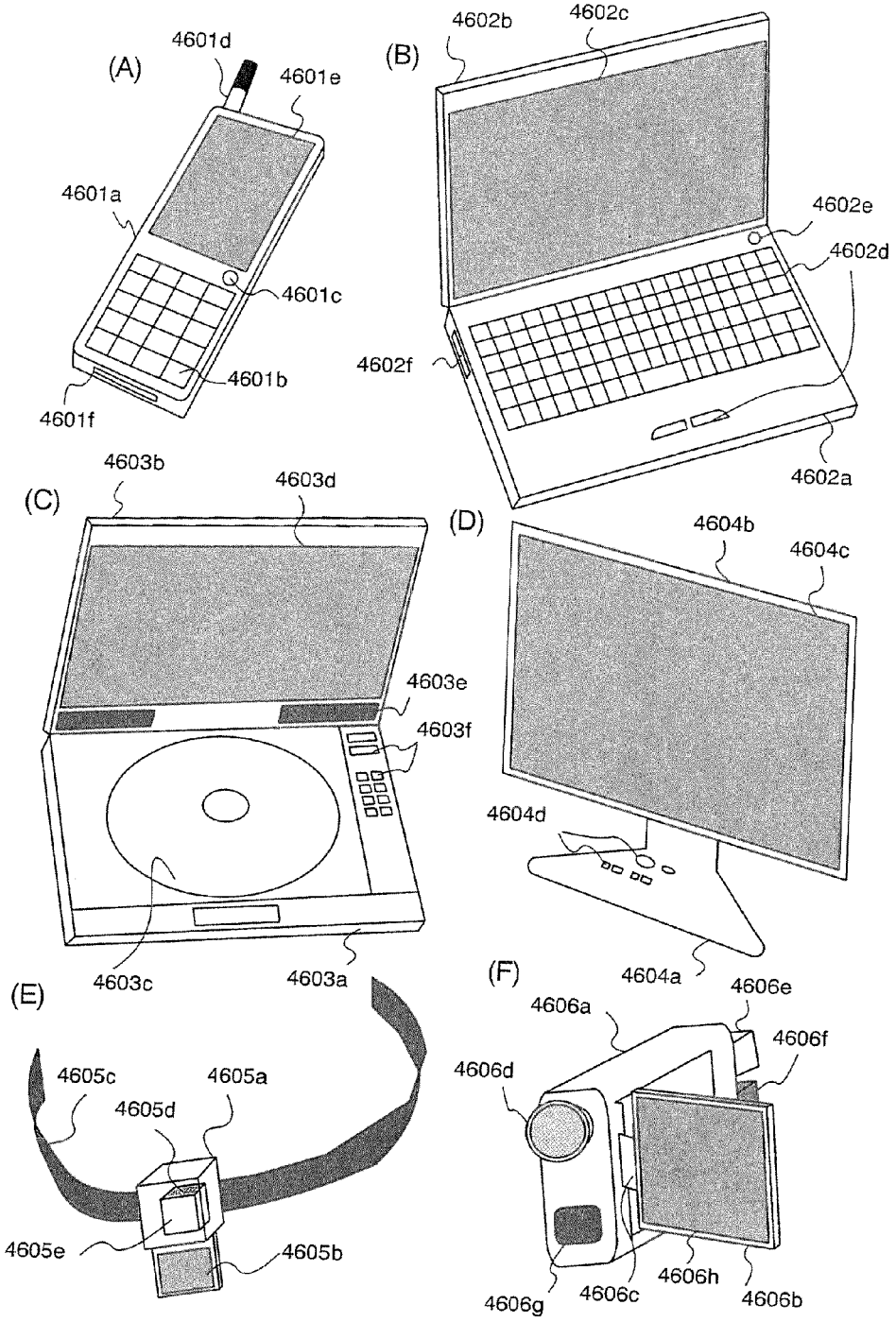
FIG. 46 are diagrams showing electronic equipment to which a display device of the present invention is applied.

This embodiment describes electronic equipment utilizing a display device of the present invention with reference to FIG. 46. FIG. 46(A) is a schematic diagram of a portable information terminal using a display device of the present invention. The portable information terminal is composed of a main body 4601*a*, operation switches 4601*b*, a power switch 4601*c*, an antenna 4601*d*, a display unit 4601*e*, and an external input port 4601*f*. The display device of the present invention can be used in the display unit 4601*e*. FIG. 46(B) is a schematic diagram of a personal computer using a display device of the present invention. The personal computer is composed of a main body 4602*a*, a casing 4602*b*, a display unit 4602*c*, operation switches 4602*d*, a power switch 4602*e*, and an external input port 4602*f*. The display device of the present invention can be used in the display unit 4602*c*. FIG. 46(C) is a schematic diagram of an image reproducing device using a display device of the present invention. The image reproducing device is composed of a main body 4603*a*, a casing 4603*b*, a recording medium 4603*c*, a display unit 4603*d*, audio output units 4603*e*, and operation switches 4603*f*. The display device of the present invention can be used in the display unit 4603*d*. FIG. 46(D) is a schematic diagram of a television set using a display device of the present invention. The television set is composed of a main body 4604*a*, a casing 4604*b*, a display unit 4604*c*, and operation switches 4604*d*. The display device of the present invention can be used in the display unit 4604*c*. FIG. 46(E) is a schematic diagram of a head-mounted display using a display device of the present invention. The head-mounted display is composed of a main body 4605*a*, a monitor unit 4605*b*, a head fixing band 4605*c*, a display unit 4605*d*, and an optical system 4605*e*. The display device of the present invention can be used in the display unit 4605*d*. FIG. 46(F) is a schematic diagram of a video camera using a display device of the present invention. The video camera is composed of a main body 4606*a*, a casing 4606*b*, a connector unit 4606*c*, an image receiving unit 4606*d*, an eyepiece unit 4606*e*, a battery 4606*f*, an audio input unit 4606*g*, and a display unit 4606*h*. The display device of the present invention can be used in the display unit 4606*h*.

The present invention is not limited to application to the above electronic equipment but is applicable to various electronic equipment. This embodiment may be combined freely with Embodiment Mode 1 through Embodiment Mode 3 and Embodiment 1 through Embodiment 18.

INDUSTRIAL APPLICABILITY

Each pixel of a display device of the present invention has a current supply circuit, a switch portion, and a light emitting element. The light emitting element, the current supply circuit, and the switch portion are connected in series between a power supply reference line and a power supply line. The switch portion is switched between ON and OFF using a digital video signal. The amount of constant current flowing in the current supply circuit is determined by a control signal inputted from the outside of the pixel. When the switch portion is ON, a constant current determined by the current supply circuit flows in the light emitting element and light is emitted. When the switch portion is OFF, no current flows in the light emitting element and the light emitting element does not emit light. ON and OFF of the switch portion is thus controlled by a video signal to display in gray scales. In this way, the luminance can be kept constant even when the current characteristic is changed by degradation of the light emitting element or the like, and this makes it possible to provide a low-cost display device which is fast in writing signals, which can display in gray scales accurately, and which can be reduced in size.

What is claimed is:

1. A display device comprising:

a light emitting element;

a capacitor;

a first transistor;

a second transistor;

a third transistor; and a fourth transistor, wherein a gate of the first transistor is electrically connected to one electrode of the capacitor, wherein one of a source and a drain of the first transistor is electrically connected to the other electrode of the capacitor, wherein the one of the source and the drain of the first transistor is electrically connected to the light emitting element, wherein one of a source and a drain of the second transistor is electrically connected to the gate of the first transistor, wherein the other of the source and the drain of the second transistor is electrically connected to a first line, wherein one of a source and a drain of the third transistor is electrically connected to the other of the source and the drain of the first transistor, and wherein one of a source and a drain of the fourth transistor is electrically connected to the other of the source and the drain of the first transistor.

2. The display device according to claim 1, wherein the first transistor is an n-channel transistor.

3. The display device according to claim 1, further comprising a fifth transistor and a sixth transistor, wherein the one of the source and the drain of the first transistor is electrically connected to the light emitting element through a channel formation region of the fifth transistor, wherein one of a source and a drain of the sixth transistor is electrically connected to a gate of the fifth transistor, and wherein the other of the source and the drain of the sixth transistor is electrically connected to a second line.

4. A display device comprising:

a light emitting element;

a capacitor;

a first transistor;

a second transistor;

a third transistor; and a fourth transistor, wherein a gate of the first transistor is electrically connected to one electrode of the capacitor, wherein one of a source and a drain of the first transistor is electrically connected to the other electrode of the capacitor, wherein the one of the source and the drain of the first transistor is electrically connected to the light emitting element, wherein one of a source and a drain of the second transistor is electrically connected to the gate of the first transistor, wherein the other of the source and the drain of the second transistor is electrically connected to a first line, wherein one of a source and a drain of the third transistor is electrically connected to the other of the source and the drain of the first transistor, wherein one of a source and a drain of the fourth transistor is electrically connected to the other of the source and the drain of the first transistor, and wherein a gate of the third transistor is electrically connected to a gate of the fourth transistor.

5. The display device according to claim 4, wherein the first transistor is an n-channel transistor.

6. The display device according to claim 4, further comprising a fifth transistor and a sixth transistor, wherein the one of the source and the drain of the first transistor is electrically connected to the light emitting element through a channel formation region of the fifth transistor, wherein one of a source and a drain of the sixth transistor is electrically connected to a gate of the second transistor, and wherein the other of the source and the drain of the sixth transistor is electrically connected to a second line.

7. The display device according to claim 4, wherein the first line is a power supply line.

8. The display device according to claim 6, wherein the second line is a video signal input line.

9. A display device comprising:

a light emitting element;

a capacitor;

a first transistor;

a second transistor;

a third transistor; and a fourth transistor, wherein a gate of the first transistor is electrically connected to one electrode of the capacitor, wherein one of a source and a drain of the first transistor is electrically connected to the other electrode of the capacitor, wherein the one of the source and the drain of the first transistor is electrically connected to the light emitting element, wherein one of a source and a drain of the second transistor is electrically connected to the gate of the first transistor, wherein the other of the source and the drain of the second transistor is electrically connected to a first line, wherein one of a source and a drain of the third transistor is electrically connected to the other of the source and the drain of the first transistor, wherein the other of the source and the drain of the third transistor is electrically connected to a second line, and wherein one of a source and a drain of the fourth transistor is electrically connected to the other of the source and the drain of the first transistor.

10. The display device according to claim 9, wherein each of the first transistor and the second transistor is an n-channel transistor.

11. The display device according to claim 9, wherein the third transistor is an n-channel transistor, and wherein the fourth transistor is a p-channel transistor.

12. The display device according to claim 9, further comprising a fifth transistor and a sixth transistor, wherein the one of the source and the drain of the first transistor is electrically connected to the light emitting element through a channel formation region of the fifth transistor, wherein one of a source and a drain of the sixth transistor is electrically connected to a gate of the fifth transistor, and wherein the other of the source and the drain of the sixth transistor is electrically connected to a third line.

13. The display device according to claim 9 wherein the first line is a current line.

14. The display device according to claim 9 wherein the second line is a power supply line.

15. The display device according to claim 9 wherein the third line is a video signal input line.

* * * * *

UNITED STATES PATENT AND TRADEMARK OFFICE

CERTIFICATE OF CORRECTION

PATENT NO. : 8,599,109 B2
APPLICATION NO. : 12/977940
DATED : December 3, 2013
INVENTOR(S) : Hajime Kimura It is certified that error appears in the above-identified patent and that said Letters Patent is hereby corrected as shown below:

In the Specifications

At column 3, line 26, "0 V In" should be --0 V. In--;

At column 7, line 50, "shown n" should be --shown in--;

At column 7, line 51, "riving" should be --driving--;

At column 8, line 50, "lowing" should be --flowing--;

At column 41, line 23, "$G_j$" should be --$G_i$--;

At column 52, line 26, "line and" should be --line W and--;

At column 53, line 27, "$CL_j$." should be --$CL_i$.--;

At column 61, line 62, "7(C)," should be --77(C),--.

Signed and Sealed this
Fifteenth Day of April, 2014

Michelle K. Lee

Michelle K. Lee
*Deputy Director of the United States Patent and Trademark Office*